US008450033B2

(12) United States Patent
Sugino et al.

(10) Patent No.: US 8,450,033 B2
(45) Date of Patent: May 28, 2013

(54) LATENT ELECTROSTATIC IMAGE BEARING MEMBER, AND IMAGE FORMING APPARATUS, IMAGE FORMING METHOD AND PROCESS CARTRIDGE USING THE SAME

(75) Inventors: Akihiro Sugino, Numazu (JP); Nobuya Mori, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 892 days.

(21) Appl. No.: 11/947,368

(22) Filed: Nov. 29, 2007

(65) Prior Publication Data

US 2008/0138728 A1 Jun. 12, 2008

(30) Foreign Application Priority Data

Nov. 30, 2006 (JP) ..... 2006-324753
Jan. 11, 2007 (JP) ..... 2007-003696

(51) Int. Cl.
*G03C 1/73* (2006.01)

(52) U.S. Cl.
USPC ..... 430/58.75; 430/58.65

(58) Field of Classification Search
USPC ..... 430/58.75, 58.65
See application file for complete search history.

(56) References Cited

U.S. PATENT DOCUMENTS 6,004,669 A 12/1999 Rokutan et al.
6,010,810 A * 1/2000 Uesaka et al. ..... 430/58.8
6,168,911 B1 1/2001 Lelental et al.
7,267,916 B2 9/2007 Sugino et al.
2005/0118518 A1 6/2005 Ikegami et al.
2006/0199092 A1* 9/2006 Sugino et al. ..... 430/66
2007/0015074 A1* 1/2007 Sugino et al. ..... 430/59.6

FOREIGN PATENT DOCUMENTS

JP 2000-171990 6/2000
JP 3258397 12/2001
JP 3267519 1/2002
JP 2003-186223 7/2003
JP 3640444 1/2005
JP 3818585 6/2006

* cited by examiner

*Primary Examiner* — Mark F Huff
*Assistant Examiner* — Rachel Zhang
(74) *Attorney, Agent, or Firm* — Oblon, Spivak, McClelland, Maier & Neustadt, L.L.P.

(57) ABSTRACT

To provide a latent electrostatic image bearing member including: an outermost surface layer that comprises a compound represented by the following General Formula (1) and a crosslinked resin formed by crosslinking between an isocyanate compound and a reactive charge transporting substance having at least two hydroxyl groups.

(1)

where $R^1$ and $R^2$ may be identical or different and each represent a substituted or unsubstituted alkyl group; and $R^3$ represents one of alkyl and aryl groups which have at least one hydroxyl group.

20 Claims, 9 Drawing Sheets

LATENT ELECTROSTATIC IMAGE BEARING MEMBER, AND IMAGE FORMING APPARATUS, IMAGE FORMING METHOD AND PROCESS CARTRIDGE USING THE SAME

BACKGROUND OF THE INVENTION

1. Field of the Invention

The present invention relates to a latent electrostatic image bearing member for use in image formation processes employing electrophotography, such as in copiers, electrostatic printing, printers, facsimiles and electrostatic recording, and to an image forming apparatus, image forming method and process cartridge using the latent electrostatic image bearing member.

2. Description of the Related Art

In an image forming apparatus utilizing electrophotography such as a copier, printer or facsimile machine, a latent electrostatic image bearing member (hereinafter referred to as "photoconductor," "electrophotographic photoconductor," or "image bearing member" in some cases) that is uniformly charged is irradiated with a write beam modulated by image data to form thereon a latent electrostatic image, and a toner is supplied to the image by means of a developing unit. Thereafter, the developed image (toner image) on the photoconductor is transferred onto a recording medium (recording paper), and heated and pressed against the recording medium by means of a fixing unit so as to be fixed onto the recording medium. Meanwhile, toner particles that remain on the photoconductor surface are scraped off by means of a cleaning blade for recovery.

In such image forming apparatus employing electrophotography, organic photoconductors are widely used that contain organic optical photoconductive material. Organic photoconductors are advantageous over other conductive photoconductors in such aspects as easiness with which materials that lend themselves to various exposure beam sources ranging in wavelength from visible to infrared beams are developed, selectivity for materials that have little environmental impact, and lower manufacturing costs. These organic photoconductors, however, have a problem that they offer low mechanical strength and thus its organic photoconductor layer wears off during a long time use, and therefore, when the photoconductor layer has worn off to a given degree, it results in change in the photoconductor's electrical characteristics and in failure to conduct proper image formation process. The photoconductor layer wears off at any position where it contacts other image formation units such as a developing unit and a transfer unit during image formation process.

To overcome this problem, studies have been made to increase the photoconductor life by reducing wear, and various suggestions have been presented in order to achieve this. For example, Japanese Patent Application Laid-Open (JP-A) No. 06-118681 suggests employing a colloidal silica-containing curable silicone resin as a surface protective layer for photoconductor.

JP-A Nos. 09-124943 and 09-190004 both suggest a photoconductor having on its surface a resin layer in which an organic silicon-modified hole transporting compound is bound to curable organic silicon-based polymer molecules.

JP-A No. 2000-171990 suggests a method of curing curable siloxane resin with charge transportability-imparting groups such that the cured resin has a three-dimensional network.

JP-A No. 2003-186223 suggests a photoconductor having a protective layer that contains therein a charge transporting substance having at least one hydroxyl group, three-dimensionally crosslinked resin, and conductive particles.

Although the invention disclosed in JP-A No. 06-118681 succeeded in improving the wear resistance of the surface layer made of colloidal silica-containing curable silicone resin, the photoconductor offers poor electrical characteristics after repetitive use, fogging and/or image blur are more likely to occur, and durability is smaller than those of longer-lasting photoconductors that have been required in recent years.

With the inventions described in JP-A Nos. 09-124943 and 09-190004, the photoconductor's resin layer tend to cause image blur and hence a drum heater or the like is required to prevent this before put into practical use, resulting in increased apparatus size and costs. Moreover, inability to sufficiently reduce the residual potential of the exposed area may lead to reduced image density in a low-potential development process where image formation is effected with reduced charging potential.

With the invention disclosed in JP-A No. 2000-171990, it may result in the generation of cracks in the coating, which are considered to be caused by volume contraction of the coating. This problem occur particularly where a cheap, easy-to-handle commercially available coating agent is used in combination. In addition, the level of residual potential of the exposed area is dependent on the coating thickness, and reduced image density in low-potential development process may become a problem. Moreover, an increased content of charge transportability-imparting groups leads to reduced coating strength, and as such provision of sufficient durability may fail. The increased content of charge transportability-imparting groups may further cause image blur. Accordingly, it is difficult to obtain an electrophotographic photoconductor easily and inexpensively which is capable of output of excellent images over a long period of time.

With the configuration of the invention disclosed in JP-A No. 2003-186223, it may succeed in achieving increased wear resistance and reduced residual potential to some extent; however, simply adding conductive particles in the protective layer decreases the volume resistance of the protective layer. For this reason, image blur tends to occur due to latent electrostatic image displacement under high-temperature, high-humidity conditions. In addition, since the charge transporting substance also constitutes the structural unit of the three-dimensionally crosslinked network of the protective layer, the greater the proportion of the charge transporting substance in the protective layer, the greater the influence of its molecular structure—particularly the number of hydroxyl groups and/or the binding sites—on the wear resistance. Thus, in some instances, it may result in failure to obtain sufficient wear resistance.

As a result of the extensive studies conducted by the present inventors, it is becoming increasingly established that an electrophotographic photoconductor, of which surface layer is a charge transporting urethane resin layer prepared by polymerizing an isocyanate compound and a reactive charge transporting substance having a specific structure, offers significantly increased wear resistance while achieving reduced residual potential. It is, however, also established that electrophotographic photoconductors having such a configuration cause image blur due to latent electrostatic image displacement when their surface layer is exposed to oxidizing gas such as ozone or NOx. In a digital image forming apparatus, such image blur reduces the image density of halftone images formed of fine dots, leading to abnormal images. Thus, there still remains a need in the art to achieve further improvements.

BRIEF SUMMARY OF THE INVENTION

It is an object of the present invention to provide a latent electrostatic image bearing member which has high wear resistance and excellent electrographic characteristics and which is capable of stable image formation over a long period of time; and an image forming apparatus, image forming method and process cartridge using the latent electrostatic image bearing member.

The means to solve the foregoing problems are as follows.

<1> A latent electrostatic image bearing member including: an outermost surface layer that comprises a compound represented by the following General Formula (1) and a crosslinked resin formed by crosslinking between an isocyanate compound and a reactive charge transporting substance having at least two hydroxyl groups.

(1)

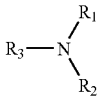

where $R^1$ and $R^2$ may be identical or different and each represent a substituted or unsubstituted alkyl group; and $R^3$ represents one of alkyl and aryl groups which have at least one hydroxyl group.

<2> The latent electrostatic image bearing member according to <1> including a substrate, a photosensitive layer over the substrate, and a protective layer over the photosensitive layer, wherein the protective layer constitutes the outermost surface layer.

<3> The latent electrostatic image bearing member according to <1>, wherein the outermost surface layer comprises conductive fine particles made of a compound having the formula $M_xSb_yO_z$ (where M represents a metal element; and x, y, and z each represent the molar ratio of its corresponding element).

<4> The latent electrostatic image bearing member according to <3>, wherein the conductive fine particles are made of zinc antimonate ($ZnSb_2O_6$).

<5> The latent electrostatic image bearing member according to <1>, wherein the outermost surface layer comprises fine particles made of at least one type of a compound selected from silica, alumina, titanium oxide, and tin oxide.

<6> The latent electrostatic image bearing member according to <1>, wherein the isocyanate compound comprises an aromatic ring and two or more isocyanate groups.

<7> The latent electrostatic image bearing member according to <6>, wherein the isocyanate compound is an adduct of a diisocyanate compound and a polyol.

<8> The latent electrostatic image bearing member according to <1>, wherein the content of isocyanate group (—NCO) in the isocyanate compound is 3% by mass to 50% by mass.

<9> The latent electrostatic image bearing member according to <1>, wherein the content of the reactive charge transporting substance is 5% by mass to 45% by mass.

<10> The latent electrostatic image bearing member according to <1>, wherein the charge transporting substance is a compound represented by the following General Formula (2).

(2)

where n represents the number of substituent Y attached to substituent X and is an integer of 1 to 4; Y represents an organic group having at least two hydroxyl groups and 1 to 6 carbon atoms when n=1, and represents an alkylene group having a hydroxyl group and 1 to 50 carbon atoms when n=2 to 4, the alkylene group optionally having substituent(s) other than hydroxyl group; and X represents a charge transporting compound group.

<11> The latent electrostatic image bearing member according to <10>, wherein substituent X comprises a diarylamino group —$NAr_1Ar_2$, where $Ar_1$ and $Ar_2$ independently represent a substituted or non-substituted aromatic group.

<12> The latent electrostatic image bearing member according to <10>, wherein substituent X comprises a structure represented by the following General Formula (3) in which hydrogen atoms attached to aromatic groups are removed.

(3)

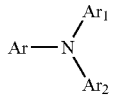

where $Ar_1$ and $Ar_2$ independently represent a substituted or non-substituted aromatic group; and Ar represents an arylene group.

<13> The latent electrostatic image bearing member according to <10>, wherein substituent X comprises a structure represented by the following General Formula (4) in which hydrogen atoms attached to aromatic groups are removed.

(4)

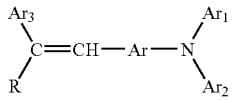

where $Ar_1$, $Ar_2$ and $Ar_3$ independently represent a substituted or non-substituted aromatic group; Ar represents an arylene group; and R represents a hydrogen atom or aromatic group.

<14> The latent electrostatic image bearing member according to <10>, wherein substituent X comprises a structure represented by the following General Formula (5) in which hydrogen atoms attached to aromatic groups are removed.

(5)

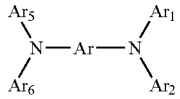

where $Ar_1$ and $Ar_2$ independently represent a substituted or non-substituted aryl group; $Ar_5$ and $Ar_6$ independently represent an alkyl group or aryl group; and Ar represents an arylene group.

<15> The latent electrostatic image bearing member according to <1>, wherein the reactive charge transporting substance comprises a structure in which a hydroxyl group is attached to each of two adjacent carbon atoms <16> The latent electrostatic image bearing member according to claim <10>, wherein substituent Y comprises a structure represented by the following General Formula (6).

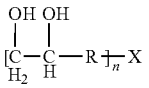

(6)

where n represents the number of substituents attached to substituent X and is an integer of 1 to 4; and R represents a divalent substituent containing 1 to 50 carbon atoms.

<17> The latent electrostatic image bearing member according to <10>, wherein substituent Y comprises a structure represented by the following General Formula (7).

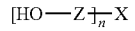

(7)

where n represents the number of substituents attached to substituent X and is an integer of 2 to 4; and Z represents either a divalent substituent containing 1 to 50 carbon atoms or a single bond.

<18> The latent electrostatic image bearing member according to <1>, wherein the outermost surface layer comprises a crosslinked resin formed using an isocyanate compound and at least one polyol compound that is not used as the reactive charge transporting substance.

<19> The latent electrostatic image bearing member according to <18>, wherein the at least one polyol compound has a molecular weight-to-number of hydroxyl groups ratio (molecular weight/number of hydroxyl groups) of 150 or less.

<20> An image forming apparatus including: a latent electrostatic image bearing member; a latent electrostatic image forming unit configured to form a latent electrostatic image on the latent electrostatic image bearing member; a developing unit configured to develop the latent electrostatic image by use of a toner to form a visible image; a transferring unit configured to transfer the visible image onto a recording medium; and a fixing unit configured to fix the visible image to the recording medium, wherein the latent electrostatic image bearing member comprises an outermost surface layer that comprises a compound represented by the following General Formula (1) and a crosslinked resin formed by crosslinking between an isocyanate compound and a reactive charge transporting substance having at least two hydroxyl groups.

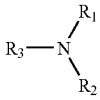

(1)

where $R^1$ and $R^2$ may be identical or different and each represent a substituted or unsubstituted alkyl group; and $R^3$ represents one of alkyl and aryl groups which have at least one hydroxyl group.

<21> The image forming apparatus according to <20>, further comprising a cleaning unit configured to remove residual toner particles from the surface of the latent electrostatic image bearing member by being contacted with the surface.

<22> The image forming apparatus according to <20>, further including a charging unit and an exposing unit, wherein the charging unit is located near but without contacting the latent electrostatic image bearing member and charges a surface of the latent electrostatic image bearing member by superimposing direct and alternating voltages and applying the superimposed voltage to the surface.

<23> The image forming apparatus according to <20>, wherein the charging unit is a charge roller that is located near but without contacting the latent electrostatic image bearing member by providing a gap forming member on both ends of the roller, and charges a surface of the latent electrostatic image bearing member by superimposing direct and alternating voltages and applying the superimposed voltage to the surface.

<24> The image forming apparatus according to <20>, further including a lubricant application mechanism by which a lubricity-imparting agent is applied over the surface of the latent electrostatic image bearing member.

<25> The image forming apparatus according to <24>, wherein the lubricity-imparting agent is at least one selected from zinc stearate, aluminum stearate, and calcium stearate.

<26> The image forming apparatus according to <20>, wherein the toner comprises a binder resin, a colorant, and a releasing agent.

<27> The image forming apparatus according to <20>, wherein the toner is prepared by dissolving or dispersing in an organic solvent a toner material, the toner material containing at least an active hydrogen group-containing compound and a polymer capable of reacting with the compound, to prepare a toner solution, emulsifying or dispersing in an aqueous medium the toner solution to prepare a dispersion liquid in which the compound and the polymer have been reacted to form a particulate adhesive base material in the aqueous medium, and by removing the organic solvent from the dispersion liquid.

<28> The image forming apparatus according to <20>, wherein the toner has an average circularity of 0.93 to 1.00.

<29> The image forming apparatus according to <20>, wherein toners having different colors are used for the formation of color images.

<30> The image forming apparatus according to <20>, wherein a plurality of image forming elements each having the latent electrostatic image bearing member, latent electrostatic image forming unit, developing unit and transferring is arranged in a tandem configuration.

<31> The image forming apparatus according to <20>, including an intermediate transfer member for primary transfer of toner images formed on the respective latent electrostatic image bearing members; and the transferring unit for secondary transfer of the toner images onto a recording medium, wherein the toner images with different colors are sequentially superimposed to form a color image, and the color image is transferred onto the recording medium.

<32> An image forming method including: forming a latent electrostatic image on a latent electrostatic image bearing member; developing the latent electrostatic image by use of a toner to form a visible image; transferring the visible image onto a recording medium; and fixing the visible image to the recording medium, wherein the latent electrostatic image bearing member is the latent electrostatic image bearing member according to any one of <1> to <19>.

<33> A process cartridge including: at least one unit selected from a charging unit, an exposing unit, a transferring unit, and a cleaning unit; and the latent electrostatic image bearing member according to any one of <1> to <19>.

In the latent electrostatic image bearing member of the present invention, the outermost surface layer contains (1) a crosslinked resin formed by crosslinking between a reactive charge transporting substance having at least two hydroxyl groups and an isocyanate compound, and (2) a compound represented by the following General Formula (1).

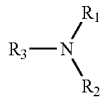

(1)

where $R^1$ and $R^2$ may be identical or different and each represent a substituted or unsubstituted alkyl group; and $R^3$ represents one of alkyl and aryl groups which have at least one hydroxyl group.

As described above, a latent electrostatic image bearing member that has in its outermost surface layer a crosslinked resin formed by polymerization between a reactive charge transporting substance having at least two hydroxyl groups and an isocyanate compound is susceptible to image density reduction when exposed to oxidizing gas such as ozone or NOx. The latent electrostatic image bearing member of the present invention, by contrast, has a tertiary amine with a specific structure and thereby the influence of such gases can be significantly reduced. Accordingly, the present invention can provide a highly durable latent electrostatic image bearing member that has high wear resistance and excellent gas resistance and that is capable of stable image formation over a long period of time.

The image forming apparatus of the present invention includes: a latent electrostatic image bearing member; a latent electrostatic image forming unit configured to form a latent electrostatic image on the latent electrostatic image bearing member; a developing unit configured to develop the latent electrostatic image by use of a toner to form a visible image; a transferring unit configured to transfer the visible image onto a recording medium; and a fixing unit configured to fix the visible image to the recording medium, wherein the latent electrostatic image bearing member is the latent electrostatic image bearing member of the present invention. Accordingly, the image forming apparatus of the present invention is capable of stable formation of excellent images over a long period of time.

The image forming method of the present invention includes: forming a latent electrostatic image on a latent electrostatic image bearing member; developing the latent electrostatic image by use of a toner to form a visible image; transferring the visible image onto a recording medium; and fixing the visible image to the recording medium, wherein the latent electrostatic image bearing member is the latent electrostatic image bearing member of the present invention. Accordingly, the image forming apparatus of the present invention is capable of stable formation of excellent images over a long period of time.

The process cartridge of the present invention includes: at least one unit selected from a charging unit, an exposing unit, a transferring unit, and a cleaning unit; and the latent electrostatic image bearing member of the present invention. Accordingly, the process cartridge of the present invention has excellent convenience and is capable of stable formation of excellent images over a long period of time.

DESCRIPTION OF THE PREFERRED EMBODIMENTS (Latent Electrostatic Image Bearing Member)

The latent electrostatic image bearing member of the present invention comprises at least an outermost surface layer, and comprises a substrate, and further comprises additional layer(s) where appropriate.

—Layer Configuration—

As a first embodiment of the specific layer configuration, the latent electrostatic image bearing member comprises a substrate and a single-layer photosensitive layer over the substrate, and further comprises a protective layer, an intermediate layer, and additional layer(s) where appropriate.

As a second embodiment the latent electrostatic image bearing member comprises a laminated photosensitive layer formed of, in order, a charge generating layer and a charge transporting layer over a substrate, and may further comprise a protective layer, an intermediate layer and additional layer(s) where necessary. Note in the second embodiment that the charge generating layer and charge transporting layer may be disposed in reverse order.

In the single-layer photosensitive layer above, either the photosensitive layer or the protective formed on the photosensitive layer serves as the outermost surface layer.

In the laminated photosensitive layer above, either the charge generating layer or the charge transporting layer serves as the outermost surface layer. Preference is particularly given to an embodiment where the protective layer is the outermost surface layer.

Figure 1:
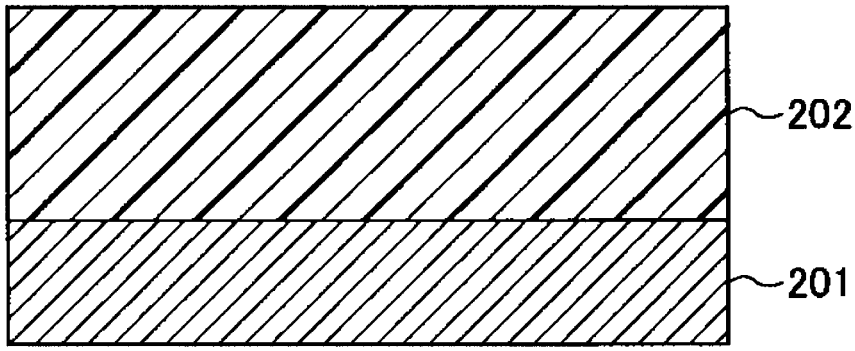
FIG. 1 is a schematic cross-sectional diagram showing an example of the layer configuration of the latent electrostatic image bearing member of the present invention.

FIG. 1 is a schematic cross-sectional diagram showing an example of the layer configuration of the latent electrostatic image bearing member of the present invention, in which example a single-layer photosensitive layer 202 is disposed on a substrate 201 and serves as the outermost surface layer. Although not shown in this drawing, it is also possible to provide a protective layer on the photosensitive layer 202; in this case, the protective layer serves as the outermost surface layer.

Figure 2:
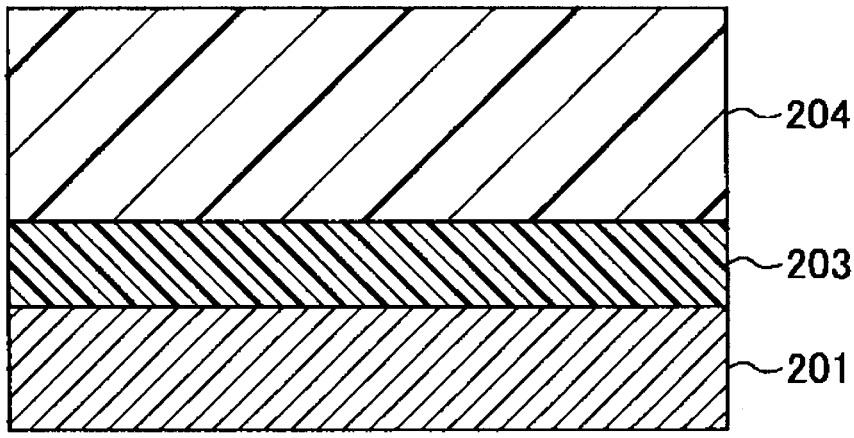
FIG. 2 is a schematic cross-sectional diagram showing another example of the layer configuration of the latent electrostatic image bearing member of the present invention.
Figure 3:
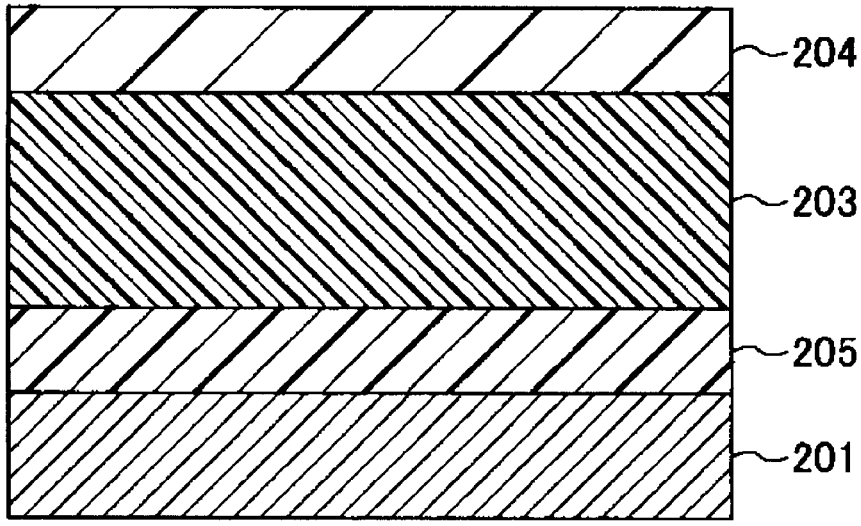
FIG. 3 is a schematic cross-sectional diagram showing still another example of the layer configuration of the latent electrostatic image bearing member of the present invention.
Figure 4:
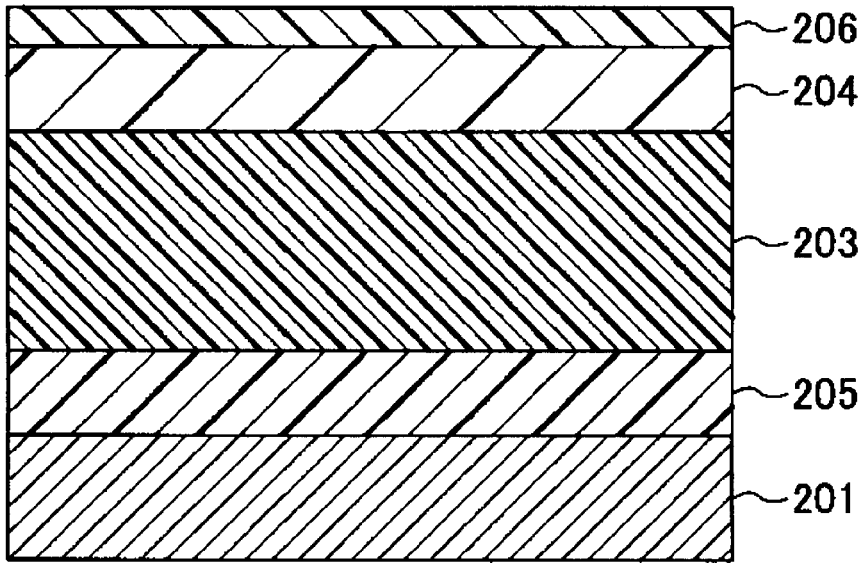
FIG. 4 is a schematic cross-sectional diagram showing yet another example of the layer configuration of the latent electrostatic image bearing member of the present invention.

FIGS. 2 to 4 each show another example of the layer configuration of the latent electrostatic image bearing member of the present invention. FIG. 2 shows a function-separated type photosensitive layer that is composed of a charge generation layer (CGL) 203 and a charge transporting layer (CTL) 204, with the charge transporting layer 204 serving as the outermost surface layer. FIG. 3 shows a configuration in which a undercoat layer 205 is provided between a substrate 201 and a function-separated type photosensitive layer composed of a charge generating layer (CGL) 203 and a charge transporting layer (CTL) 204, with the charge transporting layer 204 serving as the outermost surface layer Furthermore, an intermediate layer (not shown) may be provided between the undercoat layer 205 and the charge generating layer 203. FIG. 4 shows a configuration in which a protective layer 206 is further provided on the charge transporting layer 204 of FIG. 3, with the protective layer 206 serving as the outermost surface layer. Note that it is only necessary for the latent electrostatic image bearing member of the present invention to comprise at least the photosensitive layer over the substrate 201, and therefore, any combination of the foregoing additional layers and any combination of the foregoing photosensitive layer types may be employed.

<Outermost Surface Layer>

The outermost surface layer comprises at least a crosslinked resin—which is obtained by polymerization of an isocyanate compound and a reactive charge transporting substance containing two or more hydroxyl groups—and a compound represented by the following General Formula (1), comprises conductive fine particles, and further comprises additional ingredient(s) where necessary.

(1)

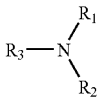

where $R^1$ and $R^2$ may be identical or different and each represent a substituted or unsubstituted alkyl group; and $R^3$ represents one of alkyl and aryl groups which have at least one hydroxyl group.

Inclusion of any compound represented by General Formula (1) leads to significantly reduction in the influence of oxidizing gas on the outermost surface layer, increasing its gas resistance remarkably. Although the mechanism underlying this effect has not yet been clearly elucidated, the following is considered to be involved: Oxidizing gas such as ozone or NOx, which results depending on the use conditions, is likely to adsorb to reactive charge transporting substances. In some instances, this causes reduction in the electrical resistance of the photosensitive layer surface, possibly leading to image blur due to latent electrostatic image displacement. In order to avoid the electrical resistance reduction caused by oxidizing gas, addition of a compound represented by General Formula (1) is found effective. It may be that the tertiary amine structure contained in the molecular structure of the compound represented by General Formula (1) effectively prevents generation of radicals from oxidizing gas. Moreover, it is preferable that one of the three substituents attached to the amino group be an aryl group because electrical characteristics deterioration, e.g., residual potential increase, caused by addition of the compound is small. Although the mechanism of this phenomenon still remains elusive at present, it may be that the aryl group itself has not a little charge transporting ability and thus the side effect that it traps charge carriers is small. Furthermore, it is preferable that the hydroxyl group that the compound represented by General Formula (1) has be an alcoholic hydroxyl group because by doing so the influence of the oxidizing gas decreases to a greater extent.

—Conductive Fine Particles—

Examples of the conductive fine particles include fine particles of metals, metal oxides and carbon black; generally, however, preference is particularly given to compounds represented by $M_xSb_yO_z$ (where M represents a metal such as Zn, In, Sn, Ti or Zr, with Zn and In particularly preferable; and x, y, and z each represent the molar ratio of its corresponding element). When the conductive fine particles are formed of $Zn_xSb_yO_z$, x:y:z is preferably 1:1.6-2.4:5-7. In the case of $In_xSb_yO_z$, x:y:z is preferably 1:0.02-1.25:1.55-4.63.

Examples of conductive fine particles of the general formula $M_xSb_yO_z$ (where M represents metal; and x, y, and z each represent the molar ratio of the corresponding element) include fine particles of zinc antimonate ($ZnSb_2O_6$) disclosed in Japanese Patent (JP-B) No. 3221132, and fine particles of indium antimonate ($InSbO_4$) disclosed in JP-B No. 3198494.

Zinc antimonate is commercially available for instance in the form of conductive sol (CELNAX series, produced by Nissan Chemical Industries, Ltd.), readily available in the form of colloidal zinc antimonate dispersed in solvent. Meanwhile, existing dispersing methods can be employed as the method of dispersing conductive fine particles that are available in the form of powder; examples are those devises using high-shear fluid dispersion method, such as MICROFLUIDIZER (manufactured by MFI) or ULTIMAIZER (manufactured by SUGINO MACHINE Ltd.).

Examples of metals are aluminum, zinc, copper, chrome, nickel, silver and stainless steel, and resin particles having any of these metals deposited onto their surface can also be used. For metal oxides, ultrafine particles of zinc oxide, titanium oxide, tin oxide, antimony oxide, indium oxide, tin-doped indium oxide, antimony-doped tin oxide and zirconium oxide can be employed.

These types of conductive fine particles can be used singly or in combination. If desired, the conductive fine particles may be surface-treated with known material by means of any known method.

Addition of the conductive fine particles is intended not only to simply adjust the electrical resistance of the outermost surface layer, but to help reactive charge transporting substance to transport charges. Accordingly, the desired type and content of conductive fine particles are closely related to those of the reactive charge transporting substance and thus are difficult to be determined based solely on the volume resistance of the protective layer. It is preferable that the allowable gas exposure level of the reactive charge transporting substance, the degree of residual potential increase upon exposure to gas, and the conductive fine particle content to prevent residual potential increase be set to optimal levels appropriately. Addition of suitable conductive fine particles can significantly reduce the residual potential increase.

In general, addition of conductive fine particles in the outermost surface layer of a latent electrostatic image bearing member reduces the bulk resistance of the outermost surface layer and thus works against retention performance of static charges on the surface. As a consequence, it raises a concern that image blur occurs due to the presence of oxidizing gas. For this reason, the allowable content of conductive fine particles is limited in order to avoid image blur while reducing the residual potential. However, it is established that conductive fine particles containing any compound of the formula $M_xSb_yO_z$ (where M represents a metal; and x, y, and z each represent the molar ratio of the corresponding element) are very suitable material because they exhibit an effect of reducing the residual potential of the exposed area and preventing image blur and therefore its allowable added amount latitude greatly widens for reduced residual potential.

The mechanisms by which the conductive fine particles of the formula $M_xSb_yO_z$ (where M represents a metal; and x, y, and z each represent the molar ratio of the corresponding element) reduce the residual potential and prevent image blur are not clearly established. But since charges move around the conductive fine particles by electron conduction rather than by ion conduction, they are resistant to oxidizing gas influences, and this property may be involved in the mechanisms. Moreover, since they offer a high residual potential reduction effect per unit amount, even addition of a trace amount results in a greater potential reduction effect in the exposed area. Thus, for example, the fact that the exposed area potential can reach a desired level without reducing the bulk resistance of the outermost surface layer too much may effectively participate in enhancing the effect of reducing residual potential.

The conductive fine particles preferably have a volume-average particle diameter of 0.01 μm to 1 μm, more preferably 0.01 μm to 0.5 μm. A volume-average particle diameter of less than 0.01 μm will result in smaller spaces among adjacent conductive fine particles contained in the outermost surface layer, which may work against retention performance of static charges on the surface. In addition, in this case, it will result in particle aggregation in the coating solution to facilitate formation of unequally-sized secondary particles, resulting in larger particles localized in the photosensitive layer. For this reason, these larger particles may lead to abnormal images, i.e., occurrence of particulate background smears in the case of exposed area development format (negative-positive development format), and occurrence of blank spots in the case of non-exposed area development format (positive-positive development format). When the conductive fine particles have a volume-average particle diameter of greater than 1 μm, it is too large for the coating thickness and it may result in poor surface leveling, thereby increasing the surface roughness of the photoconductor. For this reason, for example, when a cleaning blade is to be used for residual toner removal, the blade's ability to be kept attached to the photoconductor surface decreases, which may lead to cleaning failure as a result of escape of toner particles through the gap between the cleaning blade and photoconductor surface. This is particularly disadvantageous upon cleaning of spherical toner particles that are relatively difficult to be removed by blade cleaning. Furthermore, there is a likelihood that abnormal images will be produced due to localization of larger particles in the protective layer.

The conductive fine particles are contained in the outermost surface layer preferably in an amount of 0.5% by mass to 65% by mass, more preferably 5% by mass to 45% by mass. A content of less than 0.5% by mass may result in poor residual potential reduction effect or in failure to increase the wear resistance. Whereas a content of greater than 65% by mass results in too small bulk resistance of the outermost surface layer. This may lead to occurrence of image blur or make the coating fragile, thereby reducing its wear resistance.

It is also possible for the outermost surface layer of the latent electrostatic image bearing member to contain additional fine particles. Examples of such additional fine particles include fine particles of organic resins such as fluorine resin (e.g., polytetrafluoroethylene), silicone resin and guanamine formaldehyde resin; powders of metals such as copper, tin, aluminum and indium; powders of metal oxides such as silica, tin oxide, zinc oxide, titanium oxide, alumina, indium oxide, antimony oxide, bismuth oxide, antimony-doped tin oxide and tin-doped indium oxide; metal fluorides such as tin fluoride, calcium fluoride and aluminum fluoride; and inorganic fine particles such as potassium titanate and boron nitride. Among them, silica, alumina, titanium oxide, and tin oxide are particularly preferable because they have less influence on the electrical characteristics of the photoconductor and can remarkably increase the photoconductor's wear resistance.

When these additional fine particles are to be used in combination, the content of the compound $M_xSb_yO_z$ in the outermost surface layer is preferably 10% by mass to 100% by mass based on the total amount of fine particles. When less than 10% by mass is used, it may result in poor residual potential reduction effect and poor image blur preventing effect of the compound $M_xSb_yO_z$.

In the crosslinked resin contained in the latent electrostatic image bearing member of the present invention, the isocyanate compound, a polymerizable monomer, preferably has an aromatic ring and two or more, more preferably, three or more isocyanate groups. The crosslinked resin prepared by polymerization of an isocyanate compound and a reactive charge transporting substance having two or more hydroxyl groups is a kind of polyurethane resin that forms urethane bonds. Since polyurethane resins form a three-dimensional network by crosslinking between a poly-functional isocyanate compound and a polyol compound, they are suitably employed as high-wear resistance binder resins.

When a reactive charge transporting substance is employed as a polyol compound, at least a corresponding isocyanate compound is required in an equivalent amount. Thus, the characteristics of the isocyanate compound greatly affects the electrophotographic characteristics of the latent electrostatic image bearing member. The use of aromatic ring-containing isocyanate compounds (or aromatic isocyanate compounds) eliminates any practical problem regarding the electrophotographic characteristics in a low-speed or short-term electrophotographic process and, even in a high-speed and long-term electrophotographic process (repeating cycles of charging, exposure, development, transfer, and charge removal), there is no occurrence of abnormal images caused by the exposed area potential increase followed by image density reduction. The image density reduction can be assayed by continuous electrostatic fatigue loading evaluation using a latent electrostatic image bearing member tester. Aromatic isocyanate compounds are capable of significantly reducing the residual potential increase in the exposed area effected immediately after loading of electrostatic fatigue.

Meanwhile, when an aromatic ring-free isocyanate compound (or aliphatic isocyanate compound) as typified by hexamethylenediisocyanate (HDI) is used, it is known that the resultant latent electrostatic image bearing member shows a remarkable increase in the residual potential in the exposed area immediately after 120-minute electrostatic fatigue loading conducted under a given condition. Thus, such a latent electrostatic image bearing member is not suitable for mounting onto high-speed image forming apparatus without modification.

The cause for this remarkable residual potential increase is not clearly understood, but the following mechanism is considered to be involved. Theoretically, hydroxyl groups and isocyanate groups fully undergo polymerization to form a polyurethane resin with a three-dimensional crosslinked structure without being left intact if the number of hydroxyl groups is the same as the number of isocyanate groups. For this reason, if a hydroxyl group-containing reactive charge transporting substance is to be used, it becomes necessary to use at least an isocyanate group-containing isocyanate compound whose number of isocyanate groups is the same as the number of hydroxyl groups of the reactive charge transporting substance. Here, suppose a reactive charge transporting substance is contained in an amount of 25% by mass of the total resin, at least a similar amount of isocyanate compound is required, although it depends on the OH equivalent weight of the reactive charge transporting substance (a value obtained by dividing its molecular weight by the number of hydroxyl groups in the molecule) and on the NCO content and NCO % in the isocyanate compound. That is, the isocyanate compound is contained also in an amount of 25% by mass. At this point, when an aliphatic isocyanate compound is used, the isocyanate compound contained in the protective layer is almost free from π electrons and thus is considered to hardly contribute to charge transportation; therefore, the bulk charge transporting ability is considered to be low. Accordingly, continuous electrostatic fatigue loading by repetition of electrophotographic process inhibits charge transportation due to low charge transporting ability, leading to accumulation of residual potential. Aromatic isocyanate compounds, by contrast, are an isocyanate compound having an aromatic ring and hence have a number of π electrons. As can be understood from the fact that charge transporting compound exhibit their charge transporting ability by having an extended structure, π electrons play a significant role in charge transportability. In the outermost surface layer for the present invention that contains an aromatic isocyanate compound, π electrons are considered to be highly densely populated, and it is considered that this leads to high charge transportability and prevention of accumulation of residual potential.

When an isocyanate compound has only one isocyanate group, the isocyanate compound constitutes as terminal site by bonding to a polyol in the form of pendant. In order for the isocyanate compound to form a three-dimensional network as polyurethane resin, it is necessary to add an additional multifunctional polyisocyanate compound. If such a multifunctional polyisocyanate compound is an aromatic isocyanate, it results in increased π electron density in the resin film and the charge transportability improves. Thus, aromatic isocyanate compounds used for the present invention preferably have an aromatic and two or more isocyanate groups in the molecule. Moreover, aromatic isocyanate compounds that have three or more isocyanate groups are more preferably used because they form three-dimensional networks to constitute high-wear resistance binder resin.

In a preferred embodiment of the present invention, the isocyanate group of the aromatic ring-containing isocyanate compound is bonded to an aromatic ring via an alkyl group. The aromatic ring has a substantially planar structure due to the presence of conjugated double bonds, and the conformational freedom of molecule is small. For this reason, during formation of a three-dimensional network, the isocyanate group's movement is considered to be restricted that makes it close to a hydroxyl group for crosslinking reaction. In contrast to this, when the isocyanate group of an aromatic ring-containing isocyanate compound is bonded to an aromatic ring via an alkyl group. the alkyl group can freely rotate about the σ bond. Thus the conformational freedom of the molecule is high and thus the degree of movement restriction is small. As a result, hydroxyl and isocyanate groups are less likely to be left intact without being consumed for crosslinking, thereby reducing the likelihood of reduced wear resistance and poor electrostatic characteristics of the photoconductor due to reduction in the crosslink density and electrostatic adverse effects originated from non-reacted functional groups. It is thus easy to form excellent crosslink structure.

Furthermore, in a preferred embodiment of the present invention, the aromatic ring-containing isocyanate compound is an adduct between a diisocyanate compound and a polyol. Also in this case, the conformational freedom of the polyol moiety is high as described above and thus crosslink structure can be readily formed, allowing formation of a photosensitive layer that offers excellent wear resistance and electrostatic characteristics.

In general, the term "aromatic isocyanate compound" is often used as a collective term for any compound in which an isocyanate group is directly bonded to an aromatic ring. In the context of the present invention, however, this terms is used in a broader sense and thus encompasses any compound that has an aromatic ring in the molecule, including the foregoing compounds in which an alkyl group is interposed between the aromatic ring and isocyanate group.

Examples of the aromatic isocyanate compounds include tolylene diisocyanate (TDI), diphenylmethanediisocyanate (MDI), polymeric MDI (polymer of MDI), xylenediisocyanate (XDI), and adducts between TDI, MDI or XDI and a polyol such as trimethylolpropane.

Commercially available products can be employed for these aromatic isocyanate compounds; examples are COSMONATE T series, COSMONATE M series, COSMONATE ND, TAKENATE 500 and TAKENATE D-110N, an adduct of TAKENATE 500 (produced by Mitsui Chemicals Polyurethanes, Ltd.); BARNOCK D750, an adduct of tolylenediisocyanate (produced by Dainippon Ink and Chemicals, Incorporated); and CORONATE L (produced by Nippon Polyurethane Industry Co., Ltd.). Among them, xylenediisocyanate and an adduct thereof are preferably used because they have the structure shown below in which an aromatic ring and an isocyanate group are bonded together via a methylene group, and readily forms crosslinked structure for the reason mentioned above.

Furthermore, in a preferred embodiment of the present invention, the aromatic ring-containing isocyanate compound has a NCO content of 3% by mass to 50% by mass, more preferably 10% by mass to 40% by mass. The greater the value for NCO %, the greater the number of crosslink sites to be formed (i.e., the greater crosslink density), whereby wear resistance may be improved. If the NCO content is less than 3% by mass, the content of isocyanate compound relative to polyol increases, with the value of hydroxyl group/isocyanate group being the equivalent weight, whereby crosslink density decreases. Thus, it may result in poor wear resistance. If the NCO content is greater than 50% by mass, the isocyanate compound becomes so reactive that reactions proceed in the coating solution of the isocyanate compound before coated on a substrate, thereby reducing the coating solution life. For this reason, there is a fear that handleability of the coating solution reduces during manufacturing process and/or the amount of organic wastewater increases, placing additional load on the environmental.

Upon preparation of the crosslinked resin, it may also be possible to use an aliphatic polyisocyanate compound in combination with an aromatic isocyanate compound. Examples of aliphatic polyisocyanate compounds include linear isocyanates such as tetramethylenediisocyanate, hexamethylenediisocyanate, 2,6-diisocyanatemethylcaproate; alicyclic polyisocyanates such as isophoronediisocyanate and cyclohexylmethanediisocyanate; isocyanurates; the foregoing isocyanates blocked with phenol derivative, oxime, or caprolactam; and trimers composed of isocyanate compound (e.g., hexamethylenediisocyanate trimer).

In addition, adducts between trimethylolpropane and aliphatic polyisocyanates (e.g., hexamethylenediisocyanate) or alcyclic polyisocyanates (e.g., isophoronediisocyanate) are also used suitably. An example of an adduct formed between trimethylolpropane and hexamethylenediisocyanate is represented by Structural Formula (II) below.

(II)

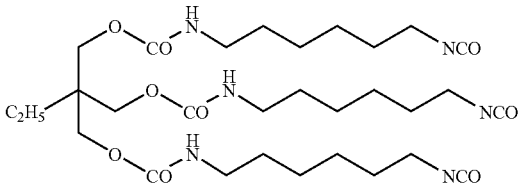

As the aliphatic polyisocyanates used in combination with aromatic polyisocyanates, commercially available products can be employed. Examples thereof include Sumidur HT (adduct formed between trimethylolpropane and hexamethylenediisocyanate, produced by Sumika Bayer Urethane Co., Ltd.). As the polyisocyanates, polyisocyanates having charge generating molecular structure, or polyisocyanates having charge transporting molecular structure are also used.

Hereinafter, hydroxyl group-containing reactive charge transporting substances that are suitably used in the present invention will be described. The outermost surface layer of the latent electrostatic image bearing member of the present invention contains crosslinked resin formed by crosslinking between an aromatic ring-containing isocyanate compound and a reactive charge transporting substance having at least two hydroxyl groups, wherein the reactive charge transporting substance preferably contains a compound represented by the following General Formula (2).

(2)

where n represents the number of substituent Y attached to substituent X and is an integer of 0 to 4; Y represents an organic group having at least two hydroxyl groups and 1 to 6 carbon atoms when n=1, and represents an alkylene group having a hydroxyl group and 1 to 50 carbon atoms when n=2 to 4, the alkylene group optionally having substituent(s) other than hydroxyl group; and X represents a charge transporting compound group.

A preferred embodiment of the latent electrostatic image bearing member of the present invention is that in the compound represented by the foregoing General Formula (2), the charge transporting compound group X contains either diarylamino group —$NAr_1Ar_2$ (where $Ar_1$ and $Ar_2$ independently represent a substituted or non-substituted aromatic group) or a moiety represented by the following General Formula (3).

(3)

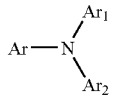

where $Ar_1$ and $Ar_2$ independently represent a substituted or non-substituted aromatic group; and Ar represents an arylene group.

The compound represented by General Formula (2) preferably has a structure in which each of n hydrogen atom(s) attached to the aromatic groups of the compound represented by the following General Formula (4) is replaced by substitutent Y.

(4)

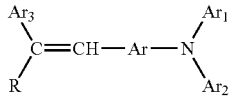

where $Ar_1$, $Ar_2$ and $Ar_3$ independently represent a substituted or non-substituted aromatic group; Ar represents an arylene group; and R represents a hydrogen atom or aromatic group.

Furthermore, the compound represented by General Formula (2) preferably has a structure in which each of n hydrogen atom(s) attached to the aromatic groups of the compound represented by the following General Formula (5) is replaced by substitutent Y.

(5)

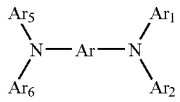

where $Ar_1$ and $Ar_2$ independently represent a substituted or non-substituted aromatic group; $Ar_5$ and $Ar_6$ independently represent an alkyl group or aromatic group; and Ar represents an arylene group. In the reactive charge transporting substance it is preferable that two adjacent carbon atoms each have a hydroxyl group.

The substituent Y in the compound represented by General Formula (2) preferably has a moiety represented by the following General Formula (6).

(6)

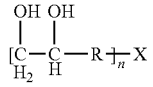

where n represents the number of substituents attached to substituent X and is an integer of 1 to 4; and R represents a divalent substituent containing 1 to 50 carbon atoms.

Moreover, the substituent Y in the compound represented by General Formula (2) preferably has a moiety represented by the following General Formula (7).

$$[HO—Z]_n—X \quad (7)$$

where n represents the number of substituents attached to substituent X and is an integer of 2 to 4; and Z represents either a divalent substituent containing 1 to 50 carbon atoms or a single bond.

Furthermore, the latent electrostatic image bearing member of the present invention preferably has in its outermost surface layer a crosslinked resin formed of an isocyanate compound and at least one polyol compound that does not act as a charge transporting compound group.

The crosslinked resin, formed by crosslinking between an isocyanate compound and a reactive charge transporting substance having at least two hydroxyl groups, is a polyurethane resin with urethane bonds formed therein. Because the urethane resin forms a three-dimensional network by crosslinking reactions between the multifunctional isocyanate compound and polyol compound, it suitably serves as high-wear resistance binder resin. The use of reactive charge transporting substance as such a polyol compound possibly results in disadvantageous conditions for the formation of three-dimensional structure, depending on their structure. For example, when a charge transporting substance having a structure other than those of the charge transporting substances employed in the present invention is used, it results in the formation of a pendant-shaped structure in which charge transporting compound groups hang down at the resin structure terminals. This structure becomes a terminal molecule in cases where the charge transporting compound groups or the like lack polyol component therein, resulting in failure to form polymer structure and thereby formation of resin layer becomes impossible. Thus, such a pendant-shaped structure is unable to form three-dimensional networks and therefore inhibits formation of such three-dimensional networks in polyurethane, significantly impairing the wear resistance. If the content of the reactive charge transporting substance is reduced and the content of the polyurethane resin component is increased for the purpose of preventing this problem, the outermost surface exhibits small charge transportability, and thus it becomes highly likely that such troubles as reduction in the photosensitivity and/or increase in the residual potential occur. More specifically, it leads to a trade-off between wear resistance and electrical characteristics of the outermost surface layer.

Hereinafter, charge transporting substances having at least two hydroxyl groups, the reactive charge transporting substances preferably employed in the present invention, will be described. The charge transporting substances employed in the present invention are preferably compounds represented by the foregoing General Formula (2): $[Y]_n$—X. In these compounds the substituent Y is either a charge transporting compound in which at least two adjacent carbon atoms each have a hydroxyl group, or a charge transporting compound connected to X group directly or via an organic group having 1 to 50 carbon atoms. Examples of more preferred charge transporting substances employed in cases where substituent Y have at least two hydroxyl groups on adjacent carbon atoms are compounds represented by General Formula (6). In addition, examples of more preferred charge transporting substances bonded directly or via an organic group having 1 to 50 carbons to substituent X of compounds represented by General Formula (2) are moieties represented by General Formula (7). It is particularly preferable that substituent X in the moieties represented by General Formulas (6) and (7) be compounds represented by General Formulas (3) to (5) from which hydrogen atoms are detached.

In the present invention, such charge transporting substances with substituent X have at least two hydroxyl groups which are preferably one of the following two types.

Examples of the first type of charge transporting substances are those having hydroxyl groups on two adjacent carbon atoms, particularly those compounds represented by General Formula (2) in which substituent Y is attached to group X— of the compound represented by General Formula (6).

Examples of the second type of charge transporting substances are those compounds represented by General Formula (2) in which substituent Y is attached to group X— of the compound represented by General Formula (7).

In the compounds of the formulas (3) to (5) $Ar_1$ to $Ar_4$ independently represent a substituted or non-substituted aromatic group; note, however, that when any of $Ar_1$ to $Ar_4$ is bonded to Y group, an example of that aromatic group is a divalent aromatic group.

Examples of the non-substituted aromatic group include phenyl, phenoxyphenyl (ortho-, meta-, or para-phenoxyphenyl), biphenyl, phenylalkylenephenyl (where alkylene is for instance methylene, ethylene, propylene, butylene, pentene (cyclopentene), or hexylene (cyclohexylene)) such as phenylethylphenyl ($-\Phi(CH_2)_2-\Phi-$: where $\Phi$ denotes $C_6H_4$) and phenylcyclohexylenephenyl, phenylalkoxylenephenyl (where alkoxylene is for instance methoxylene ($—CH_2O—$), ethoxylene ($—(CH_2)_2O—$), propoxylene ($—CH_2CH(CH_3)O—$, or butoxylene) such as phenylethoxyphenyl, and terphenyl, naphthalene and pyrene groups.

Examples of the substituted aromatic group include phenyl, phenoxyphenyl and biphenyl groups, each of which is substituted with 1-4 substituents selected from alkyl groups ($C_1$-$C_{10}$ alkyls such as methyl, ethyl, propyl, butyl, pentyl, and/or hexyl), alkoxyl groups ($C_1$-$C_{10}$ alkoxyls such as methoxy, ethoxy, propoxy, butoxy, pentoxy, and/or hexoxy), alkoxyalkyl groups, halogens (fluorine, chlorine, bromine, and/or iodine atoms), cyano, nitro, and alkoxycarbonyl groups.

Substituent R in the compounds represented by General Formula (4) denotes any of the above-described substituents $Ar_1$ to $A_4$ or hydroxyl group. In the case that substituent R is hydroxyl group, it, of course, has no bonds available for attachment to substituent Y.

Ar in the compounds represented by General Formulas (4) and (5) denotes the same substituent as the foregoing $Ar_1$ to $A_4$ bonded to substituent Y: divalent substituted or non-substituted aromatic groups.

Substituent X in the compounds represented by General Formulas (3) to (5) has n substituents Y represented by General Formula (2).

Such substituent Y is either a group having hydroxyl groups on two adjacent carbon atoms, or a substituent represented by General Formula (7). The groups having hydroxyl groups on two adjacent carbon atoms are substituents represented by General Formula (6).

In General Formula (6), R denotes a divalent organic group having 1 to 50 carbon atoms, and n is an integer of 1 to 4. More specific examples of such a divalent organic group include alkylene groups having 1 to 50 carbon atoms such as methylene, ethylene, propylene, butylene, pentene and hexylene groups; divalent alkoxylene groups having 1 to 50 carbon atoms such as methoxylene, ethoxylene, propoxylene, butoxylene, pentoxylene and hexoxylene; and divalent alkylenecarbonyloxy groups having 1 to 50 carbon atoms. In this case only one R may appear (for example, methyleneoxy group appear), two or more identical Rs may appear (for example, methyleneoxypropoxylene group), or two or more different Rs may appear (for example, divelent alkoxyalkylene group such as methoxyethylene group, and alkoxyalkylenecarbonyloxy group such as methoxypentenecarbonyloxy group).

The following Tables 1 to 36 list more specific examples of charge transporting substances represented by General Formula (2), each of which is composed of substituent X selected from General Formulas (3) to (5) and of substituent Y selected from General Formulas (6) and (7).

Tables 1 to 7 below list examples of compounds having the structure of General Formula (2) in which substituent X has the moiety represented by General Formula (3) and substituent Y has the moiety represented by General Formula (7).

TABLE 1

| No. | Y | Z | n | Ar1 | Ar2 | Ar3 | Position of Y | Chemical formula |
|---|---|---|---|---|---|---|---|---|
| 2-6-1-1(No1) | Y = —OH | Single bond | 2 | 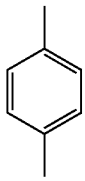 | 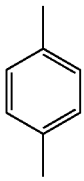 | 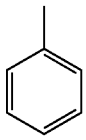 | Ar1, Ar2 | 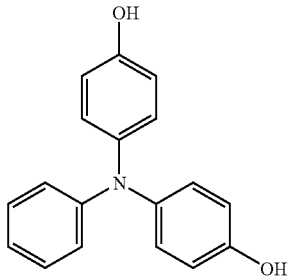 |
| 2-6-1-2(No2) | Y = —OH | Single bond | 2 | 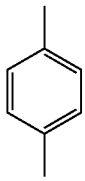 | 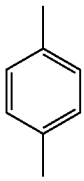 | 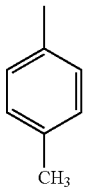 | Ar1, Ar2 | 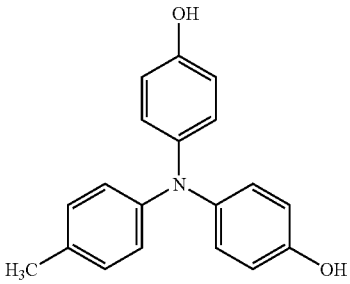 |
| 2-6-1-3(No3) | Y = —OH | Single bond | 2 | 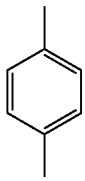 | 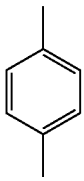 | 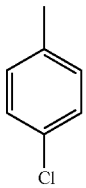 | Ar1, Ar2 | 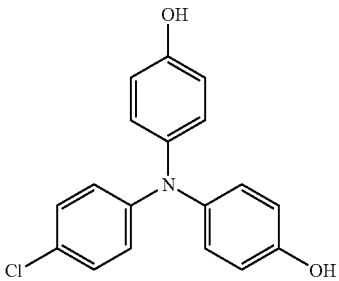 |
| 2-6-1-4(No4) | Y = —OH | Single bond | 2 | 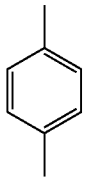 | 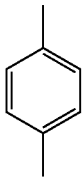 | 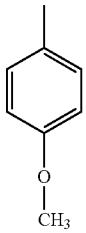 | Ar1, Ar2 | 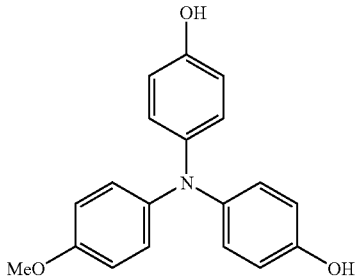 |

TABLE 1-continued
| No. | Y | Z | n | Ar1 | Ar2 | Ar3 | Position of Y | Chemical formula |
|---|---|---|---|---|---|---|---|---|
| 2-6-1-5(No5) | Y = —OH | Single bond | 2 | 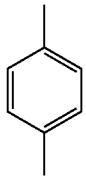 | 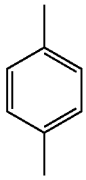 | 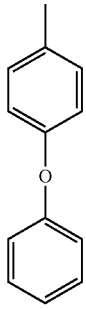 | Ar1, Ar2 | 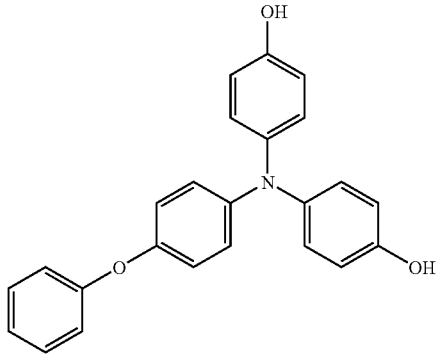 |
| 2-6-1-6(No7) | Y = —OH | Single bond | 2 | 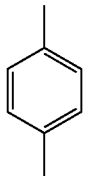 | 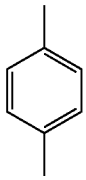 | 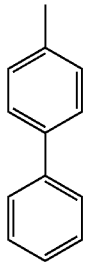 | Ar1, Ar2 | 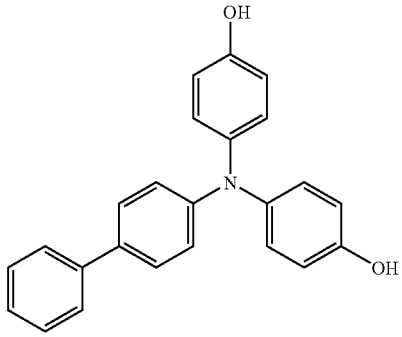 |
| 2-6-1-7(No8) | Y = —OH | Single bond | 2 | 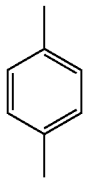 | 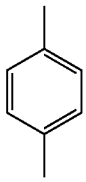 | 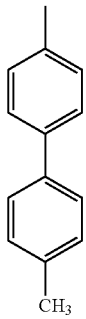 | Ar1, Ar2 | 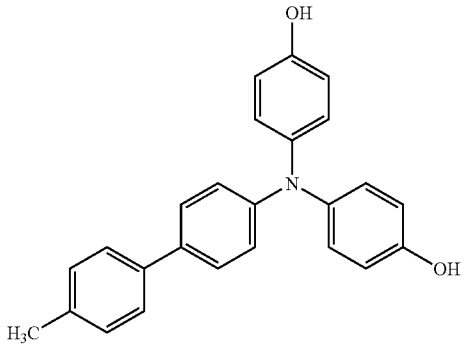 |
| 2-6-1-8(No9) | Y = —OH | Single bond | 2 | 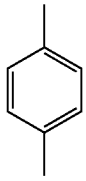 | 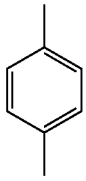 | 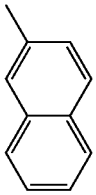 | Ar1, Ar2 | 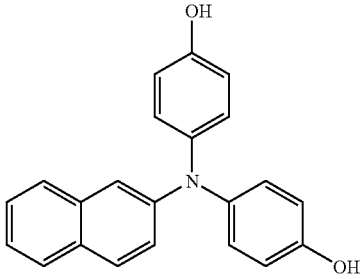 |

TABLE 2
| No. | Y | Z | n | Ar1 | Ar2 | Ar3 | Position of Y |
|---|---|---|---|---|---|---|---|
| 2-6-1-9(No10) | Y = —OH | Single bond | 2 | 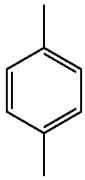 | 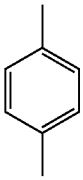 | 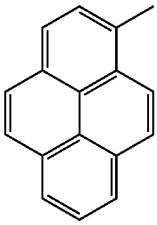 | Ar1, Ar2 |
| 2-6-1-10(No15) | Y = —OH | Single bond | 2 | 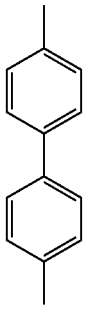 | 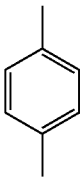 | 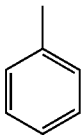 | Ar1, Ar2 |
| 2-6-1-11(No16) | Y = —OH | Single bond | 2 | 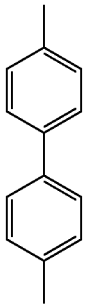 | 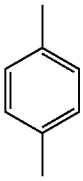 | 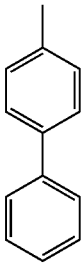 | Ar1, Ar2 |
| 2-6-1-12(No17) | Y = —OH | Single bond | 2 | 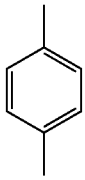 | 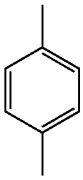 | 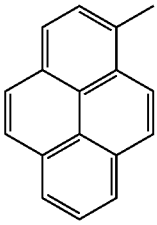 | Ar1, Ar2 |
| 2-6-1-13(No18) | Y = —OH | Single bond | 2 | 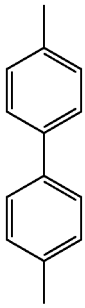 | 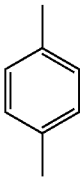 | 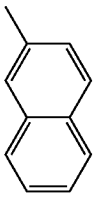 | Ar1, Ar2 |

TABLE 2-continued
| | | | | | |
|---|---|---|---|---|---|
| 2-6-1-14(No19) | Y = —OH | Single bond | 2 | 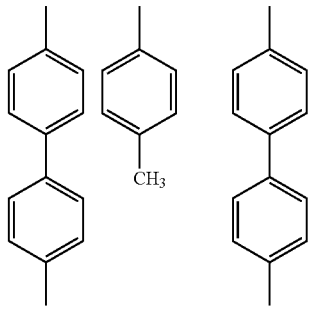 | Ar1, Ar3 |
| 2-6-1-15(No20) | Y = —OH | Single bond | 2 | 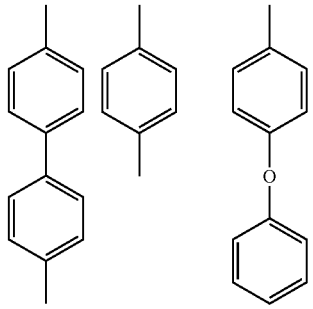 | Ar1, Ar2 |
| No. | Chemical formula |
|---|---|
| 2-6-1-9(No10) | 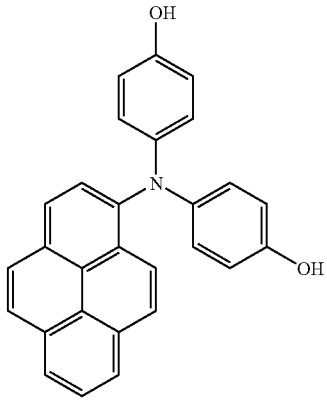 |
| 2-6-1-10(No15) | 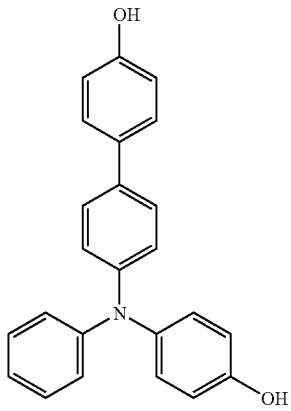 |

TABLE 2-continued
2-6-1-11(No16)
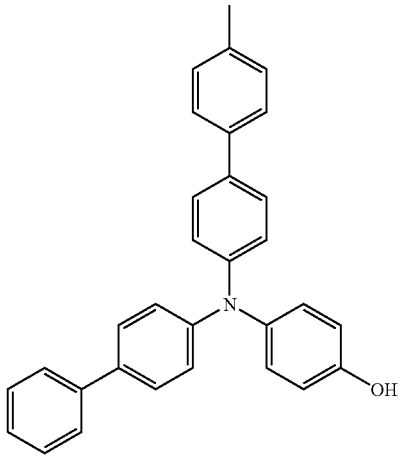
2-6-1-12(No17)
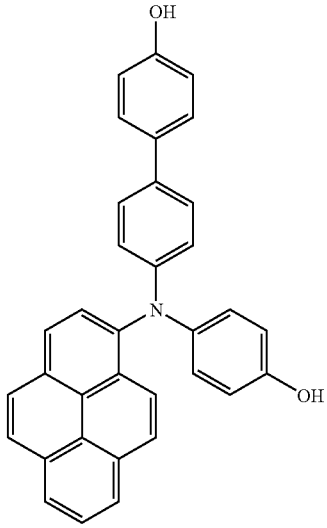
2-6-1-13(No18)
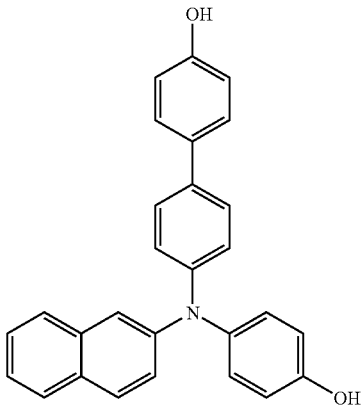

TABLE 2-continued
| | |
|---|---|
| 2-6-1-14(No19) | 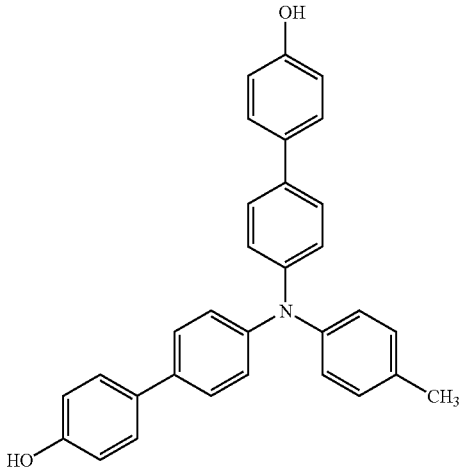 |
| 2-6-1-15(No20) | 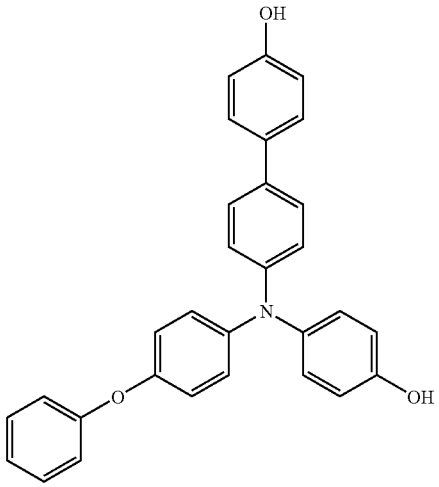 |
TABLE 3
| No. | Y | Z | n | Ar1 | Ar2 | Ar3 | Position of Y |
|---|---|---|---|---|---|---|---|
| 2-6-2-1(No28) | Y = —CH2OH | R = —CH2— | 2 | 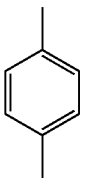 | 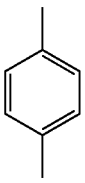 | 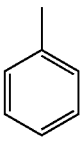 | Ar1, Ar2 |
| 2-6-2-2(No29) | Y = —CH2OH | R = —CH2— | 2 | 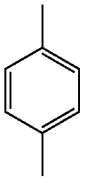 | 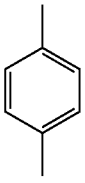 | 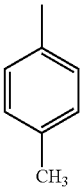 | Ar1, Ar2 |

TABLE 3-continued
| | | | | | |
|---|---|---|---|---|---|
| 2-6-2-3(No30) | Y = —CH2OH | R = —CH2— | 2 | 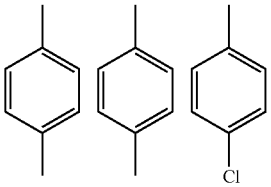 | Ar1, Ar2 |
| 2-6-2-4(No31) | Y = —CH2OH | R = —CH2— | 2 | 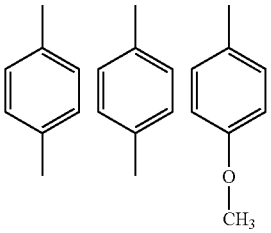 | Ar1, Ar2 |
| 2-6-2-5(No32) | Y = —CH2OH | R = —CH2— | 2 | 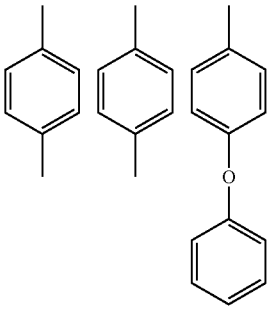 | Ar1, Ar2 |
| 2-6-2-6(No34) | Y = —CH2OH | R = —CH2— | 2 | 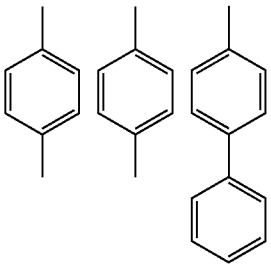 | Ar1, Ar2 |
| 2-6-2-7(No35) | Y = —CH2OH | R = —CH2— | 2 | 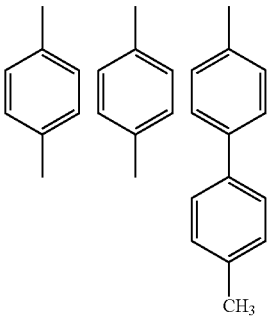 | Ar1, Ar2 |
| 2-6-2-8(No36) | Y = —CH2OH | R = —CH2— | 2 | 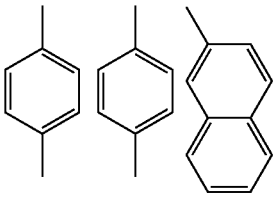 | Ar1, Ar2 |

TABLE 3-continued
| No. | Chemical formula |
|---|---|
| 2-6-2-1(No28) | 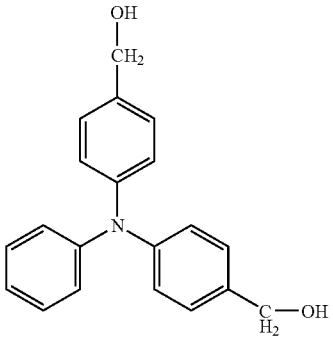 |
| 2-6-2-2(No29) | 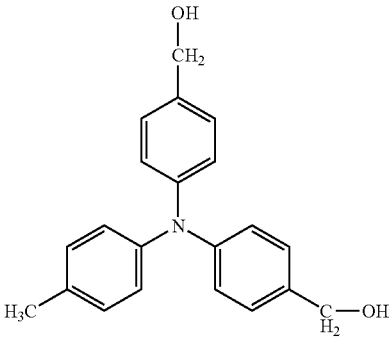 |
| 2-6-2-3(No30) | 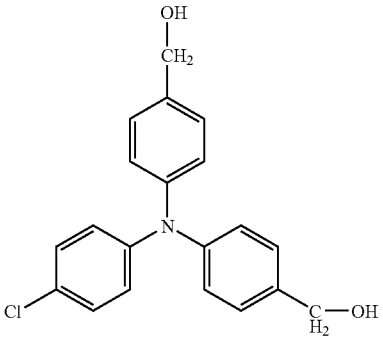 |
| 2-6-2-4(No31) | 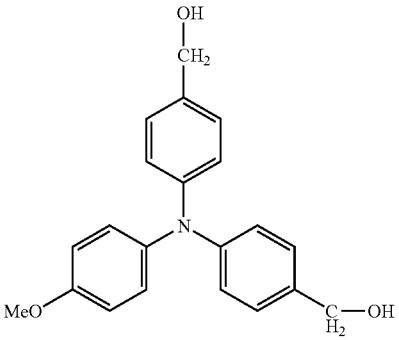 |

TABLE 3-continued
2-6-2-5(No32)
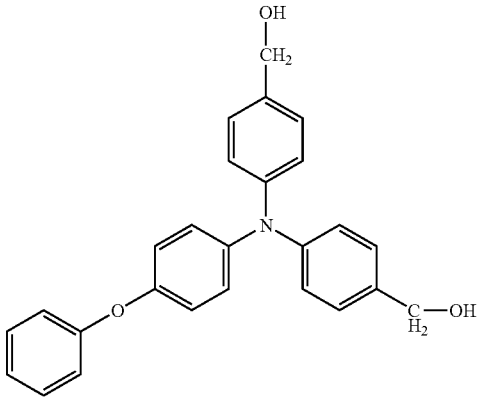
2-6-2-6(No34)
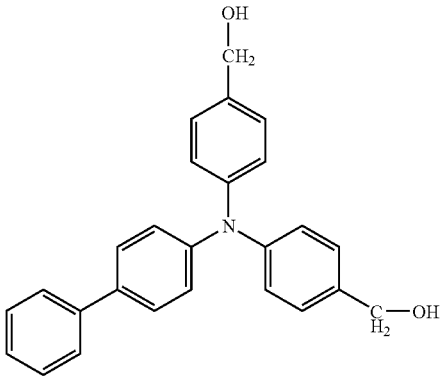
2-6-2-7(No35)
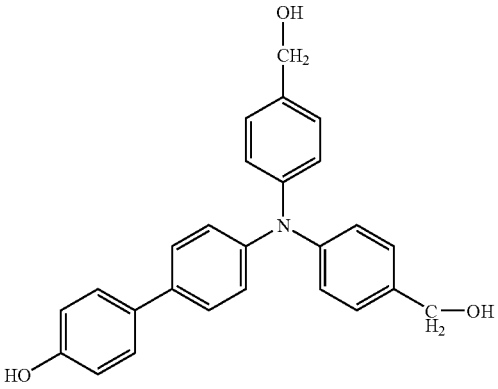
2-6-2-8(No36)
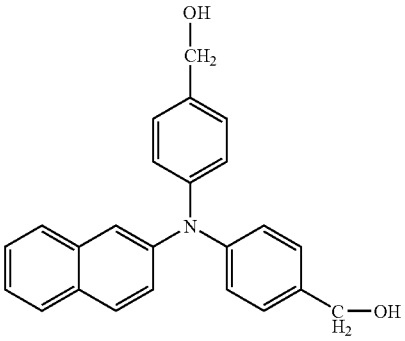

TABLE 4
| No. | Y | Z | n | Ar1 | Ar2 | Ar3 |
|---|---|---|---|---|---|---|
| 2-6-2-9(No.37) | Y = —CH2OH | R = —CH2— | 2 | 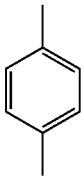 | 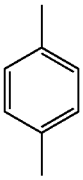 | 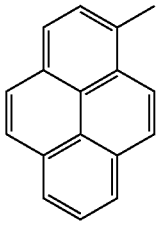 |
| 2-6-2-10(No.41) | Y = —CH2OH | R = —CH2— | 2 | 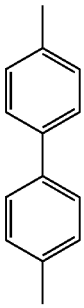 | 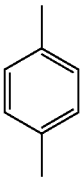 | 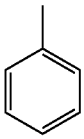 |
| 2-6-2-11(No.42) | Y = —CH2OH | R = —CH2— | 2 | 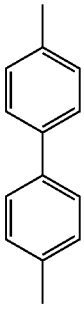 | 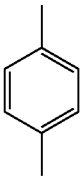 | 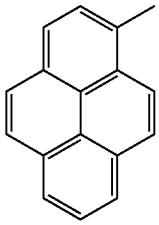 |
| 2-6-2-12(No.43) | Y = —CH2OH | R = —CH2— | 2 | 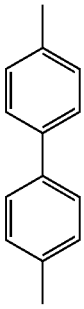 | 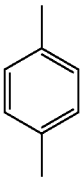 | 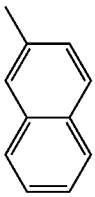 |
| 2-6-2-13(No.44) | Y = —CH2OH | R = —CH2— | 2 | 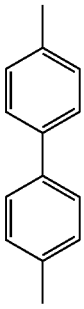 | 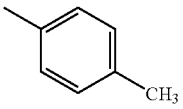  | 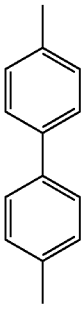 |

TABLE 4-continued
| | | | | |
|---|---|---|---|---|
| 2-6-2-14(No.45) | Y = —CH2OH | R = —CH2— | 2 | 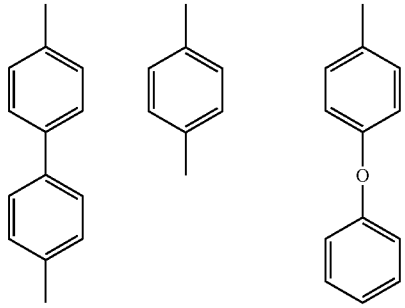 |
| 2-6-2-15(No163) | Y = —O—(CH2)2 —OH | z = —(CH2)2—O— | 2 | 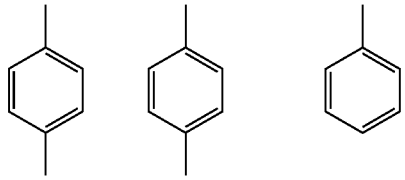 |
| 2-6-2-16(No164) | Y = —O—(CH2)4—OH | z = —(CH2)4—O— | 2 | 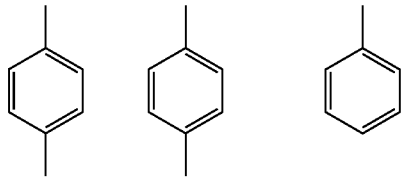 |
| No. | Position of Y | Chemical formula |
|---|---|---|
| 2-6-2-9(No.37) | Ar1, Ar2 | 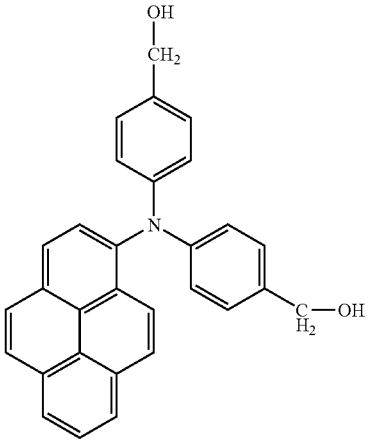 |
| 2-6-2-10(No.41) | Ar1, Ar2 | 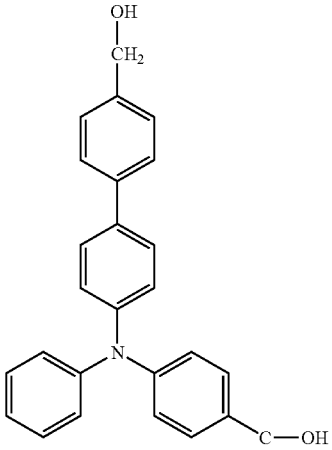 |

TABLE 4-continued
2-6-2-11(No.42) Ar1, Ar2
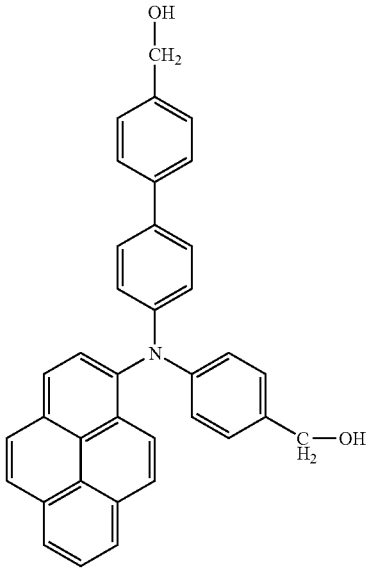
2-6-2-12(No.43) Ar1, Ar2
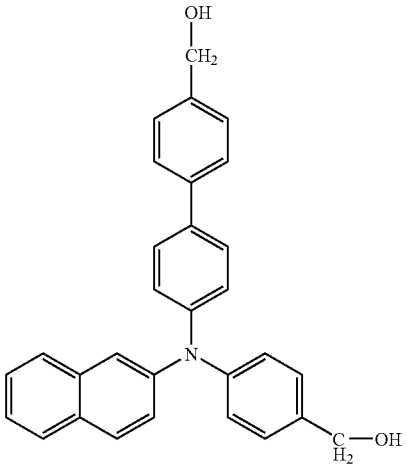
2-6-2-13(No.44) Ar1, Ar2
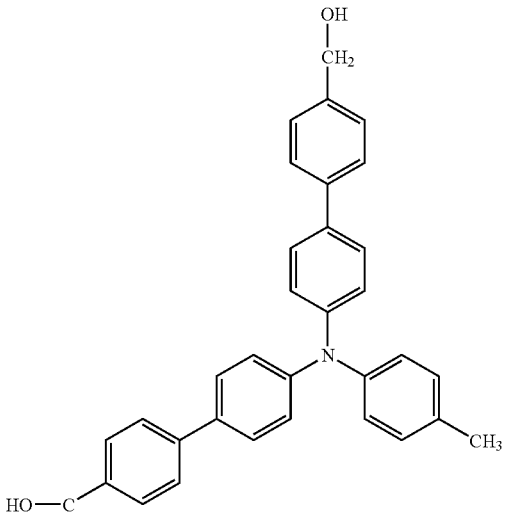

TABLE 4-continued
| | | |
|---|---|---|
| 2-6-2-14(No.45) | Ar1, Ar2 | 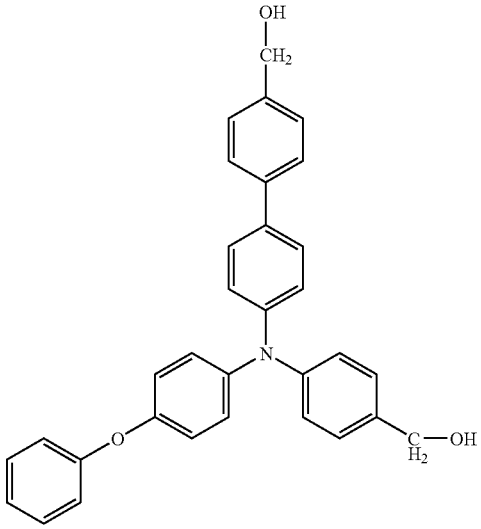 |
| 2-6-2-15(No163) | Ar1, Ar2 | 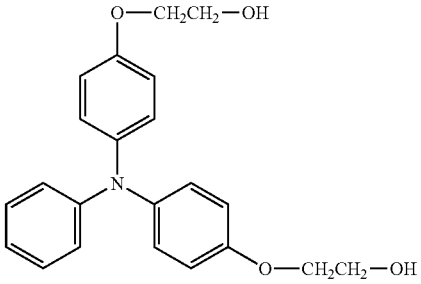 |
| 2-6-2-16(No164) | Ar1, Ar2 | 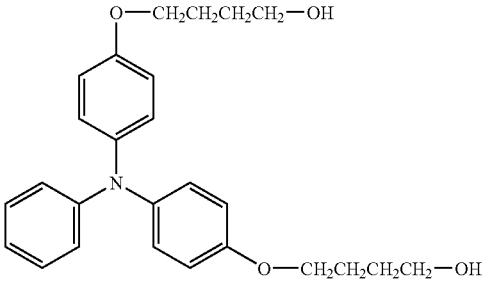 |
TABLE 5
| No. | Y | Z | n | Ar1 | Ar2 | Ar3 |
|---|---|---|---|---|---|---|
| 2-6-2-17(No165) | Y = —O—(CH2)2—OH | z = —(CH2)2—O— | 2 | 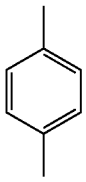 | 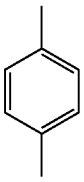 | 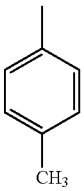 |
| 2-6-2-18(No166) | Y = —O—(CH2)4—OH | z = —(CH2)4—O— | 2 | 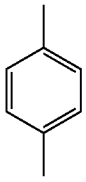 | 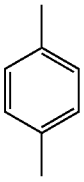 | 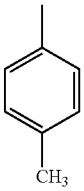 |

TABLE 5-continued
| | | | | |
|---|---|---|---|---|
| 2-6-2-19(No167) | Y = —O—(CH2)2—OH | z = —(CH2)2—O— | 2 | 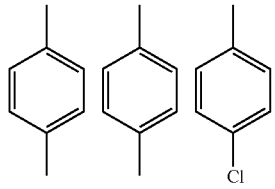 |
| 2-6-2-20(No168) | Y = —O—(CH2)3—OH | z = —(CH2)3—O— | 2 | 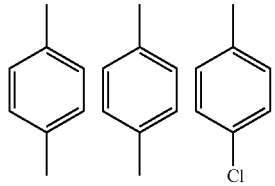 |
| 2-6-2-21(No169) | Y = —O—(CH2)2—OH | z = —(CH2)2—O— | 2 | 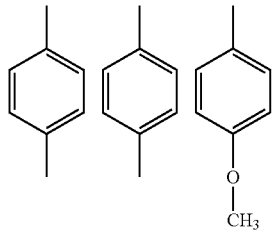 |
| 2-6-2-22(No170) | Y = —(O—CH2—CH2—OH | z = —(O—CH2—CH2)2— | 2 | 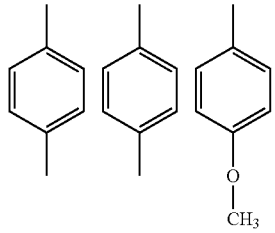 |
| 2-6-2-23(No171) | Y = —O—(CH2)2—OH | z = —(CH2)2—O— | 2 | 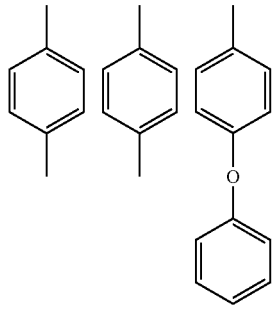 |
| 2-6-2-24(No172) | Y = —O—(CH2)5—OH | z = —(CH2)5—O— | 2 | 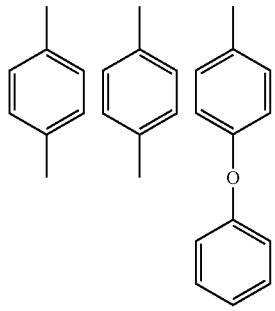 |

TABLE 5-continued
| | | | | |
|---|---|---|---|---|
| 2-6-2-25(No175) | Y = —O—(CH2)2—OH | z = —(CH2)2—O— | 2 | 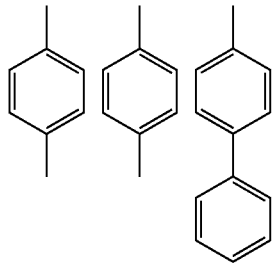 |
| No. | Position of Y | Chemical formula |
|---|---|---|
| 2-6-2-17(No165) | Ar1, Ar2 | 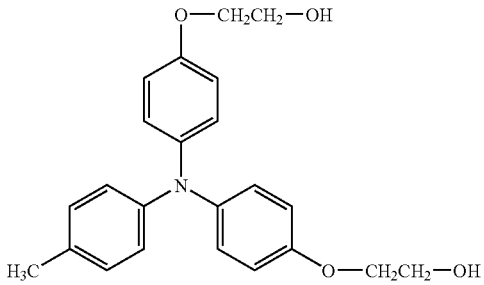 |
| 2-6-2-18(No166) | Ar1, Ar2 | 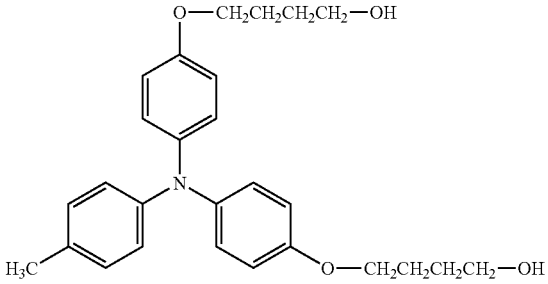 |
| 2-6-2-19(No167) | Ar1, Ar2 | 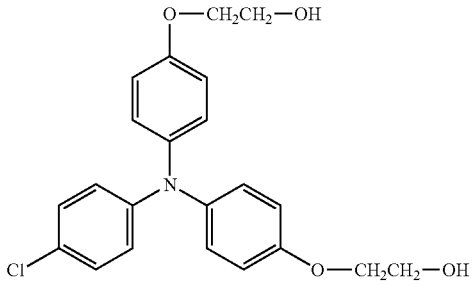 |
| 2-6-2-20(No168) | Ar1, Ar2 | 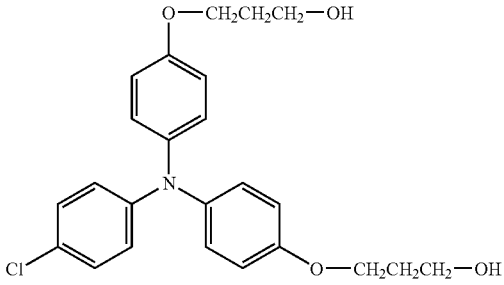 |

TABLE 5-continued
2-6-2-21(No169) Ar1, Ar2
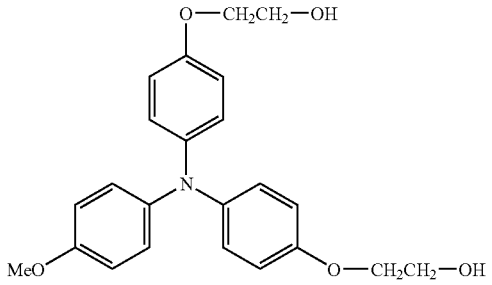
2-6-2-22(No170) Ar1, Ar2
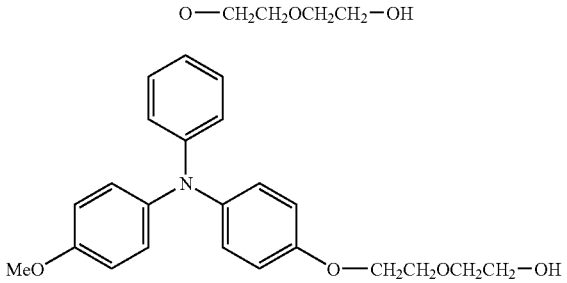
2-6-2-23(No171) Ar1, Ar2
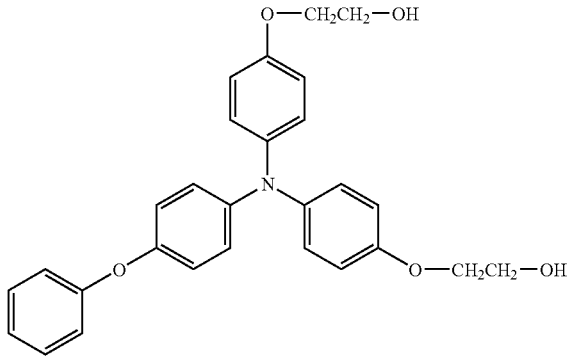
2-6-2-24(No172) Ar1, Ar2
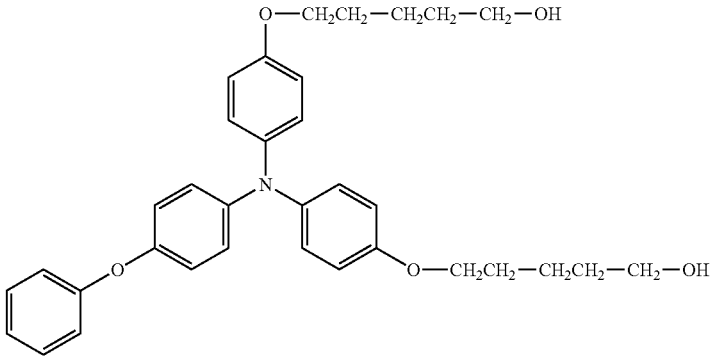

TABLE 5-continued
| | | |
|---|---|---|
| 2-6-2-25(No175) | Ar1, Ar2 | 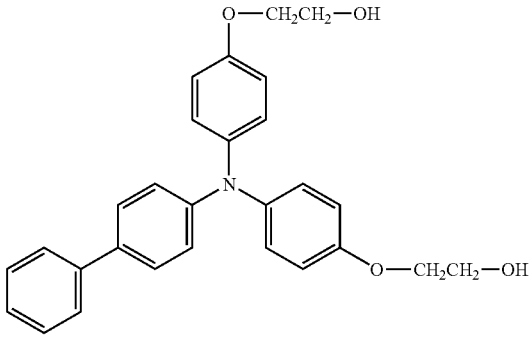 |
TABLE 6
| No. | Y | Z | n | Ar1 | Ar2 | Ar3 |
|---|---|---|---|---|---|---|
| 2-6-2-26(No.176) | Y = —O—(CH2)6—OH | z = —O—(CH2)6— | 2 | 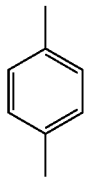 | 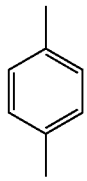 | 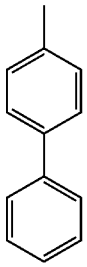 |
| 2-6-2-27(No.177) | Y = —O—(CH2)2OH | z = —O—(CH2)2 | 2 | 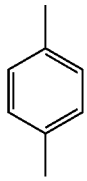 | 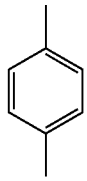 | 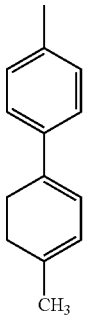 |
| 2-6-2-28(No.178) | Y = —(O—CH2—CH2)2—OH | z = —(O—CH2—CH2)2— | 2 | 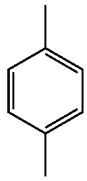 | 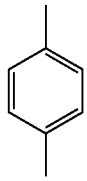 | 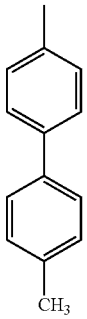 |
| 2-6-2-29(No.179) | Y = —O—(CH2)2OH | z = —O—(CH2)2— | 2 | 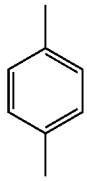 | 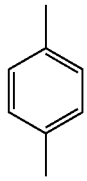 | 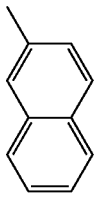 |

TABLE 6-continued

| | | | | |
|---|---|---|---|---|
| 2-6-2-30(No.180) | Y = —O—(CH2)4OH | R = —O—(CH2)4 | 2 | |
| 2-6-2-31(No.181) | Y = —O—(CH2)2OH | z = —O—(CH2)2— | 2 | |
| 2-6-2-32(No.182) | Y = —O—(CH2)3OH | z = —O—(CH2)3— | 2 | |
| 2-6-2-33(No.191) | Y = —O—(CH2)2OH | z = —O—(CH2)2— | 2 | |
| 2-6-2-34(No.192) | Y = —(O—CH2—CH2)2—OH | z = —(O—CH2—CH2)2— | 2 | |
| 2-6-2-35(No.193) | Y = —O(CH2)2OH | z = —O(CH2)2— | | |

TABLE 6-continued
| | | | |
|---|---|---|---|
| 2-6-2-36(No.194) | Y = —O(CH2)3OH | z = —O(CH2)3— | 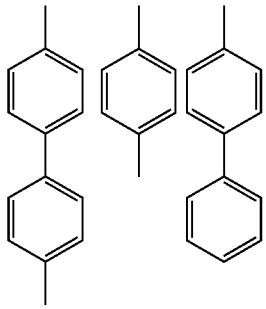 |
| No. | Position of Y | Chemical formula |
|---|---|---|
| 2-6-2-26(No.176) | Ar1, Ar2 | 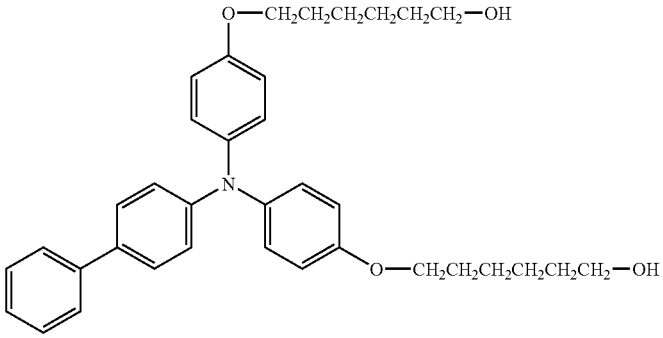 |
| 2-6-2-27(No.177) | Ar1, Ar2 | 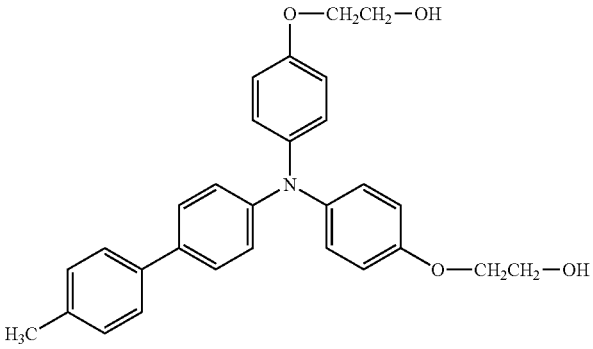 |
| 2-6-2-28(No.178) | Ar1, Ar2 | 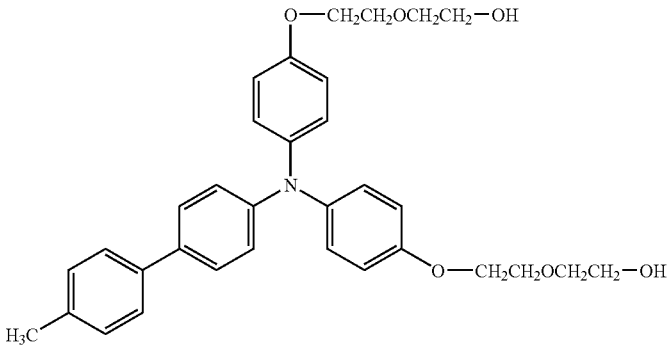 |

TABLE 6-continued
2-6-2-29(No.179) Ar1, Ar2
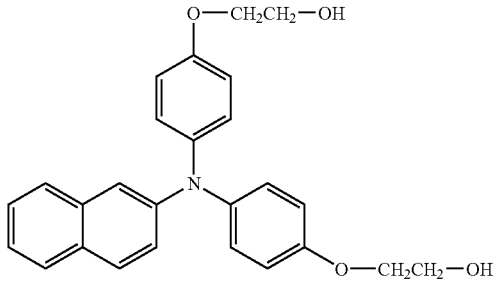
2-6-2-30(No.180) Ar1, Ar2
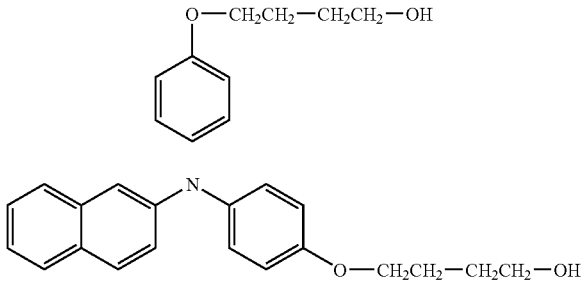
2-6-2-31(No.181) Ar1, Ar2
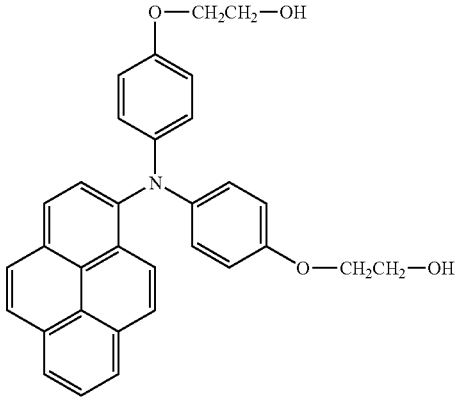
2-6-2-32(No.182) Ar1, Ar2
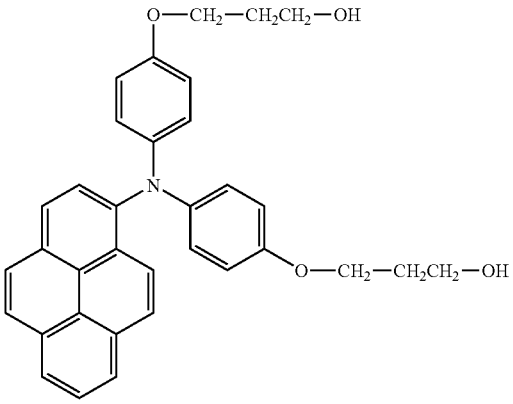

TABLE 6-continued
2-6-2-33(No.191) Ar1, Ar2
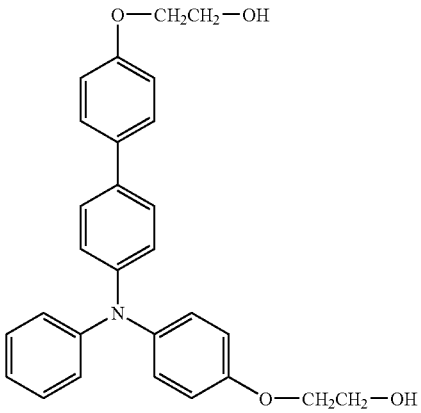
2-6-2-34(No.192) Ar1, Ar2
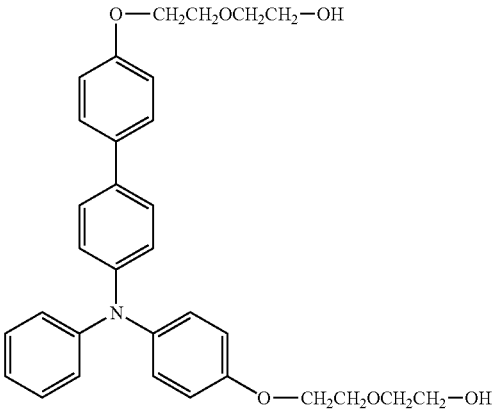
2-6-2-35(No.193) Ar1, Ar2
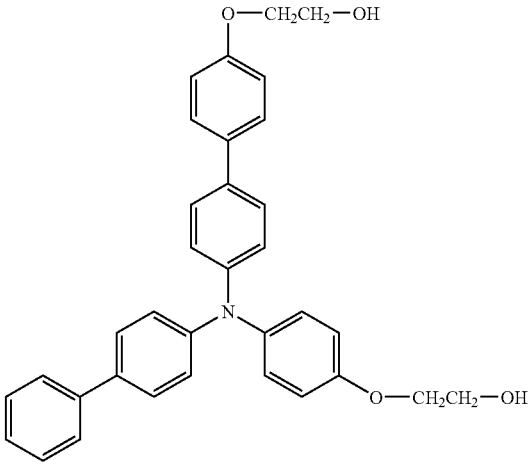

TABLE 6-continued
| | | |
|---|---|---|
| 2-6-2-36(No.194) | Ar1, Ar2 | 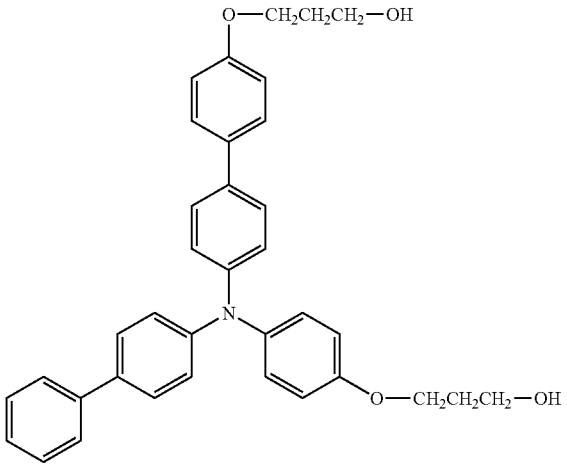 |
TABLE 7
| No. | Y | Z | n | Ar1 | Ar2 | Ar3 |
|---|---|---|---|---|---|---|
| 2-6-2-37(No.195) | Y = —O(CH2)2OH | z = —O(CH2)2— | 2 | 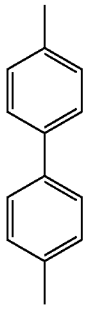 | 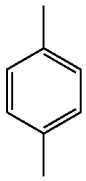 | 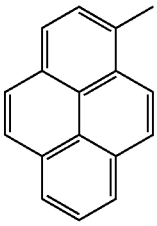 |
| 2-6-2-38(No.196) | Y = —O(CH2)3OH | z = —O(CH2)3— | 2 | 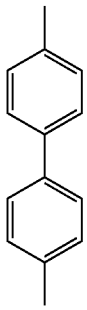 | 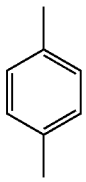 | 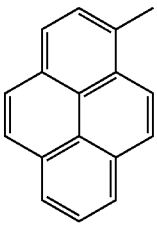 |
| 2-6-2-39(No.197) | Y = —O—(CH2)2OH | z = —O—(CH2)2— | 2 | 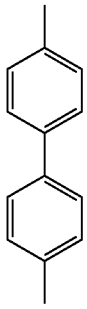 | 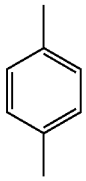 | 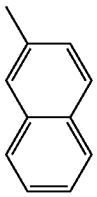 |

TABLE 7-continued

| | | | | |
|---|---|---|---|---|
| 2-6-2-40(No.198) | Y = —O—(CH2)4OH | z = —O—(CH2)4— | 2 | |
| 2-6-2-41(No.199) | Y = —O—(CH2)2OH | z = —O—(CH2)2— | 2 | |
| 2-6-2-42(No.200) | Y = —O—(CH2)5OH | z = —O—(CH2)5— | 2 | |
| 2-6-2-43(No.201) | Y = —O—(CH2)2OH | z = —O—(CH2)2— | 2 | |
| 2-6-2-44(No.202) | Y = —(O—CH2—CH2)2—OH | z = —(O—CH2—CH2)2— | 2 | |

TABLE 7-continued
| No. | Position of Y | Chemical formula |
|---|---|---|
| 2-6-2-37(No.195) | Ar1, Ar2 | 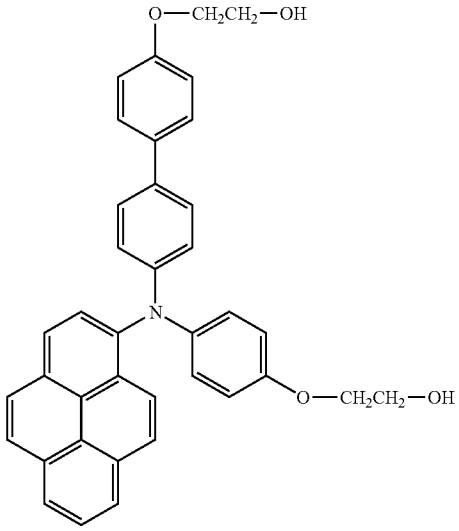 |
| 2-6-2-38(No.196) | Ar1, Ar2 | 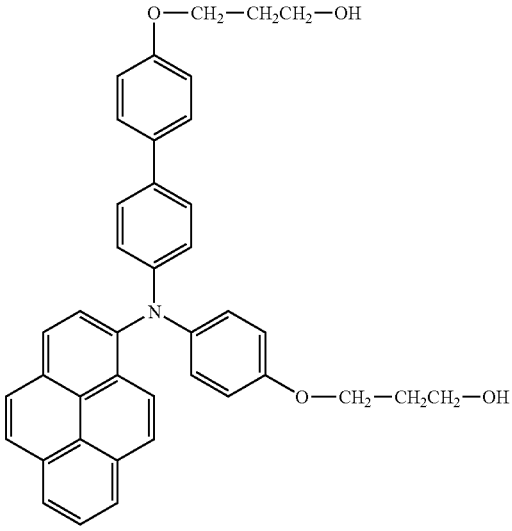 |
| 2-6-2-39(No.197) | Ar1, Ar2 | 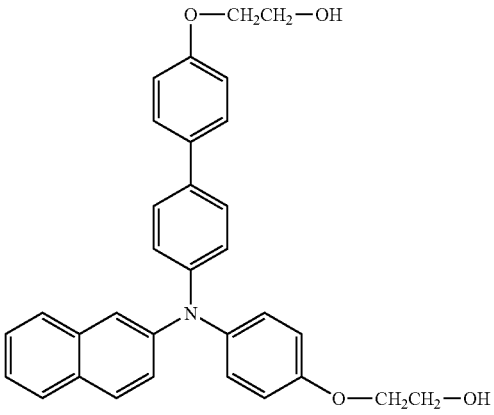 |

TABLE 7-continued
2-6-2-40(No.198) Ar1, Ar2
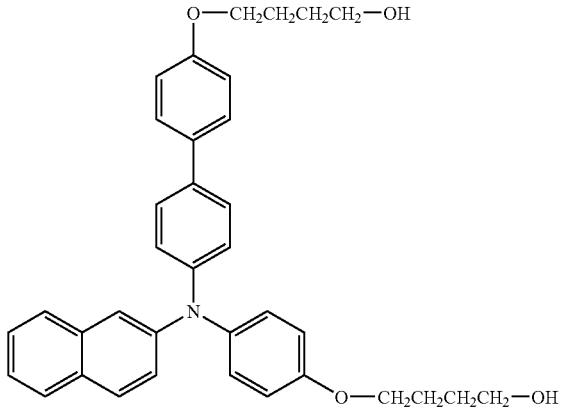
2-6-2-41(No.199) Ar1, Ar2
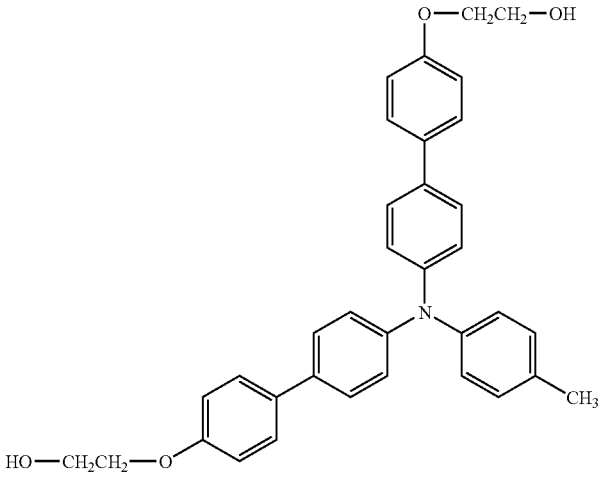
2-6-2-42(No.200) Ar1, Ar2
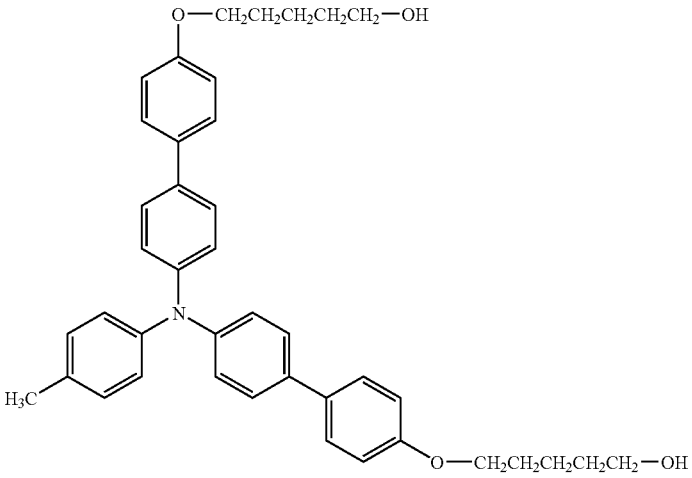

TABLE 7-continued
| | | |
|---|---|---|
| 2-6-2-43(No.201) | Ar1, Ar2 | 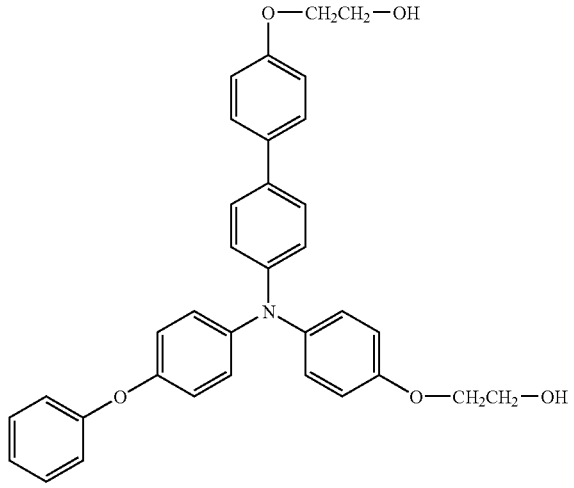 |
| 2-6-2-44(No.202) | Ar1, Ar2 | 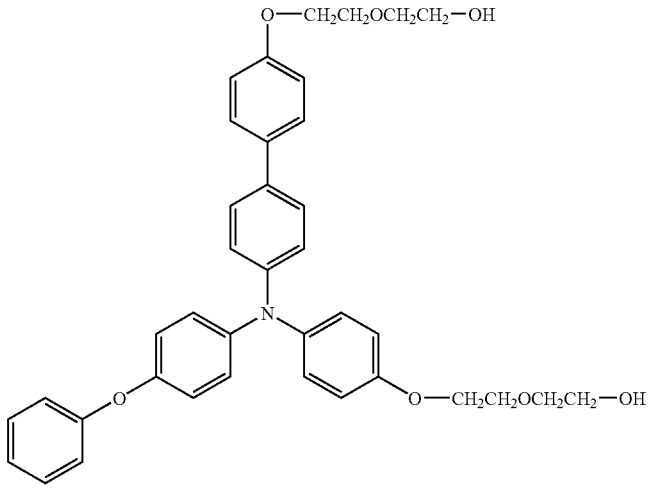 |
Tables 8 to 22 below list examples of compounds having the structure of General Formula (2) in which substituent X has the moiety represented by General Formula (3) and substituent Y has the moiety represented by General Formula (6).
TABLE 8
| No. | R | n | Ar1 | Ar2 | Ar3 | Position of Y | Chemical formula |
|---|---|---|---|---|---|---|---|
| 2-5-1-1(No.53) | R = —CH2O— | 1 | 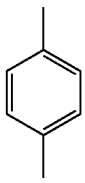 | 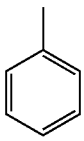 | 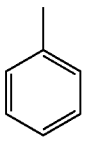 | Ar1 | 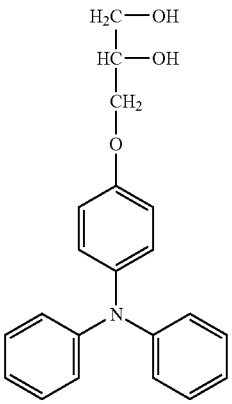 |

TABLE 8-continued
| No. | R | n | Ar1 | Ar2 | Ar3 | Position of Y | Chemical formula |
|---|---|---|---|---|---|---|---|
| 2-5-1-2(No.54) | R = —CH2O— | 1 | 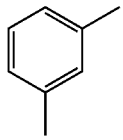 | 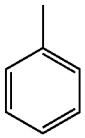 | 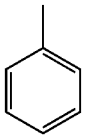 | Ar1 | 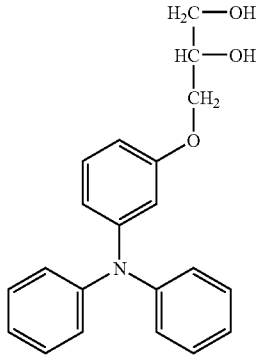 |
| 2-5-1-3(No.55) | R = —CH2O— | 1 | 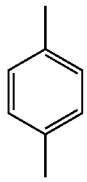 | 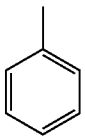 | 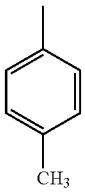 | Ar1 | 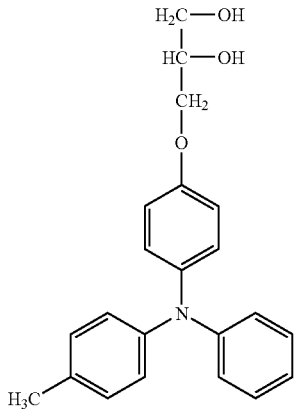 |
| 2-5-1-4(No.56) | R = —CH2O— | 1 | 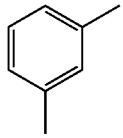 | 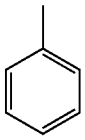 | 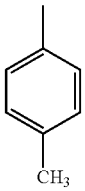 | Ar1 | 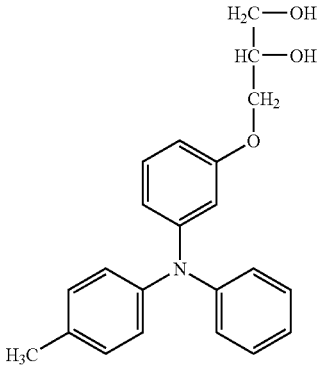 |
| 2-5-1-5(No.57) | R = —CH2O— | 1 | 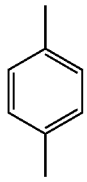 | 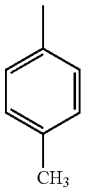 | 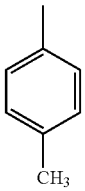 | Ar1 | 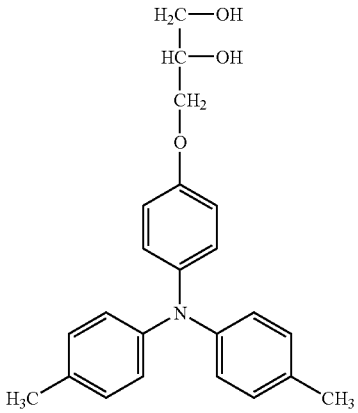 |

TABLE 8-continued
| No. | R | n | Ar1 | Ar2 | Ar3 | Position of Y | Chemical formula |
|---|---|---|---|---|---|---|---|
| 2-5-1-6(No.58) | R = —CH2O— | 1 | 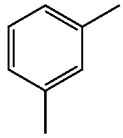 | 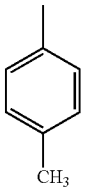 | 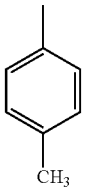 | Ar1 | 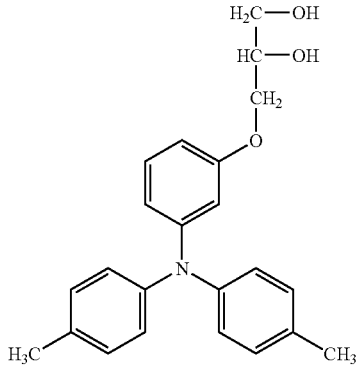 |
TABLE 9
| No. | R | n | Ar1 | Ar2 | Ar3 | Position of Y | Chemical formula |
|---|---|---|---|---|---|---|---|
| 2-5-1-7(No.59) | R = —CH2O— | 1 | 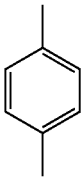 | 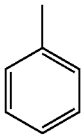 | 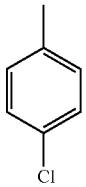 | Ar1 | 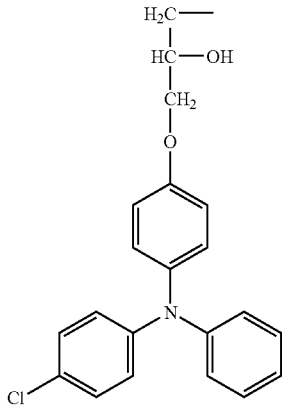 |
| 2-5-1-8(No.60) | R = —CH2O— | 1 | 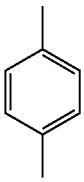 | 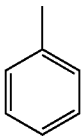 | 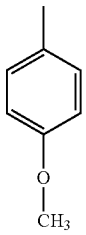 | Ar1 | 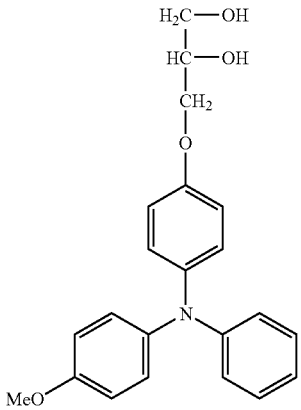 |

TABLE 9-continued
| No. | R | n | Ar1 | Ar2 | Ar3 | Position of Y | Chemical formula |
|---|---|---|---|---|---|---|---|
| 2-5-1-9(No.61) | R = —CH2O— | 1 | 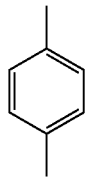 | 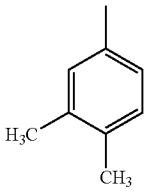 | 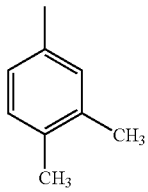 | Ar1 | 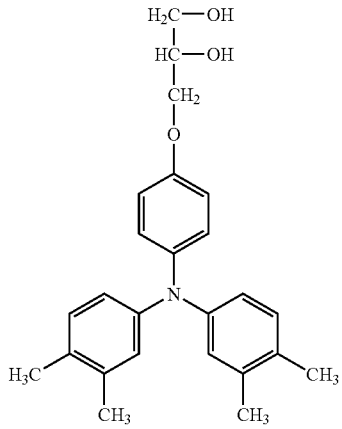 |
| 2-5-1-10(No.62) | R = —CH2O— | 1 | 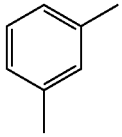 | 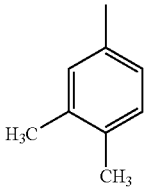 | 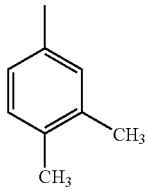 | Ar1 | 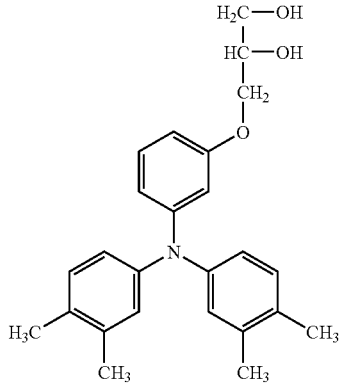 |
| 2-5-1-11(No.63) | R = —CH2O— | 1 | 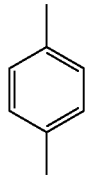 | 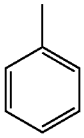 | 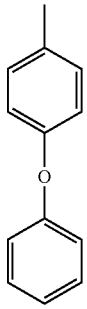 | Ar1 | 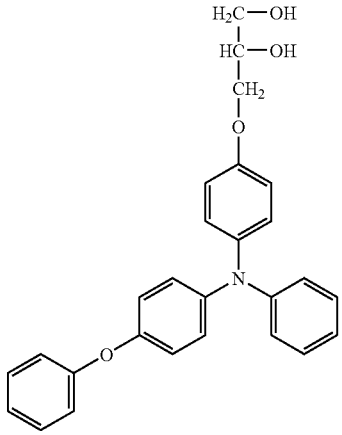 |

TABLE 9-continued

| No. | R | n | Ar1 | Ar2 | Ar3 | Position of Y | Chemical formula |
|---|---|---|---|---|---|---|---|
| 2-5-1-12(No.66) | R = —CH2O— | 1 | | | | Ar1 | |

TABLE 10

| No. | R | n | Ar1 | Ar2 | Ar3 | Position of Y |
|---|---|---|---|---|---|---|
| 2-5-1-13(No.67) | R = —CH2O— | 1 | | | | Ar1 |
| 2-5-1-14(No.68) | R = —CH2O— | 1 | | | | Ar1 |
| 2-5-1-15(No.69) | R = —CH2O— | 1 | | | | Ar1 |

TABLE 10-continued
| | | | | |
|---|---|---|---|---|
| 2-5-1-16(No.70) | R = —CH2O— | 1 | 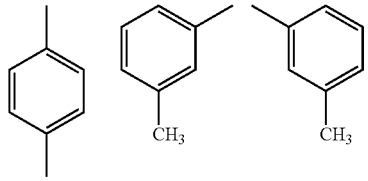 | Ar1 |
| 2-5-1-17(No.71) | R = —CH2O— | 1 | 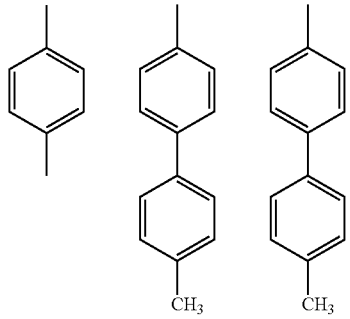 | Ar1 |
| No. | Chemical formula |
|---|---|
| 2-5-1-13(No.67) | 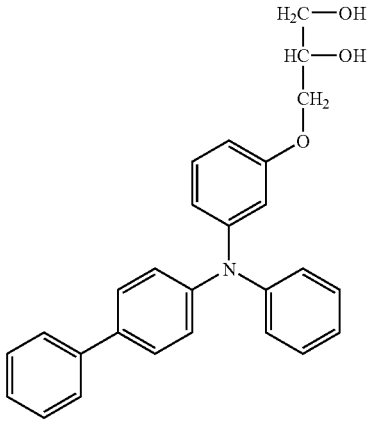 |
| 2-5-1-14(No.68) | 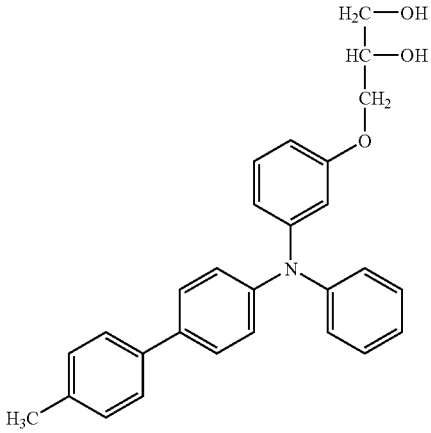 |

TABLE 10-continued
2-5-1-15(No.69)
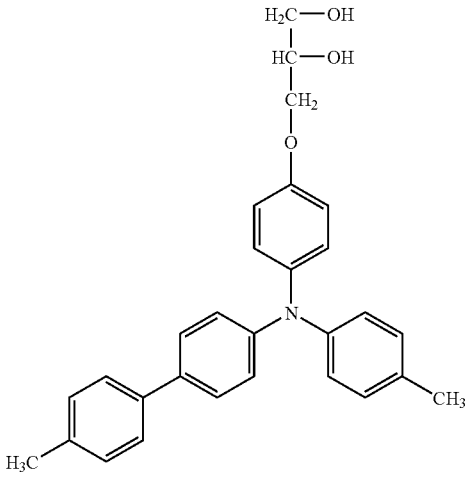
2-5-1-16(No.70)
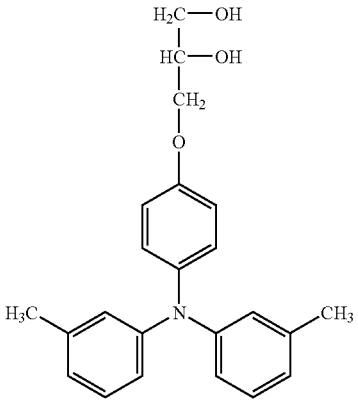
2-5-1-17(No.71)
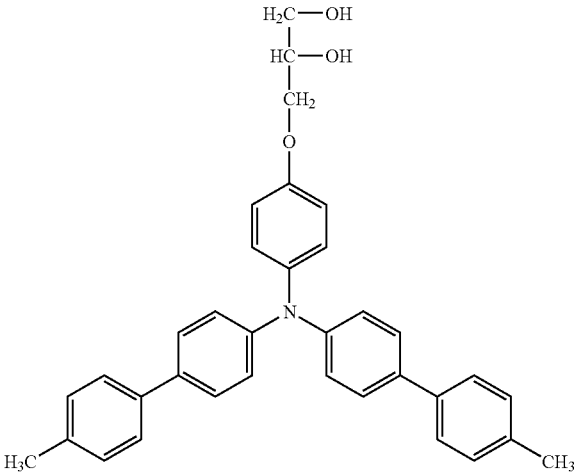

TABLE 11

| No. | R | n | Ar1 | Ar2 | Ar3 |
|---|---|---|---|---|---|
| 2-5-1-18(No.72) | R = —CH2O— | 1 | | | |
| 2-5-1-19(No.73) | R = —CH2O— | 1 | | $CH_3$ | $CH_3$ |
| 2-5-1-20(No.74) | R = —CH2O— | 1 | | $H_3C$ $CH_3$ | $CH_3$ $CH_3$ |
| 2-5-1-21(No.75) | R = —CH2O— | 1 | | $H_3C$ $CH_3$ | $CH_3$ $CH_3$ |
| 2-5-1-22(No.76) | R = —CH2O— | 1 | $CH_3$ | $CH_3$ | $CH_3$ |
| 2-5-1-23(No.77) | R = —CH2O— | 1 | | | |

TABLE 11-continued
| No. | Position of Y | Chemical formula |
|---|---|---|
| 2-5-1-18(No.72) | Ar1 | 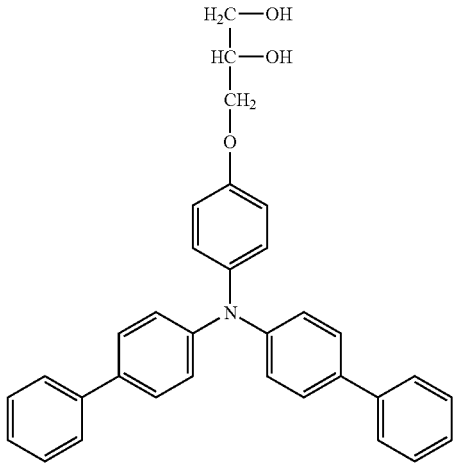 |
| 2-5-1-19(No.73) | Ar1 | 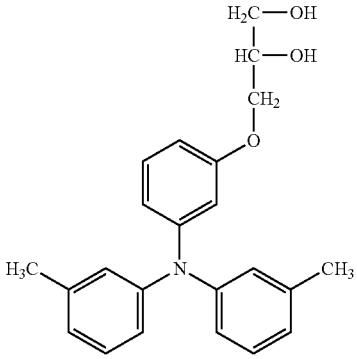 |
| 2-5-1-20(No.74) | Ar1 | 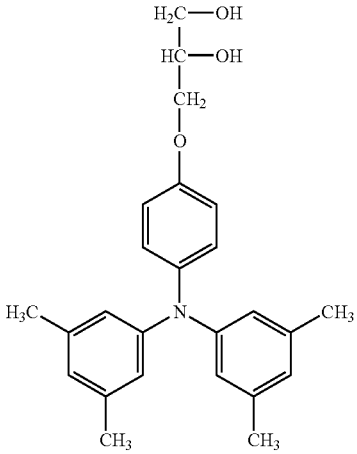 |

TABLE 11-continued
| | | |
|---|---|---|
| 2-5-1-21(No.75) | Ar1 | 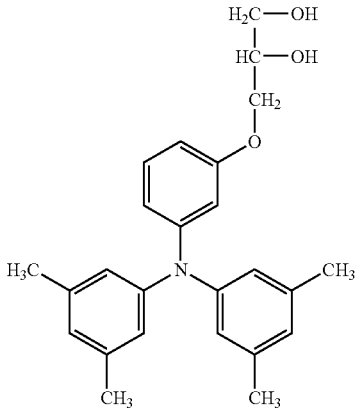 |
| 2-5-1-22(No.76) | Ar1 | 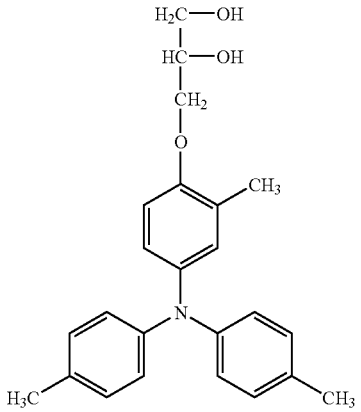 |
| 2-5-1-23(No.77) | Ar1 | 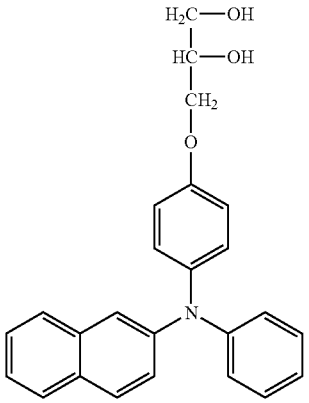 |

TABLE 12
| No. | R | n | Ar1 | Ar2 | Ar3 | Position of Y | Chemical formula |
|---|---|---|---|---|---|---|---|
| 2-5-1-24(No.78) | R = —CH2O— | 1 | 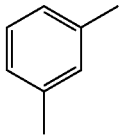 | 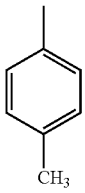 | 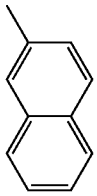 | Ar1 | 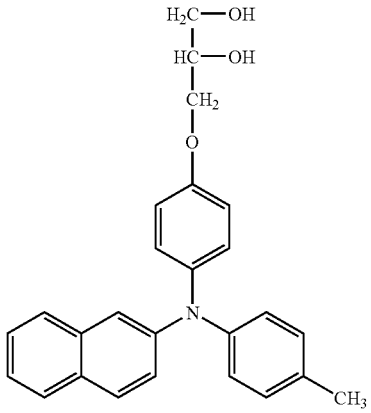 |
| 2-5-1-25(No.79) | R = —CH2O— | 1 | 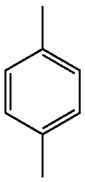 | 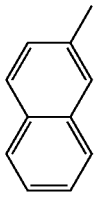 | 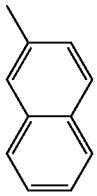 | Ar1 | 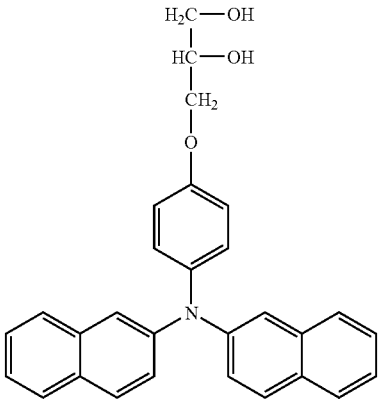 |
| 2-5-1-26(No.80) | R = —CH2O— | 1 | 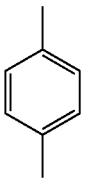 | 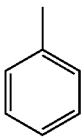 | 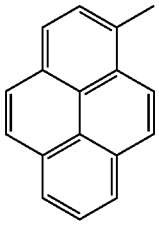 | Ar1 | 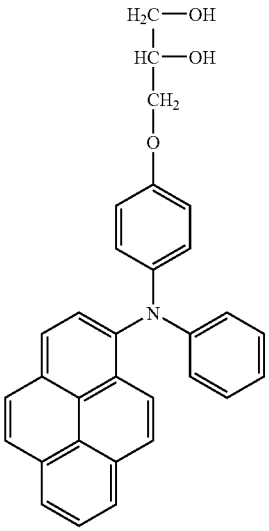 |

TABLE 12-continued
| No. | R | n | Ar1 | Ar2 | Ar3 | Position of Y | Chemical formula |
|---|---|---|---|---|---|---|---|
| 2-5-1-27(No.81) | R = —CH2O— | 1 | 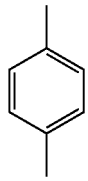 | 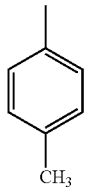 | 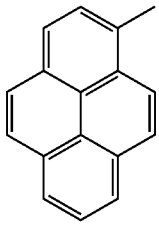 | Ar1 | 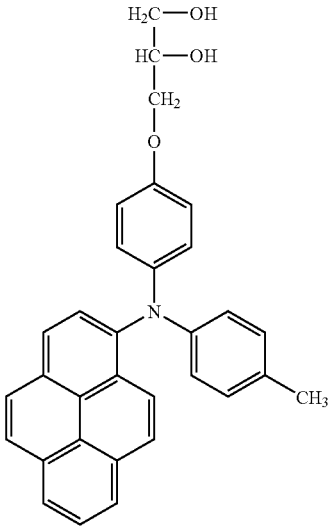 |
| 2-5-1-28(No.86) | R = —CH2O— | 1 | 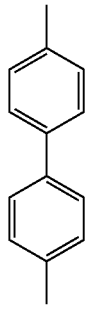 | 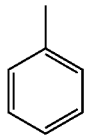 | 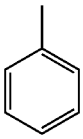 | Ar1 | 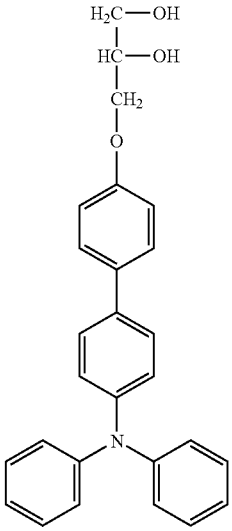 |
| 2-5-1-29(No.87) | R = —CH2O— | 1 | 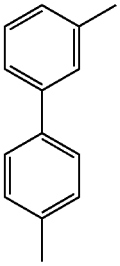 | 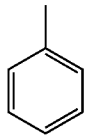 | 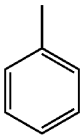 | Ar1 | 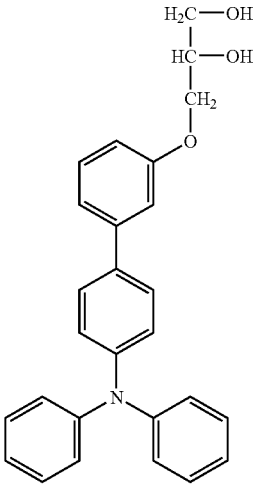 |

TABLE 13
| No. | R | n | Ar1 | Ar2 | Ar3 | Position of Y | Chemical formula |
|---|---|---|---|---|---|---|---|
| 2-5-1-30(No.88) | R = —CH2O— | 1 | 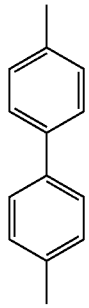 | 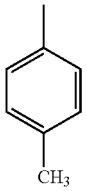 | 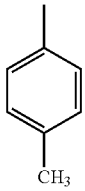 | Ar1 | 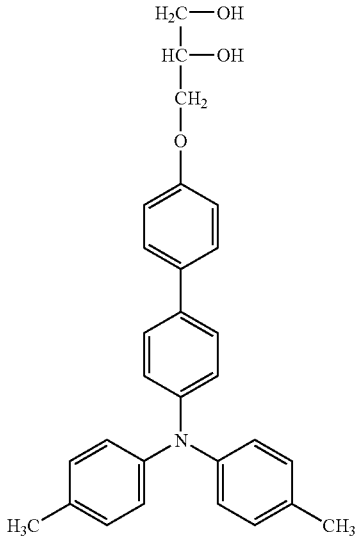 |
| 2-5-1-31(No.89) | R = —CH2O— | 1 | 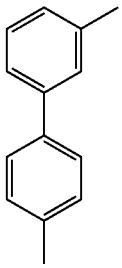 | 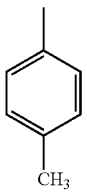 | 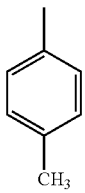 | Ar1 | 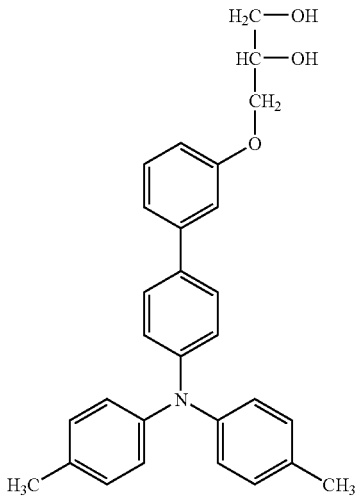 |

TABLE 13-continued
| No. | R | n | Ar1 | Ar2 | Ar3 | Position of Y | Chemical formula |
|---|---|---|---|---|---|---|---|
| 2-5-1-32(No.90) | R = —CH2O— | 1 | 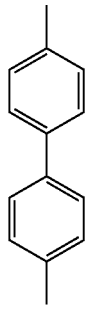 | 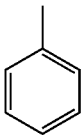 | 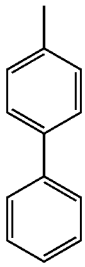 | Ar1 | 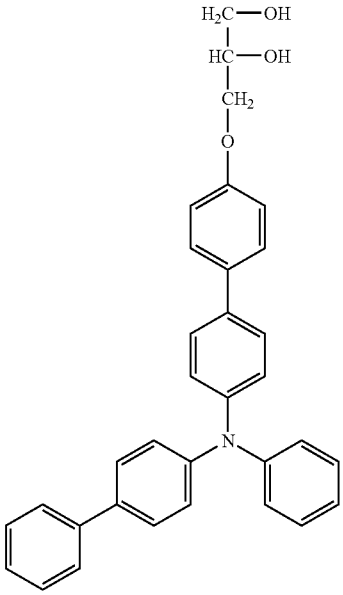 |
| 2-5-1-33(No.91) | R = —CH2O— | 1 | 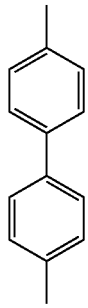 | 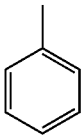 | 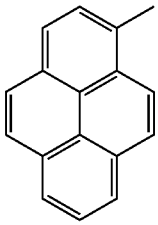 | Ar1 | 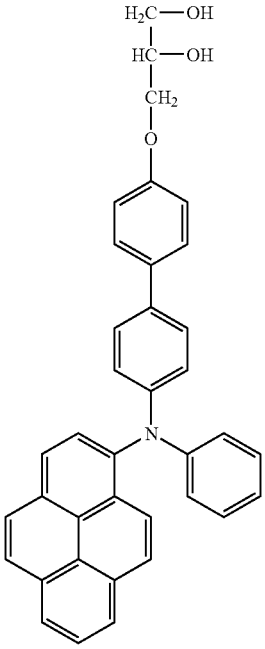 |

TABLE 13-continued
| No. | R | n | Ar1 | Ar2 | Ar3 | Position of Y | Chemical formula |
|---|---|---|---|---|---|---|---|
| 2-5-1-34(No.92) | R = —CH2O— | 1 | 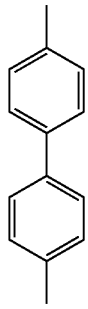 | 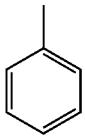 | 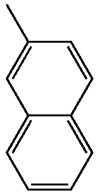 | Ar1 | 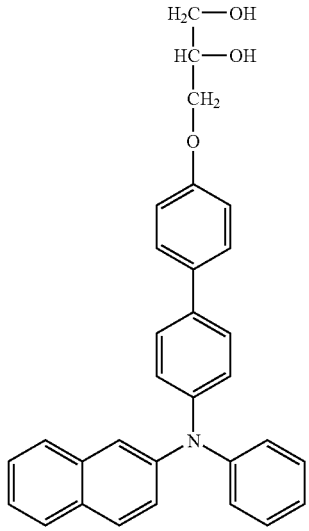 |
| 2-5-1-35(No.93) | R = —CH2O— | 1 | 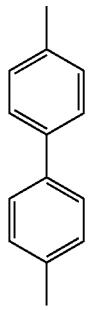 | 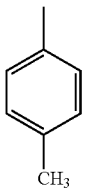 | 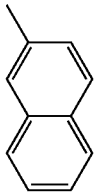 | Ar1 | 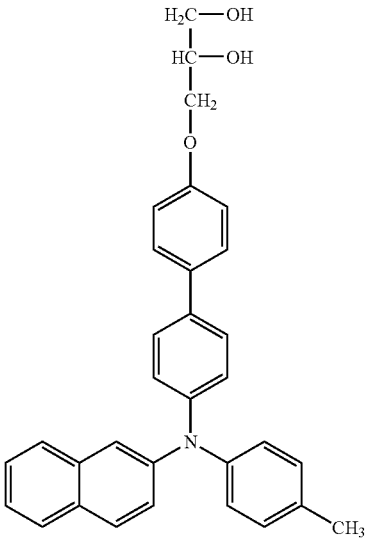 |

TABLE 14
| No. | R | n | Ar1 | Ar2 | Ar3 | Position of Y | Chemical formula |
|---|---|---|---|---|---|---|---|
| 2-5-1-36(No.94) | R = —CH2O— | 1 | 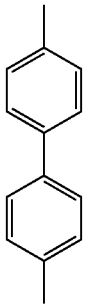 | 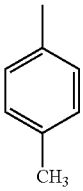 | 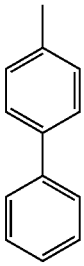 | Ar1 | 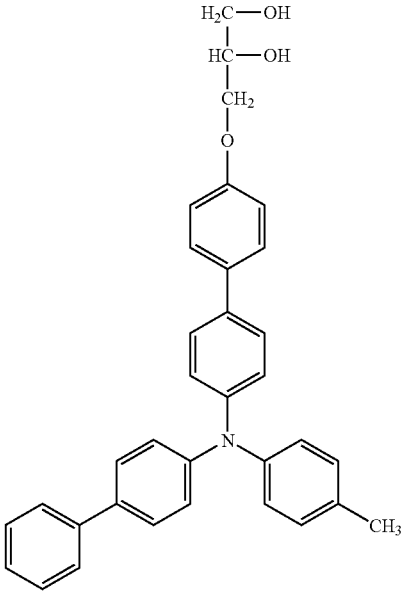 |
| 2-5-1-37(No.95) | R = —CH2O— | 1 | 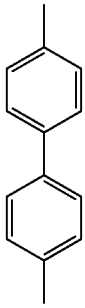 | 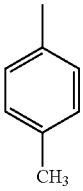 | 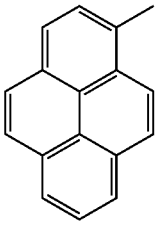 | Ar1 | 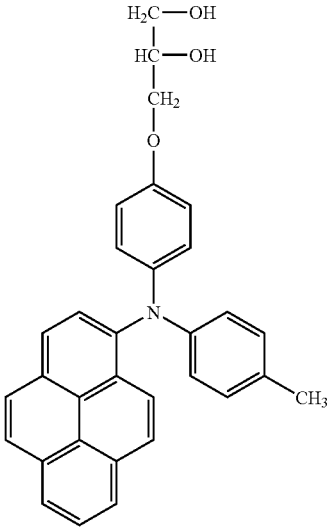 |

TABLE 14-continued

| No. | R | n | Ar1 | Ar2 | Ar3 | Position of Y | Chemical formula |
|---|---|---|---|---|---|---|---|
| 2-5-1-38(No.96) | R = —CH2O— | 1 | | | | Ar1 | |
| 2-5-1-39(No.97) | R = —CH2O— | 1 | | | | Ar1 | |

TABLE 14-continued
| No. | R | n | Ar1 | Ar2 | Ar3 | Position of Y | Chemical formula |
|---|---|---|---|---|---|---|---|
| 2-5-1-40(No.98) | R = —CH2O— | 1 | 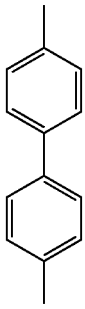 | 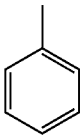 | 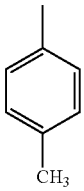 | Ar1 | 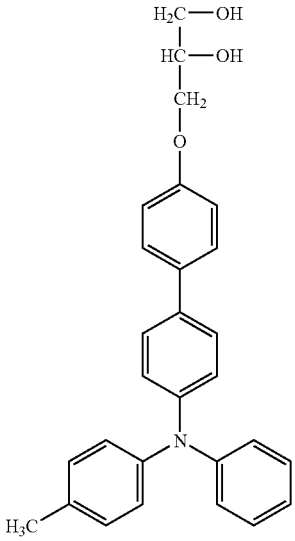 |
| 2-5-1-41(No.99) | R = —CH2O— | 1 | 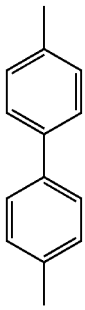 | 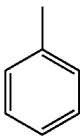 | 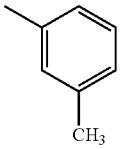 | Ar1 | 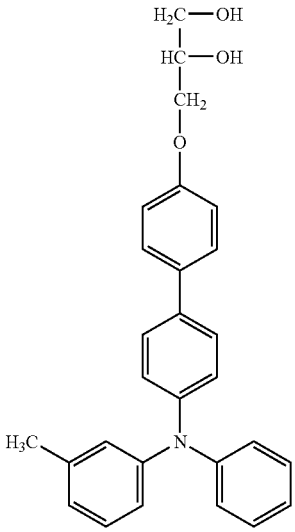 |

TABLE 15
| No. | R | n | Ar1 | Ar2 | Ar3 | Position of Y | Chemical formula |
|---|---|---|---|---|---|---|---|
| 2-5-1-42(No.100) | R = —CH2O— | 1 | 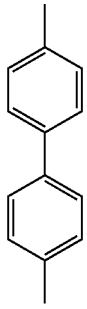 | 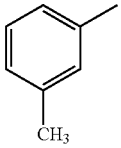 | 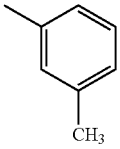 | Ar1 | 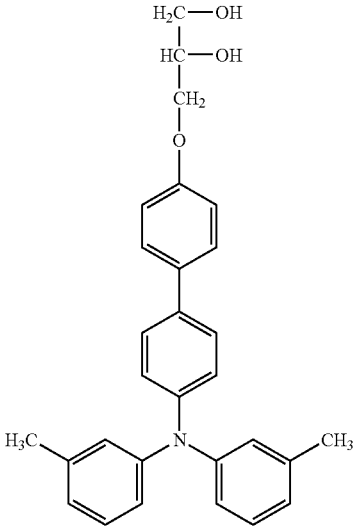 |
| 2-5-1-43(No.101) | R = —CH2OCH2— | 1 | 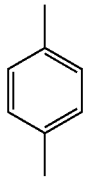 | 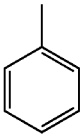 | 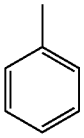 | Ar1 | 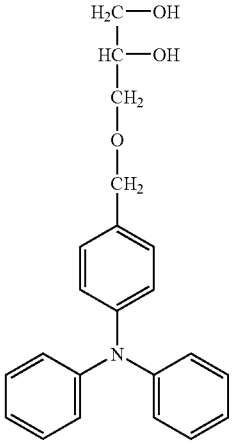 |
| 2-5-1-44(No.102) | R = —CH2OCH2— | 1 | 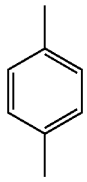 | 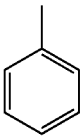 | 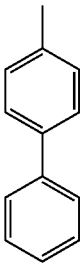 | Ar1 | 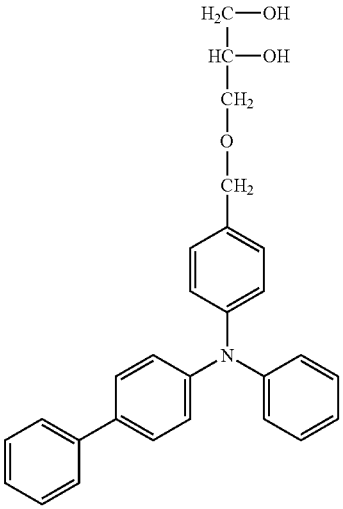 |

TABLE 15-continued
| No. | R | n | Ar1 | Ar2 | Ar3 | Position of Y | Chemical formula |
|---|---|---|---|---|---|---|---|
| 2-5-1-45(No.103) | R = —CH2OCH2— | 1 | 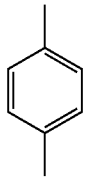 | 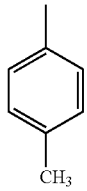 | 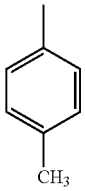 | Ar1 | 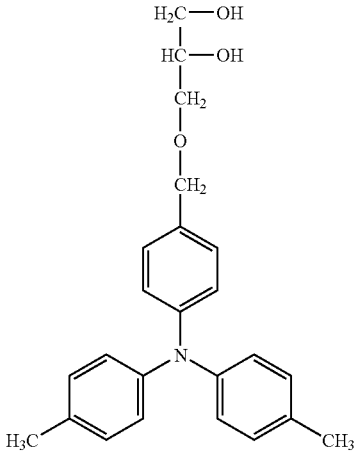 |
| 2-5-1-46(No.104) | R = —CH2O(CH2)2— | 1 | 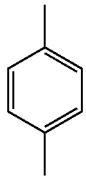 | 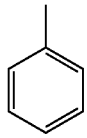 | 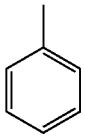 | Ar1 | 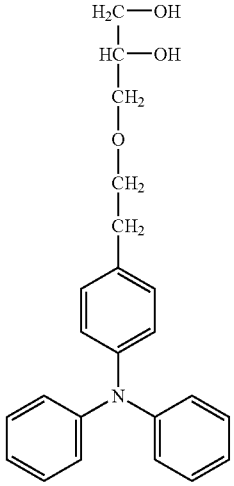 |
| 2-5-1-47(No.105) | R = —CH2O(CH2)2— | 1 | 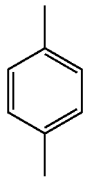 | 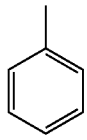 | 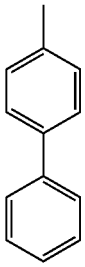 | Ar1 | 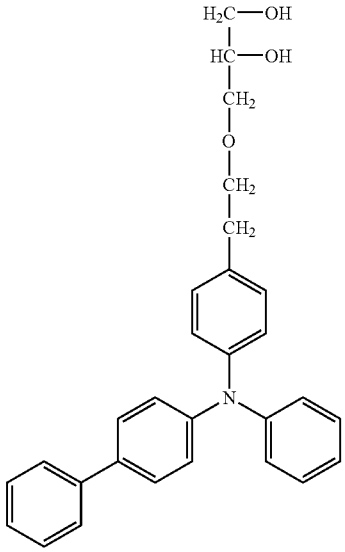 |

TABLE 16
| No. | R | n | Ar1 | Ar2 | Ar3 | Position of Y |
|---|---|---|---|---|---|---|
| 2-5-1-48(No.106) | R = —CH2O(CH2)2— | 1 | 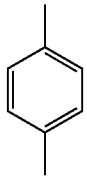 | 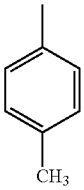 | 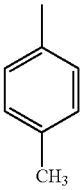 | Ar1 |
| 2-5-1-49(No.107) | R = —CH2O— | 1 | 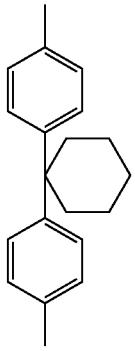 | 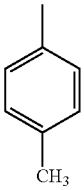 | 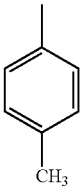 | Ar1 |
| 2-5-1-50(No.108) | R = —CH2O— | 1 | 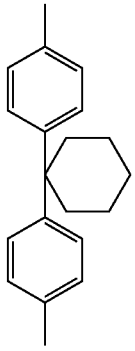 | 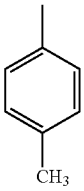 | 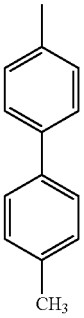 | Ar1 |
| 2-5-1-51(No.109) | R = —CH2O— | 1 | 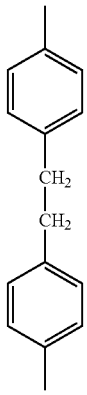 | 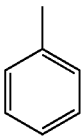 | 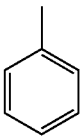 | Ar1 |

TABLE 16-continued
| | | | | |
|---|---|---|---|---|
| 2-5-1-52(110) | R = —CH2O— | 1 | 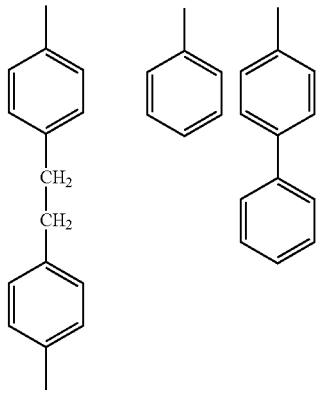 | Ar1 |
| No. | Chemical formula |
|---|---|
| 2-5-1-48(No.106) | 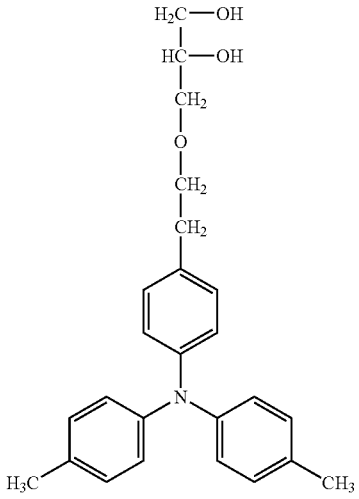 |
| 2-5-1-49(No.107) | 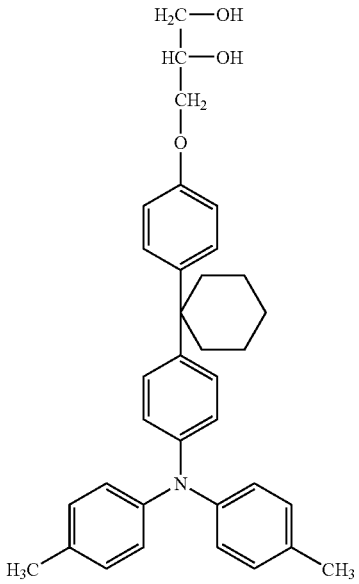 |

TABLE 16-continued
2-5-1-50(No.108)
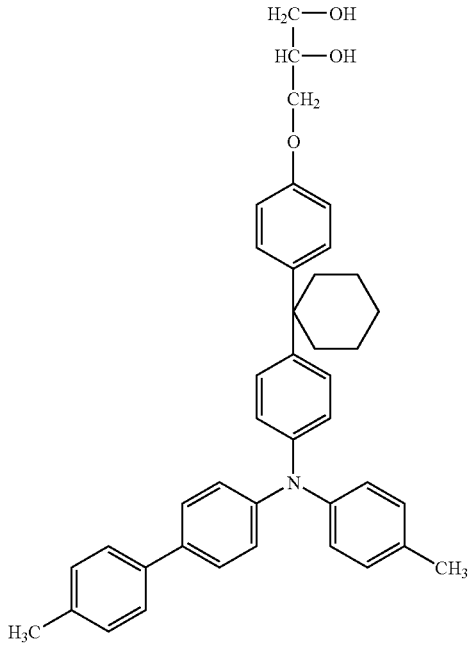
2-5-1-51(No.109)
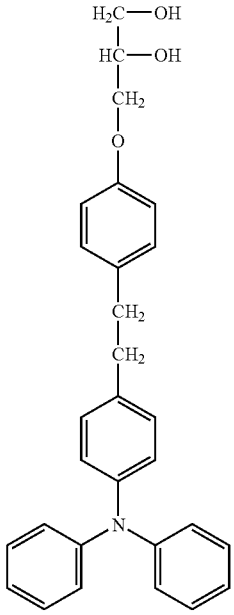

TABLE 16-continued
| | |
|---|---|
| 2-5-1-52(110) | 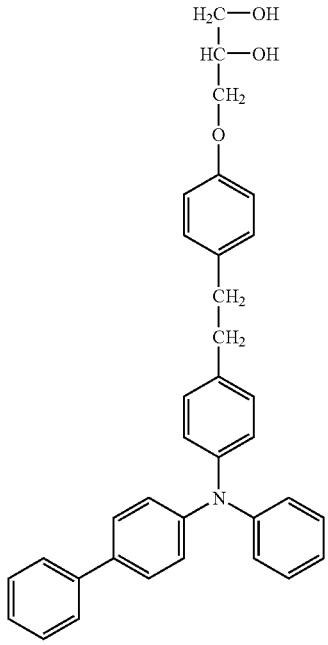 |
TABLE 17
| No. | R | n | Ar1 | Ar2 | Ar3 | Position of Y | Chemical formula |
|---|---|---|---|---|---|---|---|
| 2-5-1-53(No.111) | R = —CH2O— | 1 | 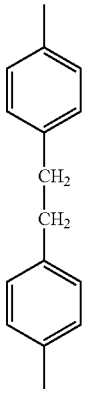 | 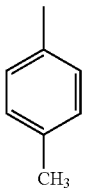 | 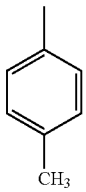 | Ar1 | 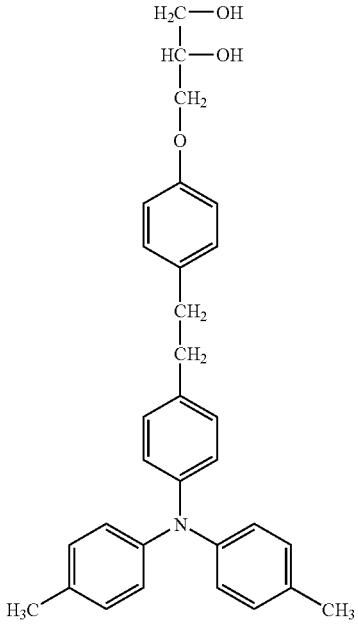 |

TABLE 17-continued
| No. | R | n | Ar1 | Ar2 | Ar3 | Position of Y | Chemical formula |
|---|---|---|---|---|---|---|---|
| 2-5-1-54(No.112) | R = —CH2O— | 1 | 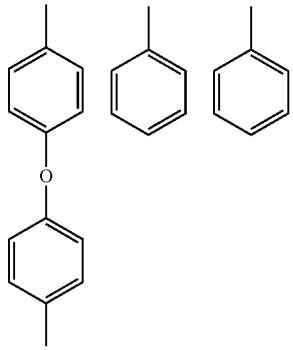 | | | Ar1 | 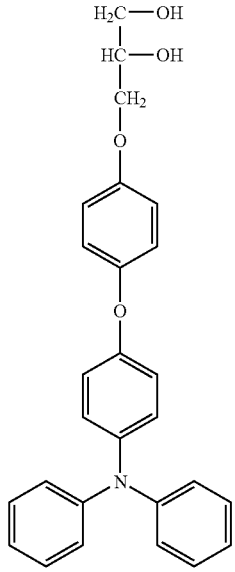 |
| 2-5-1-55(No.113) | R = —CH2O— | 1 | 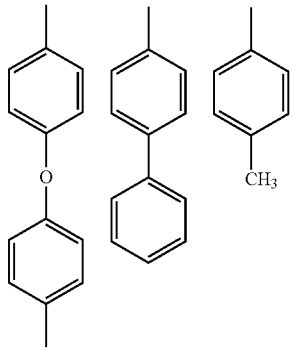 | | | Ar1 | 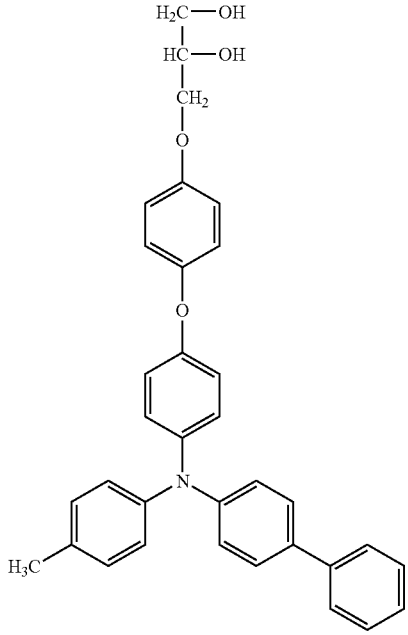 |

TABLE 17-continued
| No. | R | n | Ar1 | Ar2 | Ar3 | Position of Y | Chemical formula |
|---|---|---|---|---|---|---|---|
| 2-5-1-56(No.114) | R = —CH2O— | 1 | 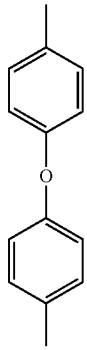 | 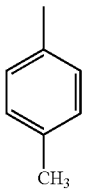 | 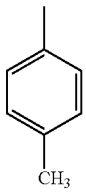 | Ar1 | 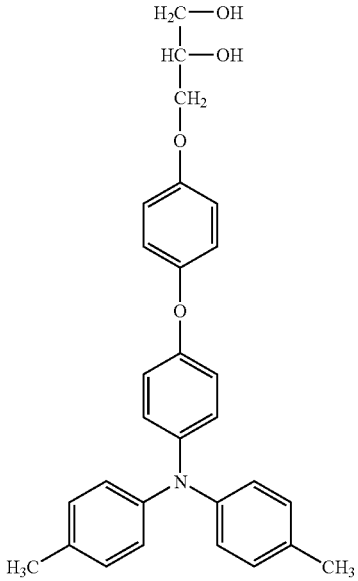 |
| 2-5-1-57(No.121) | R = —CH2O— | 1 | 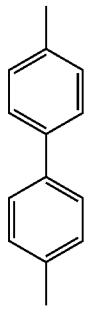 | 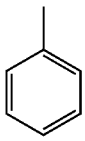 | 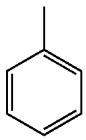 | Ar1 | 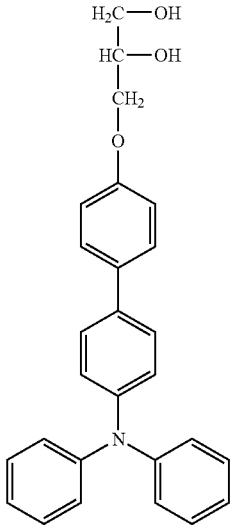 |

TABLE 17-continued

| No. | R | n | Ar1 | Ar2 | Ar3 | Position of Y | Chemical formula |
|---|---|---|---|---|---|---|---|
| 2-5-1-58(No.122) | R = —CH2O— | 1 | | | | Ar1 | |

TABLE 18

| No. | R | n | Ar1 | Ar2 | Ar3 |
|---|---|---|---|---|---|
| 2-5-1-59(No.123) | R = —CH2O— | 1 | | | |
| 2-5-1-60(No.124) | R = —CH2O— | 1 | | | |

TABLE 18-continued
| | | |
|---|---|---|
| 2-5-1-61(No.125) R = —CH2O— | 1 | 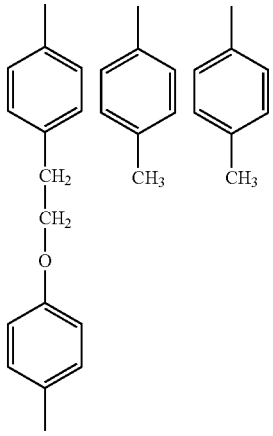 |
| 2-5-1-62(No.126) R = —CH2OCH(CH3)CH2O— | 1 | 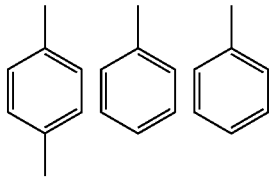 |
| 2-5-1-63(No.127) R = —CH2OCH(CH3)CH2O— | 1 | 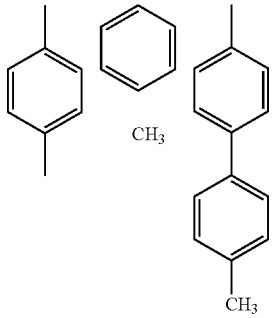 |
| 2-5-1-64(No.128) R = —CH2OCH(CH3)CH2O— | 1 | 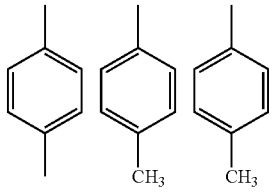 |

TABLE 18-continued
| No. | Position of Y | Chemical formula |
|---|---|---|
| 2-5-1-59(No.123) | Ar1 | 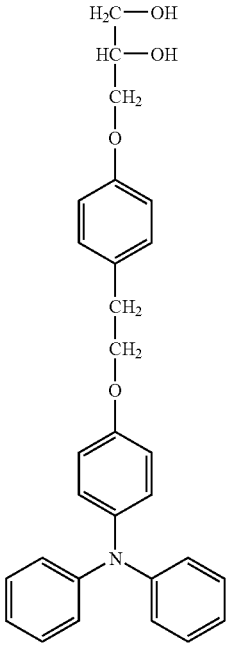 |
| 2-5-1-60(No.124) | Ar1 | 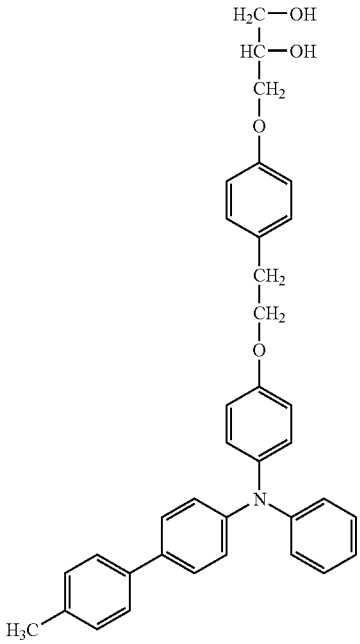 |

TABLE 18-continued
| | | |
|---|---|---|
| 2-5-1-61(No.125) | Ar1 | 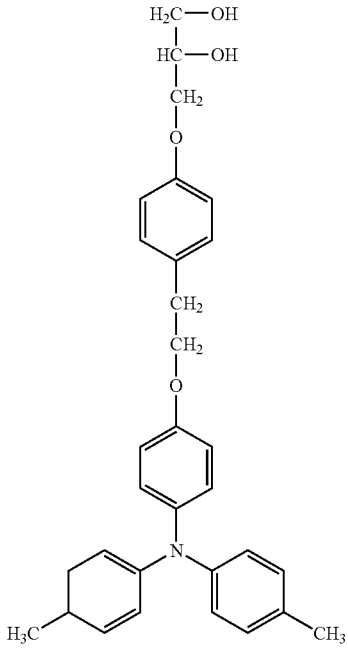 |
| | | |
|---|---|---|
| 2-5-1-62(No.126) | Ar1 | 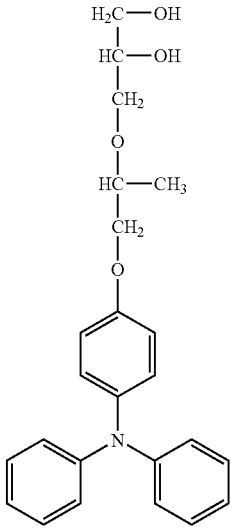 |

TABLE 18-continued
| | | |
|---|---|---|
| 2-5-1-63(No.127) | Ar1 | 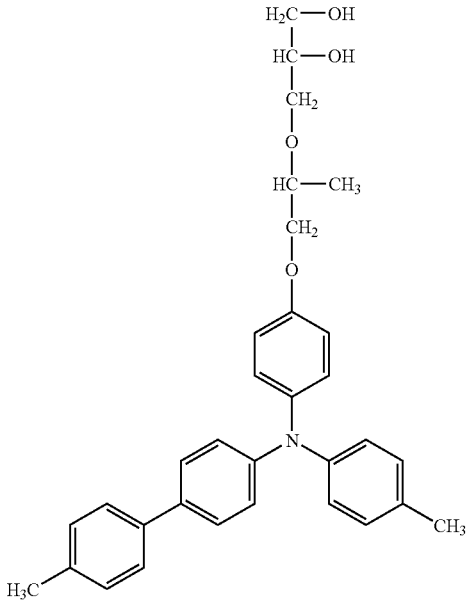 |
| 2-5-1-64(No.128) | Ar1 | 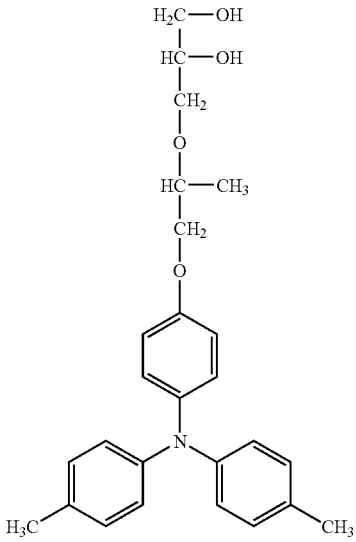 |
TABLE 19
| No. | R | n | Ar1 | Ar2 | Ar3 | Position of Y |
|---|---|---|---|---|---|---|
| 2-5-1-65(No.129) | R = —CH2O(CH2)5COO— | 1 | 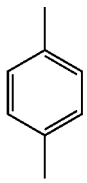 | 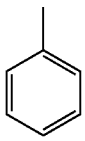 | 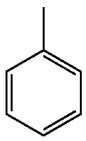 | Ar1 |

TABLE 19-continued
| | | | |
|---|---|---|---|
| 2-5-1-66(No.130) R = —CH2O(CH2)5COO— | 1 | 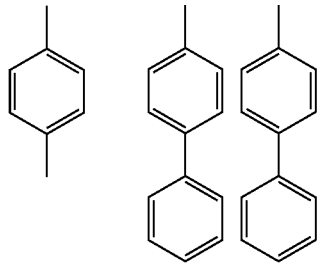 | Ar1 |
| 2-5-1-67(No.131) R = —CH2(O((CH2)5CO)2O— | 1 | 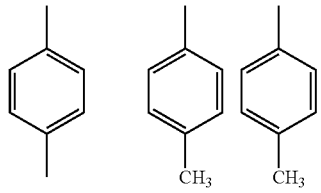 | Ar1 |
| 2-5-1-68(No.132) R = —CH2OCH(CH3)CH2O— | 1 | 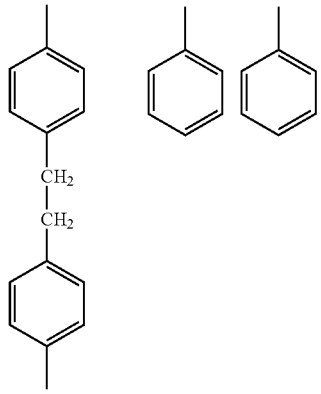 | Ar1 |
| 2-5-1-69(No.133) R = —CH2OH(CH3)CH2O— | 1 | 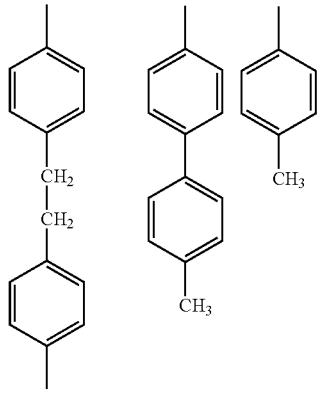 | Ar1 |

TABLE 19-continued
| | | | |
|---|---|---|---|
| 2-5-1-70(No.134) R = —CH2(OCH(CH3)CH2)3O | 1 | 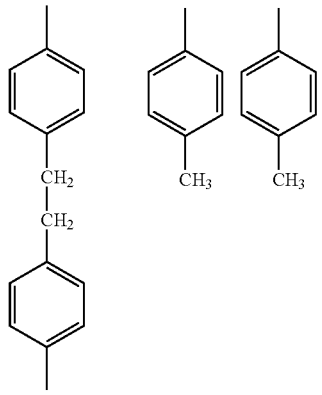 | Ar1 |
| 2-5-1-71(No.107) R = —CH2O— | 1 | 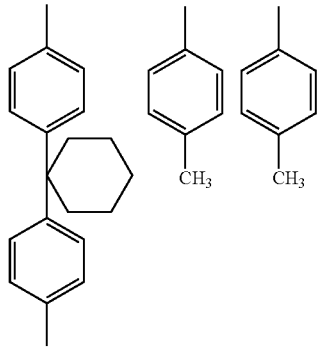 | Ar1 |
| 2-5-1-72(No.108) R = —CH2O— | 1 | 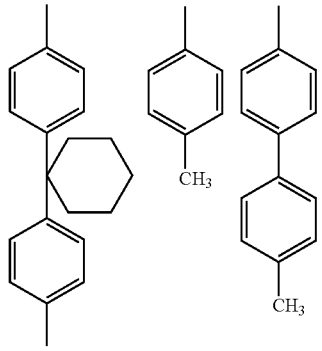 | Ar1 |
| No. | Chemical formula |
|---|---|
| 2-5-1-65(No.129) | 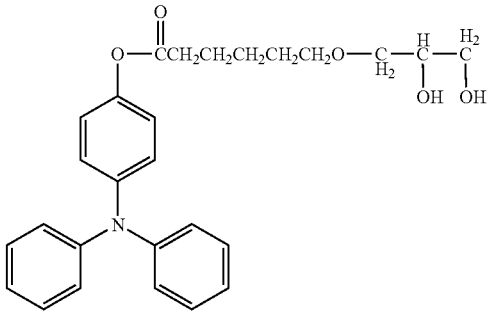 |

TABLE 19-continued
2-5-1-66(No.130)
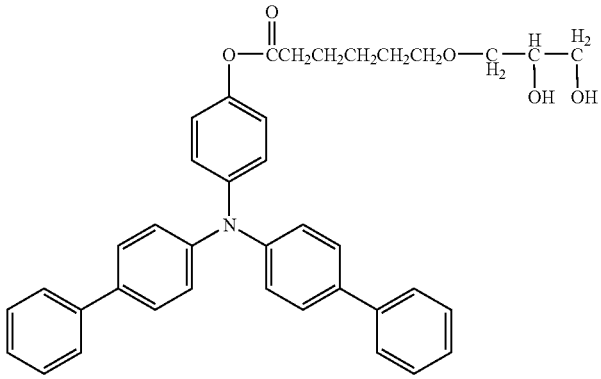
2-5-1-67(No.131)
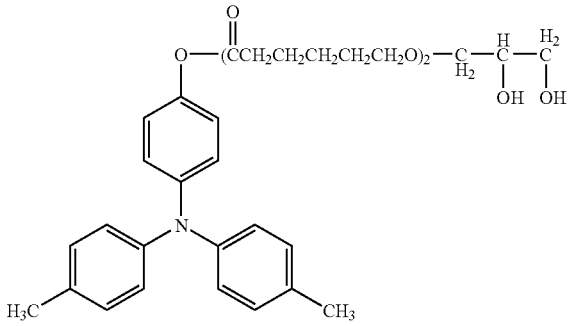
2-5-1-68(No.132)
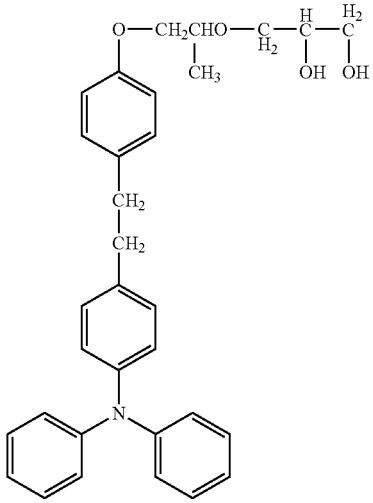

TABLE 19-continued
2-5-1-69(No.133)
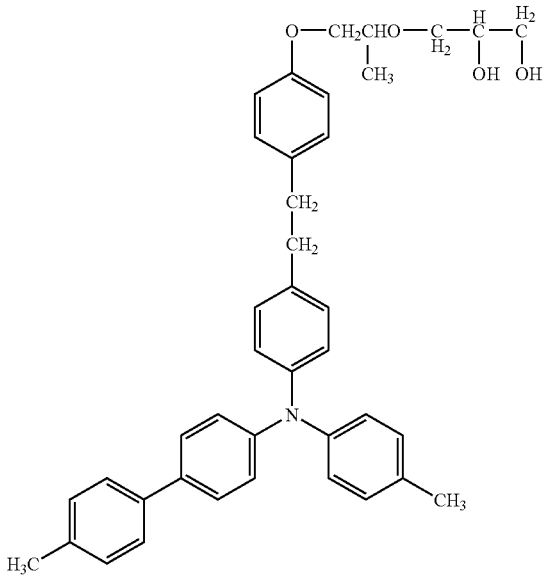
2-5-1-70(No.134)
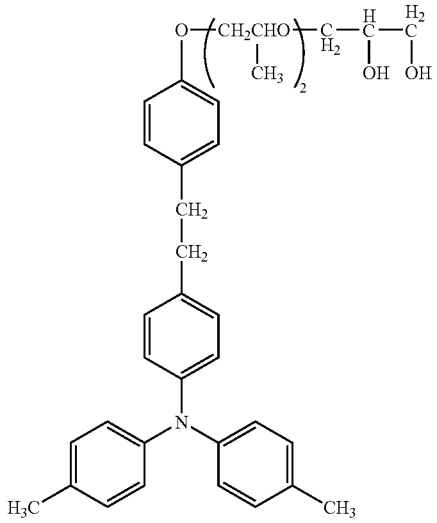

TABLE 19-continued
| | |
|---|---|
| 2-5-1-71(No.107) | 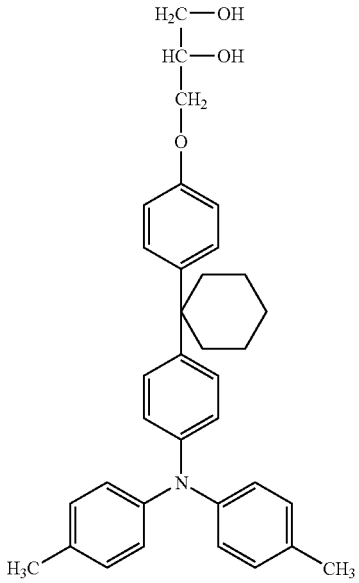 |
| 2-5-1-72(No.108) | 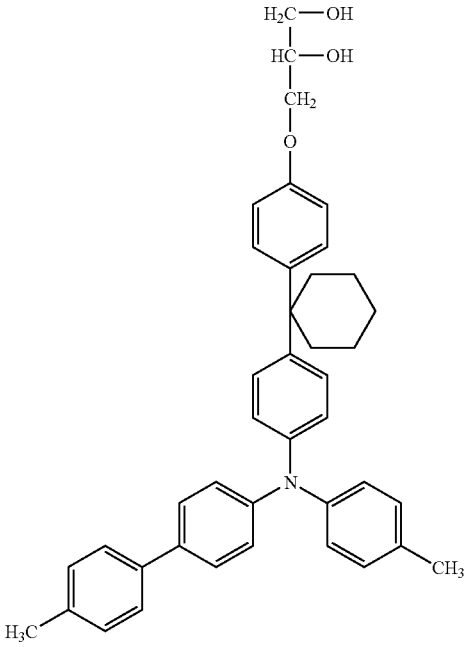 |
TABLE 20
| No. | R | n | Ar1 | Ar2 | Ar3 | Position of Y |
|---|---|---|---|---|---|---|
| 2-5-2-1(No.135) | R = —CH2O— | 2 | 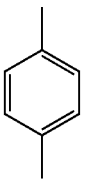 | 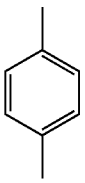 | 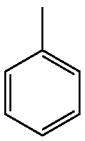 | Ar1, Ar2 |

TABLE 20-continued
| | | | | |
|---|---|---|---|---|
| 2-5-2-2(No.136) | R = —CH2O— | 2 | 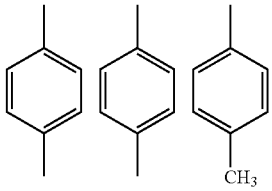 | Ar1, Ar2 |
| 2-5-2-3(No.137) | R = —CH2O— | 2 | 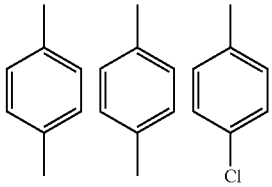 | Ar1, Ar2 |
| 2-5-2-4(No.138) | R = —CH2O— | 2 | 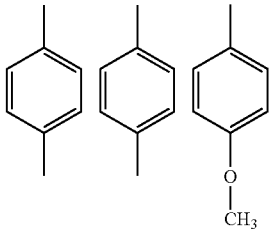 | Ar1, Ar2 |
| 2-5-2-5(No.139) | R = —CH2O— | 2 | 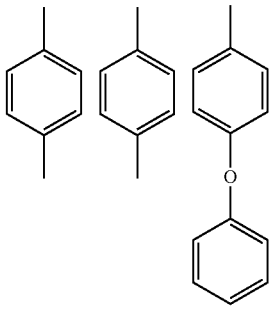 | Ar1, Ar2 |
| No. | Chemical formula |
|---|---|
| 2-5-2-1(No.135) | 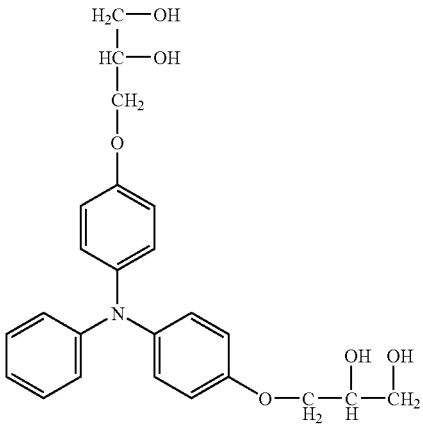 |

TABLE 20-continued
2-5-2-2(No.136)
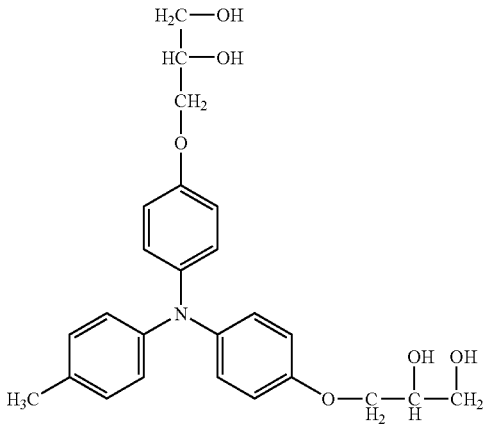
2-5-2-3(No.137)
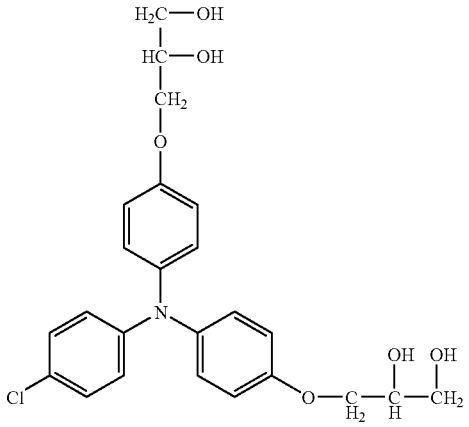
2-5-2-4(No.138)
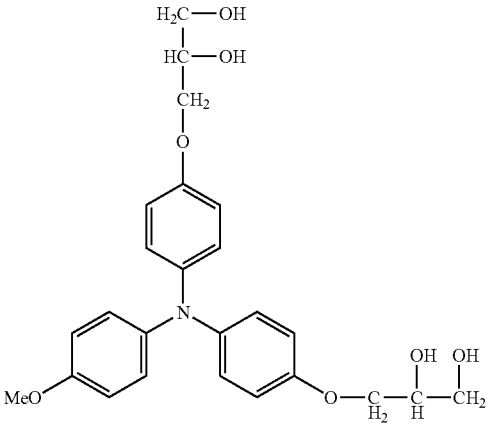

TABLE 20-continued
| | |
|---|---|
| 2-5-2-5(No.139) | 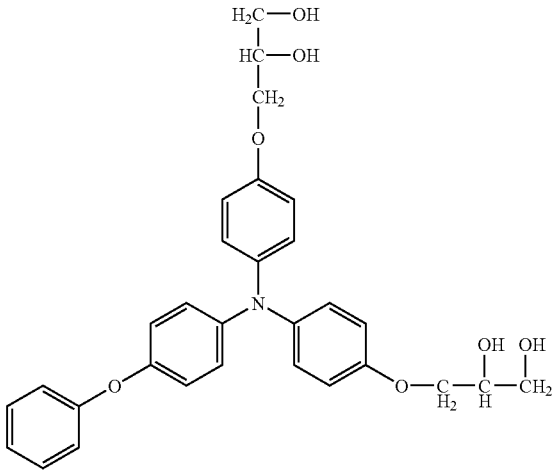 |
TABLE 21
| No. | R | n | Ar1 | Ar2 | Ar3 | Position of Y |
|---|---|---|---|---|---|---|
| 2-5-2-6(No.141) | R = —CH2O— | 2 | 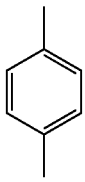 | 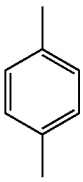 | 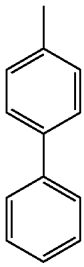 | Ar1, Ar2 |
| 2-5-2-7(No.142) | R = —CH2O— | 2 | 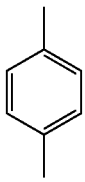 | 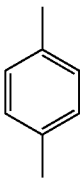 | 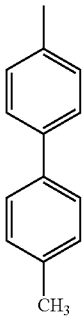 | Ar1, Ar2 |
| 2-5-2-8(No.143) | R = —CH2O— | 2 | 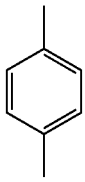 | 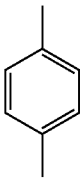 | 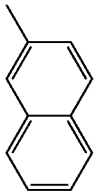 | Ar1, Ar2 |

TABLE 21-continued
| | | | | |
|---|---|---|---|---|
| 2-5-2-9(No.144) | R = —CH2O— | 2 | 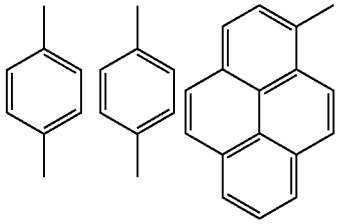 | Ar1, Ar2 |
| 2-5-2-10(No.149) | R = —CH2O— | 2 | 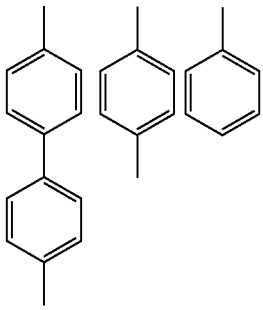 | Ar1, Ar2 |
| No. | Chemical formula |
|---|---|
| 2-5-2-6(No.141) | 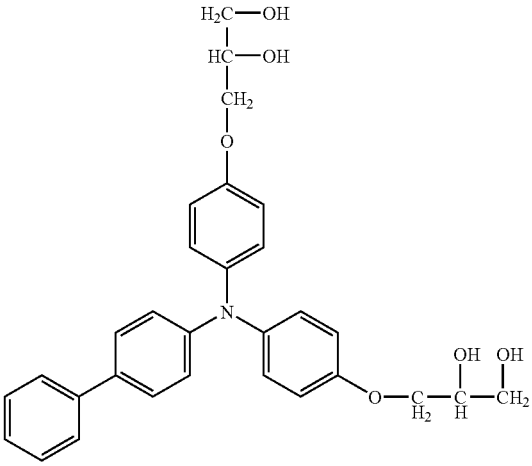 |
| 2-5-2-7(No.142) | 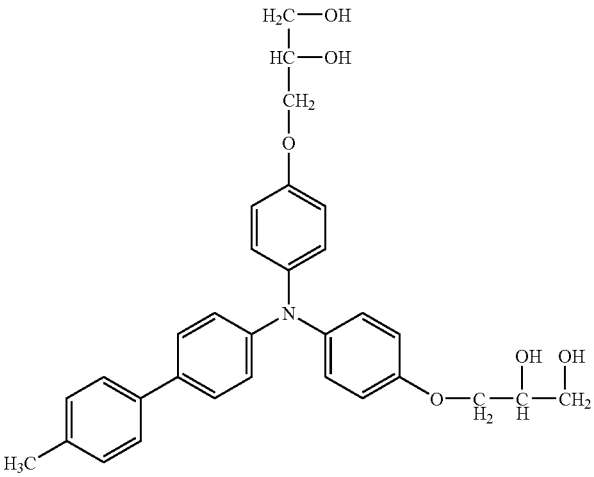 |

TABLE 21-continued
2-5-2-8(No.143)
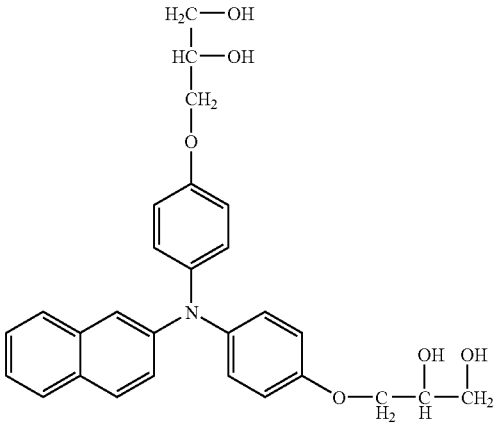
2-5-2-9(No.144)
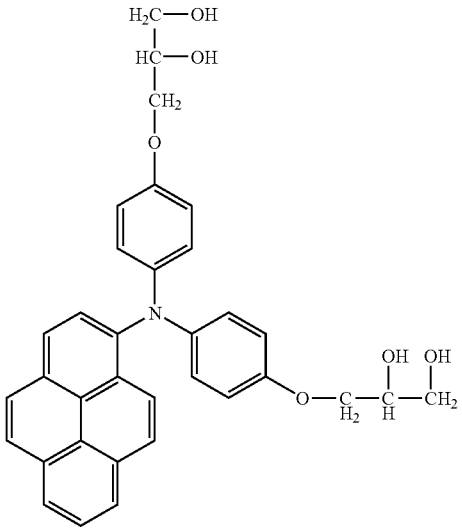
2-5-2-10(No.149)
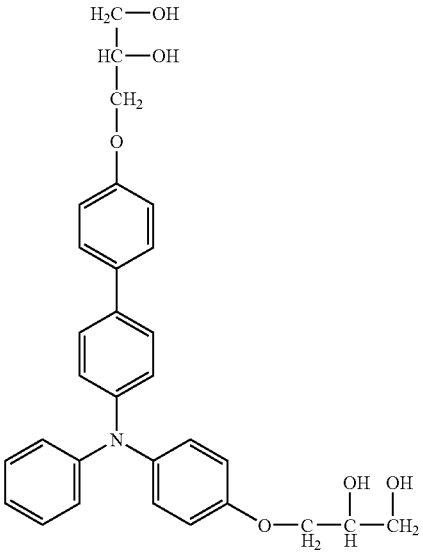

TABLE 22
| No. | R | n | Ar1 | Ar2 | Ar3 | Position of Y |
|---|---|---|---|---|---|---|
| 2-5-2-11(No.150) | R = —CH2O— | 2 | 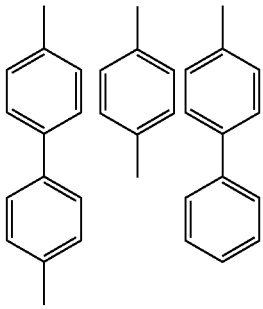 | | | Ar1, Ar2 |
| 2-5-2-12(No.151) | R = —CH2O— | 2 | 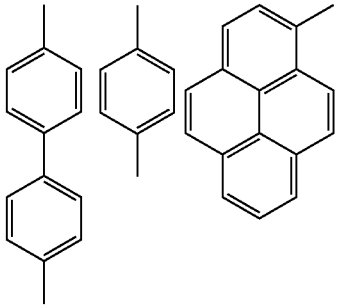 | | | Ar1, Ar2 |
| 2-5-2-13(No.152) | R = —CH2O— | 2 | 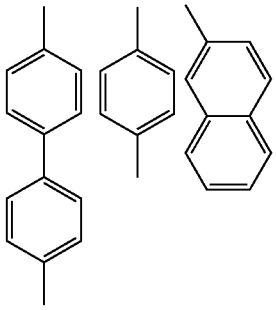 | | | Ar1, Ar2 |
| 2-5-2-14(No.153) | R = —CH2O— | 2 | 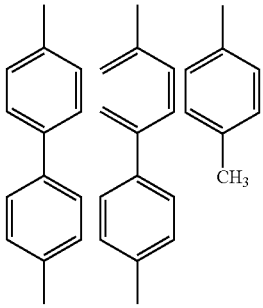 | | $CH_3$ | Ar1, Ar2 |
| 2-5-2-15(No.154) | R = —CH2O— | 2 | 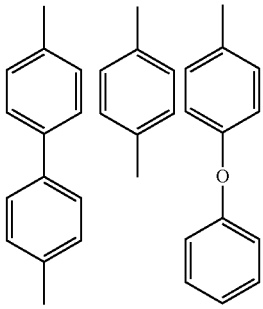 | | O | Ar1, Ar2 |

TABLE 22-continued
| No. | Chemical formula |
|---|---|
| 2-5-2-11(No.150) | 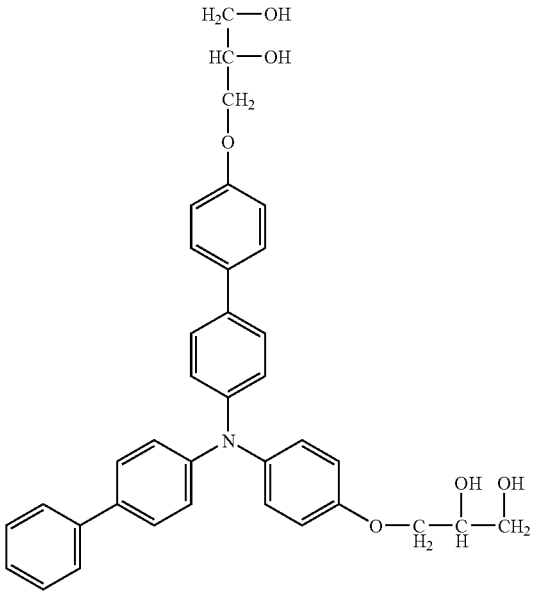 |
| 2-5-2-12(No.151) | 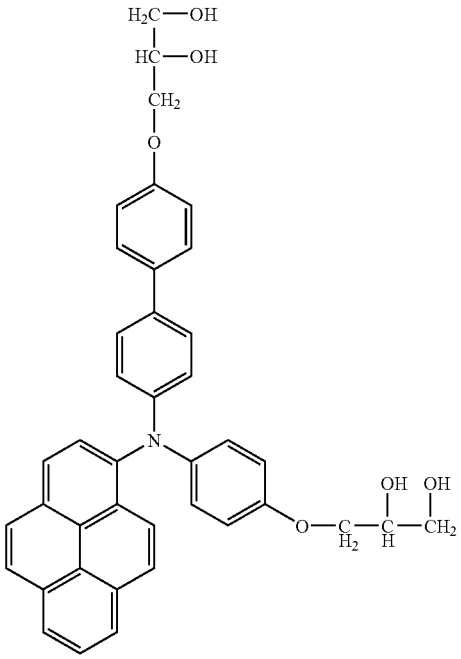 |

TABLE 22-continued
2-5-2-13(No.152)
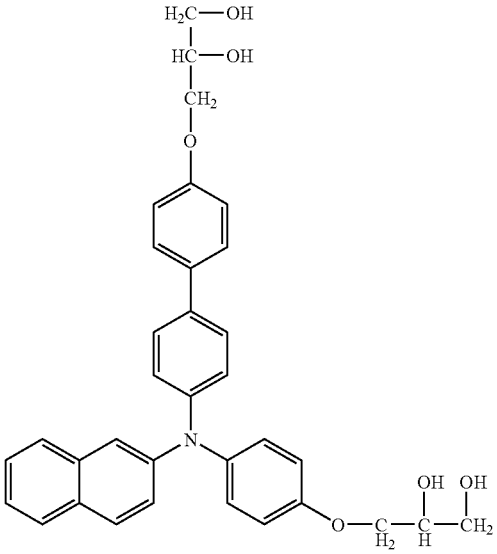
2-5-2-14(No.153)
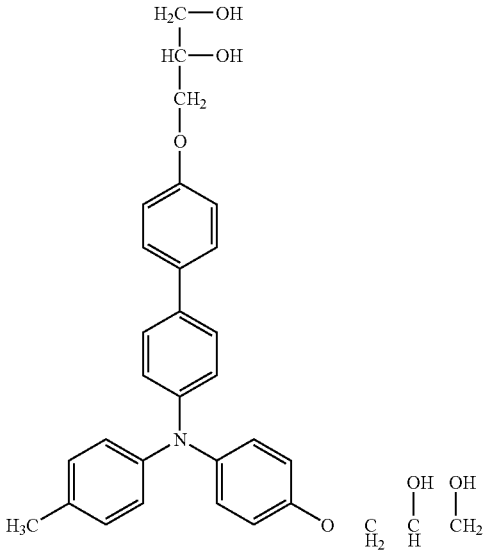

TABLE 22-continued
| | |
|---|---|
| 2-5-2-15(No.154) | 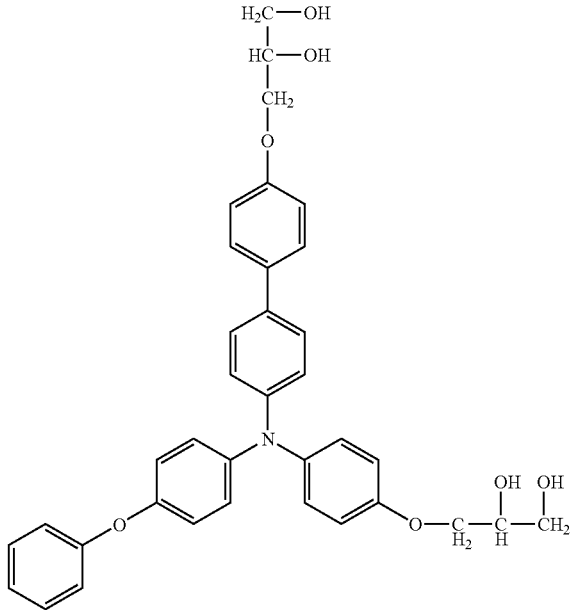 |
Tables 23 to 30 below list examples of compounds having the structure of General Formula (2) in which substituent X has the moiety represented by General Formula (4) and substituent Y has the moiety represented by General Formula (7).
TABLE 23
| No. | Y | R or Z | n | Ar1 | Ar2 | Ar3 | 1 = Ar | Ar |
|---|---|---|---|---|---|---|---|---|
| 3-6-1-1(No.21) | Y = —OH | Z = —(single bond) | 3 | 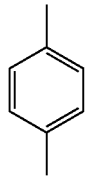 | 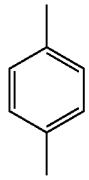 | 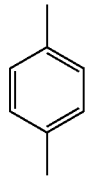 | H | 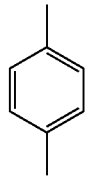 |
| 3-6-1-2(No.22) | Y = —OH | Z = — | 2 | 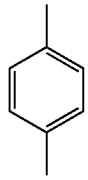 | 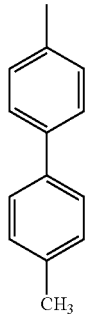 | 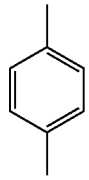 | H | 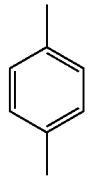 |
| 3-6-1-3(No.23) | Y = —OH | Z = — | 3 | 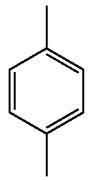 | 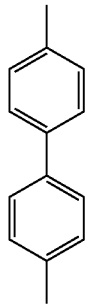 | 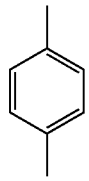 | H | 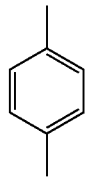 |

TABLE 23-continued

| | | | | | | |
|---|---|---|---|---|---|---|
| 3-6-1-4(No.46) | Y = —CH2OH | Z = —CH2— | 3 | | H | |
| 3-6-1-5(No.47) | Y = —CH2OH | Z = —CH2— | 2 | $CH_3$ | H | |

| No. | Position of Y | Chemical formula |
|---|---|---|
| 3-6-1-1(No.21) | Ar1~Ar3 | |
| 3-6-1-2(No.22) | Ar1, Ar3 | |

TABLE 23-continued
3-6-1-3(No.23) Ar1~Ar3
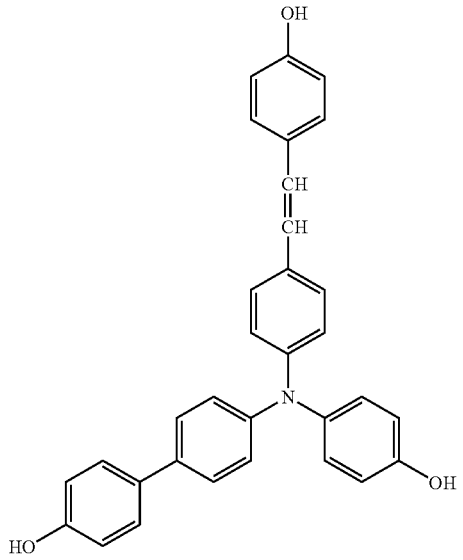
3-6-1-4(No.46) Ar1~Ar3
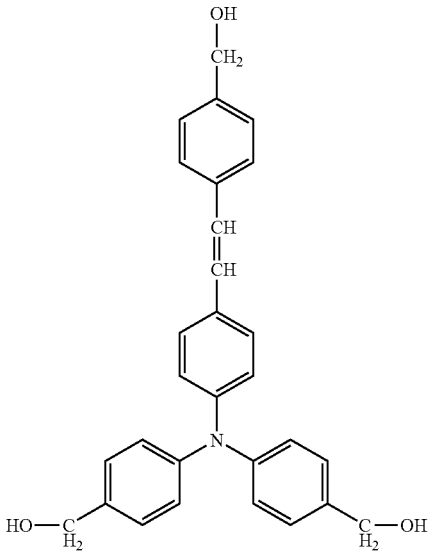

TABLE 23-continued
| | | |
|---|---|---|
| 3-6-1-5(No.47) | Ar1, Ar3 | 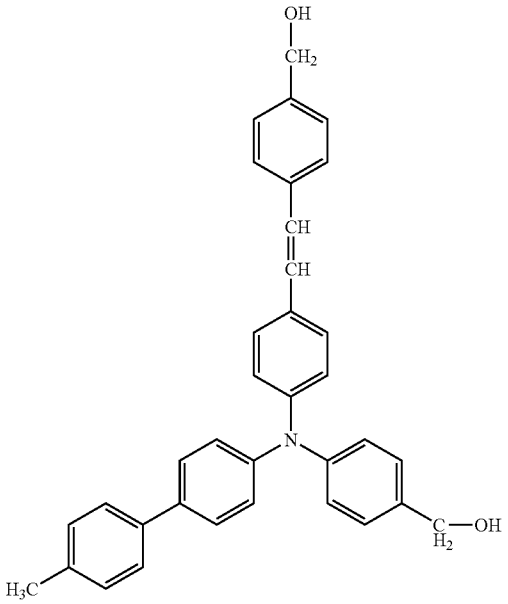 |
TABLE 24
| No. | Y | R or Z | n | Ar1 | Ar2 | Ar3 | 1 = Ar | Ar | Position of Y |
|---|---|---|---|---|---|---|---|---|---|
| 3-6-1-6(No.48) | Y = —CH2OH | Z = —CH2— | 3 | 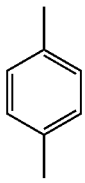 | 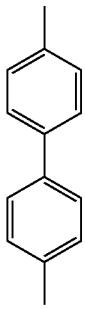 | 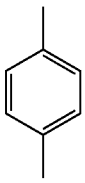 | H | 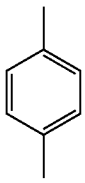 | Ar1~Ar3 |
| 3-6-1-7(No. 203) | Y = —O(CH2)2OH | Z = —O(CH2)2— | 3 | 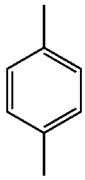 | 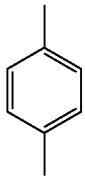 | 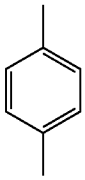 | H | 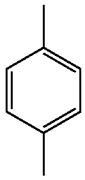 | Ar1~Ar3 |
| 3-6-1-8(No. 204) | Y = —(O(CH2)2)2OH | Z = —(O(CH2)2)2— | 3 | 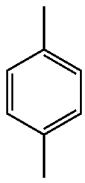 | 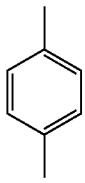 | 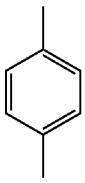 | H | 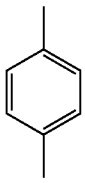 | Ar1~Ar3 |

TABLE 24-continued
| | | | | | | |
|---|---|---|---|---|---|---|
| 3-6-1-9(No. 205) | Y = —O(CH2)2OH | Z = —O(CH2)2— | 2 | 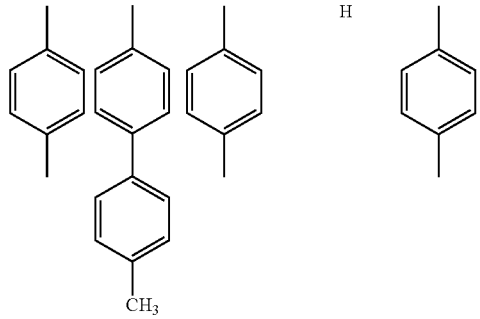 | H | Ar1, Ar3 |
| 3-6-1-10(No. 206) | Y = —O(CH2)4OH | Z = —O(CH2)4— | 2 | 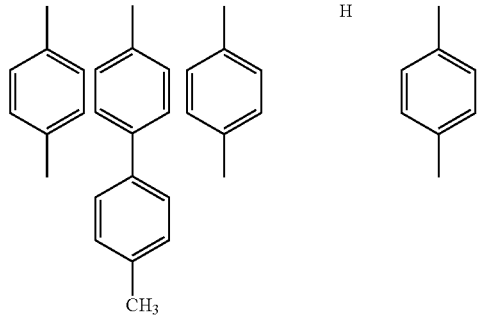 | H | Ar1, Ar3 |
| No. | Chemical formula |
|---|---|
| 3-6-1-6(No.48) | 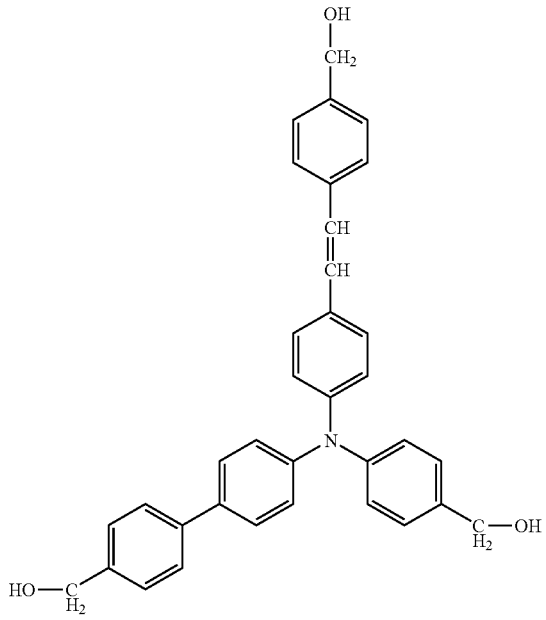 |

TABLE 24-continued
3-6-1-7(No. 203)
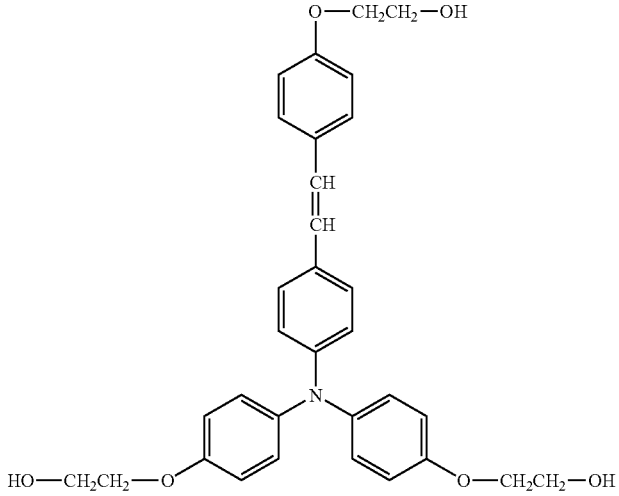
3-6-1-8(No. 204)
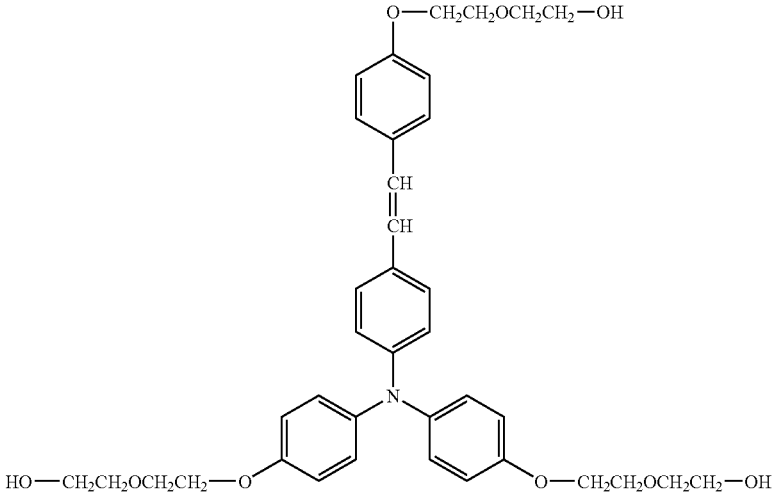
3-6-1-9(No. 205)
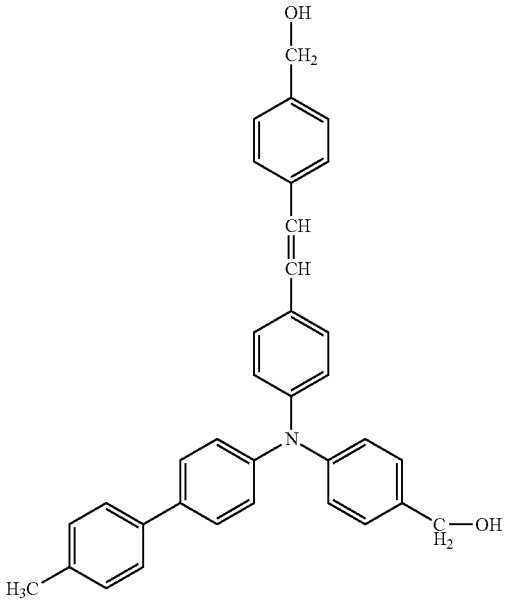

TABLE 24-continued
| | |
|---|---|
| 3-6-1-10(No. 206) | 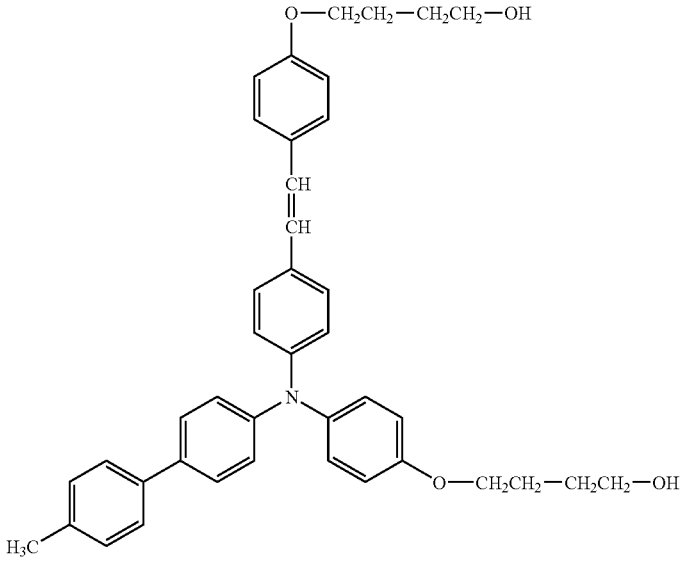 |
TABLE 25
| No. | Y | R or Z | n | Ar1 | Ar2 | Ar3 | 1 = Ar | Ar | Position of Y |
|---|---|---|---|---|---|---|---|---|---|
| 3-6-1-11(No. 207) | Y = —O(CH2)2OH | Z = —O(CH2)2— | 3 | 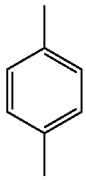 | 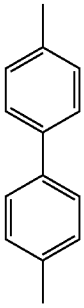 | 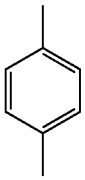 | H | 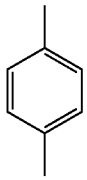 | Ar1~Ar3 |
| 3-6-1-12(No. 208) | Y = —O(CH2)3OH | Z = —O(CH2)3— | 3 | 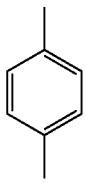 | 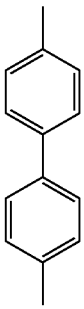 | 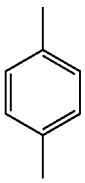 | H | 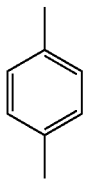 | Ar1~Ar3 |
| 3-6-1-13(No. 209) | Y = —O(CH2)2OH | Z = —O(CH2)2— | 2 | 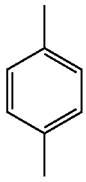 | 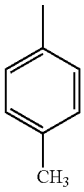  | 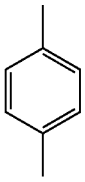 | H | 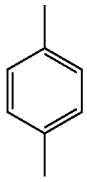 | Ar1, Ar3 |

TABLE 25-continued
| | | | | | |
|---|---|---|---|---|---|
| 3-5-1-1(No. 115) | R = —CH2O— | 1 | 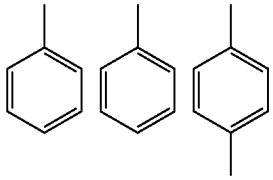 | H | 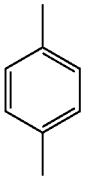 | Ar1~Ar3 |
| 3-5-1-2(No. 116) | Z = —CH2O— | 1 | 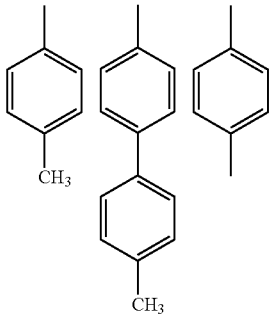  | H | 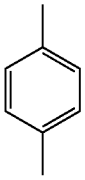 | Ar1 |
| No. | Chemical formula |
|---|---|
| 3-6-1-11(No. 207) | 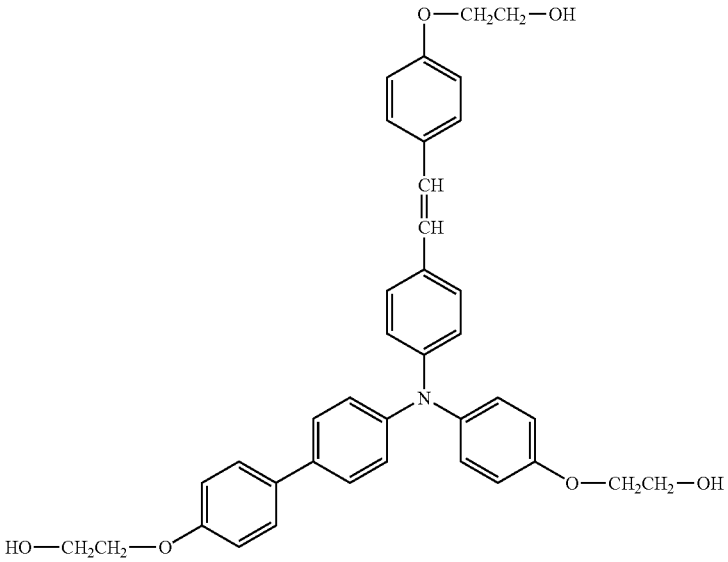  |

TABLE 25-continued
3-6-1-12(No. 208)
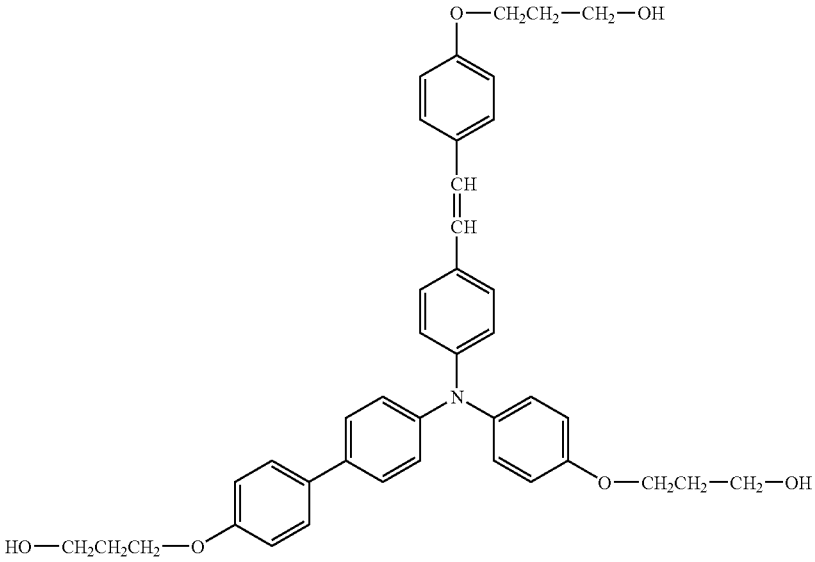
3-6-1-13(No. 209)
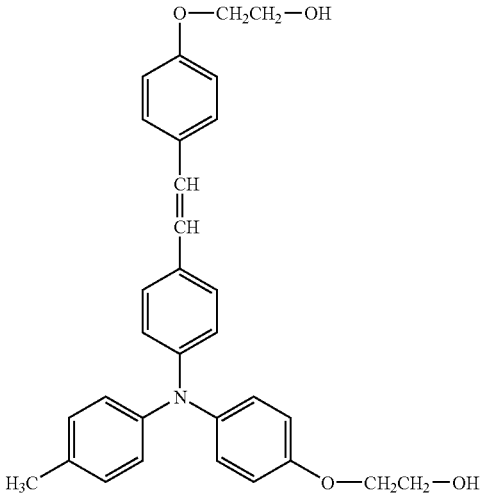

TABLE 25-continued
| | |
|---|---|
| 3-5-1-1(No. 115) | 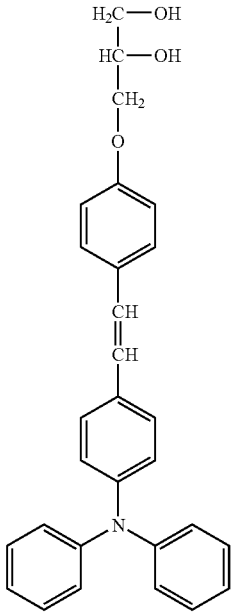 |
| 3-5-1-2(No. 116) | 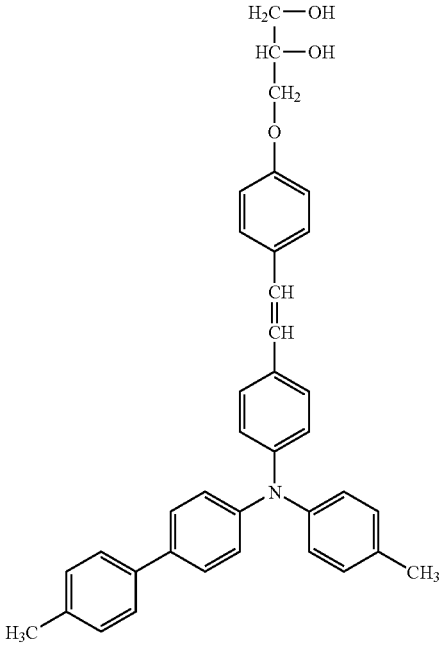 |
TABLE 26
| No. | Y | R or Z | n | Ar1 | Ar2 | Ar3 | 1 = Ar | Ar | Position of Y |
|---|---|---|---|---|---|---|---|---|---|
| 3-5-1-3(No. 117) | | R = —CH2O— | 1 | 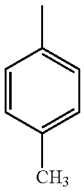 | 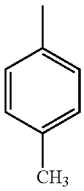 | 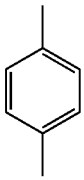 | H | 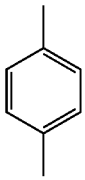 | Ar1 |

TABLE 26-continued
| | | | | | |
|---|---|---|---|---|---|
| 3-5-1-4(No. 156) | R = —CH2O— | 3 | 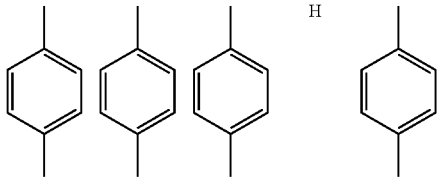 | H |  | Ar1~Ar3 |
| 3-5-1-5(No. 157) | R = —CH2O— | 2 | 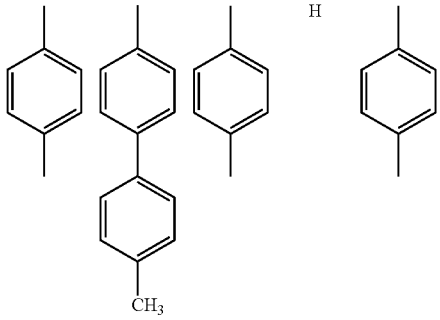 | H |  | Ar1, Ar3 |
| 3-5-1-6(No. 158) | R = —CH2O— | 3 | 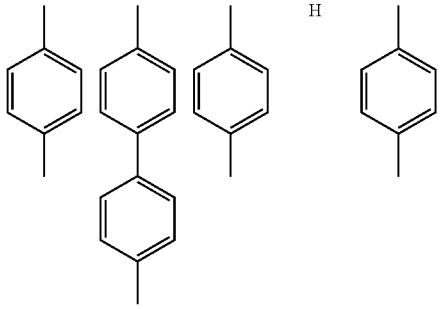 | H |  | Ar1~Ar3 |
| No. | Chemical formula |
|---|---|
| 3-5-1-3(No. 117) | 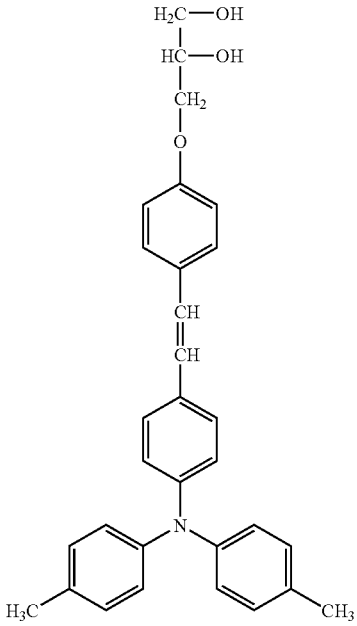 |

TABLE 26-continued
3-5-1-4(No. 156)
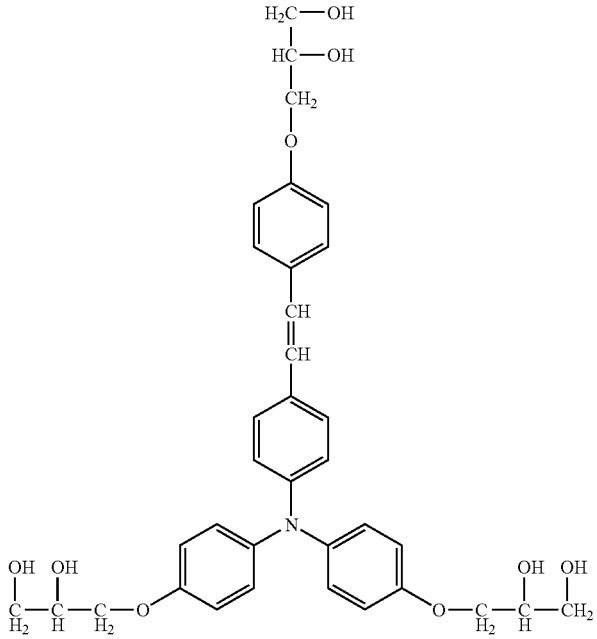
3-5-1-5(No. 157)
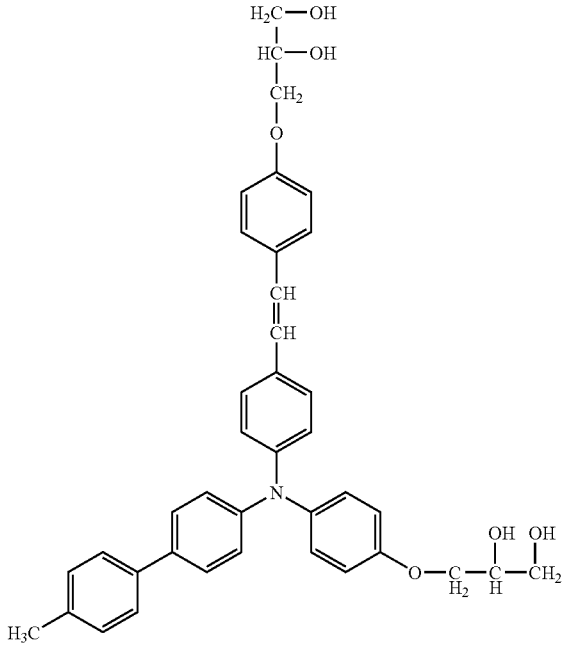

TABLE 26-continued
| | |
|---|---|
| 3-5-1-6(No. 158) | 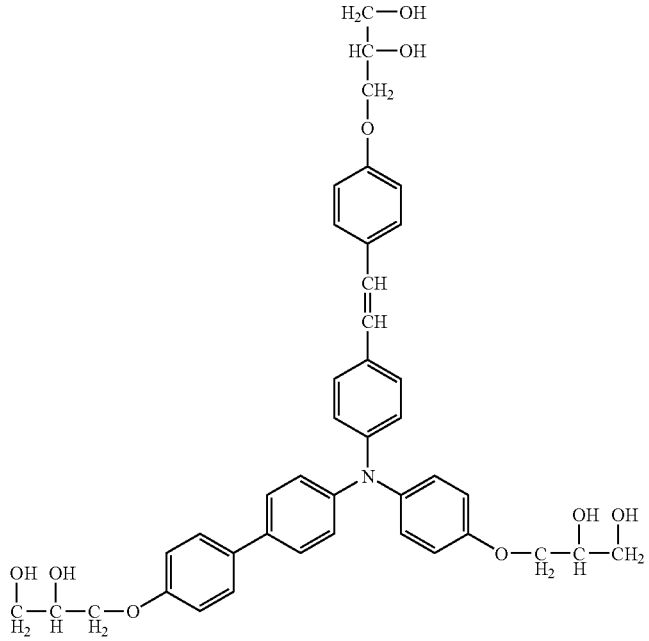 |
TABLE 27
| No. | Y | Z | n | Ar1 | Ar2 | Ar3 | R1 = Ar4 | Ar |
|---|---|---|---|---|---|---|---|---|
| 3-6-2-1(No. 11) | Y = —OH | Z = —(single bond) | 2 | 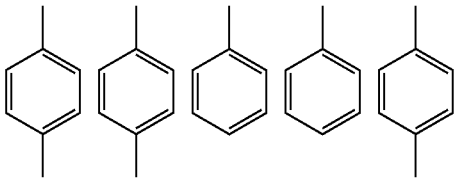 | | | | |
| 3-6-2-2(No. 12) | Y = —OH | Z = — | 3 | 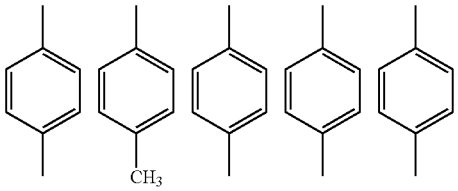 | | | | |
| 3-6-2-3(No. 24) | Y = —OH | Z = — | 2 | 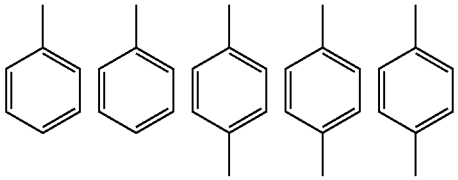 | | | | |
| 3-6-2-4(No. 25) | Y = —OH | Z = — | 2 | 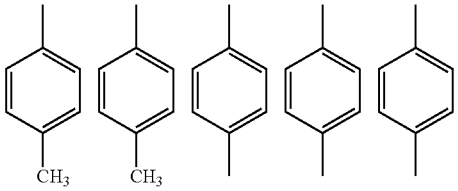 | | | | |

TABLE 27-continued

| | | | |
|---|---|---|---|
| 3-6-2-5(No. 26) | Y = —OH | Z = — | 3 |
| 3-6-2-6(No. 27) | Y = —OH | Z = — | 4 |

| No. | Position of Y | Chemical formula |
|---|---|---|
| 3-6-2-1(No. 11) | Ar1~Ar3 | |
| 3-6-2-2(No. 12) | Ar1, Ar3, Ar4 | |

TABLE 27-continued
| | | |
|---|---|---|
| 3-6-2-3(No. 24) | Ar3, Ar4 | 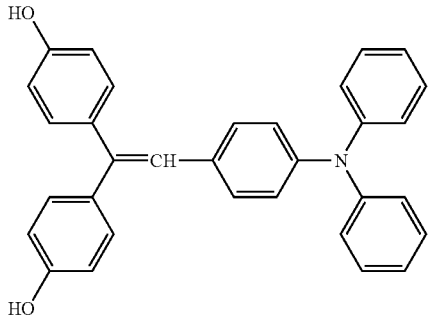 |
| 3-6-2-4(No. 25) | Ar3, Ar4 | 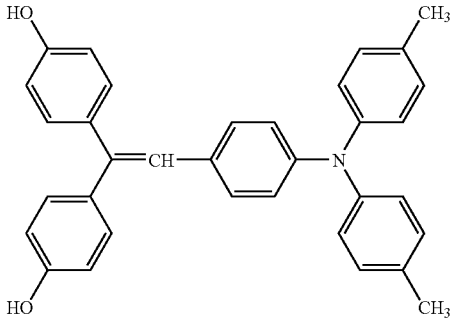 |
| 3-6-2-5(No. 26) | Ar2~Ar4 | 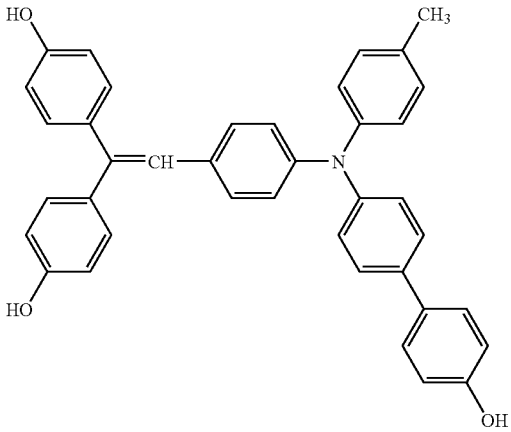 |
| 3-6-2-6(No. 27) | Ar1~Ar4 | 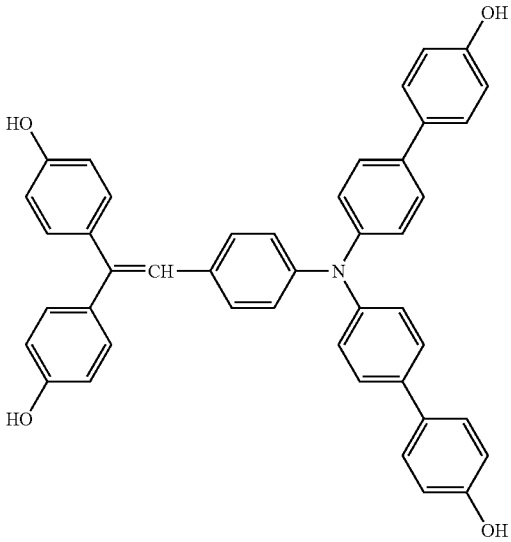 |

TABLE 28

| No. | Y | Z | n | Ar1 | Ar2 | Ar3 | R1 = Ar4 | Ar |
|---|---|---|---|---|---|---|---|---|
| 3-6-2-7(No. 38) | Y = —CH2OH | Z = —CH2— | 2 | | | | | |
| 3-6-2-8(No. 49) | Y = —CH2OH | Z = —CH2— | 2 | | | | | |
| 3-6-2-9(No. 50) | Y = —CH2OH | Z = —CH2— | 2 | $CH_3$ | $CH_3$ | | | |
| 3-6-2-10(No. 51) | Y = —CH2OH | Z = —CH2— | 4 | | | | | |
| 3-6-2-11(No. 52) | Y = —CH2OH | Z = —CH2— | 3 | $CH_3$ | | | | |
| 3-6-2-12(No. 183) | Y = —O(CH2)2OH | Z = —O(CH2)2— | 2 | | | | | |

TABLE 28-continued
| No. | Position of Y | Chemical formula |
|---|---|---|
| 3-6-2-7(No. 38) | Ar1~Ar2 | 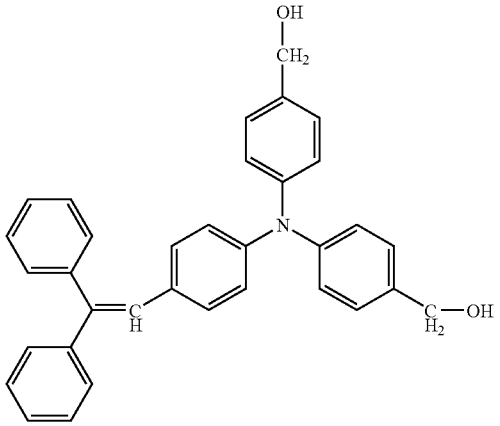 |
| 3-6-2-8(No. 49) | Ar3~Ar4 | 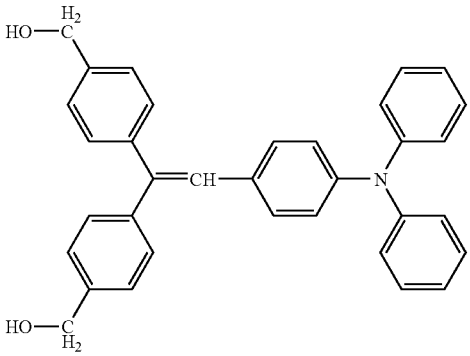 |
| 3-6-2-9(No. 50) | Ar3~Ar4 | 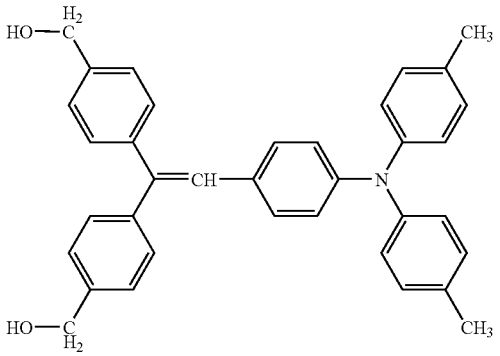 |

TABLE 28-continued
3-6-2-10(No. 51) Ar1, Ar3~Ar4
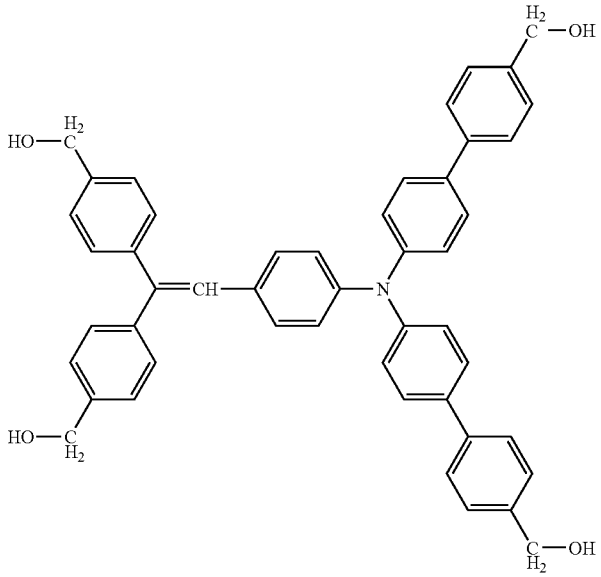
3-6-2-11(No. 52) Ar2~Ar4
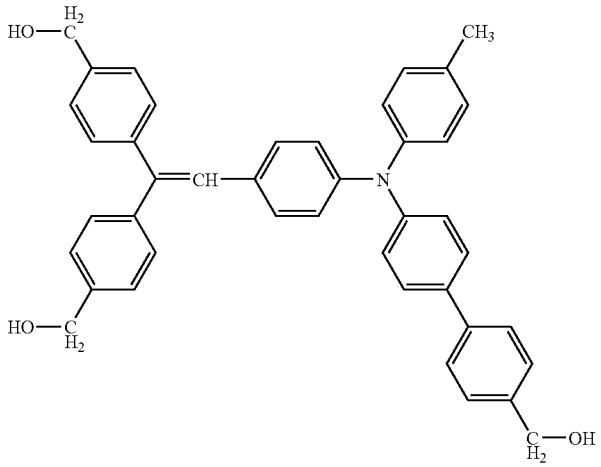
3-6-2-12(No. 183) Ar1~Ar2
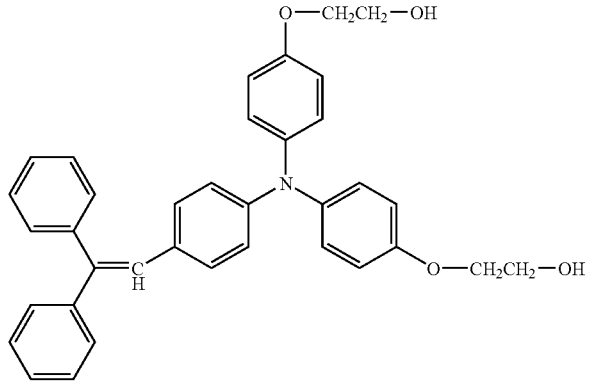

TABLE 29

| No. | Y | Z | n | Ar1 | Ar2 | Ar3 | R1 = Ar4 | Ar | Position of Y |
|---|---|---|---|---|---|---|---|---|---|
| 3-6-2-13(No. 184) | Y = —(O(CH2)2)2OH | Z = —(O(CH2)2)2— | 2 | | | | | | Ar1~Ar2 |
| 3-6-2-14(No. 185) | Y = —O(CH2)2OH | Z = —O(CH2)2— | 3 | | $CH_3$ | | | | Ar1, Ar3~Ar |
| 3-6-2-15(No. 186) | Y = —O(CH2)4OH | Z = —O(CH2)4— | 3 | | $CH_3$ | | | | Ar1, Ar3~Ar4 |
| 3-6-2-16(No. 210) | Y = —O(CH2)2OH | Z = —O(CH2)2— | 2 | | | | | | Ar3~Ar4 |
| 3-6-2-17(No. 211) | Y = —O(CH2)3OH | Z = —O(CH2)3— | 2 | | | | | | Ar3~Ar4 |
| 3-6-2-18(No. 212) | Y = —O(CH2)2OH | Z = —O(CH2)2— | 4 | | | | | | Ar1~Ar4 |

TABLE 29-continued
| No. | Chemical formula |
|---|---|
| 3-6-2-13(No. 184) | 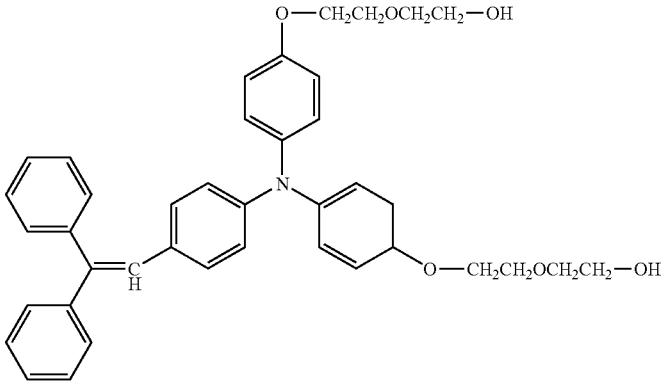 |
| 3-6-2-14(No. 185) | 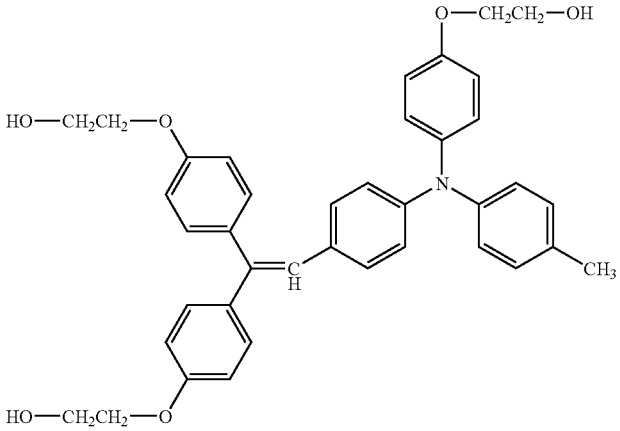 |
| 3-6-2-15(No. 186) | 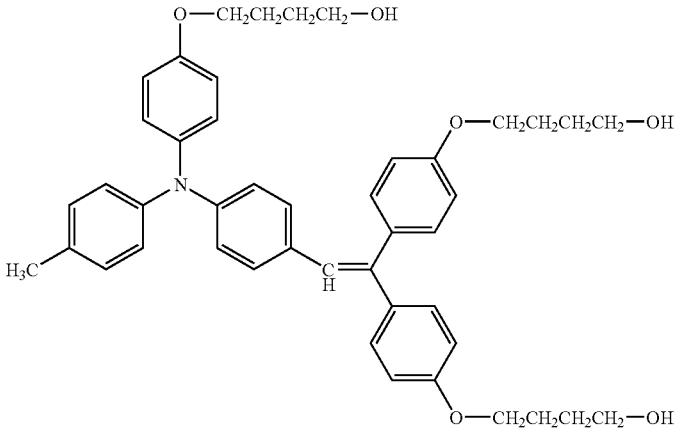 |
| 3-6-2-16(No. 210) | 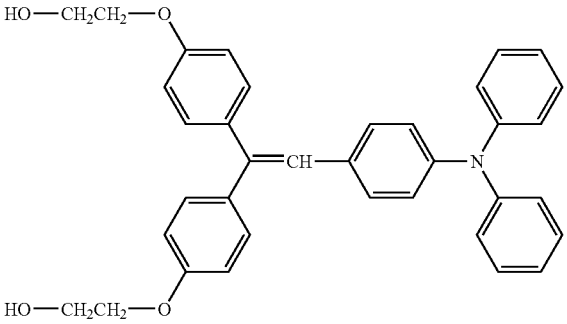 |

TABLE 29-continued
3-6-2-17(No. 211)
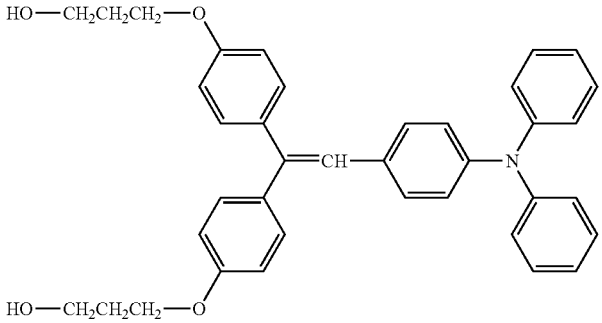
3-6-2-18(No. 212)
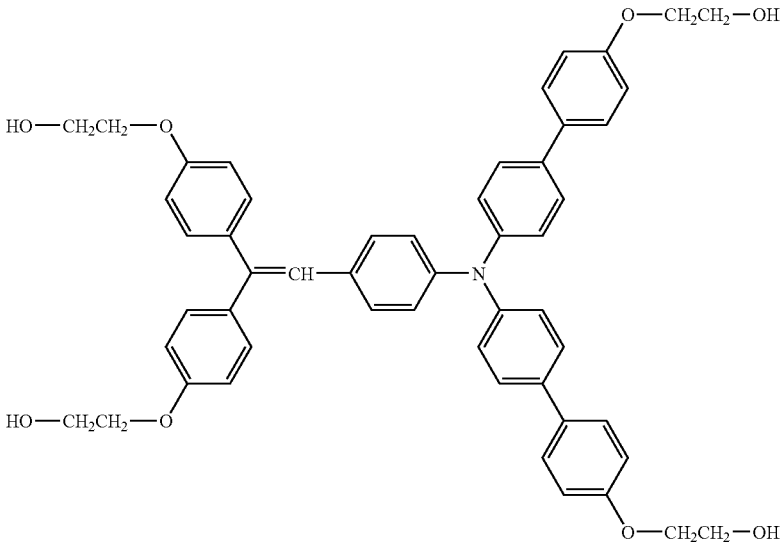
TABLE 30
| No. | Y | Z | n | Ar1 | Ar2 | Ar3 | R1 = Ar4 | A | Position of Y |
|---|---|---|---|---|---|---|---|---|---|
| 3-6-2-19(No. 213) | Y = —O(CH2)2OH | Z = —O(CH2)2— | 2 | 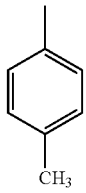 | 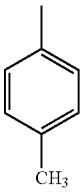 | 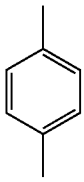 | 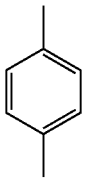 | 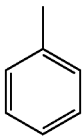 | Ar3~Ar4 |
| 3-6-2-20(No. 214) | Y = —O(CH2)6OH | Z = —O(CH2)6— | 2 | 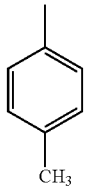 | 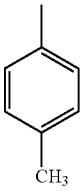 | 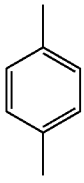 | 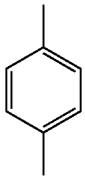 | 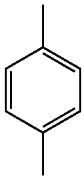 | Ar3~Ar4 |

TABLE 30-continued
| | | | |
|---|---|---|---|
| 3-6-2-21(No. 215) Y = —O(CH2)3OH Z = —O(CH2)3— | 4 | 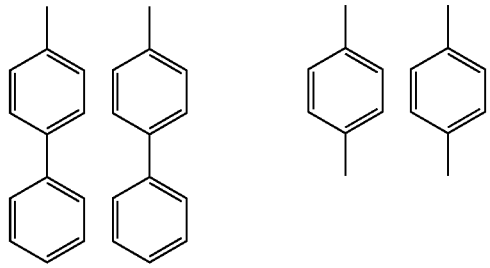 | Ar1~Ar4 |
| 3-6-2-22(No. 216) Y = —O(CH2)2OH Z = —O(CH2)2— | 3 | 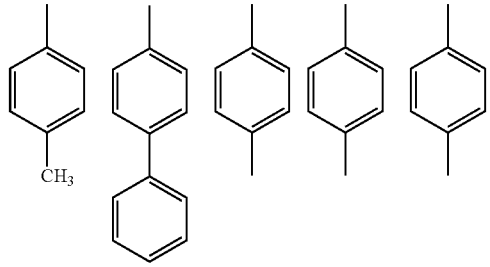 | Ar2~Ar4 |
| 3-6-2-23(No. 217) Y = —O(CH2)3OH Z = —O(CH2)3— | 3 | 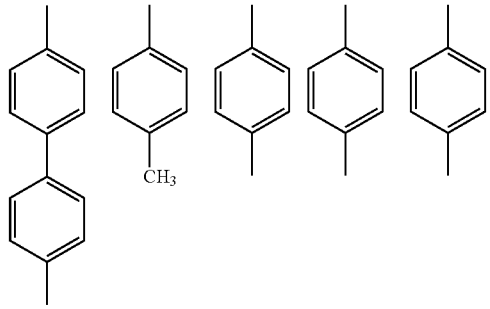 | Ar1, Ar3~Ar4 |
| No. | Chemical formula |
|---|---|
| 3-6-2-19(No. 213) | 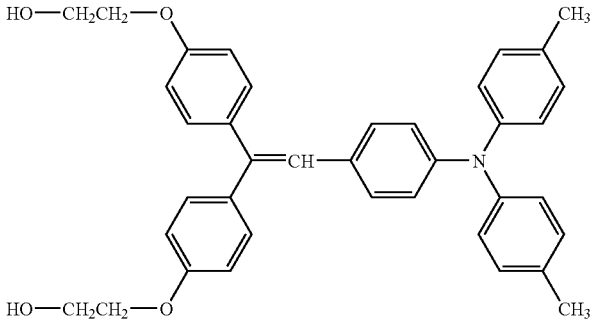 |
| 3-6-2-20(No. 214) | 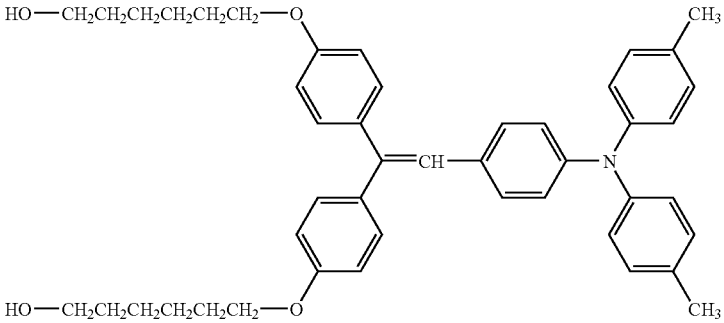 |

TABLE 30-continued
3-6-2-21(No. 215)
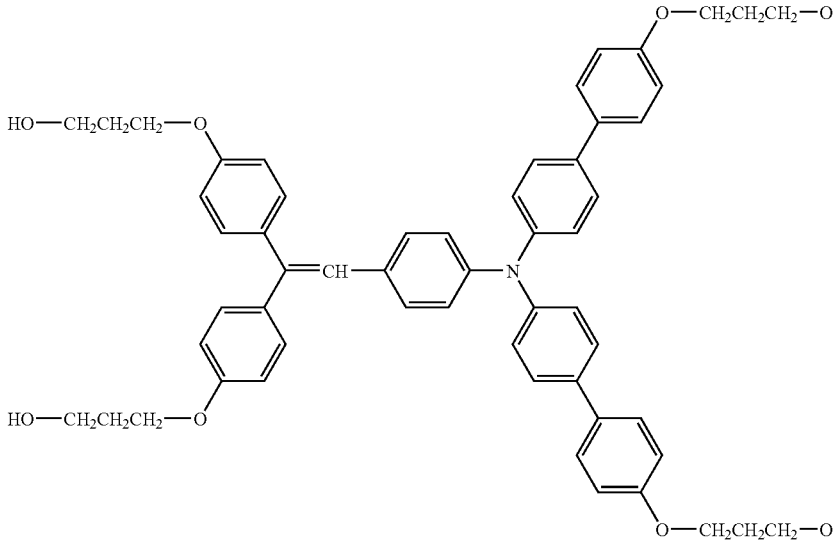
3-6-2-22(No. 216)
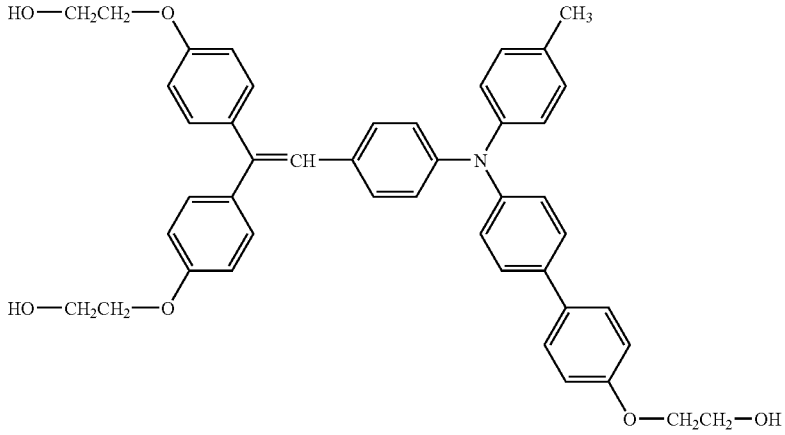
3-6-2-23(No. 217)
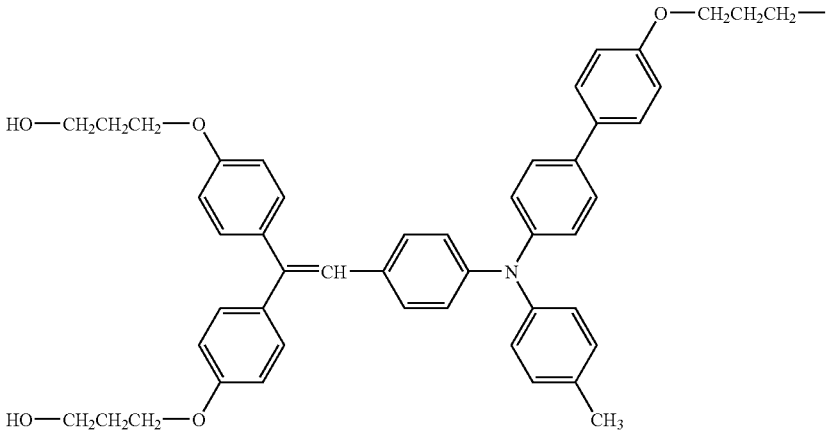

Tables 31 and 32 below list examples of compounds having the structure of General Formula (2) in which substituent X has the moiety represented by General Formula (4) and substituent Y has the moiety represented by General Formula (6).
TABLE 31
| No. | R | n | Ar1 | Ar2 | Ar3 | R1 = Ar4 | Ar | Position of Y |
|---|---|---|---|---|---|---|---|---|
| 3-5-2-1(No. 82) | R = —CH2O— | 1 | 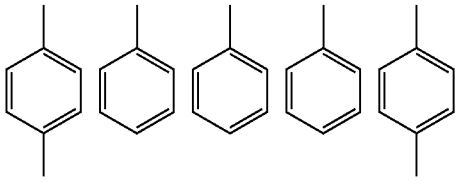 | | | | | Ar1 |
| 3-5-2-2(No. 83) | R = —CH2O— | 1 | 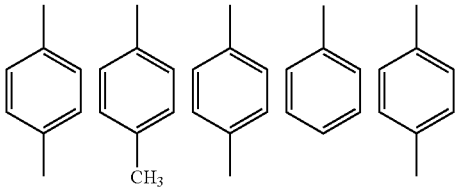 | | | | | Ar1 |
| 3-5-2-3(No. 118) | R = —CH2O— | 1 | 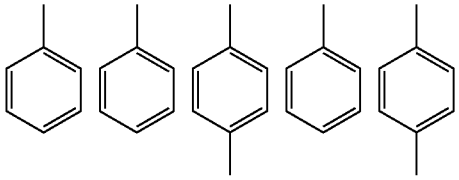 | | | | | Ar3 |
| 3-5-2-4(No. 119) | R = —CH2O— | 1 | 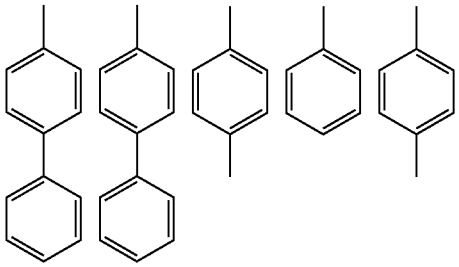 | | | | | Ar3 |
| 3-5-2-5(No. 120) | R = —CH2O— | 1 | 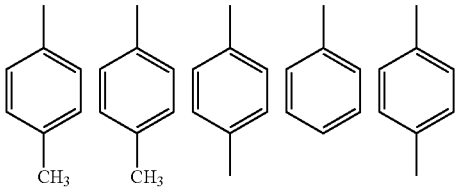 | | | | | Ar3 |
| 3-5-2-6(No. 145) | R = —CH2O— | 2 | 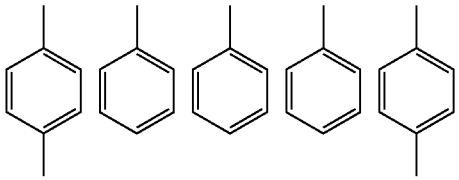 | | | | | Ar1, Ar2 |

TABLE 31-continued
| No. | Chemical Formula |
|---|---|
| 3-5-2-1(No. 82) | 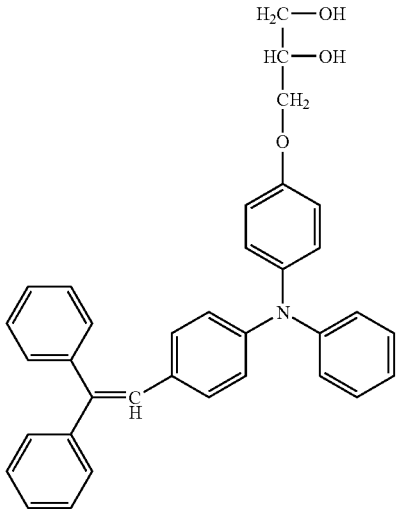 |
| 3-5-2-2(No. 83) | 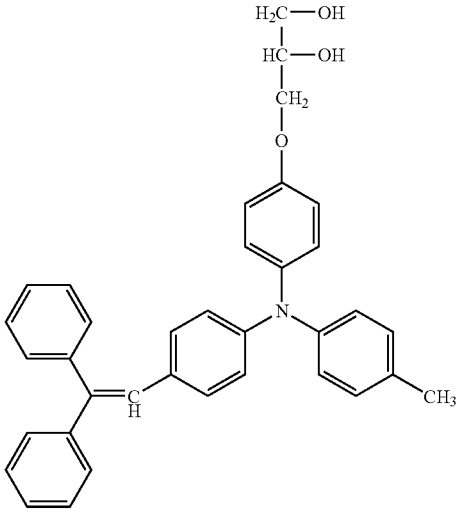 |
| 3-5-2-3(No. 118) | 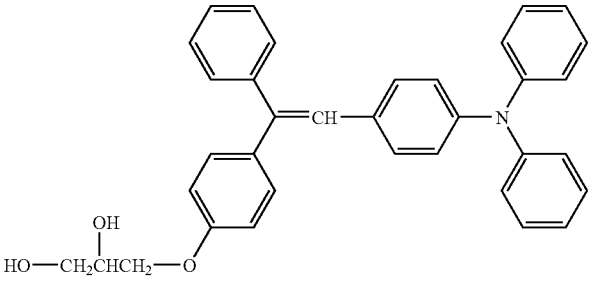 |

TABLE 31-continued
3-5-2-4(No. 119)
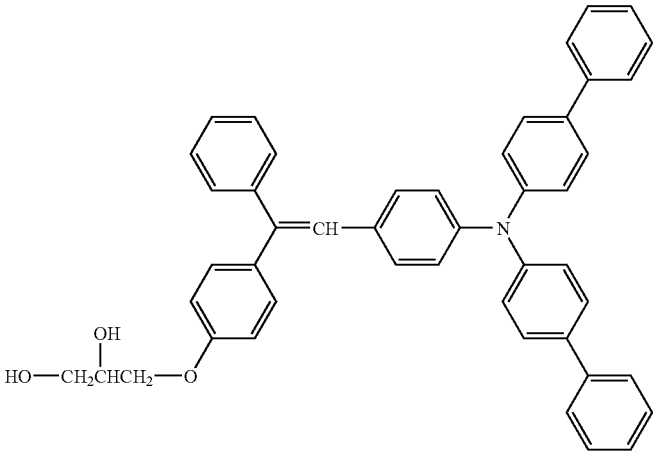
3-5-2-5(No. 120)
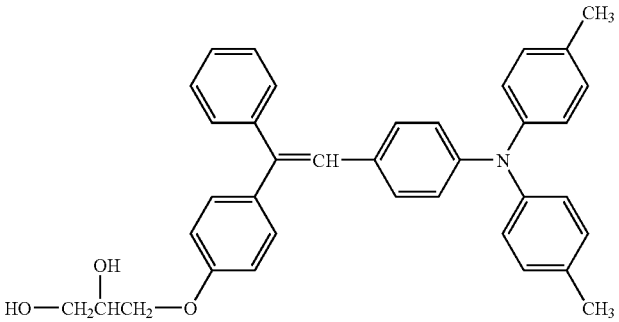
3-5-2-6(No. 145)
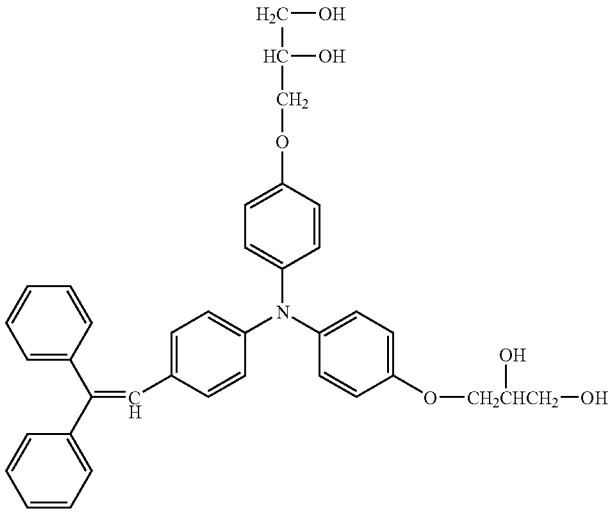
TABLE 32
| No. | R | n | Ar1 | Ar2 | Ar3 | R1 = Ar4 | Ar | Position of Y |
|---|---|---|---|---|---|---|---|---|
| 3-5-2-7(No. 146) | R = —CH2O— | 3 | 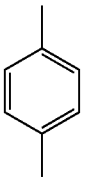 | 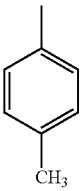 | 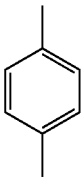 | 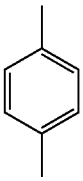 | 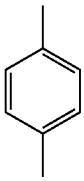 | Ar1, Ar3~Ar4 |

TABLE 32-continued
| | | | | |
|---|---|---|---|---|
| 3-5-2-8(No. 159) | R = —CH2O— | 2 | 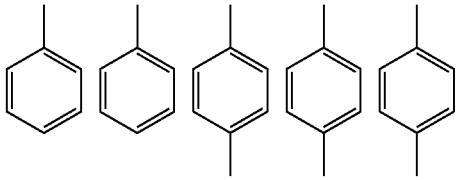 | Ar3~Ar4 |
| 3-5-2-9(No. 160) | R = —CH2O— | 2 | 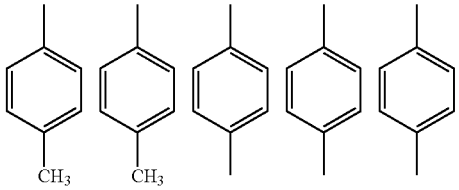 | Ar3~Ar4 |
| 3-5-2-10(No. 161) | R = —CH2O— | 4 | 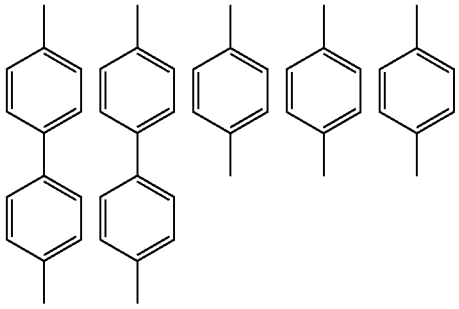 | Ar1~Ar4 |
| 3-5-2-11(No. 162) | R = —CH2O— | 3 | 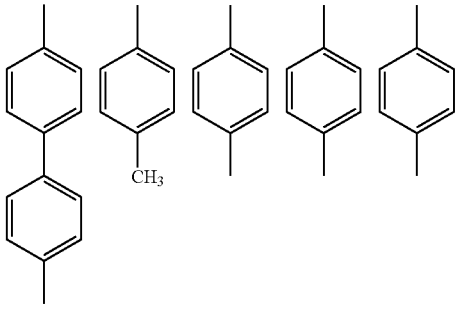 | Ar1, Ar3~Ar4 |
| No. | Chemical Formula |
|---|---|
| 3-5-2-7(No. 146) | 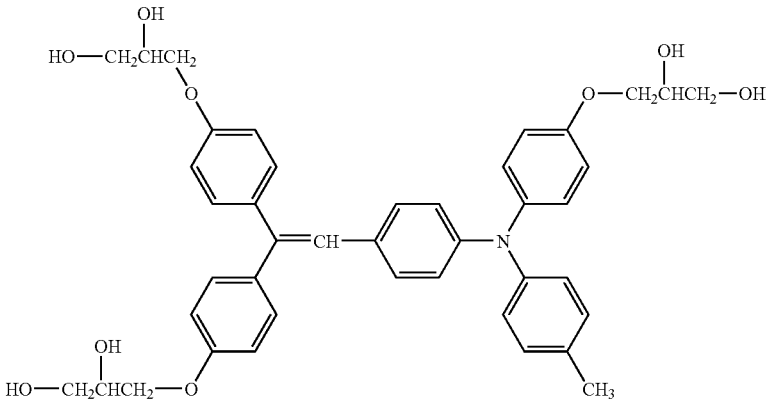 |

TABLE 32-continued
3-5-2-8(No. 159)
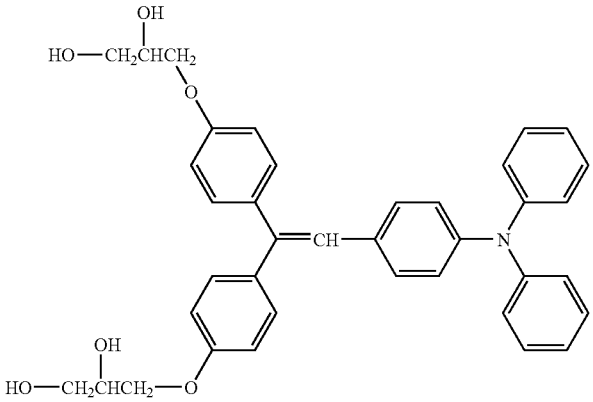
3-5-2-9(No. 160)
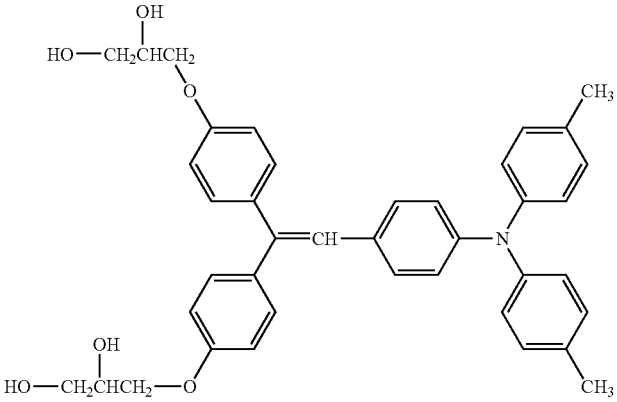
3-5-2-10(No. 161)
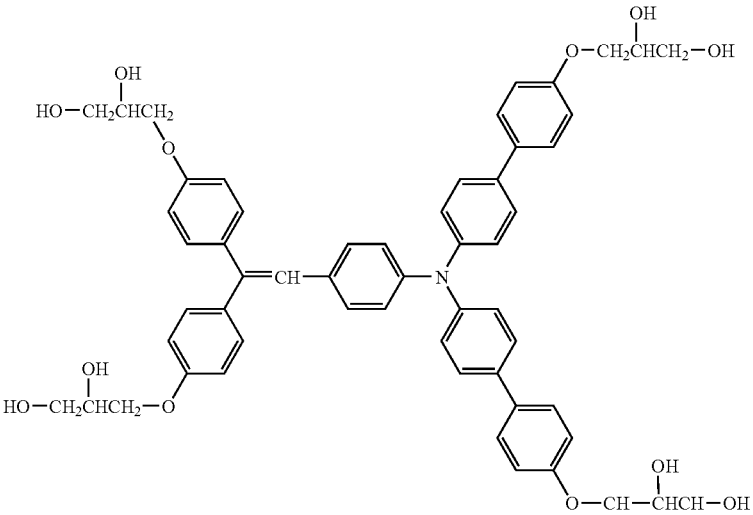

TABLE 32-continued
| | |
|---|---|
| 3-5-2-11(No. 162) | 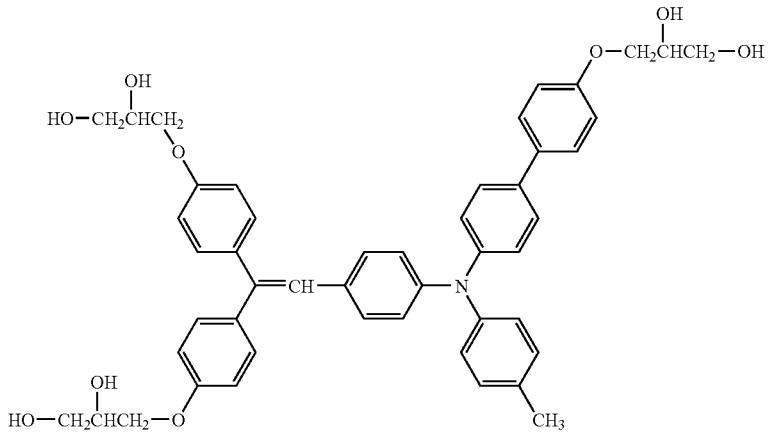 |
Tables 33 and 34 below list examples of compounds having the structure of General Formula (2) in which substituent X has the moiety represented by General Formula (5) and substituent Y has the moiety represented by General Formula (7).
TABLE 33
| No. | Y | Z | n | Ar1 | Ar2 | Ar5 | Ar6 | Ar |
|---|---|---|---|---|---|---|---|---|
| 4-6-1(No. 6) | Y = —OH | Z = —(single bond) | 2 | Ar1 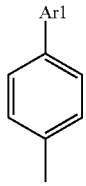 | 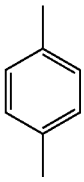 | 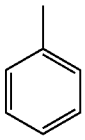 | 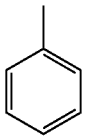 | 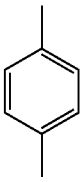 |
| 4-6-2(No. 13) | Y = —OH | Z = — | 3 | 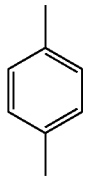 | 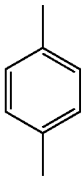 | 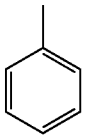 | 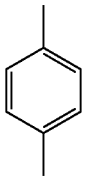 | 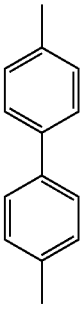 |
| 4-6-3(No. 14) | Y = —OH | Z = — | 2 | 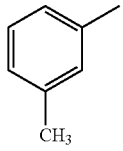 | 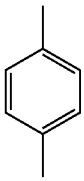 | 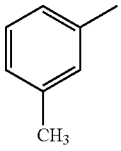 | 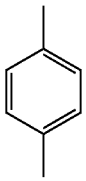 | 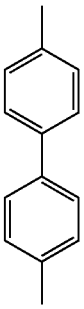 |
| 4-6-4(No. 33) | Y = —CH2OH | Z = —CH2— | 2 | 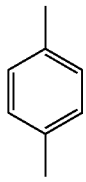 | 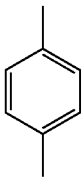 | 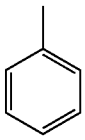 | 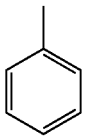 | 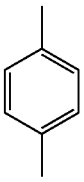 |

TABLE 33-continued
| | | | | |
|---|---|---|---|---|
| 4-6-5(No. 38) | Y = —CH2OH | Z = —CH2— | 2 | 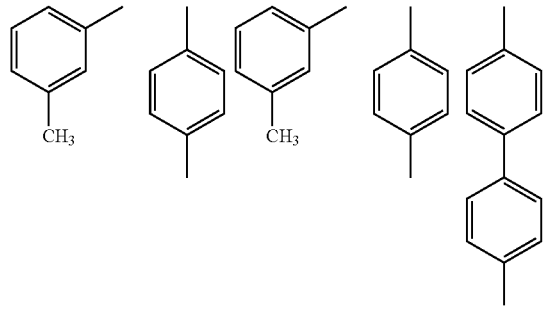 |
| 4-6-6(No. 40) | Y = —CH2OH | Z = —CH2— | 3 | 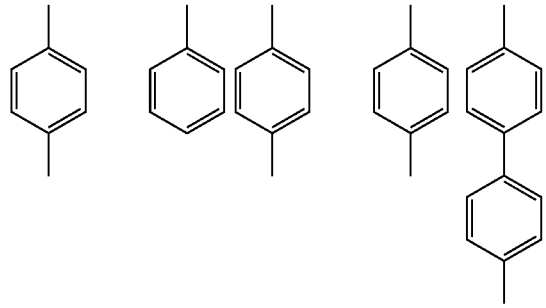 |
| No. | Position of Y | Chemical Formula |
|---|---|---|
| 4-6-1(No. 6) | Ar1, Ar2 | 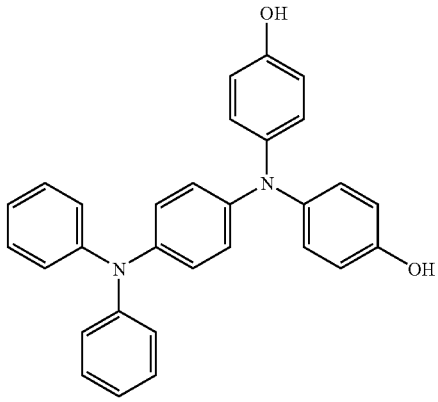 |
| 4-6-2(No. 13) | Ar1, Ar2, Ar4 | 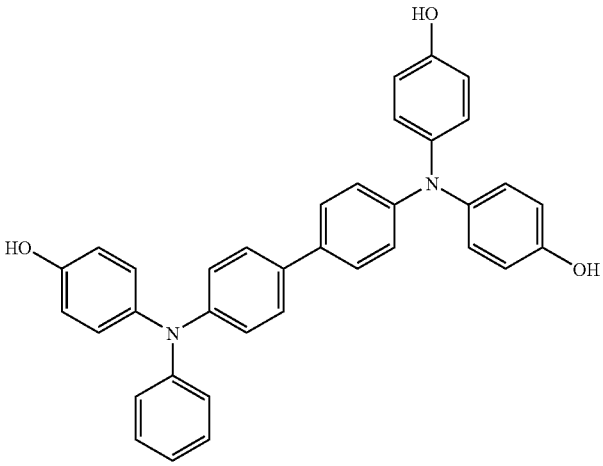 |

TABLE 33-continued
| | | |
|---|---|---|
| 4-6-3(No. 14) | Ar2, Ar4 | 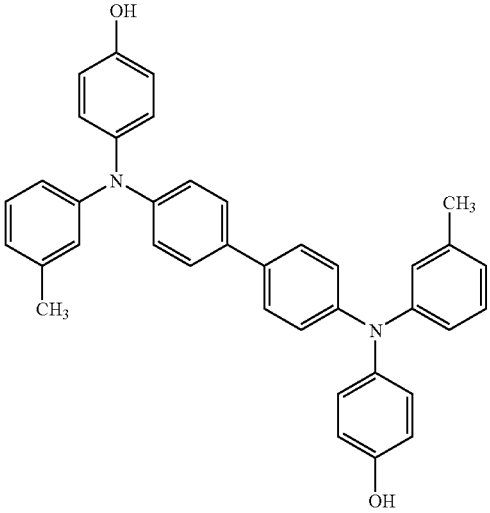 |
| 4-6-4(No. 33) | Ar1, Ar2 | 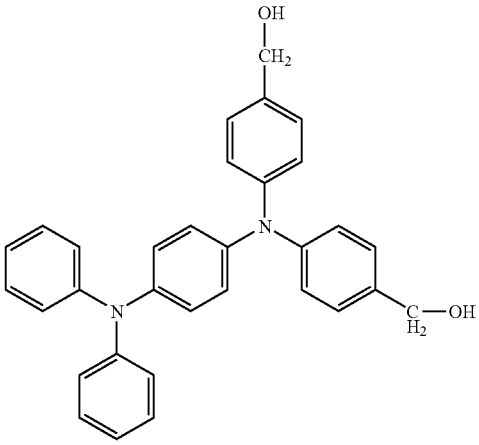 |
| 4-6-5(No. 38) | Ar2, Ar4 | 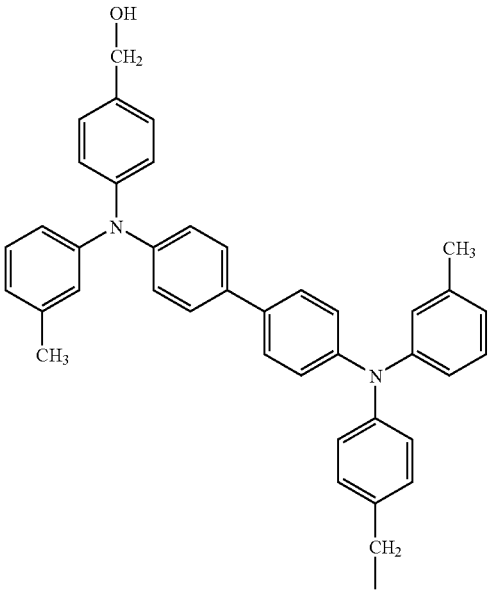 |

TABLE 33-continued
| | | |
|---|---|---|
| 4-6-6(No. 40) | Ar1, Ar3, Ar4 | 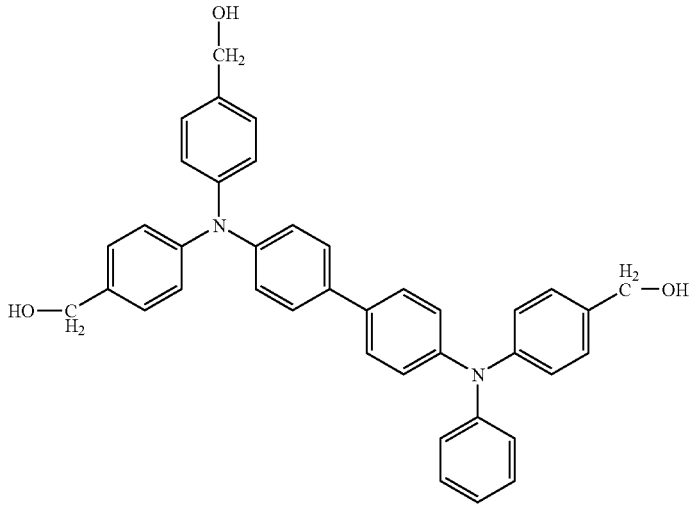 |
TABLE 34
| No. | Y | Z | n | Ar1 | Ar2 | Ar5 | Ar6 | Ar | Position of Y |
|---|---|---|---|---|---|---|---|---|---|
| 4-6-7(No. 173) | Y = —O(CH2)2OH | Z = —O(CH2)2— | 2 | 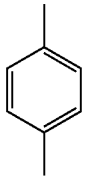 | 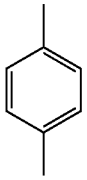 | 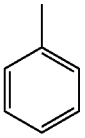 | 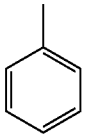 | 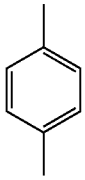 | Ar1, Ar2 |
| 4-6-8(No. 174) | Y = —O(CH2)5OH | Z = —O(CH2)5— | 2 | 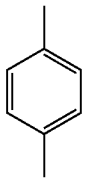 | 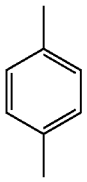 | 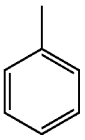 | 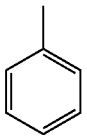 | 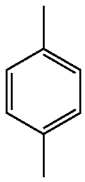 | Ar1, Ar2 |
| 4-6-9(No. 187) | Y = —(O(CH2)2OH | Z = —O(CH2)2— | 3 | 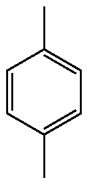 | 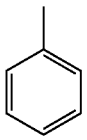 | 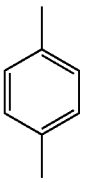 | 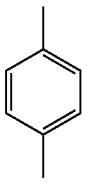 | 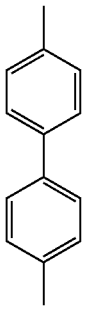 | Ar1, Ar3, Ar4 |
| 4-6-10(No. 188) | Y = —(O(CH2)2)2OH | Z = —(O(CH2)2)2— | 3 | 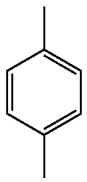 | 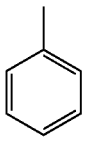 | 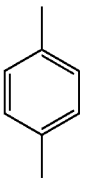 | 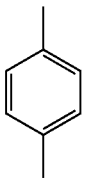 | 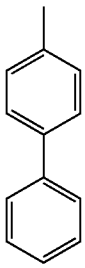 | Ar1, Ar3, Ar4 |

TABLE 34-continued

| | | | | |
|---|---|---|---|---|
| 4-6-11(No. 189) | Y = —O(CH2)2OH | Z = —O(CH2)2— | 2 | Ar2, Ar4 |
| 4-6-12(No. 190) | Y = —O(CH2)4OH | Z = —O(CH2)4— | 2 | Ar2, Ar4 |

| No. | Chemical Formula |
|---|---|
| 4-6-7(No. 173) | |
| 4-6-8(No. 174) | |

TABLE 34-continued
4-6-9(No. 187)
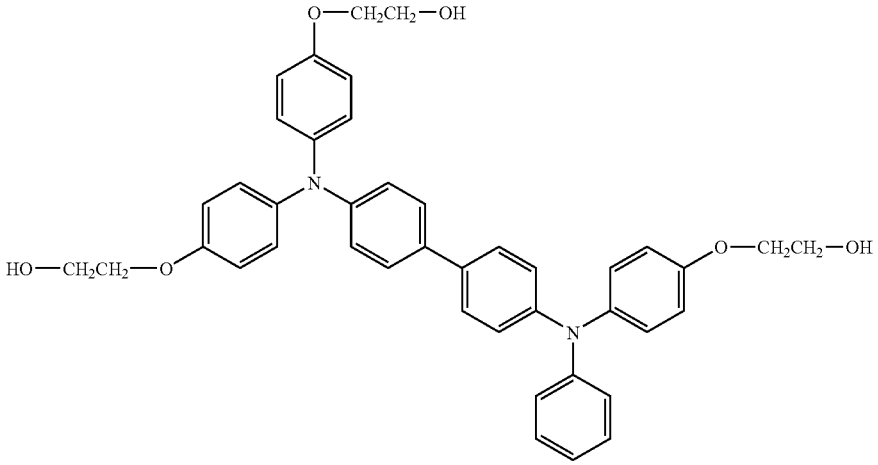
4-6-10(No. 188)
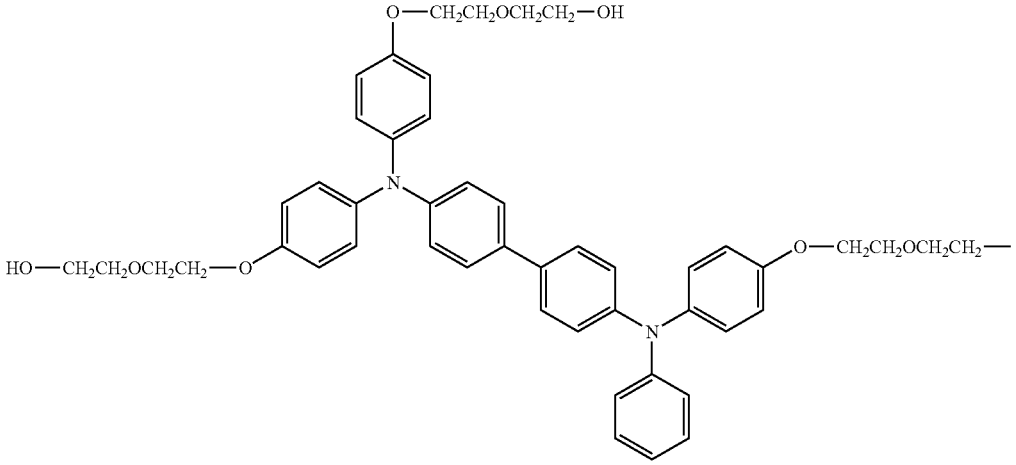
4-6-11(No. 189)
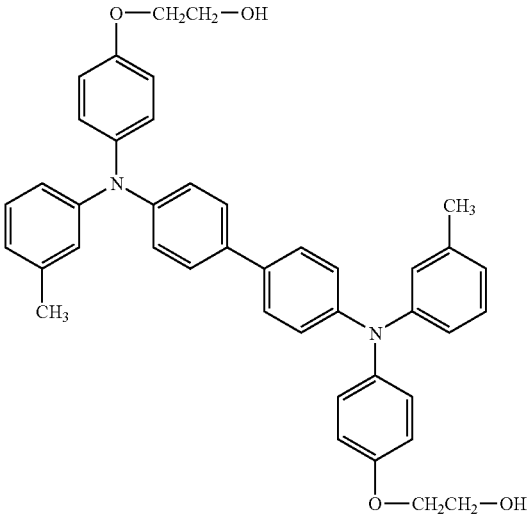

TABLE 34-continued
| | |
|---|---|
| 4-6-12(No. 190) | 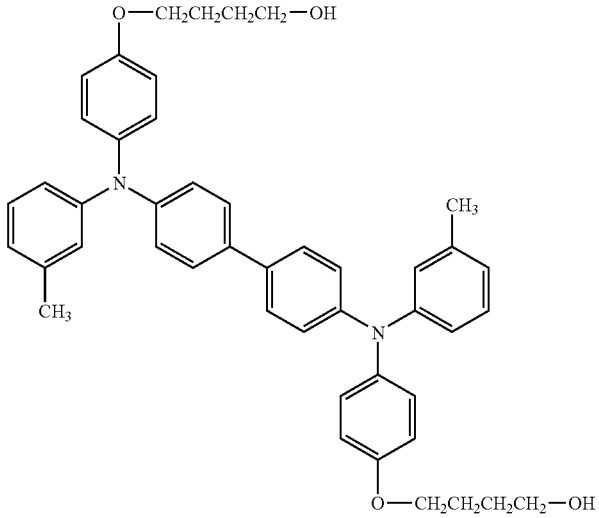 |
Tables 35 and 36 below list examples of compounds having the structure of General Formula (2) in which substituent X has the moiety represented by General Formula (5) and substituent Y has the moiety represented by General Formula (6).
TABLE 35
| No. | R | n | Ar1 | Ar2 | Ar5 | Ar6 | Ar |
|---|---|---|---|---|---|---|---|
| 4-5-1(No. 64) | R = —CH2O— | 1 | 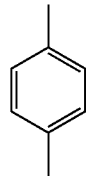 | 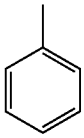 | 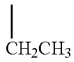 | 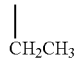 | 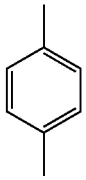 |
| 4-5-2(No. 65) | R = —CH2O— | 1 | 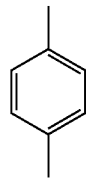 | 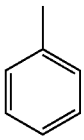 | 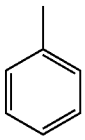 | 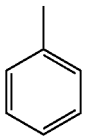 | 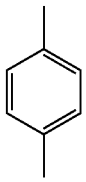 |
| 4-5-3(No. 84) | R = —CH2O— | 1 | 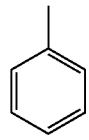 | 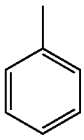 | 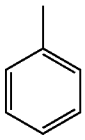 | 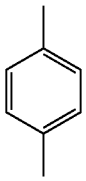 | 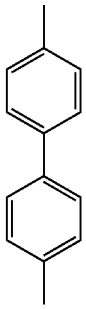 |

TABLE 35-continued
| | | | |
|---|---|---|---|
| 4-5-4(No. 85) | R = —CH2O— | 1 | 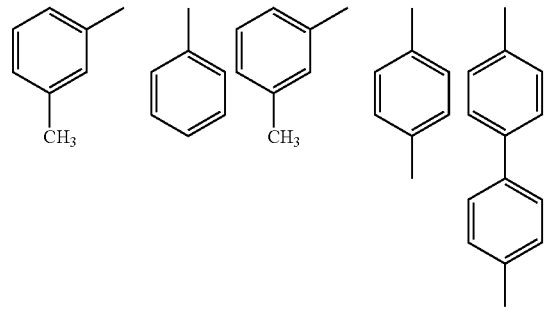 |
| No. | Position of Y | Chemical Formula |
|---|---|---|
| 4-5-1(No. 64) | Ar1 | 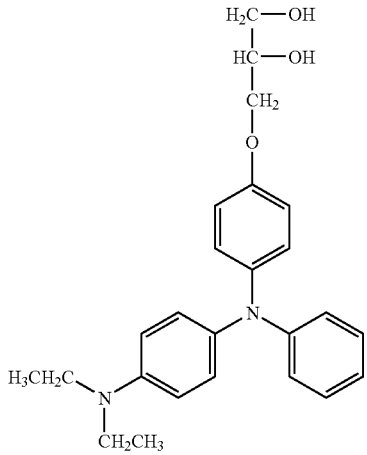 |
| 4-5-2(No. 65) | Ar1 | 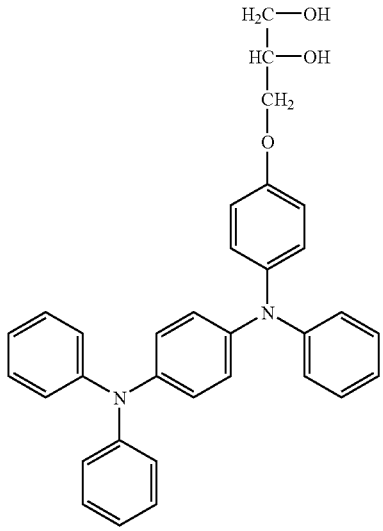 |

TABLE 35-continued
| | | |
|---|---|---|
| 4-5-3(No. 84) | Ar4 | 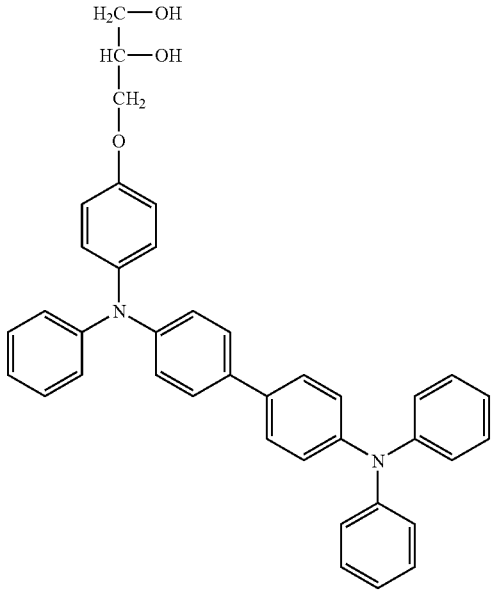 |
| 4-5-4(No. 85) | Ar4 | 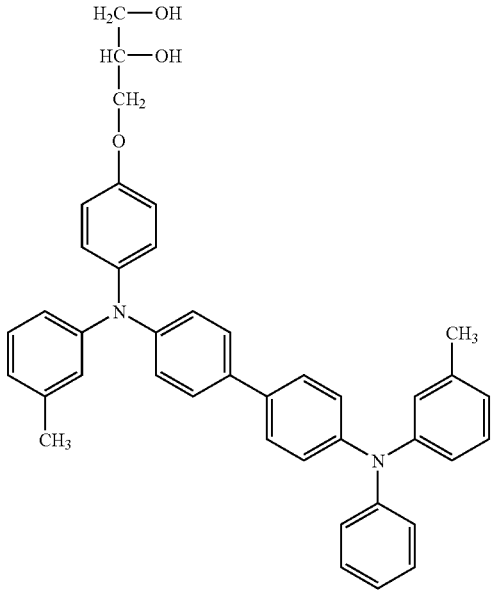 |
TABLE 36
| No. | R | n | Ar1 | Ar2 | Ar5 | Ar6 | Ar | Position of Y |
|---|---|---|---|---|---|---|---|---|
| 4-5-5(No. 140) | R = —CH2O— | 2 | 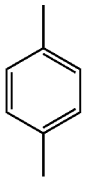 | 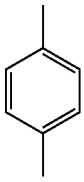 | 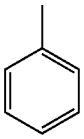 | 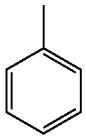 | 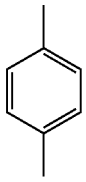 | Ar1, Ar2 |

TABLE 36-continued
| | | | | |
|---|---|---|---|---|
| 4-5-6(No. 147) | R = —CH2O— | 3 | 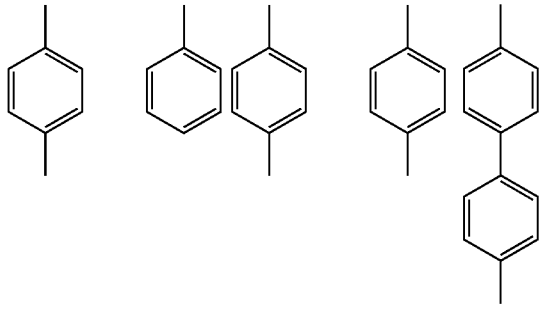 | Ar1, Ar3, Ar4 |
| 4-5-6(No. 148) | R = —CH2O— | 2 | 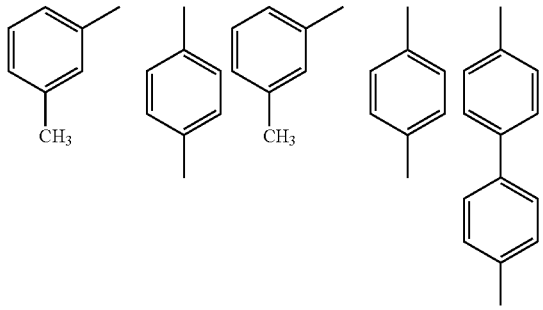 | Ar2, Ar4 |
| No. | Chemical Formula |
|---|---|
| 4-5-5(No. 140) | 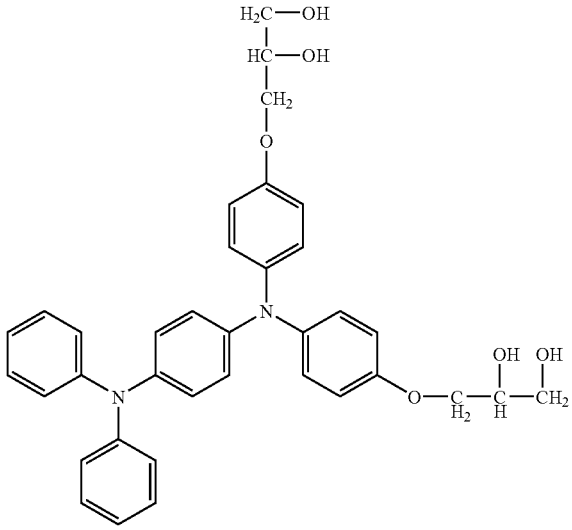 |

TABLE 36-continued
4-5-6(No. 147)
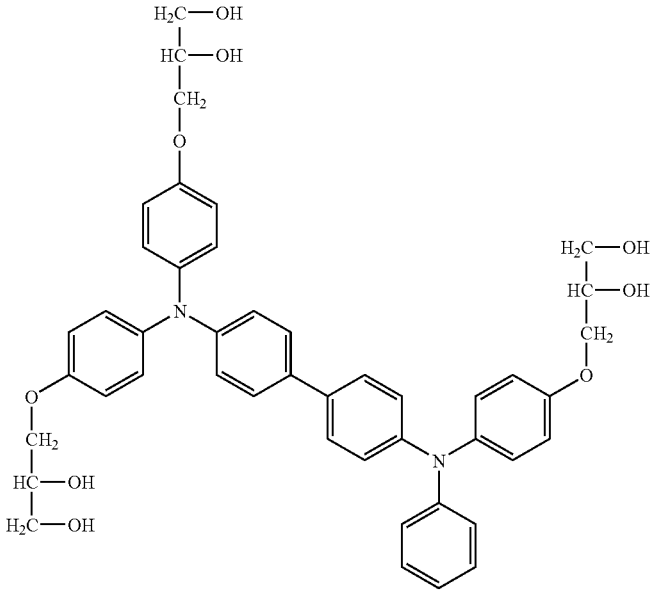
4-5-6(No. 148)
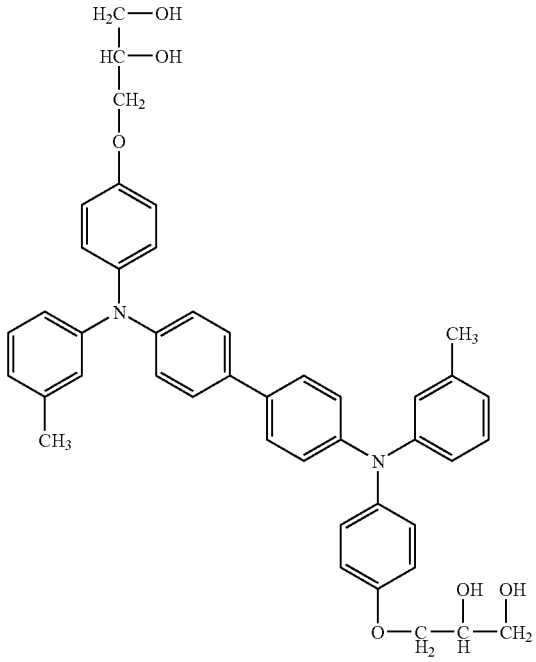

All of the compounds listed above can be catalogued in the following Tables 37 to 42 by assigning them unique identification number "Compound No." First, reactive charge transporting substances employed in the present invention, i.e., charge transporting substances having two or more hydroxyl groups will be described. For such compounds, compounds that have two or more hydroxyl groups attached to different terminals of the charge transporting compound group can be first contemplated. Among them, examples of charge transporting substances in which hydroxyl groups are bonded directly or via methylene chain to a charge transporting compound group are listed below.

TABLE 37

No. 1

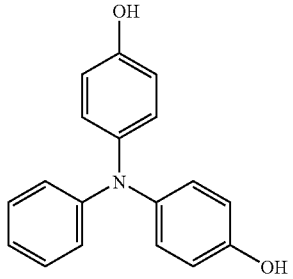

No. 2

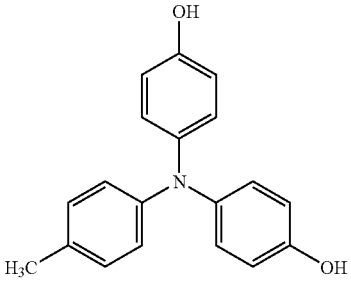

No. 3

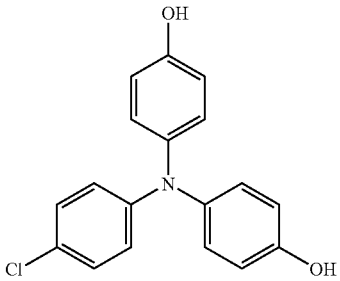

No. 4

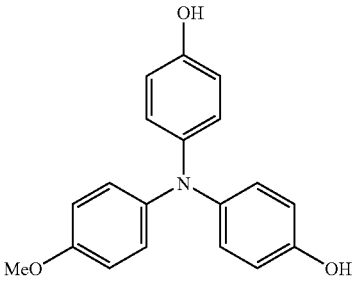

TABLE 37-continued

No. 5

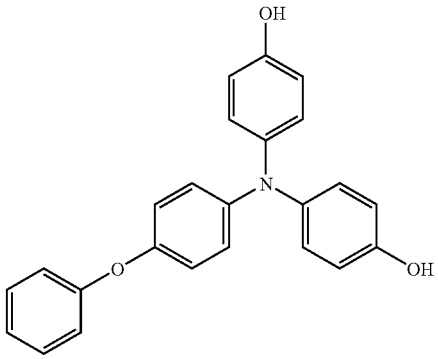

No. 6

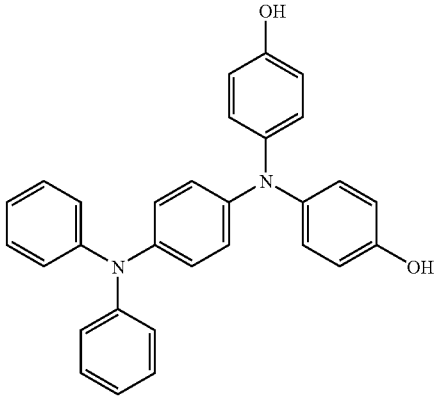

No. 7

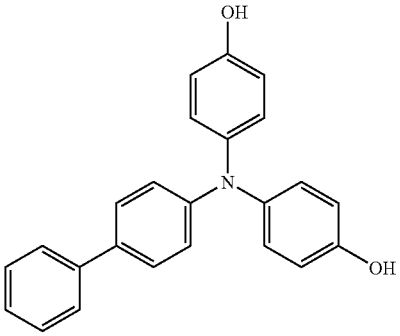

No. 8

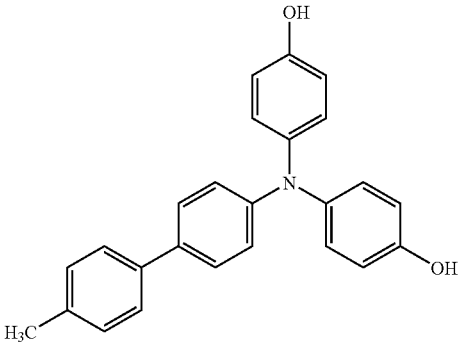

TABLE 37-continued
No. 9
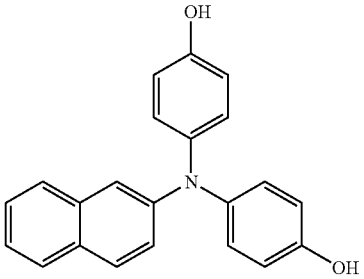
No. 10
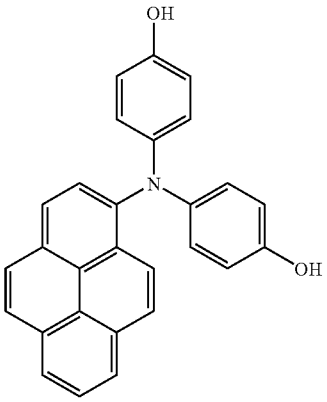
TABLE 37-continued
No. 11
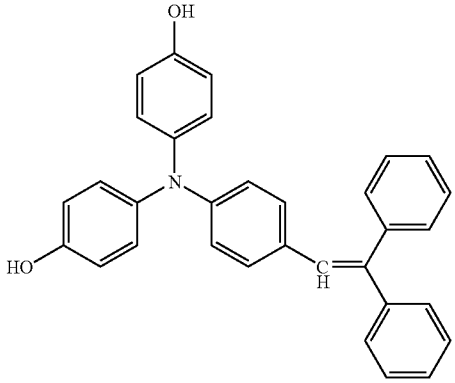
No. 12
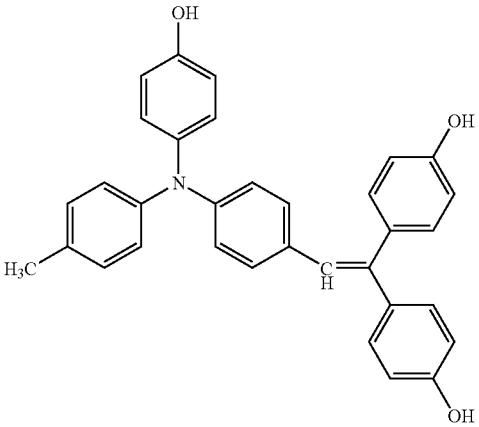
TABLE 38
No. 13
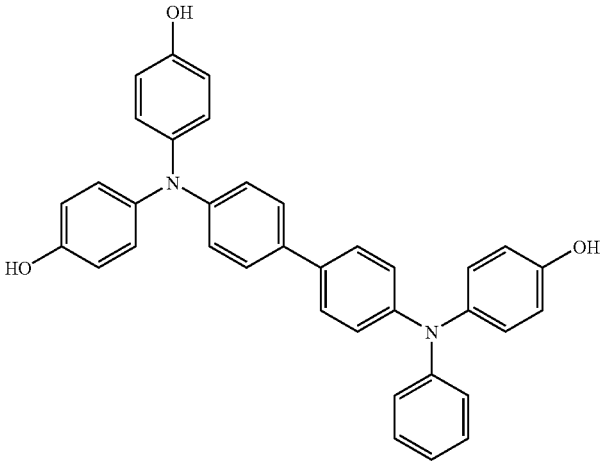

TABLE 38-continued
No. 14
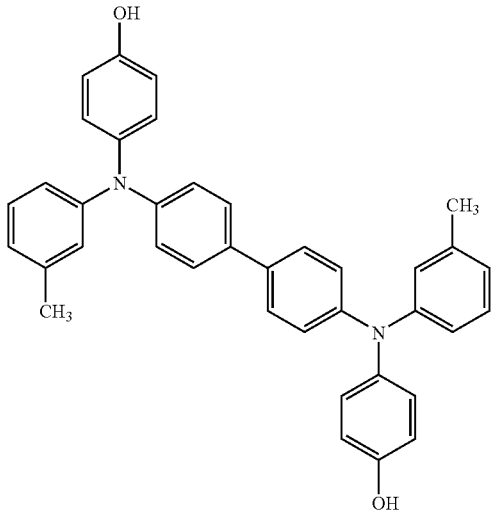
No. 15
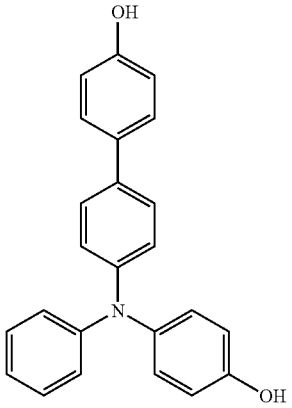
No. 16
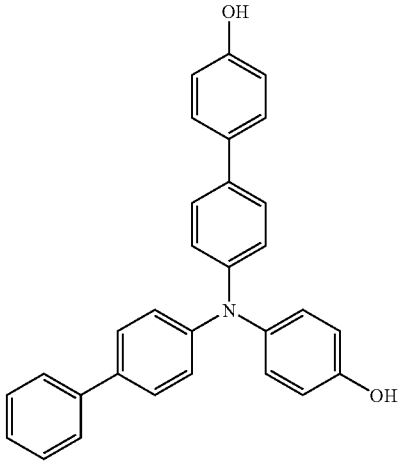

TABLE 38-continued
No. 17
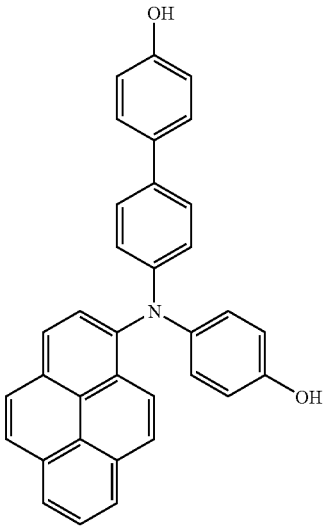
No. 18
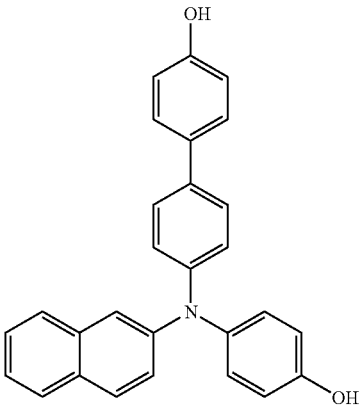
No. 19
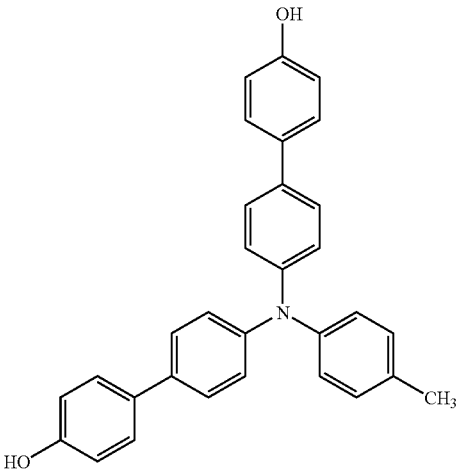

TABLE 38-continued
No. 20
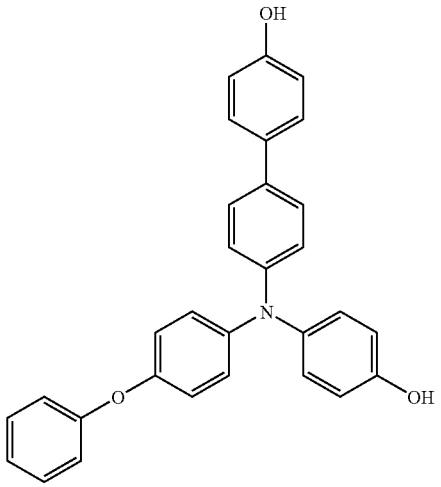
No. 21
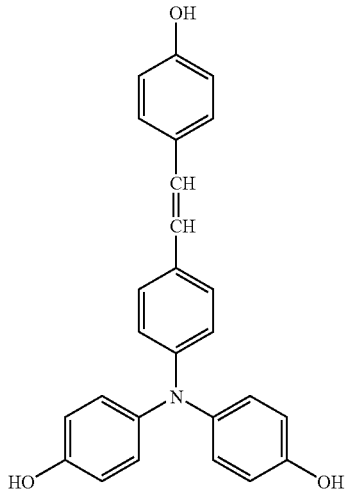
TABLE 39
No. 22
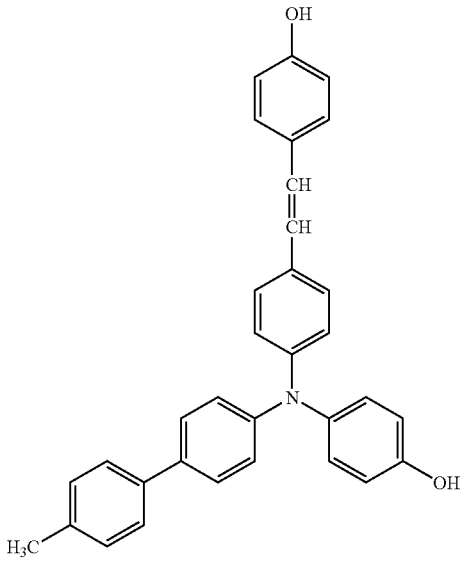

TABLE 39-continued
No. 23
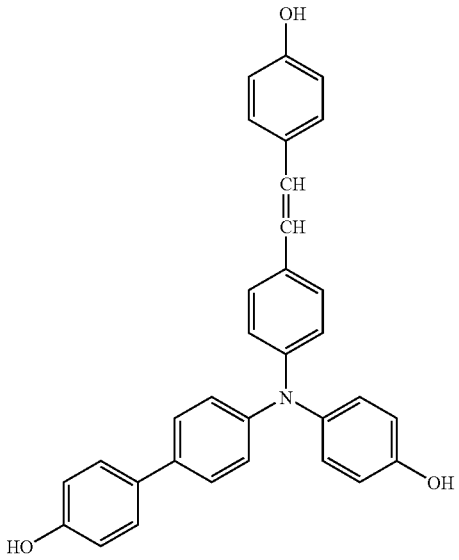
No. 24
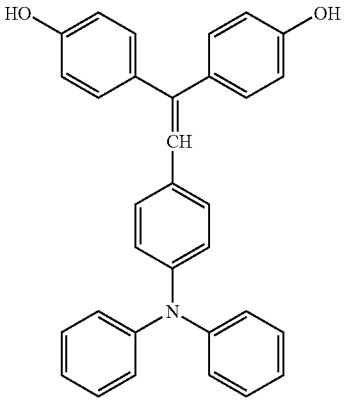
No. 25
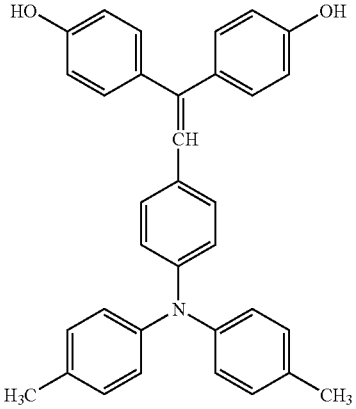

TABLE 39-continued
No. 26
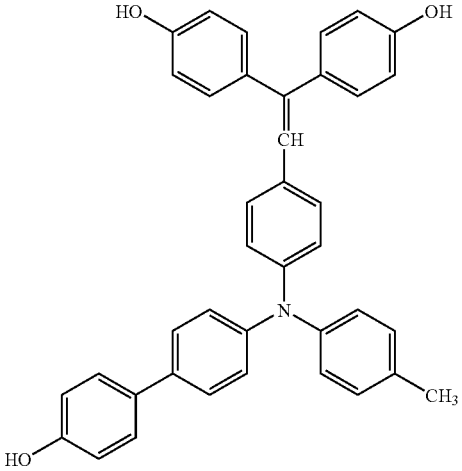
No. 27
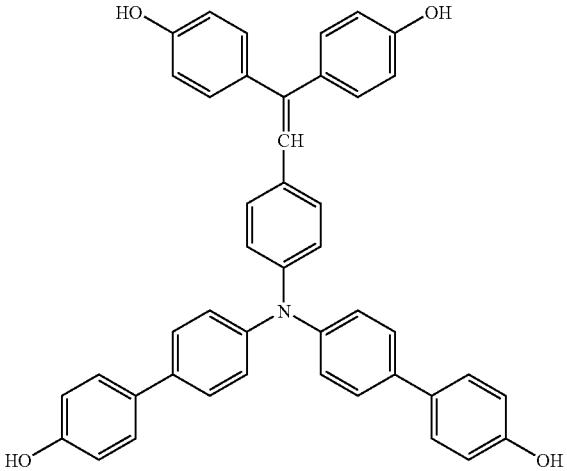
No. 28
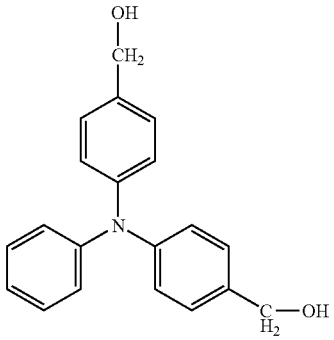
No. 29
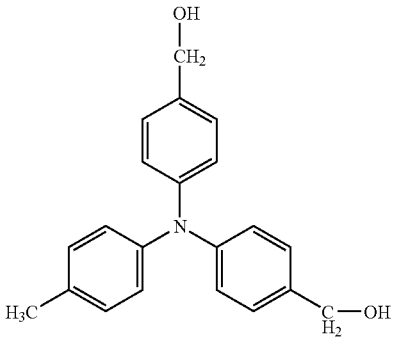

TABLE 39-continued
No. 30
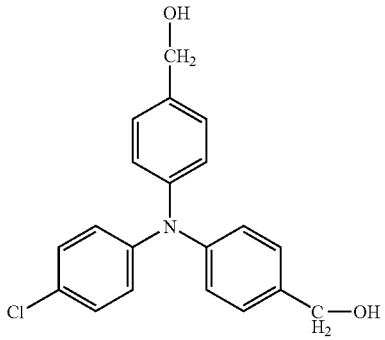
TABLE 40
No. 31
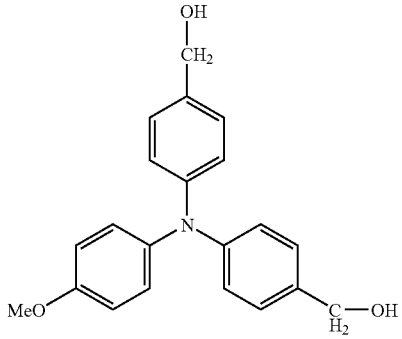
No. 32
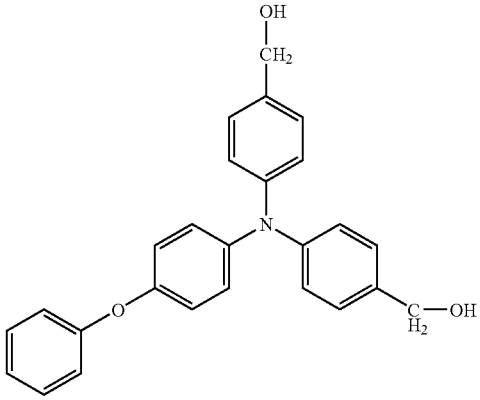
No. 33
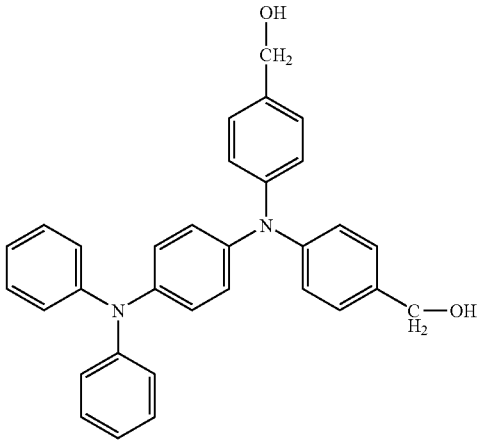
TABLE 40-continued
No. 34
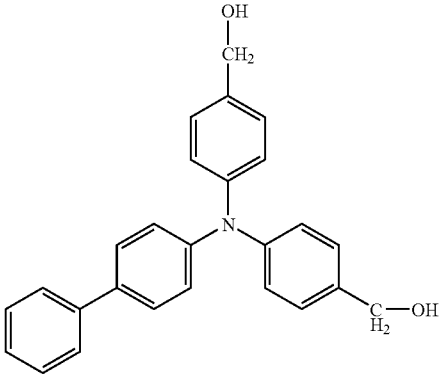
No. 35
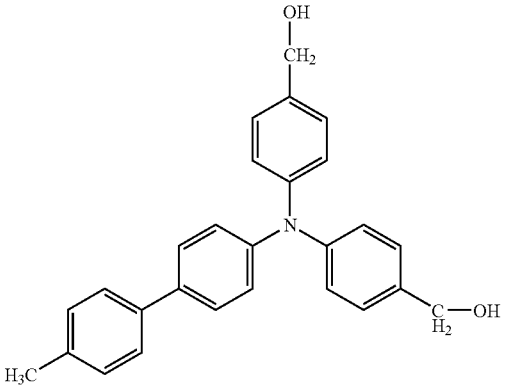

TABLE 40-continued
No. 36
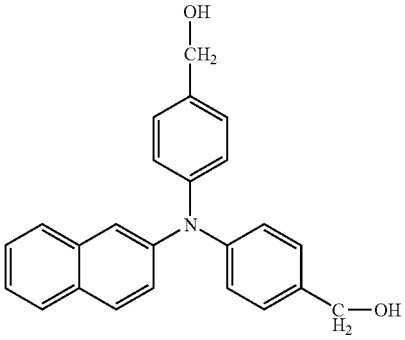
No. 37
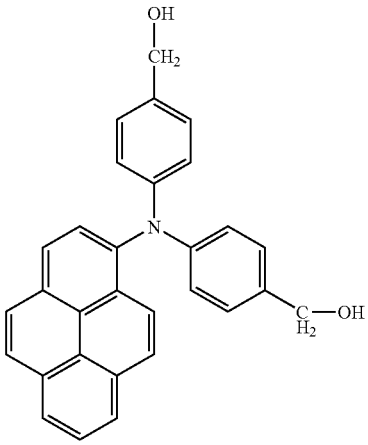
TABLE 40-continued
No. 38
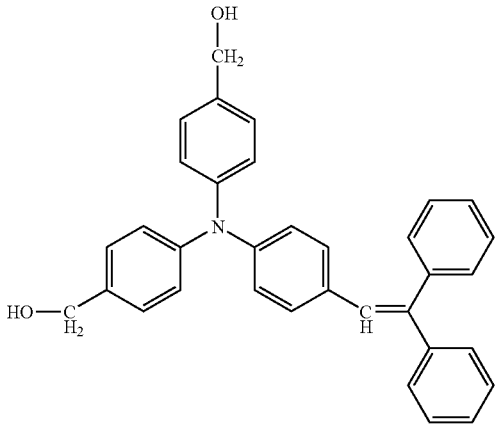
No. 39
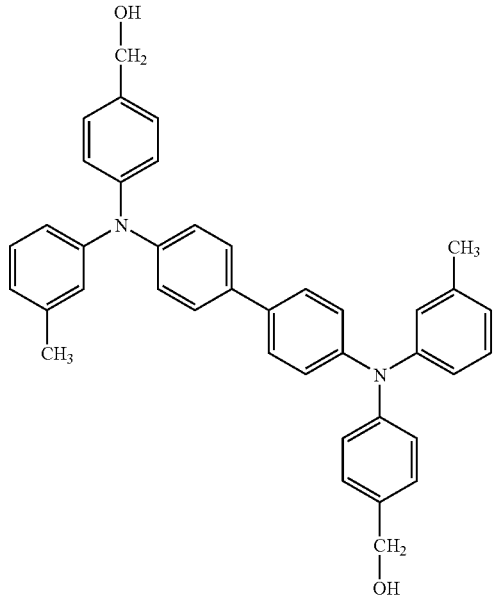
TABLE 41
No. 40
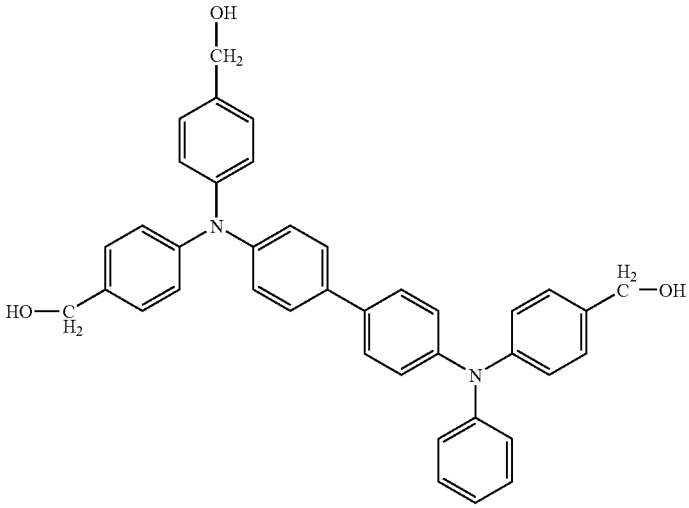

TABLE 41-continued
No. 41
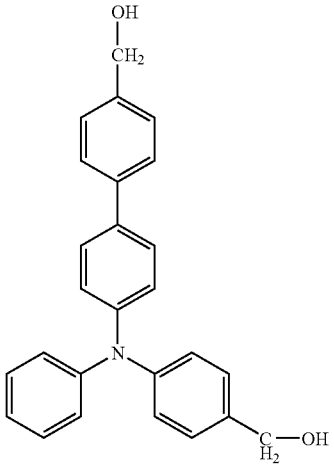
No. 42
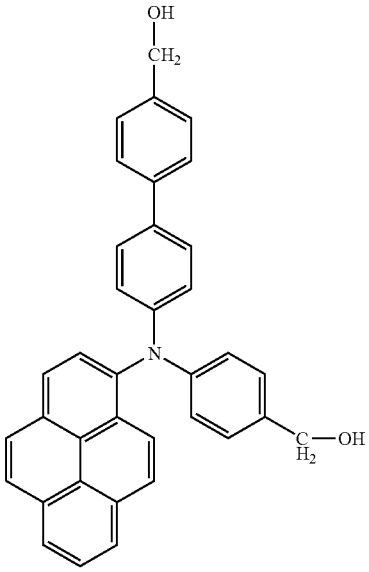
No. 43
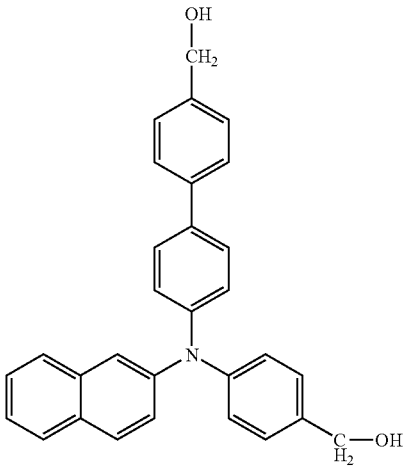

TABLE 41-continued
No. 44
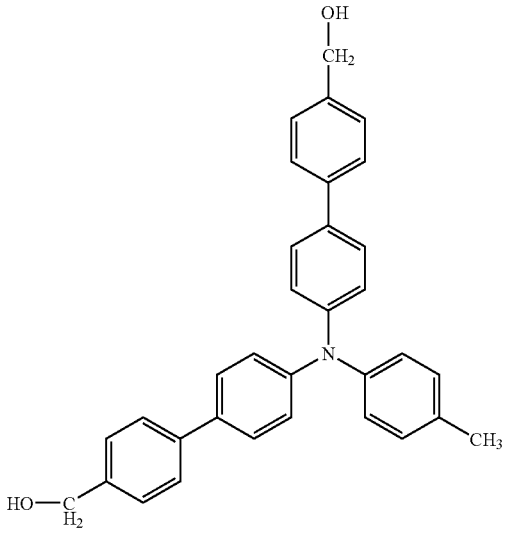
No. 45
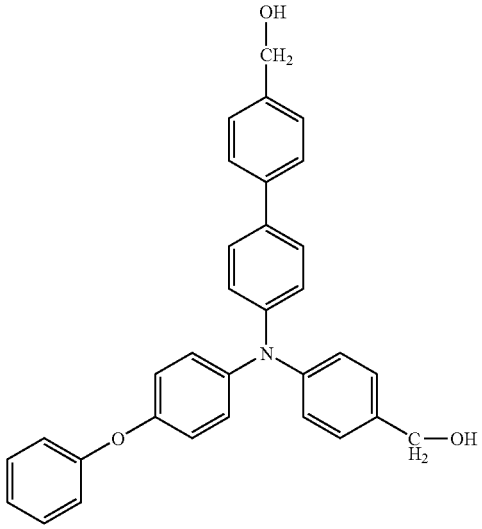
No. 46
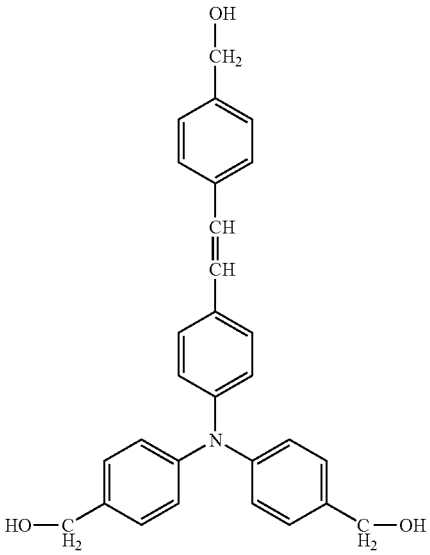

TABLE 41-continued
No. 47
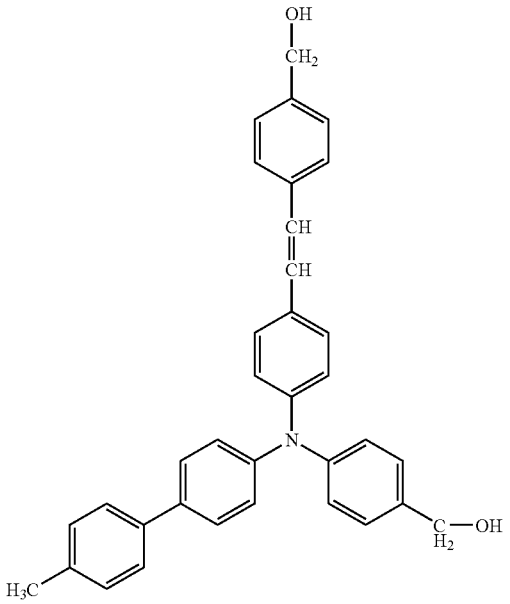
No. 48
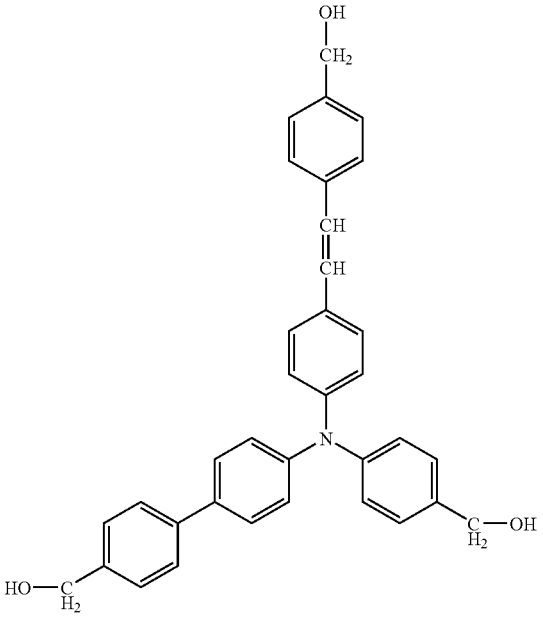

TABLE 42
No. 49
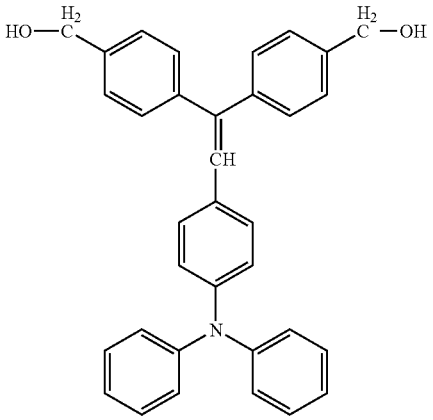
No. 50
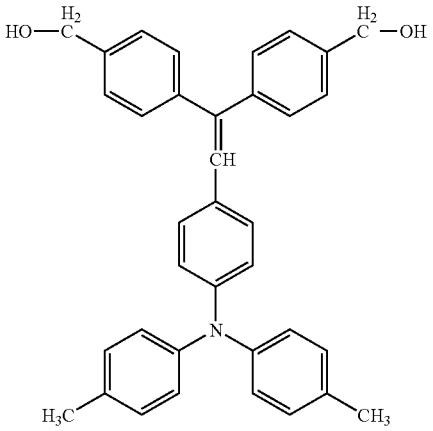
No. 51
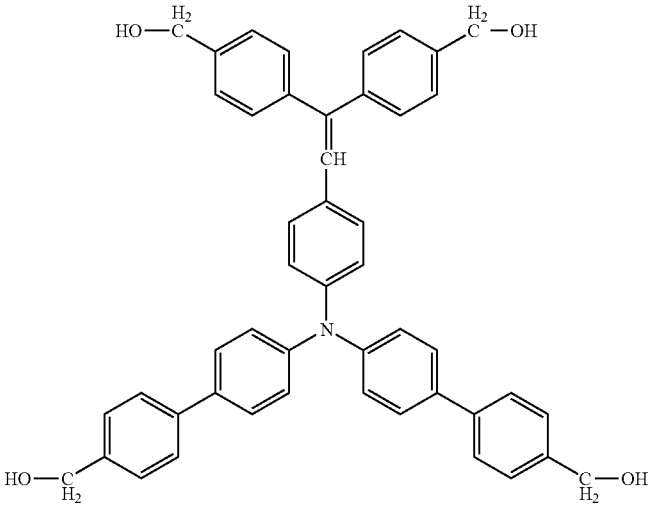

TABLE 42-continued

No. 52

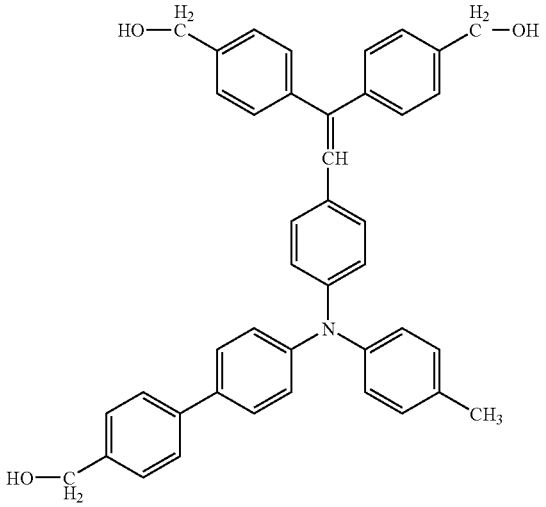

In contrast to pendant-shaped polymer structure like reactive charge transporting substances having only one hydroxyl group, these reactive charge transporting substances as typified by the compounds listed above constitute structure in which the charge transporting compound group in the molecular is surrounded by a plurality of polyurethane bonds. More specifically, since these compounds are reacted with a polyfunctional isocyanate compound to form network structure, the resultant resin film offers much greater wear resistance than the polyurethane resin film formed using a reactive charge transporting substance having only one hydroxyl group. When these reactive charge transporting substances are used, however, the charge transporting compound group is incorporated as a main chain of the polyurethane chain. Moreover, the conformational freedom between the charge transporting compound group and polyurethane bonds becomes very small, increasing the likelihood that steric strain occurs due to the secondary structures of polyurethane chains formed upon formation of resin layer. This steric strain leads to weak π electron conjugated systems in the charge transporting compound group, resulting in increased ionization potential and reduced charge transportability. This may cause troubles such as reduced sensitivity and increased residual potential in some cases.

More preferred reactive charge transporting substances employed in the present invention are listed in the Table below.

TABLE 43

No. 53

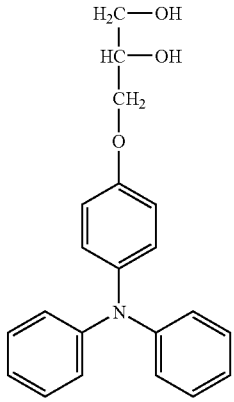

No. 54

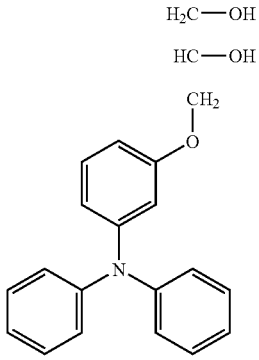

TABLE 43-continued
No. 55
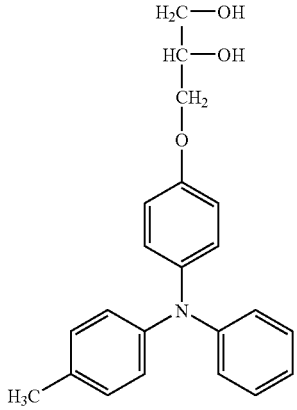
No. 56
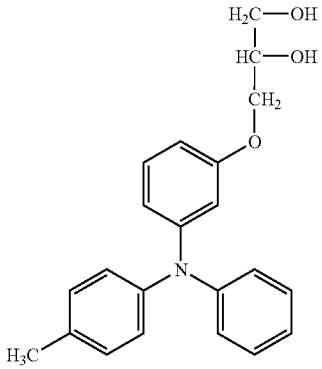
No. 57
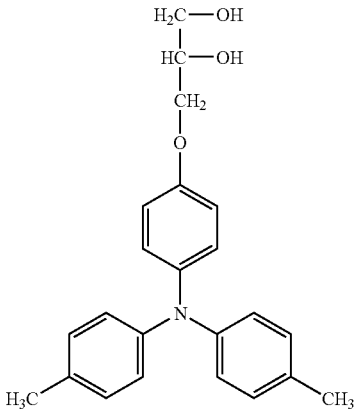
No. 58
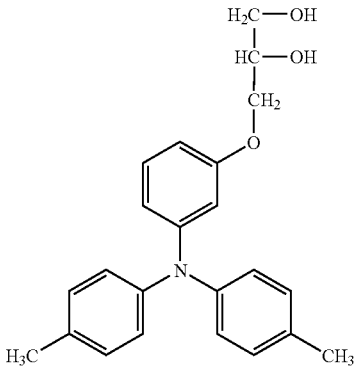
TABLE 43-continued
No. 59
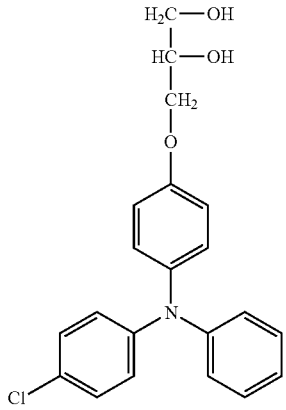
No. 60
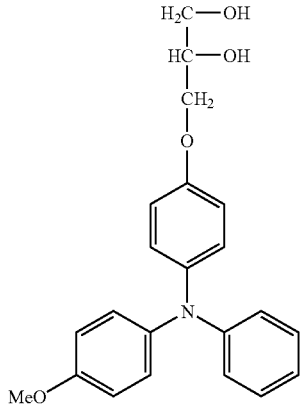
No. 61
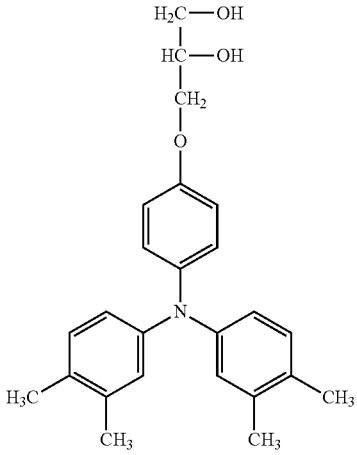

TABLE 43-continued
No. 62
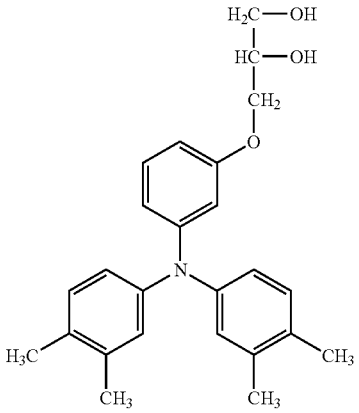
No. 63
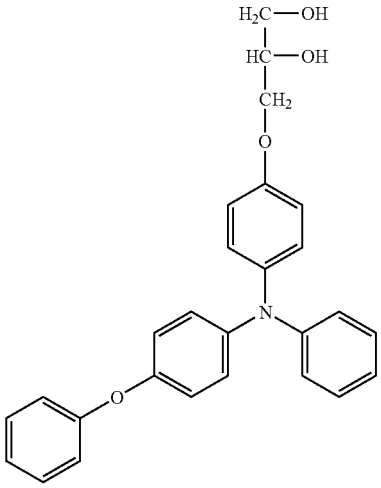
No. 64
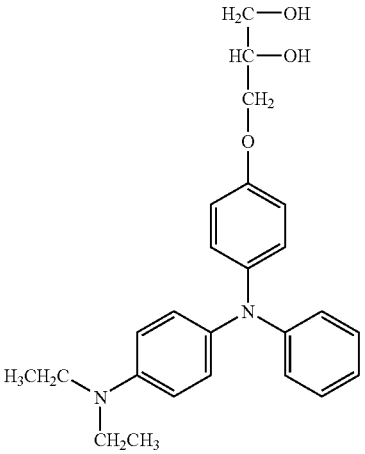
TABLE 43-continued
No. 65
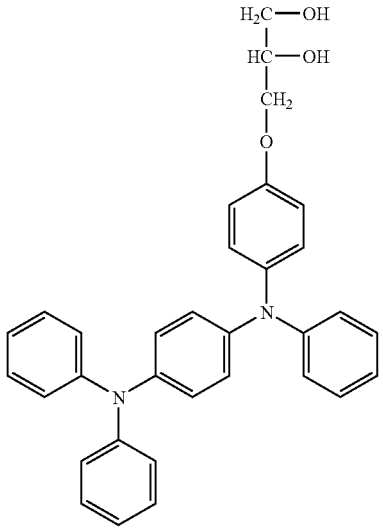
No. 66
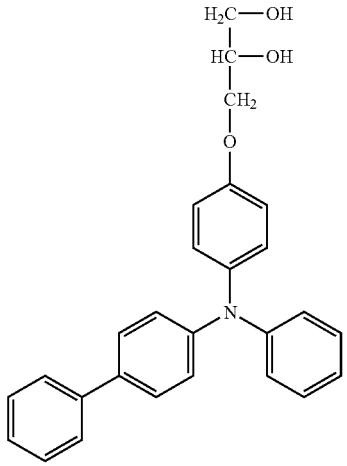

TABLE 43-continued
No. 67
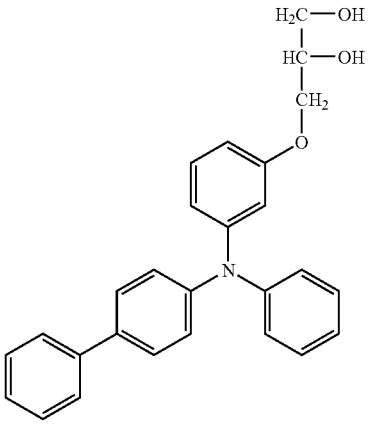
TABLE 43-continued
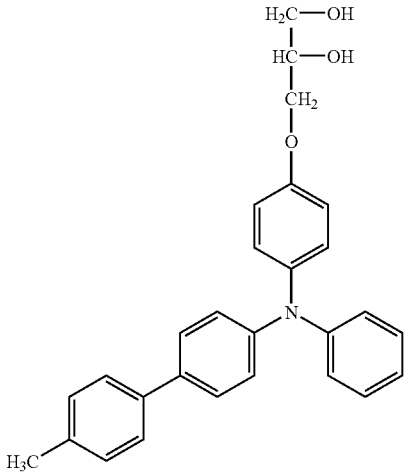
TABLE 44
No. 69
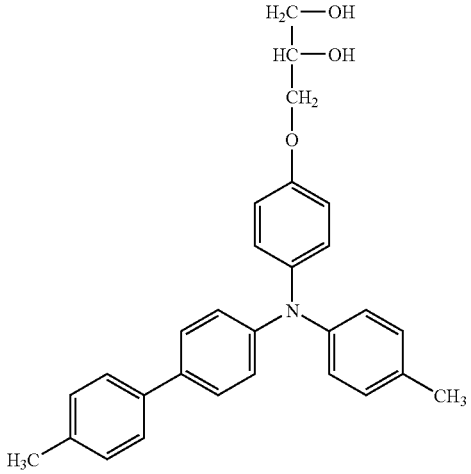
No. 70
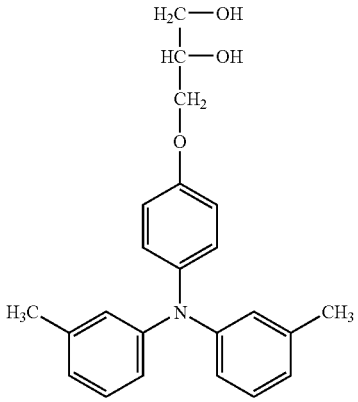

TABLE 44-continued
No. 71
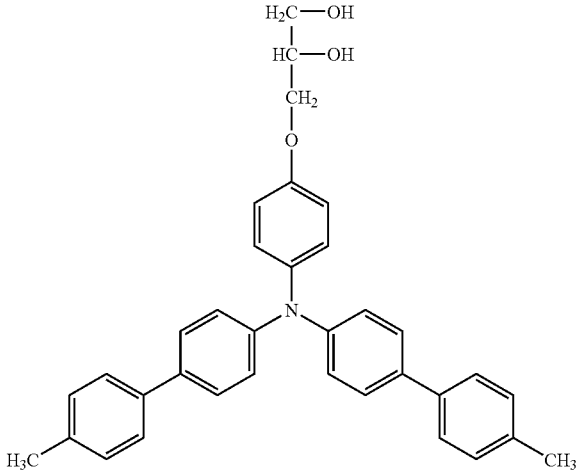
No. 72
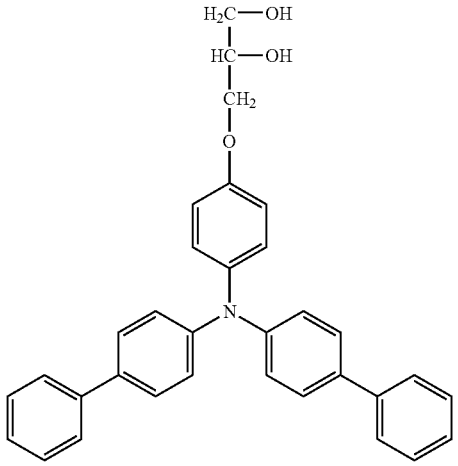
No. 73
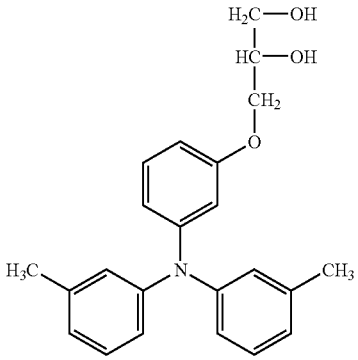

TABLE 44-continued
No. 74
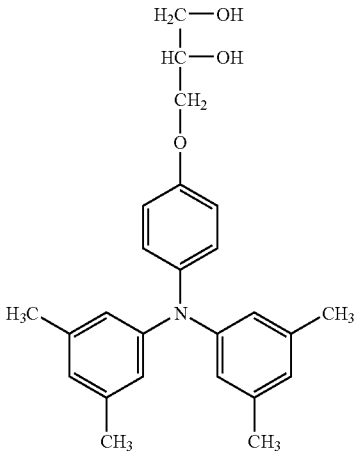
No. 75
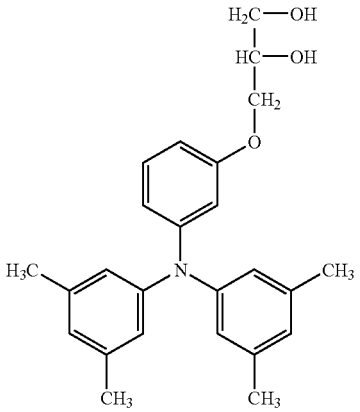
No. 76
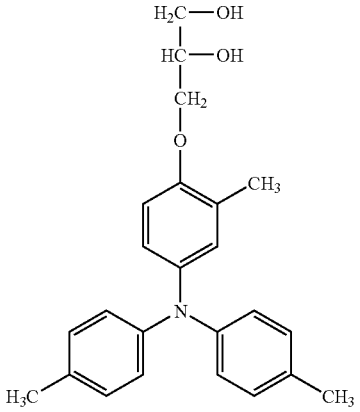

TABLE 44-continued
No. 77
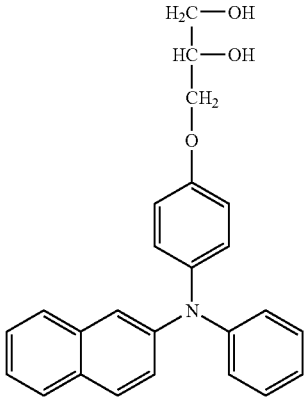
No. 78
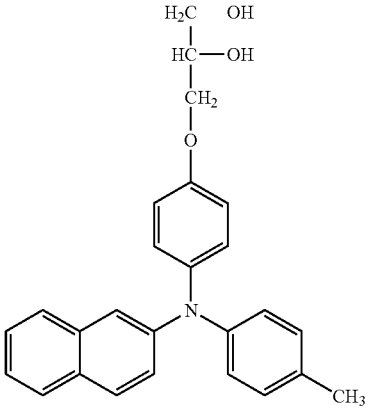
No. 79
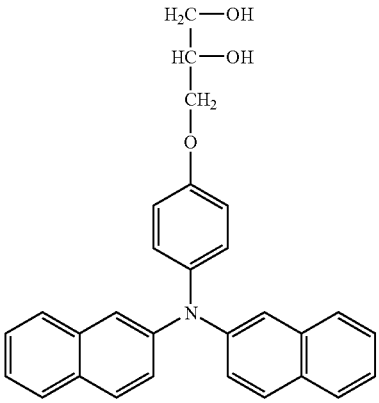

TABLE 44-continued
No. 80
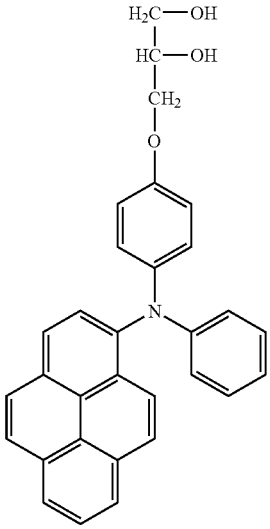
No. 81
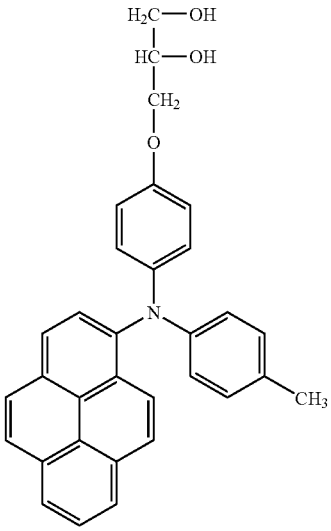

TABLE 44-continued
No. 82
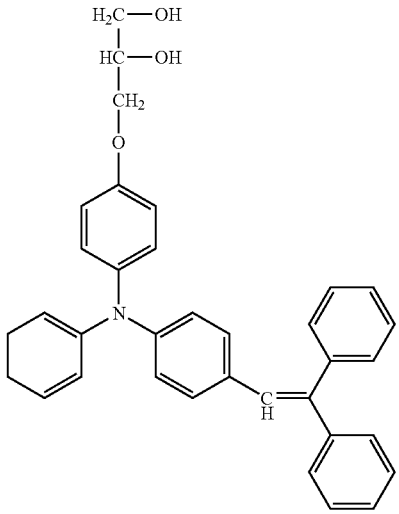
No. 83
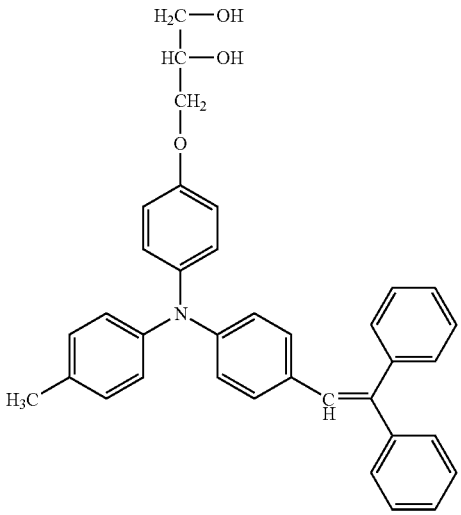

TABLE 45
No. 84
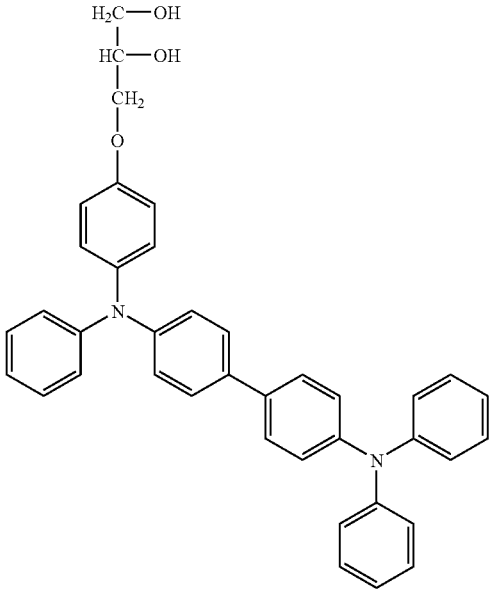
No. 85
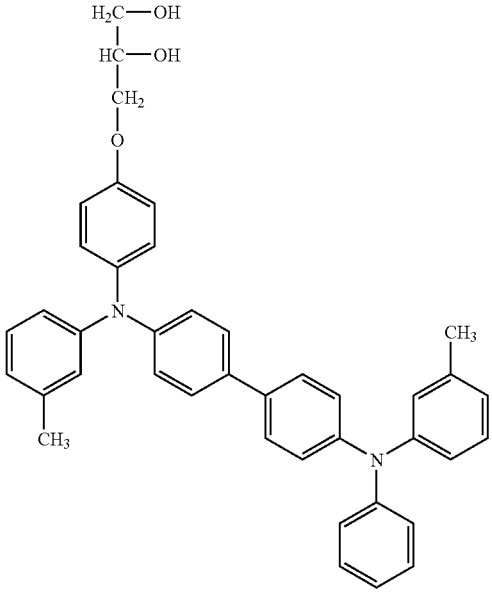
TABLE 45-continued
No. 86
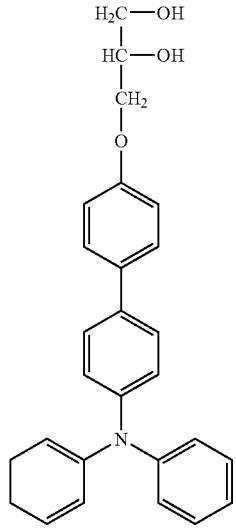
No. 87
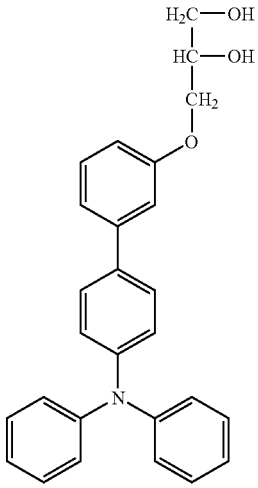
No. 88
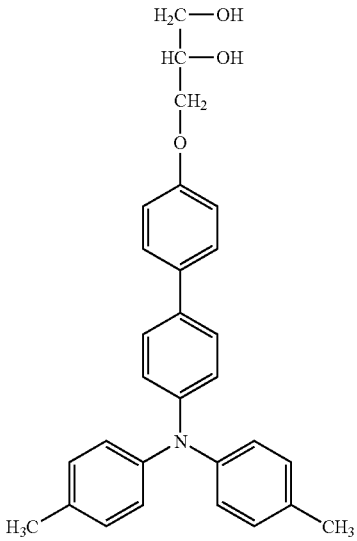

TABLE 45-continued
No. 89
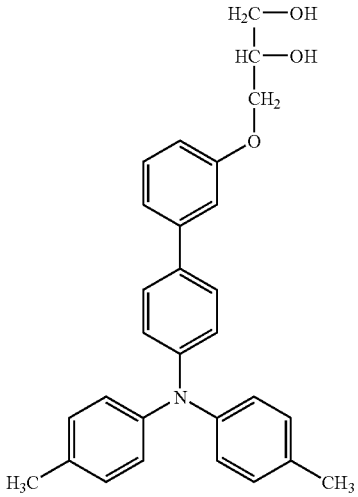
No. 90
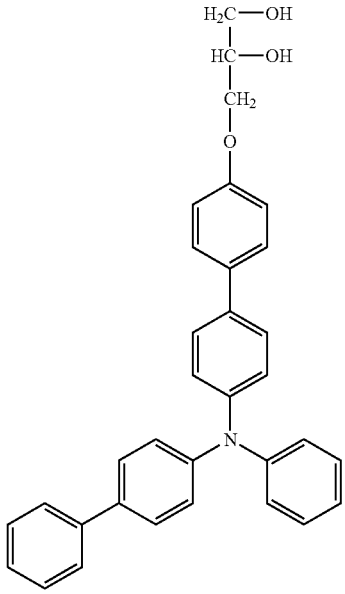
TABLE 45-continued
No. 91
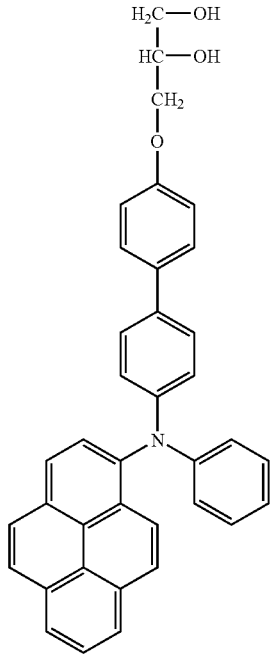
No. 92
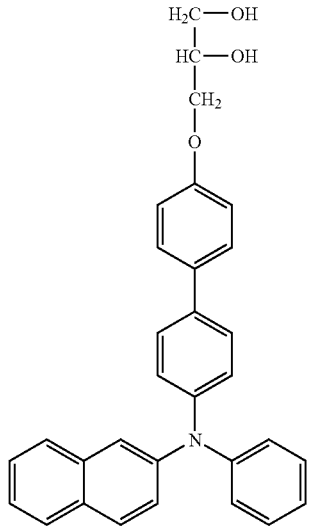

TABLE 45-continued
No. 93
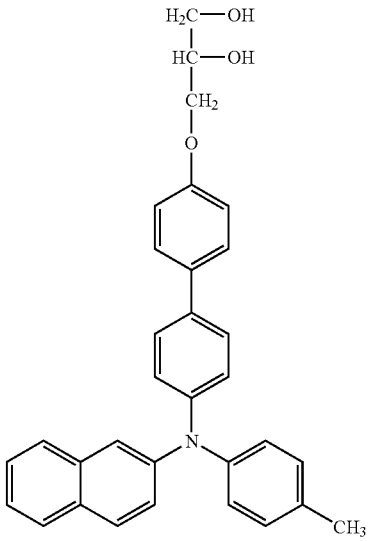
No. 94
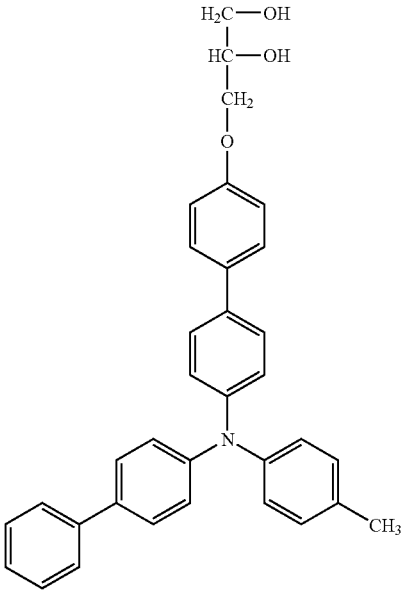
TABLE 46
No. 95
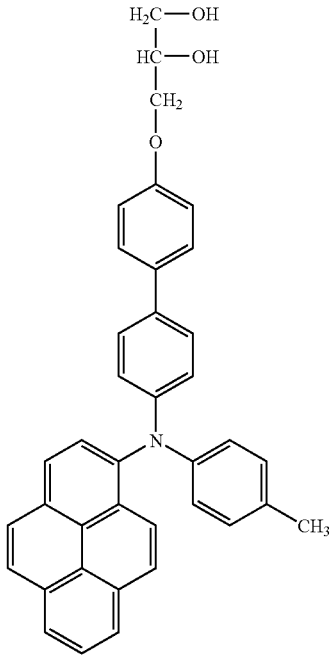
No. 96
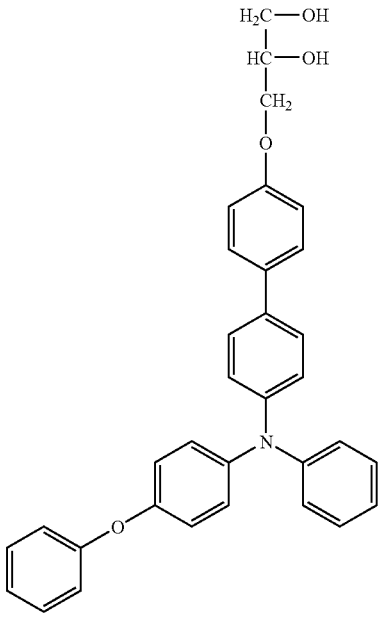

TABLE 46-continued
No. 97
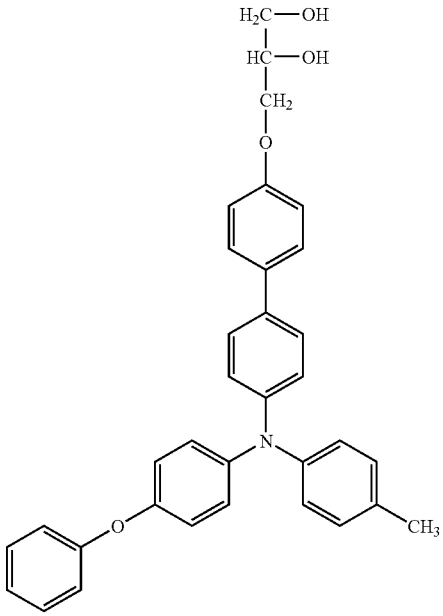
No. 98
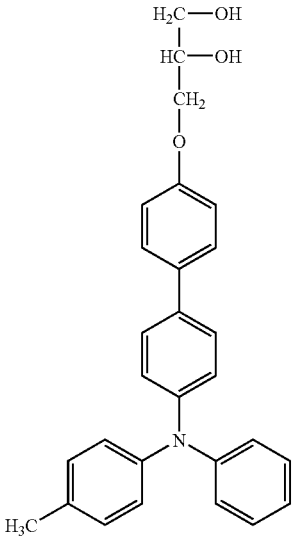
TABLE 46-continued
No. 99
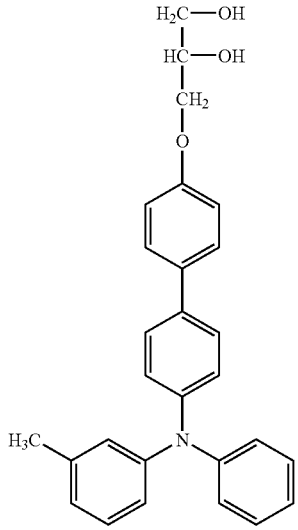
No. 100
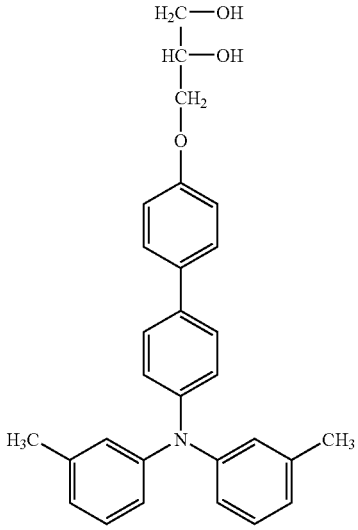
No. 101
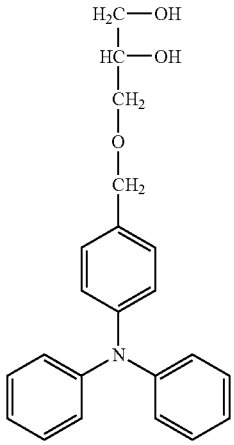

TABLE 46-continued
No. 102
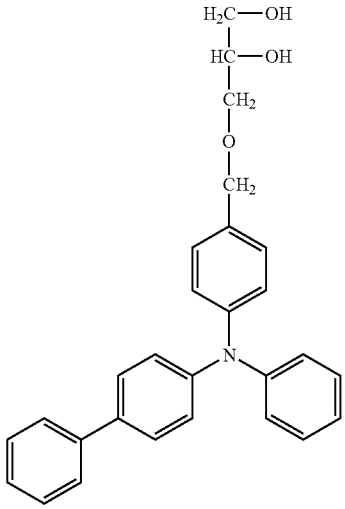
No. 103
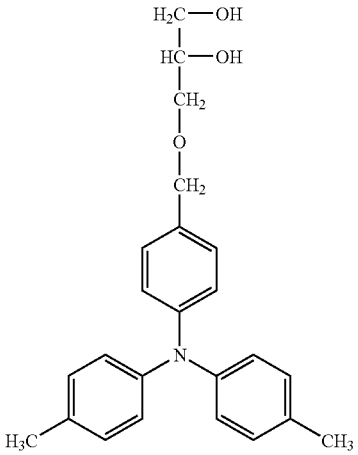
No. 104
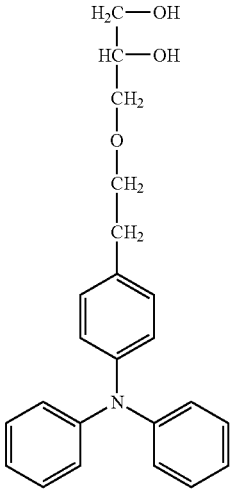
TABLE 46-continued
No. 105
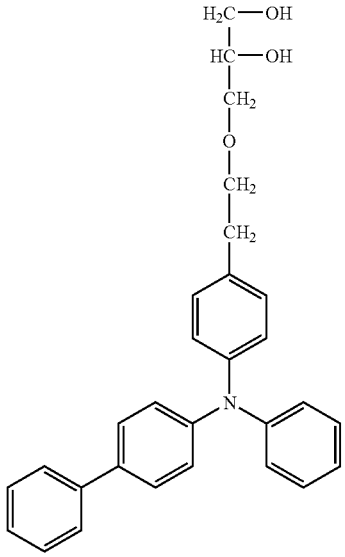
No. 106
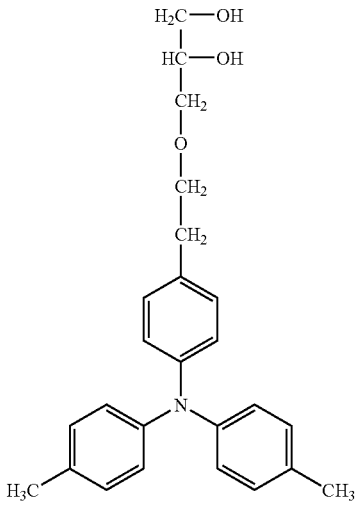

TABLE 47
No. 107
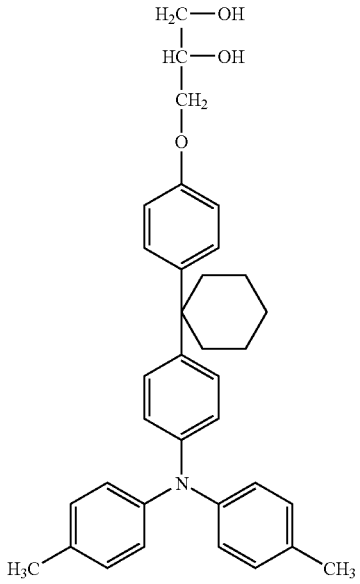
No. 108
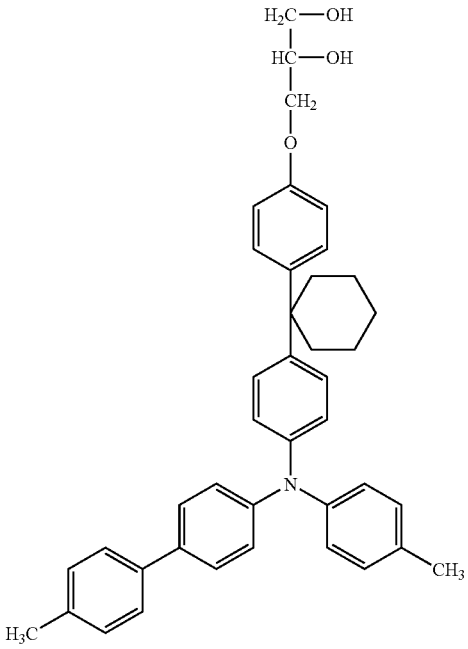
TABLE 47-continued
No. 109
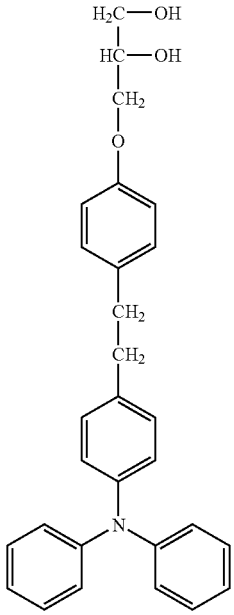
No. 110
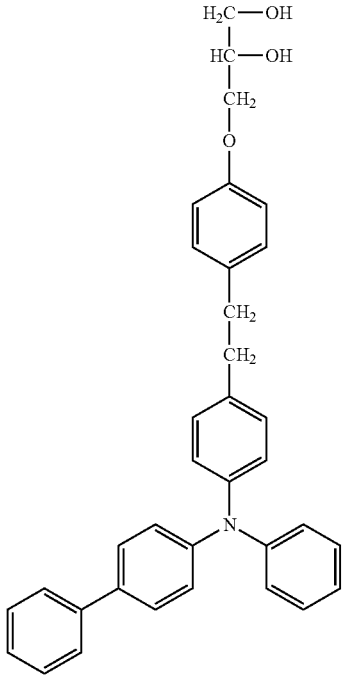

TABLE 47-continued
No. 111
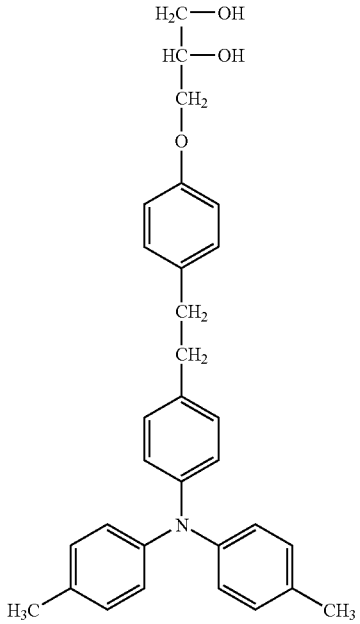
No. 112
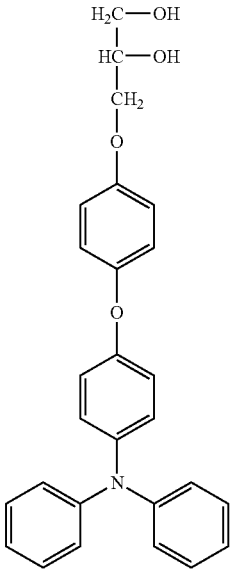
TABLE 47-continued
No. 113
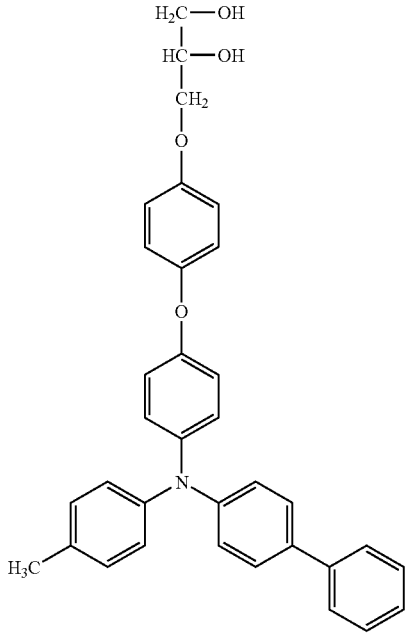
No. 114
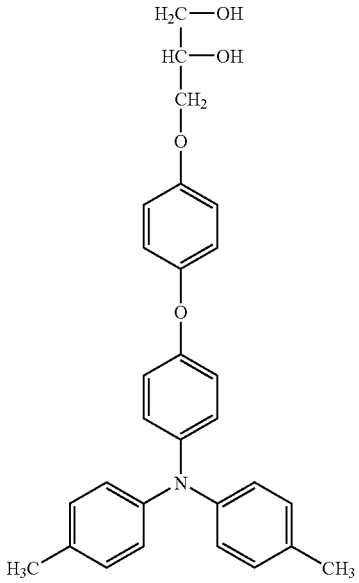

TABLE 47-continued
No. 115
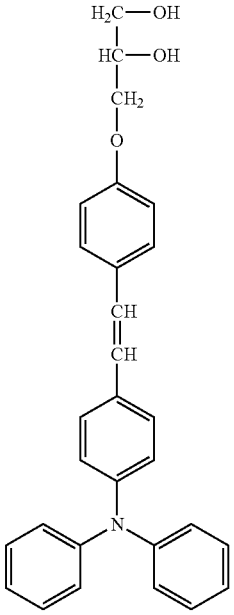
No. 116
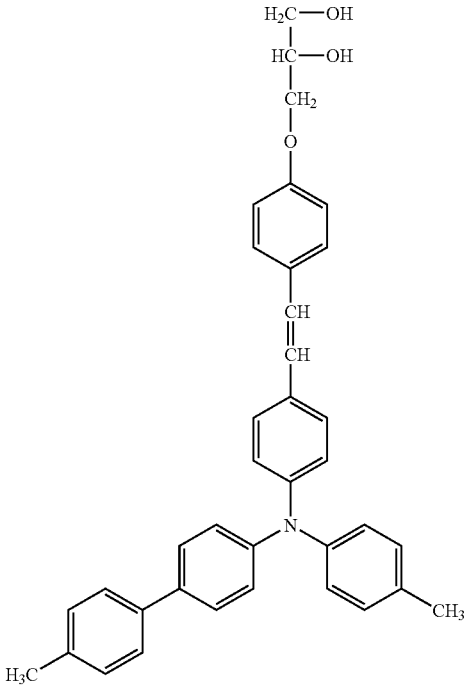
TABLE 47-continued
No. 117
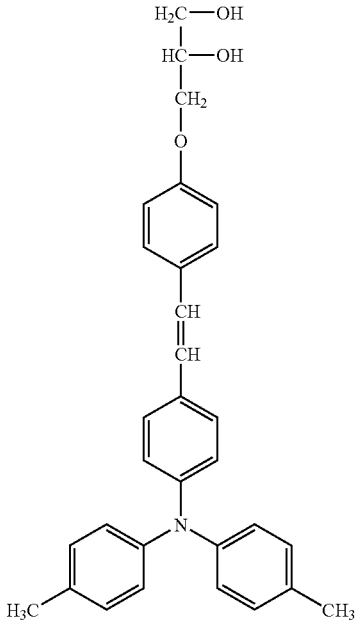
No. 118
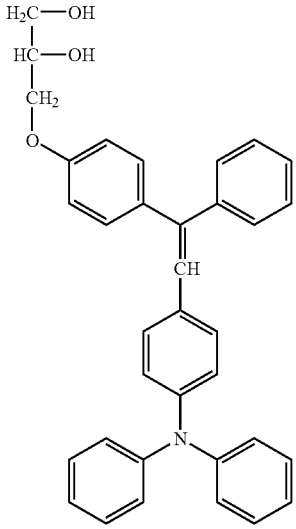

TABLE 48
No. 119
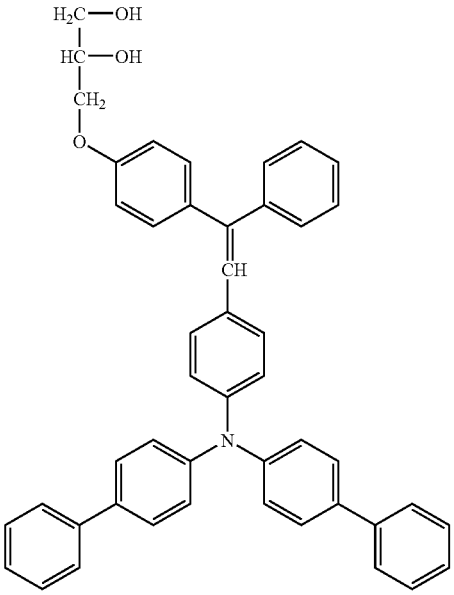
No. 120
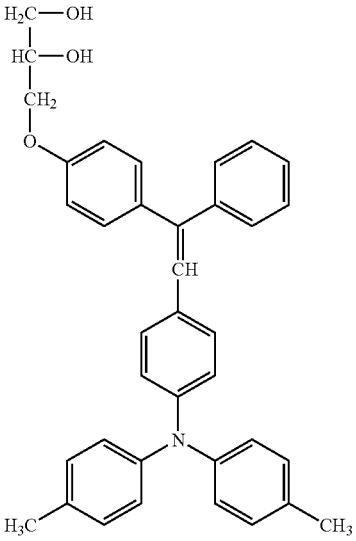
TABLE 48-continued
No. 121
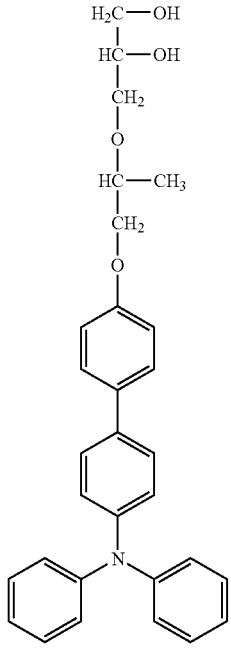
No. 122
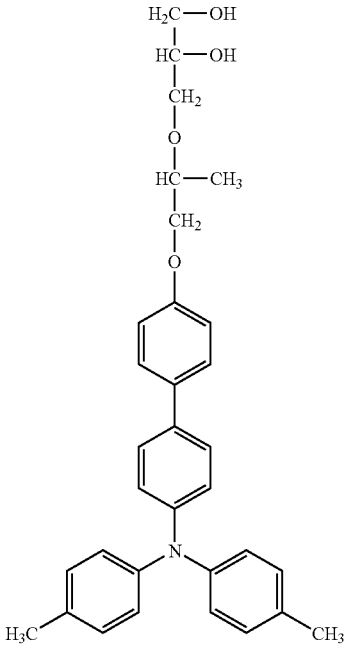

TABLE 48-continued
No. 123
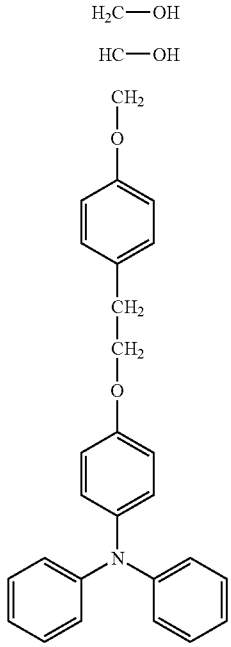
No. 124
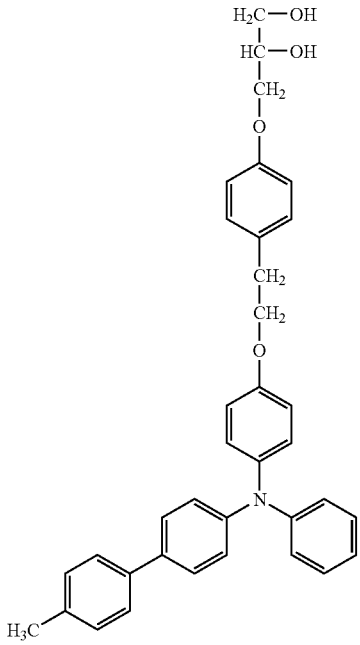
TABLE 48-continued
No. 125
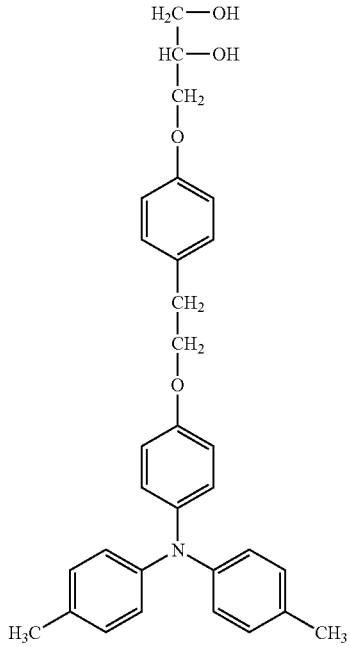
No. 126
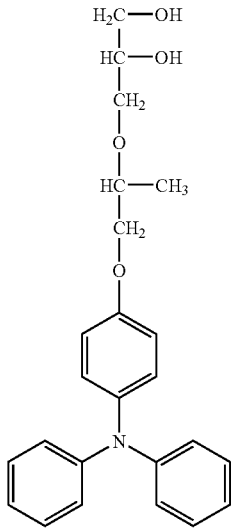

TABLE 48-continued
No. 127
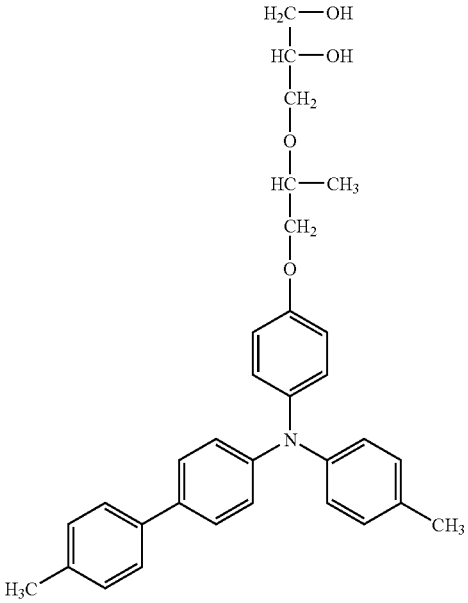
No. 128
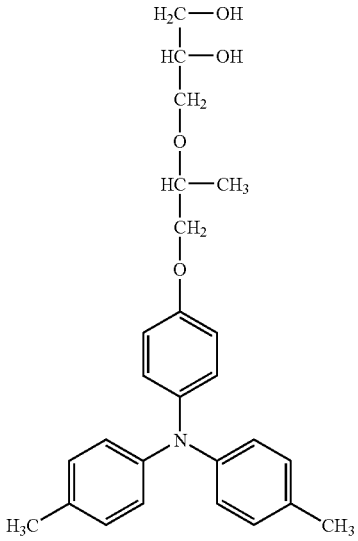
TABLE 48-continued
No. 129
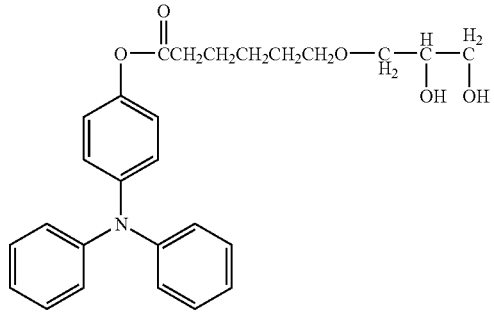
TABLE 49
No. 130
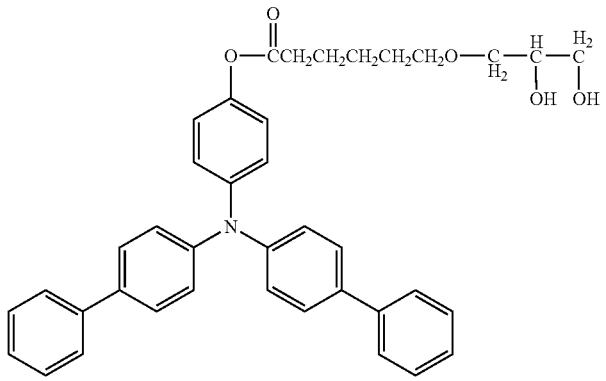

TABLE 49-continued
No. 131
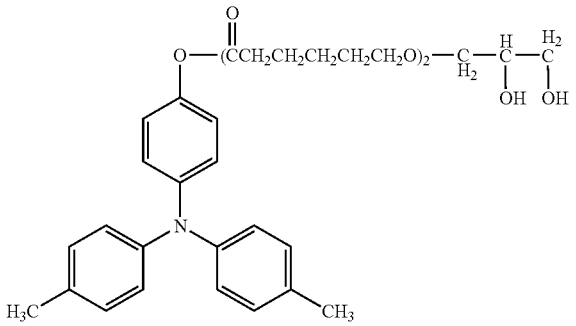
No. 132
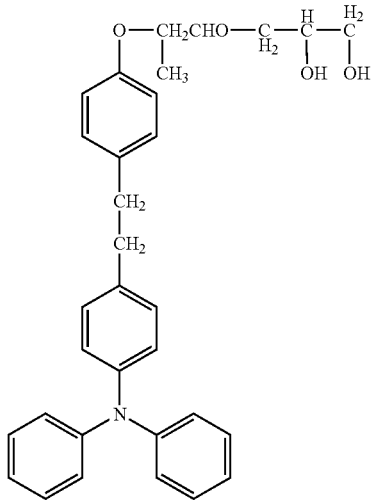
No. 133
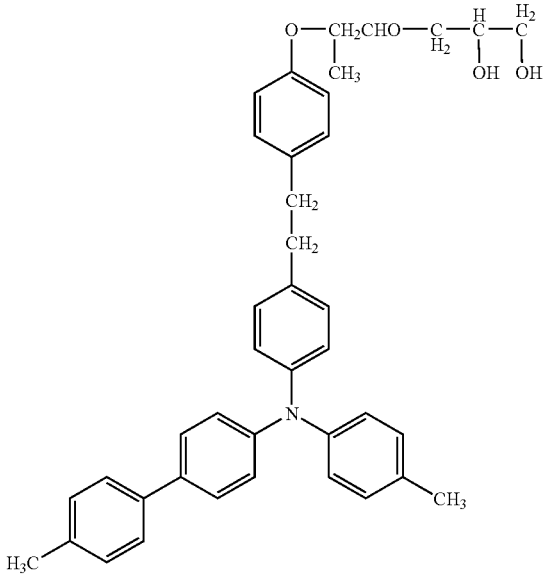

TABLE 49-continued
No. 134
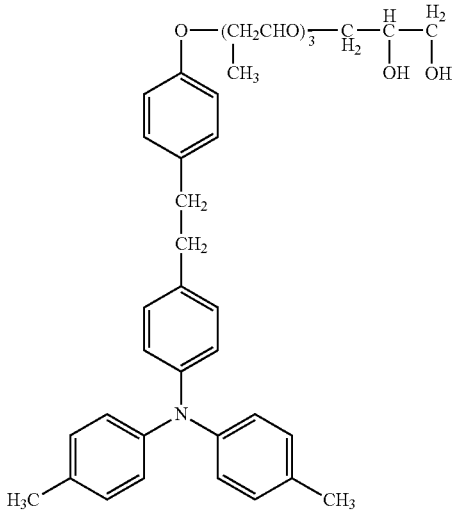
TABLE 50
No. 135
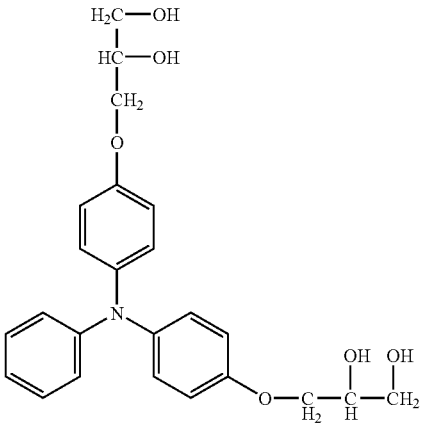
No. 136
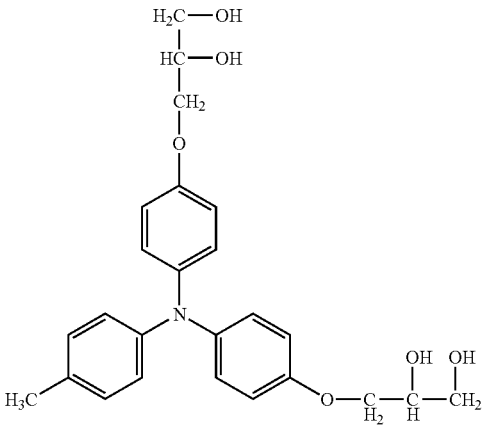

TABLE 50-continued
No. 137
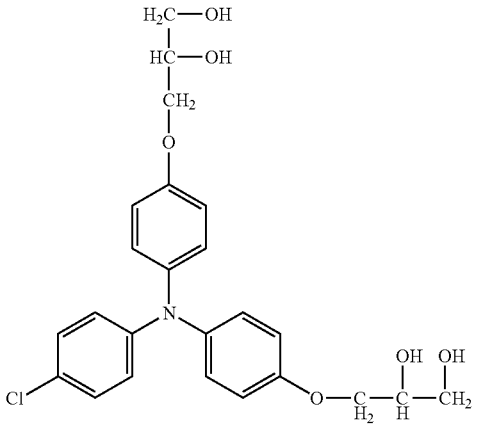
No. 138
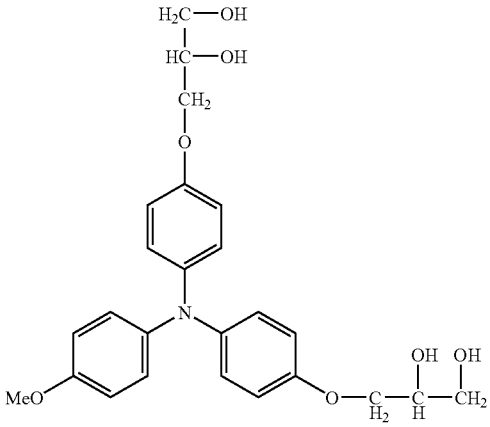
No. 139
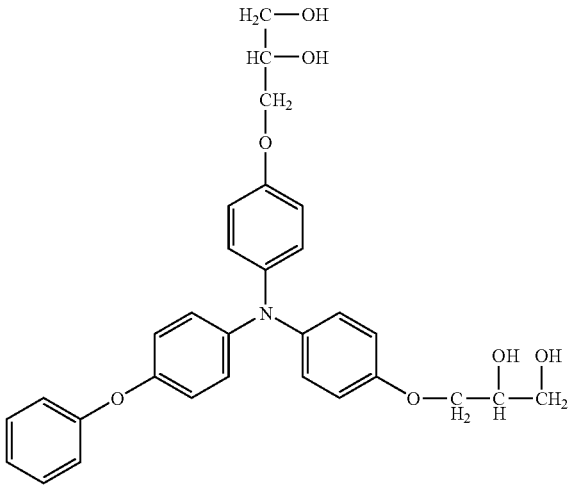

TABLE 50-continued
No. 140
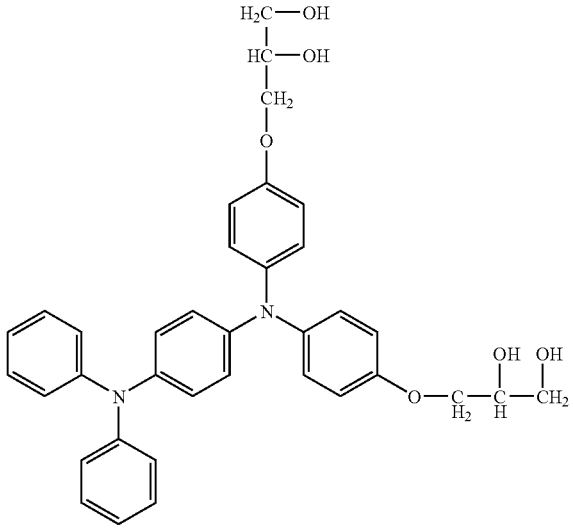
No. 141
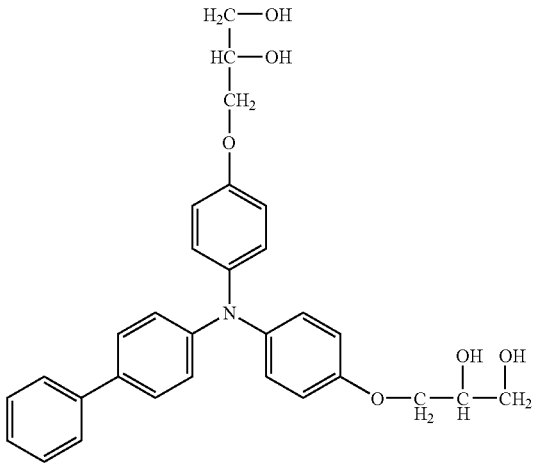
No. 142
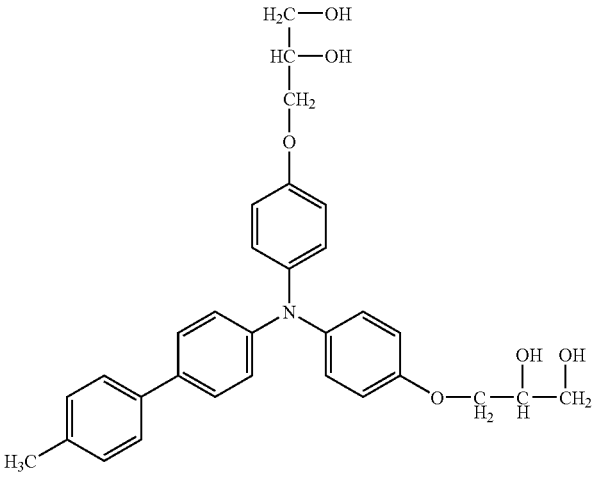

TABLE 50-continued
No. 143
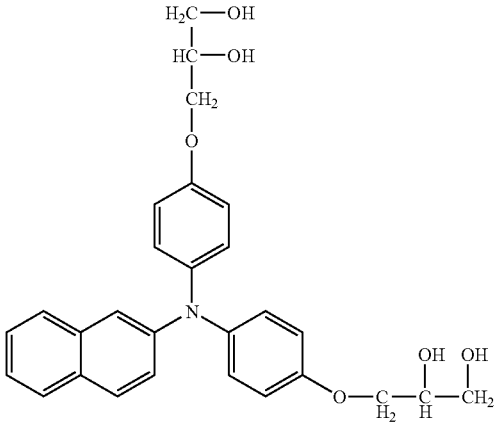
20
TABLE 51
No. 144
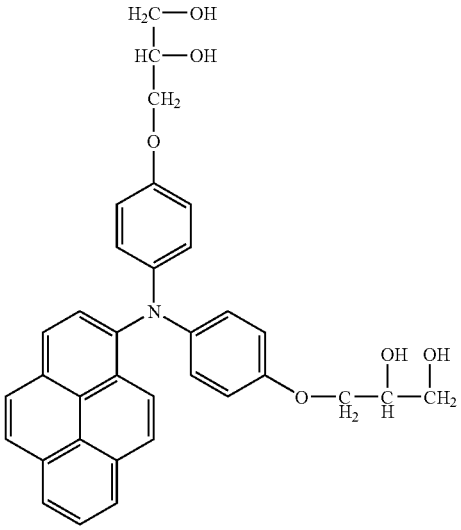
No. 145
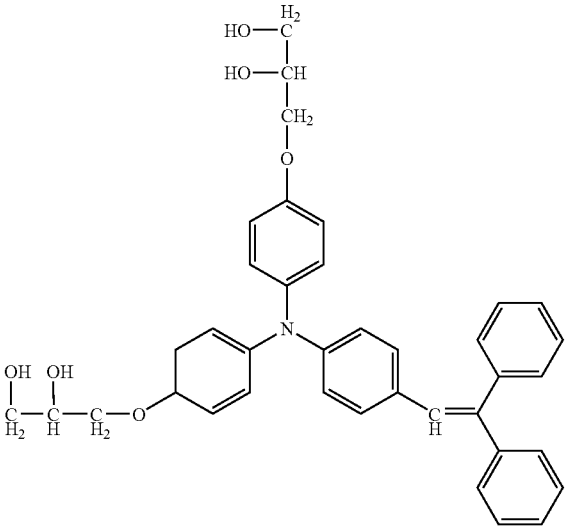

TABLE 51-continued
No. 146
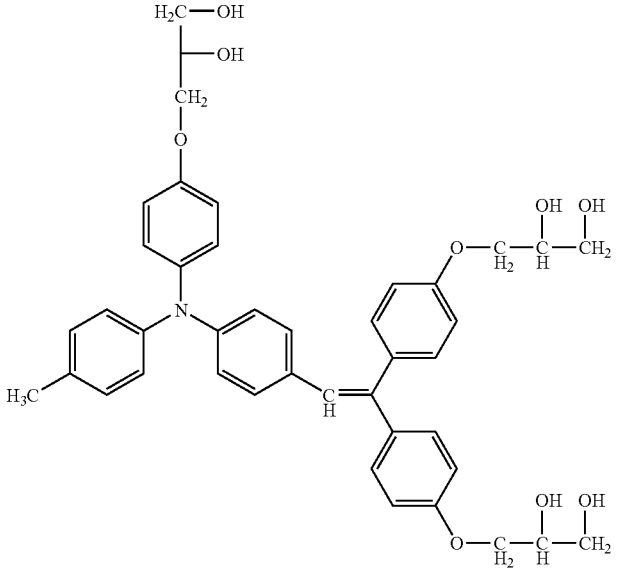
No. 147
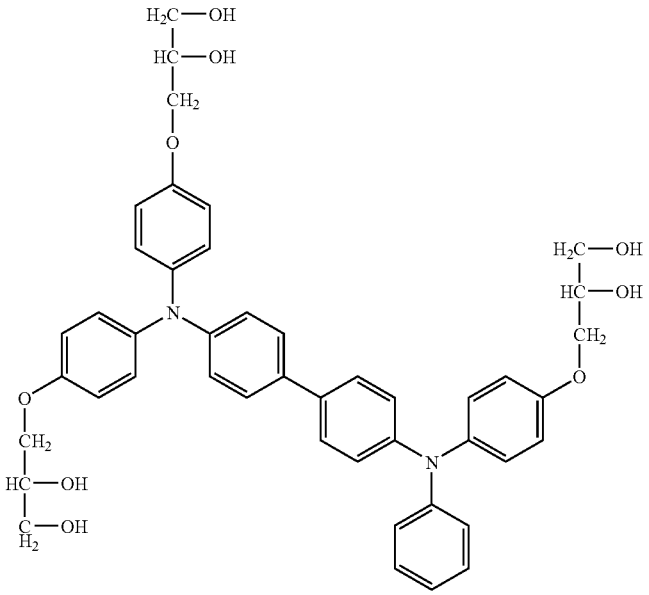

TABLE 51-continued
No. 148
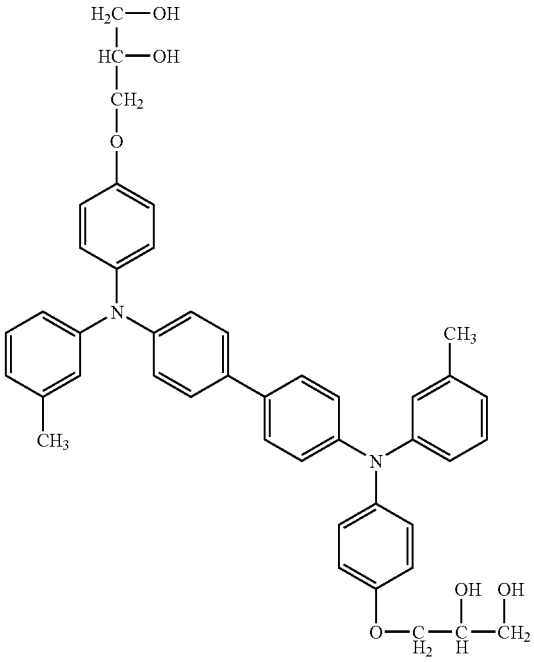
No. 149
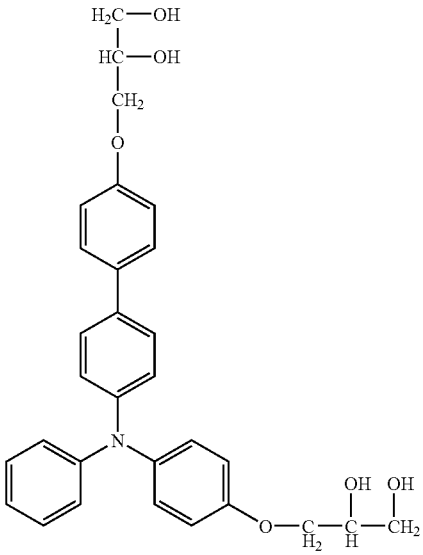

TABLE 51-continued
No. 150
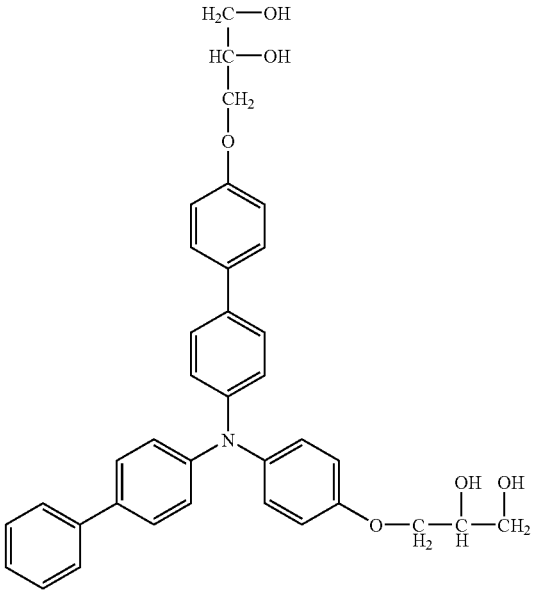
No. 151
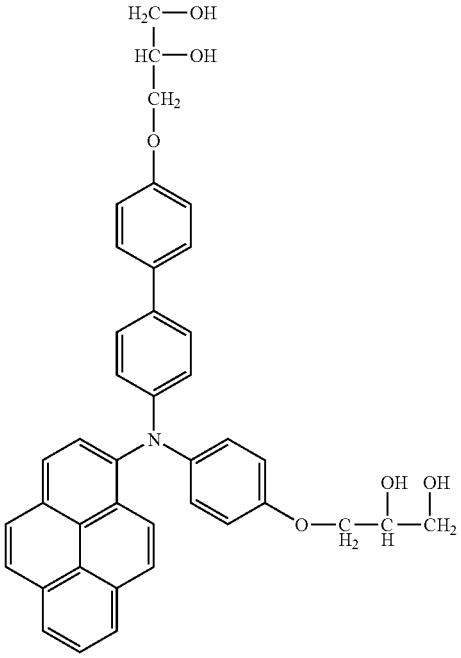

TABLE 51-continued
No. 152
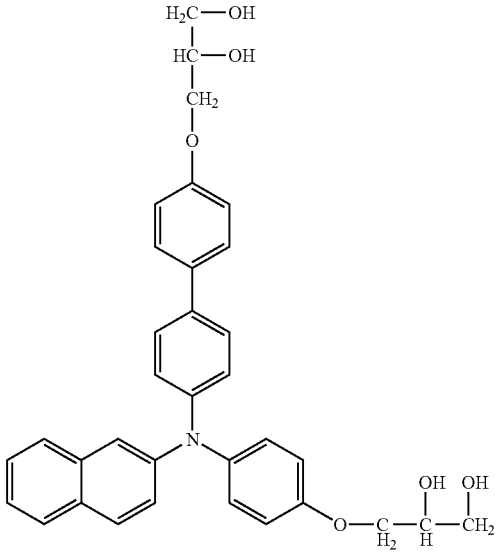
TABLE 52
No. 153
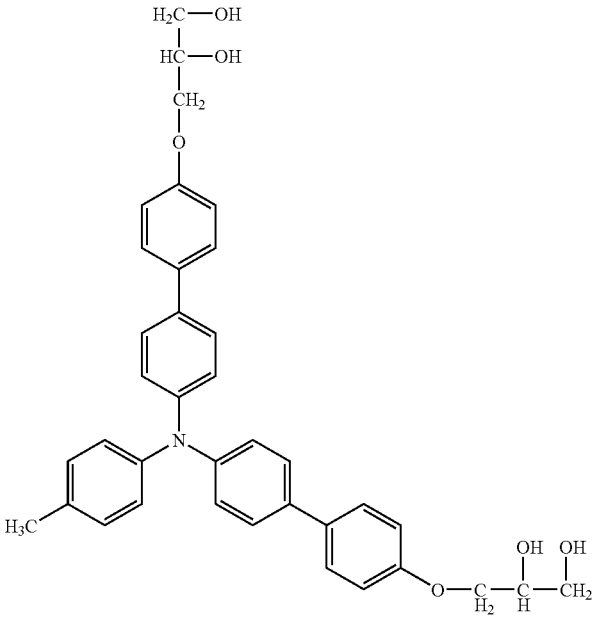

TABLE 52-continued
No. 154
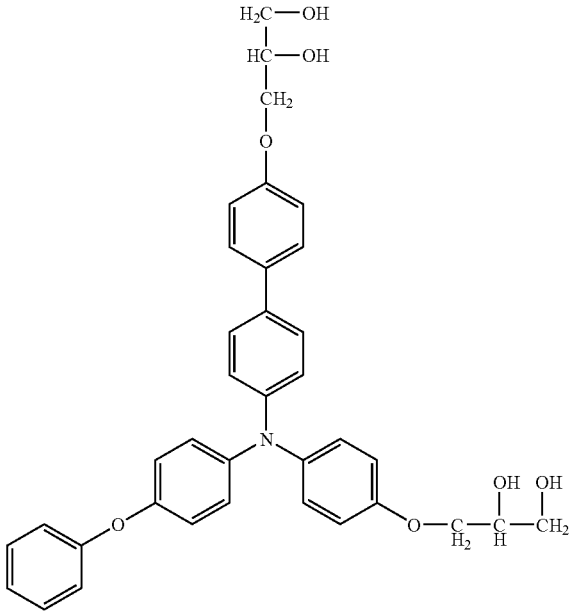
No. 156
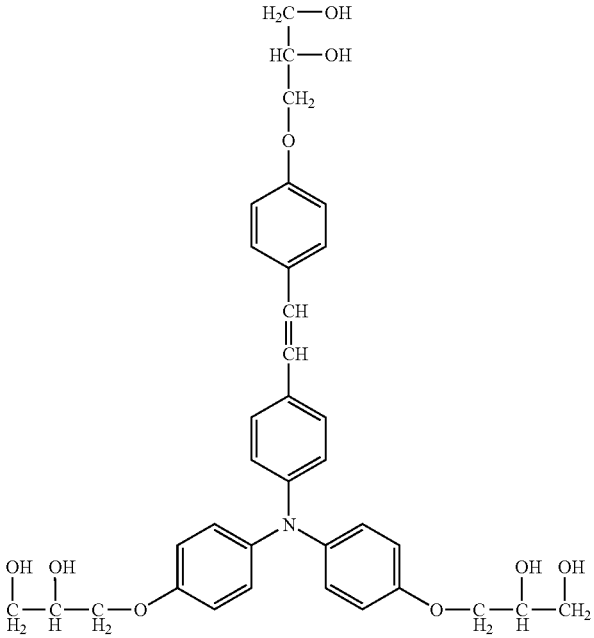

TABLE 52-continued
No. 157
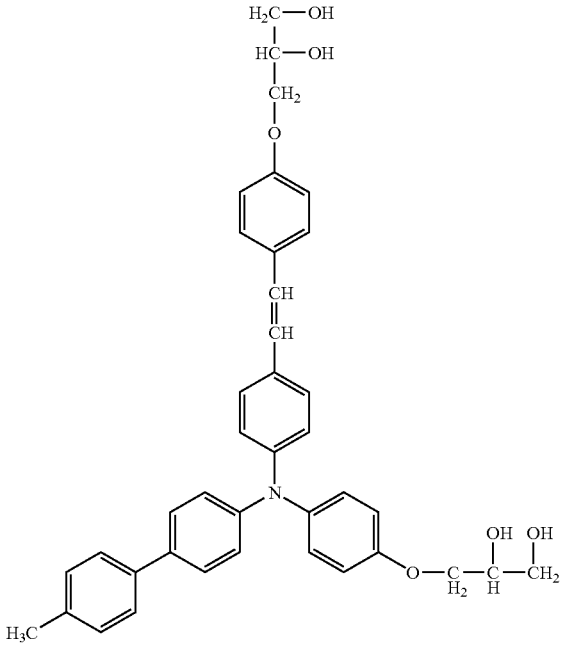
No. 158
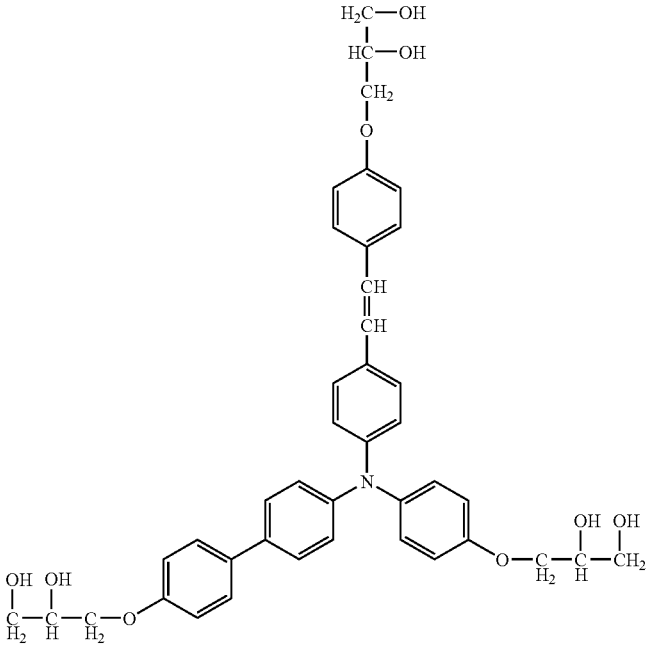

TABLE 53
No. 159
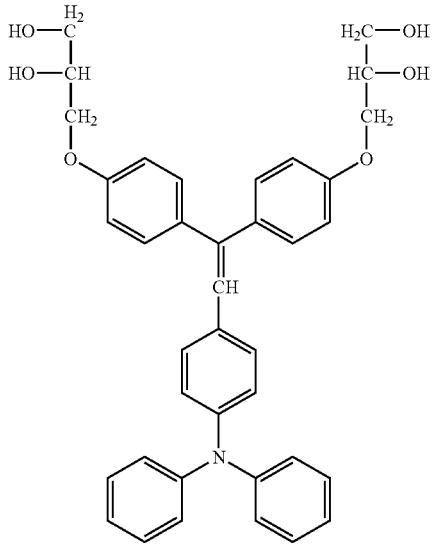
No. 160
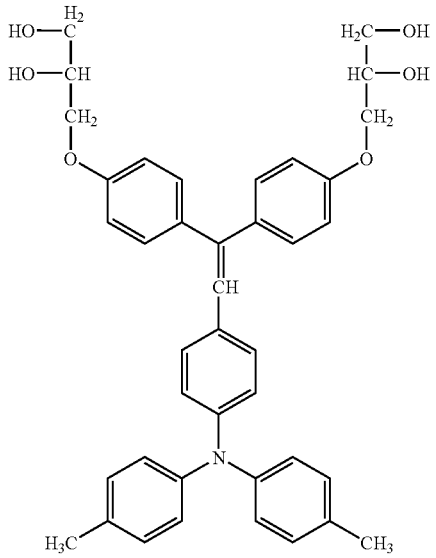

TABLE 53-continued

No. 161

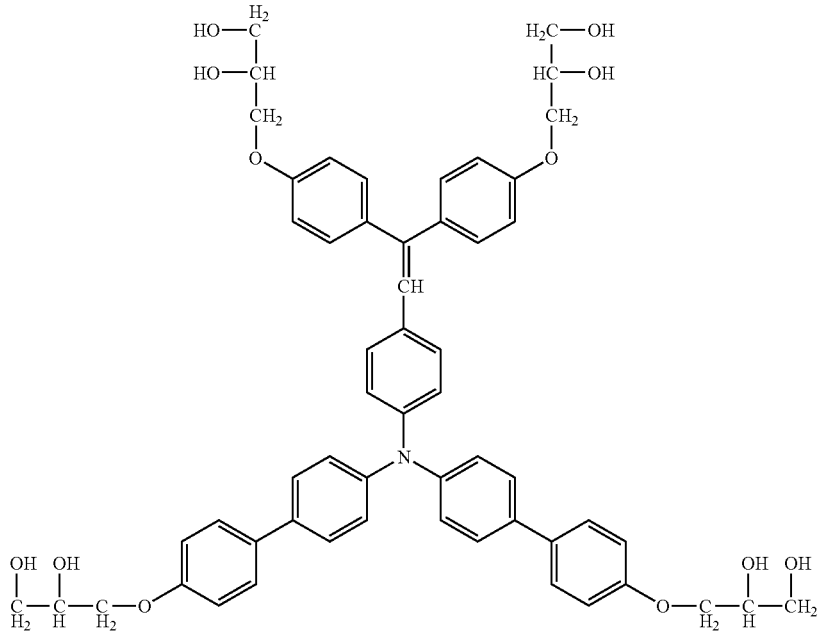

No. 162

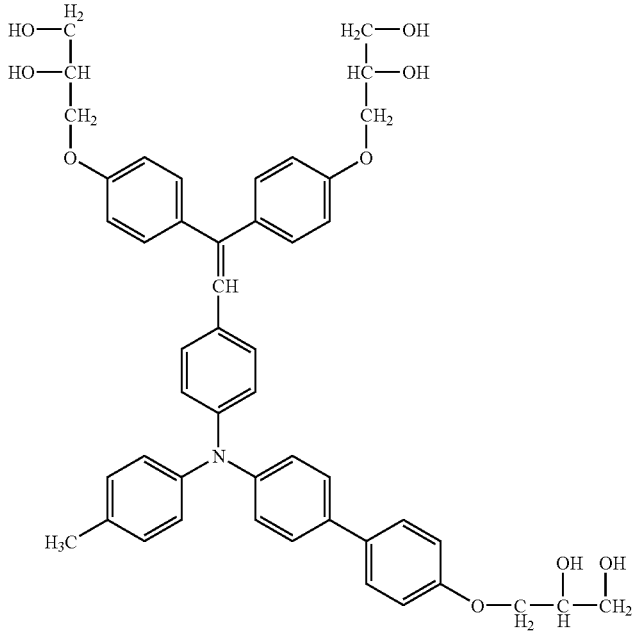

It was established that use of these reactive charge transporting substances causes no troubles described above and leads to high wear resistance. The possible mechanism for this will be described. The compounds represented by General Formula (2), i.e., the foregoing reactive charge transporting substances, have a structure in which an alkyl or alkoxy group having at least two hydroxyl groups is bonded to a charge transporting compound group to form a pendant-shaped structure having two or more crosslink sites on the polyurethane chain. For this reason, the compound structure is less likely to be affected by the secondary structure of the polyurethane chain and thus steric strain is hard to occur in the charge transporting compound group, leading to the conclusion that this prevents reductions in the charge transportability and sensitivity as well as increase in residual potential for the achievement of high wear resistance. Examples of other more preferable reactive charge transporting substances are listed below.

TABLE 54
No. 163
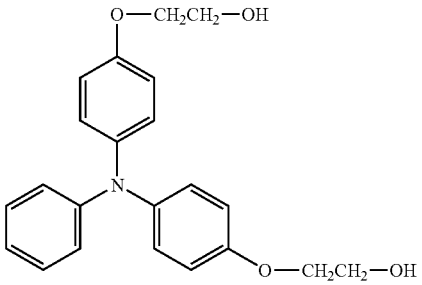
No. 164
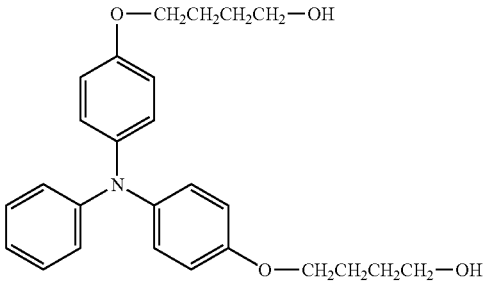
No. 165
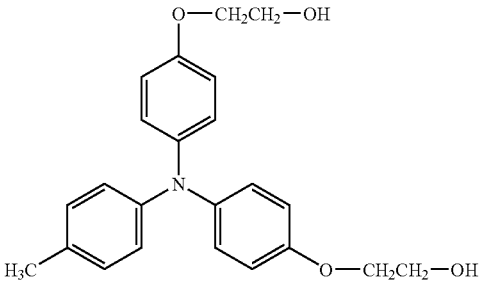
No. 166
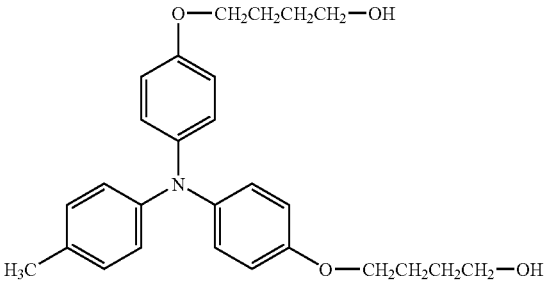
No. 167
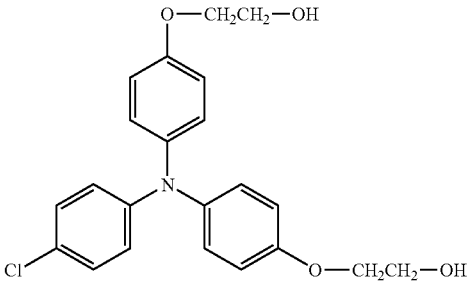

TABLE 54-continued
No. 168
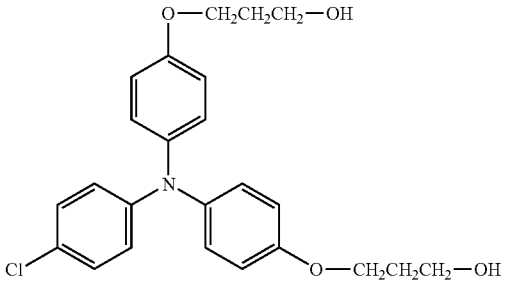
No. 169
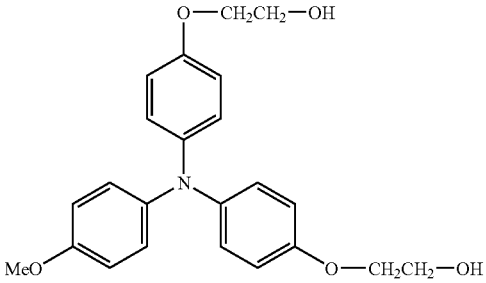
No. 170
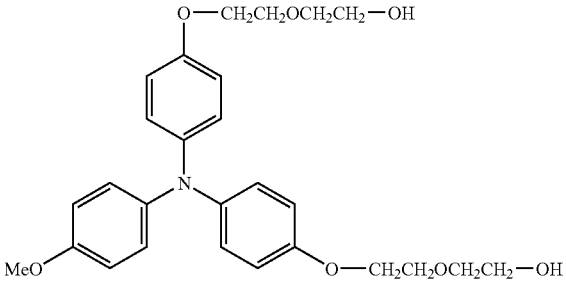
No. 171
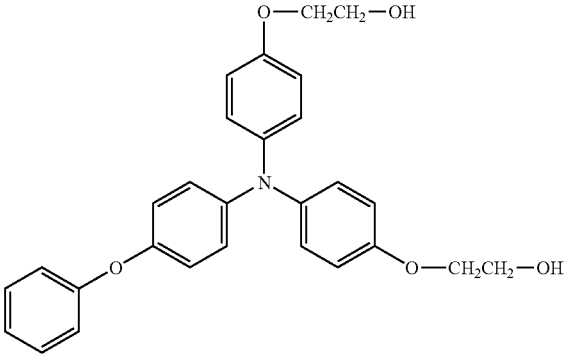
No. 172
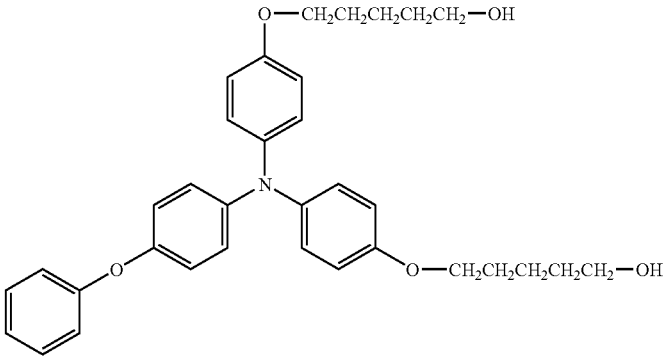

TABLE 54-continued
No. 173
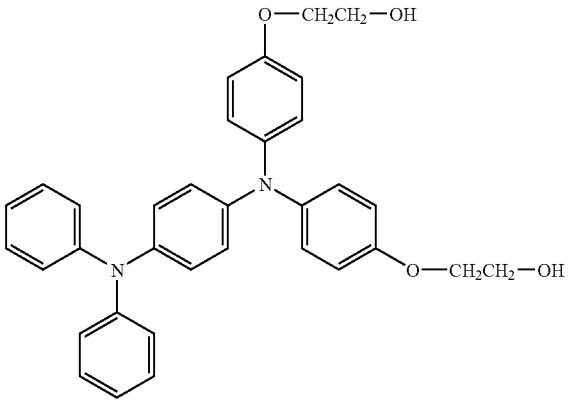
No. 174
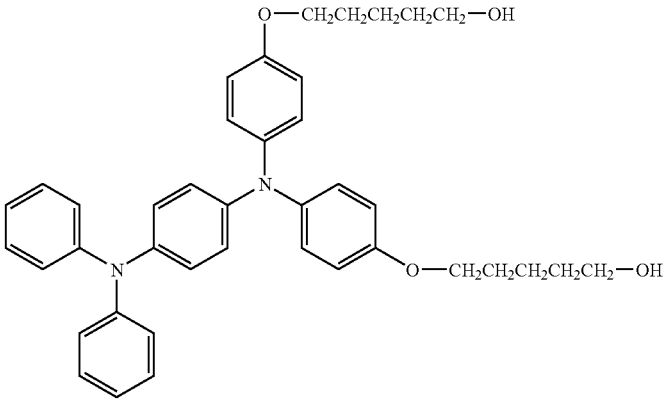
No. 175
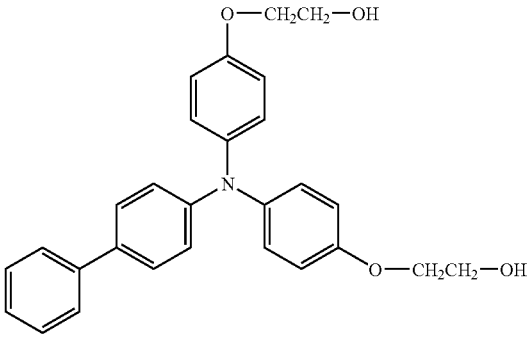

TABLE 55
No. 176
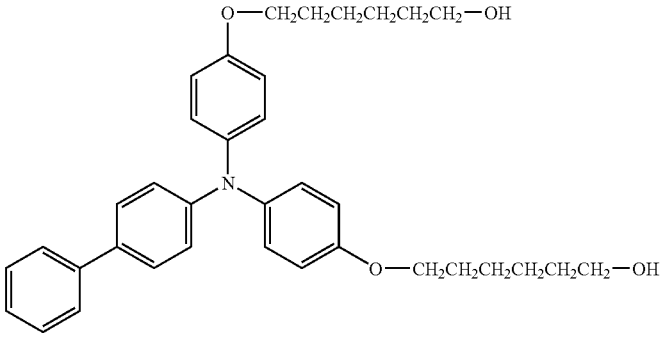
No. 177
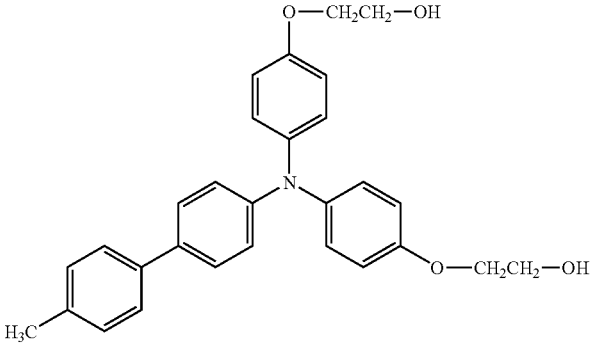
No. 178
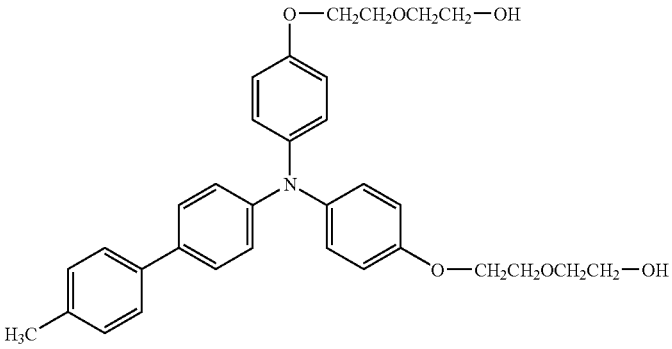
No. 179
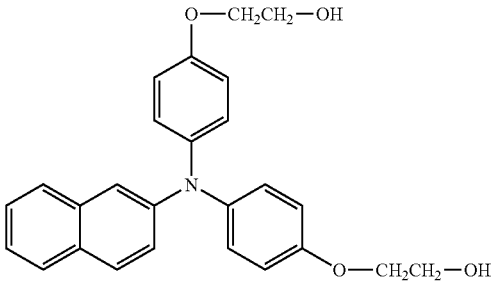
No. 180
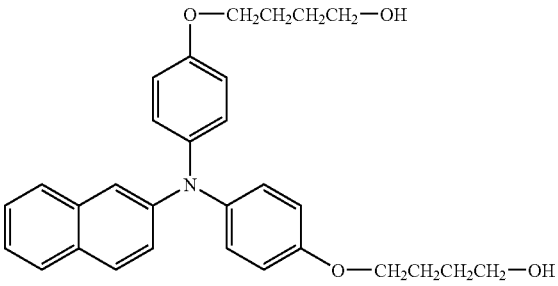

TABLE 55-continued
No. 181
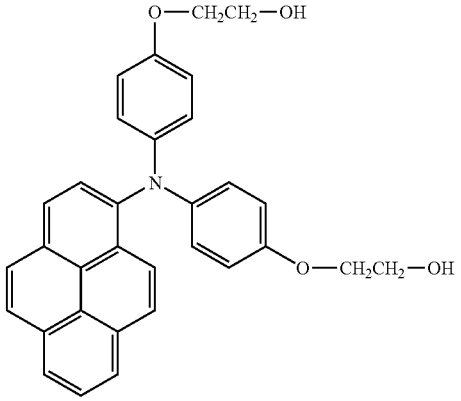
No. 182
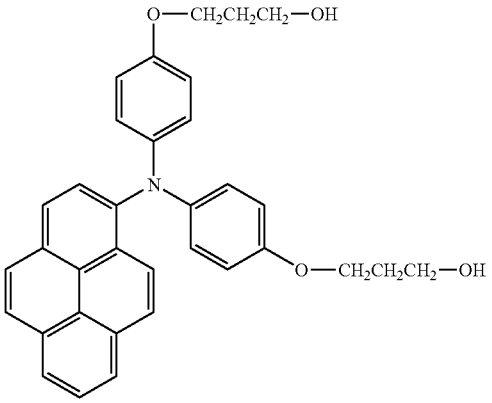
No. 183
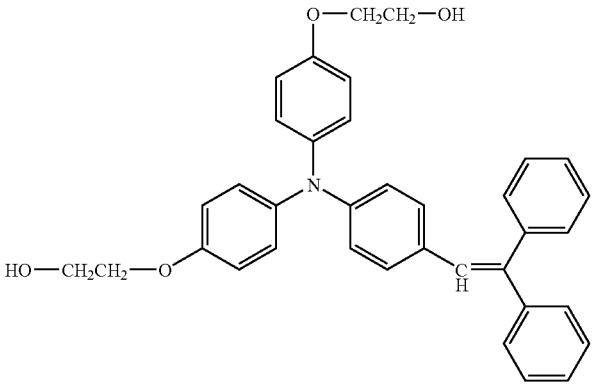
No. 184
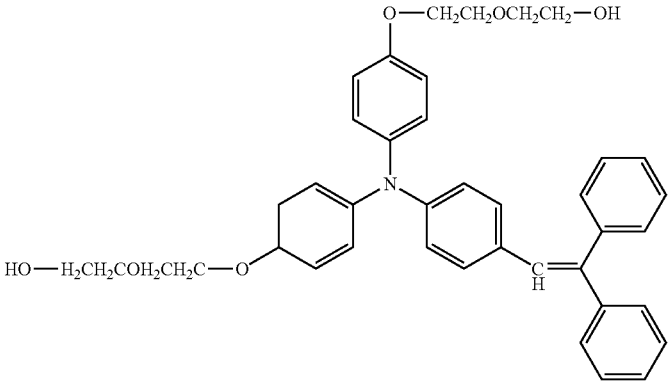

TABLE 56
No. 185
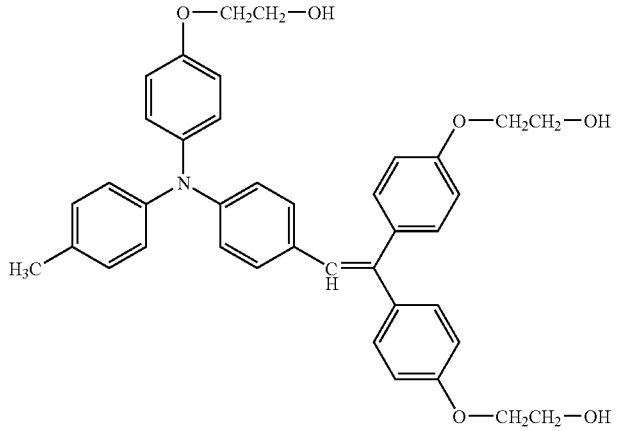
No. 186
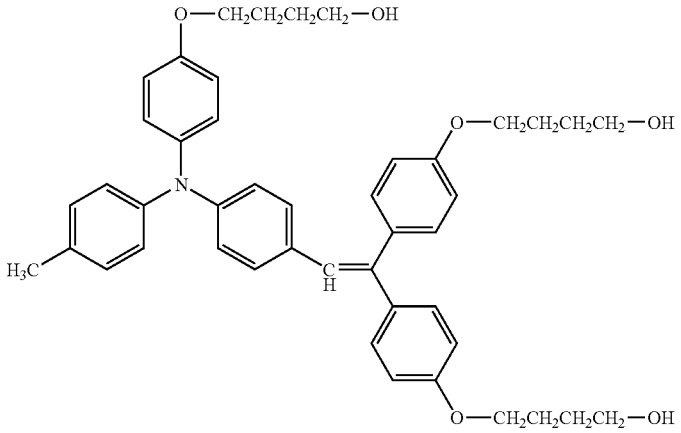
No. 187
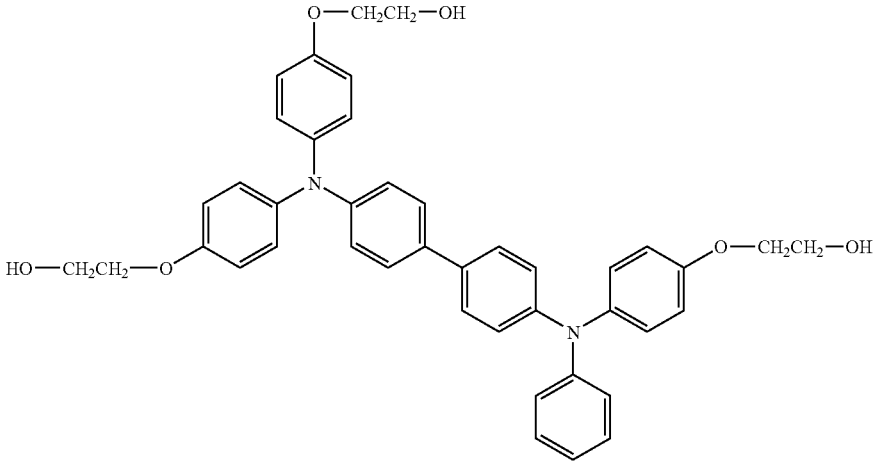

TABLE 56-continued
No. 188
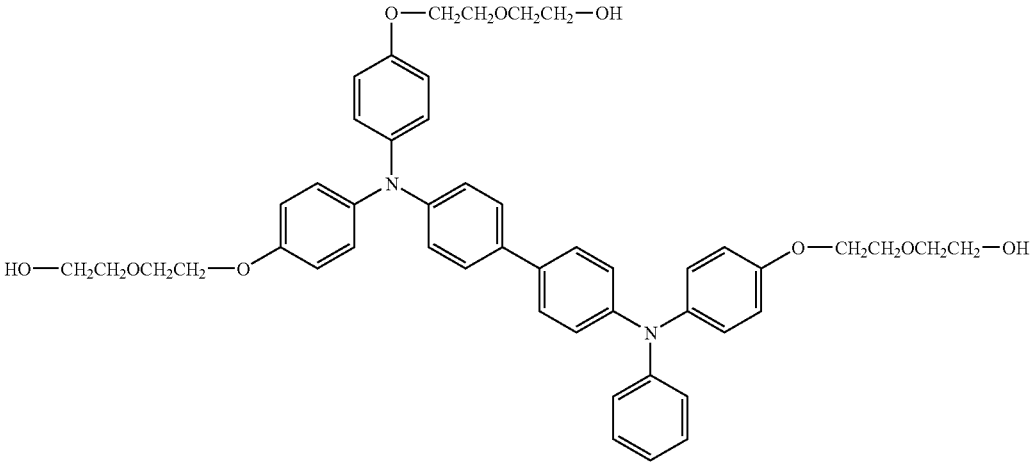
No. 189
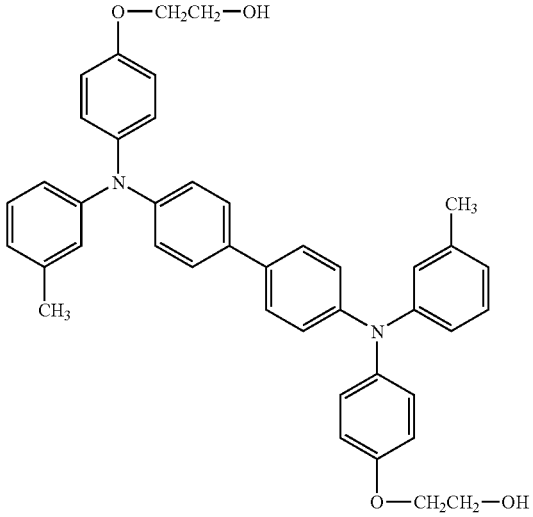
No. 190
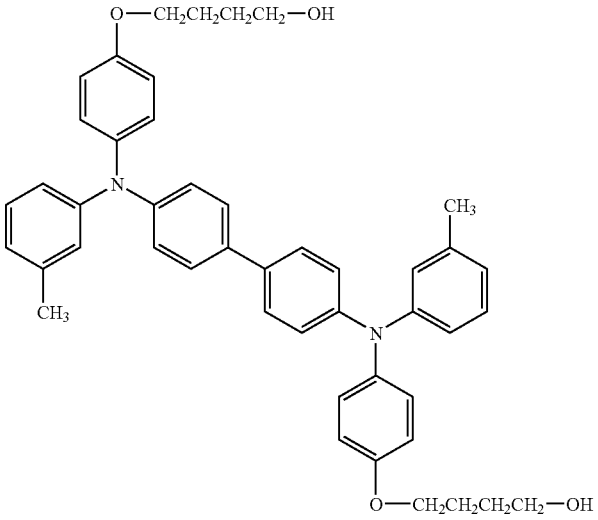

TABLE 57
No. 191
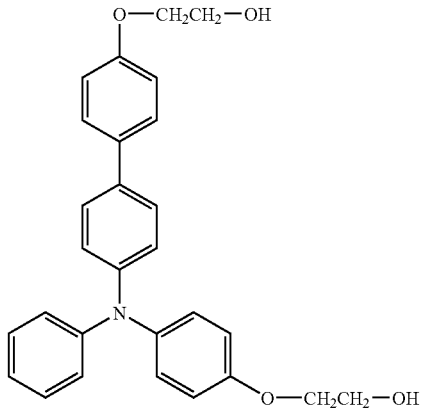
No. 192
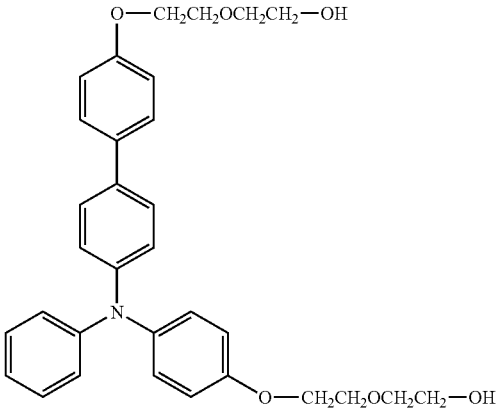
No. 193
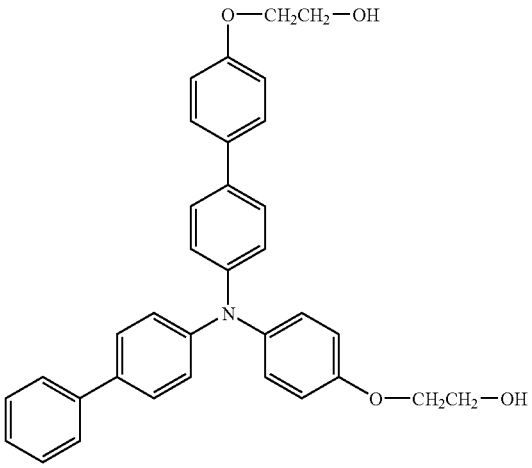

TABLE 57-continued
No. 194
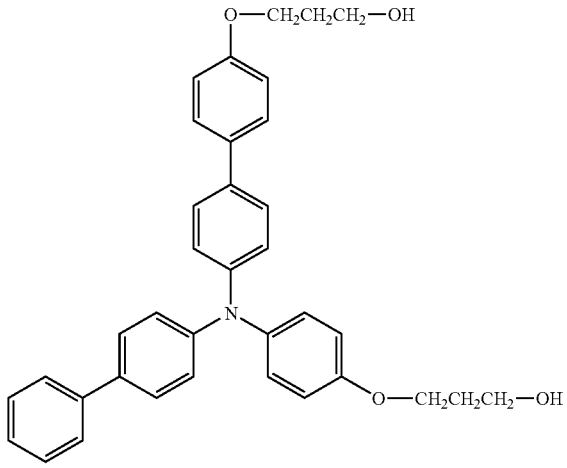
No. 195
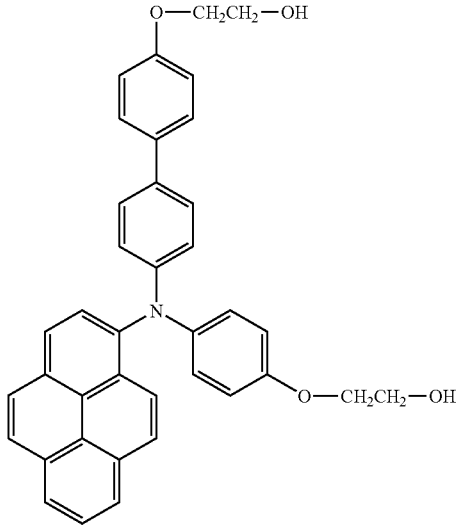
No. 196
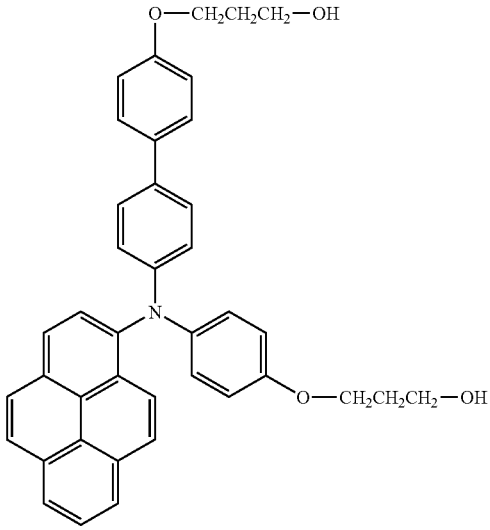

TABLE 57-continued
No. 197
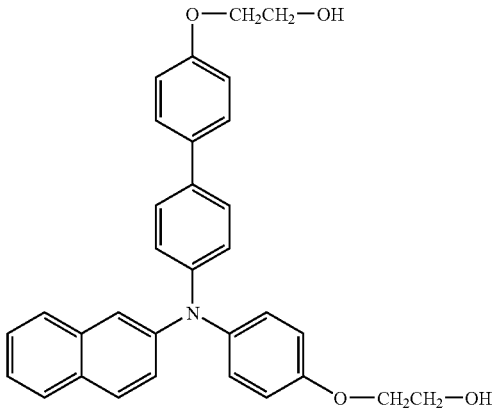
No. 198
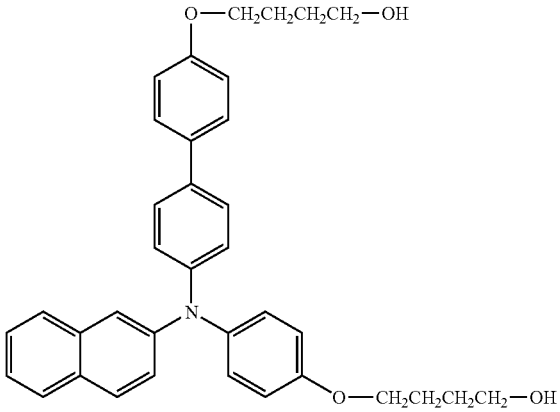
No. 199
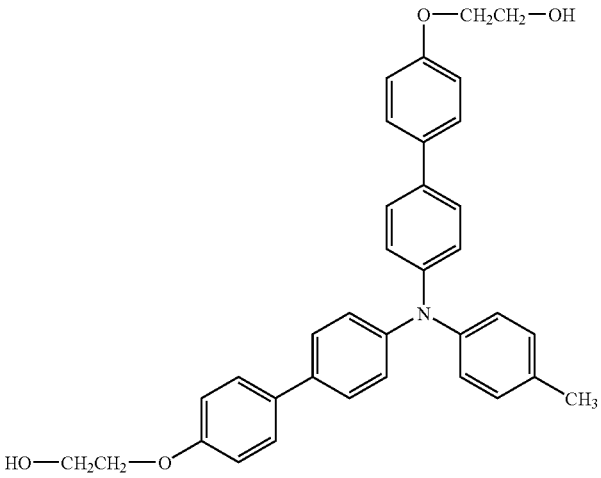

TABLE 57-continued
No. 200
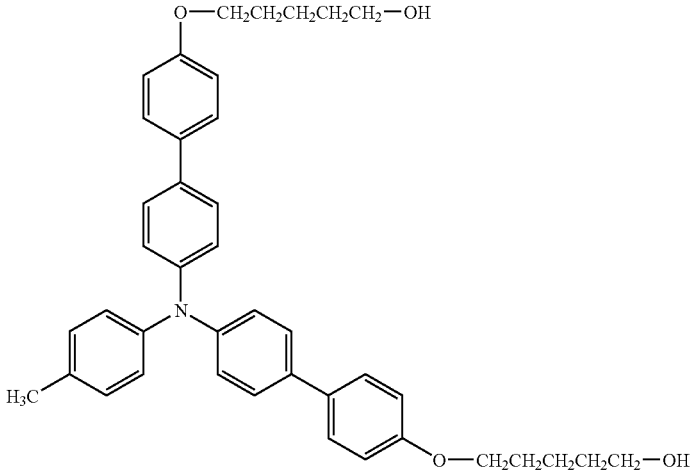
TABLE 58
No. 201
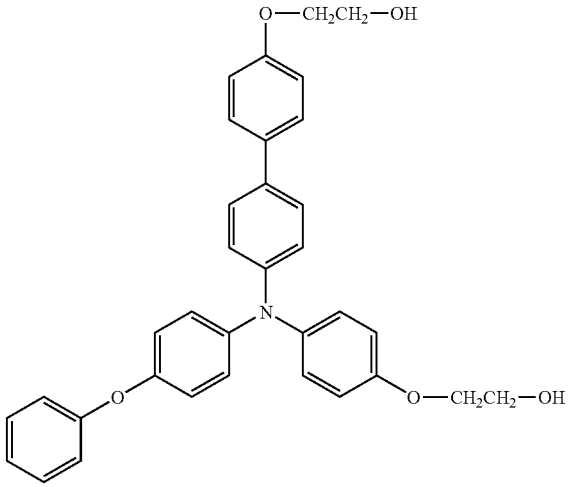
No. 202
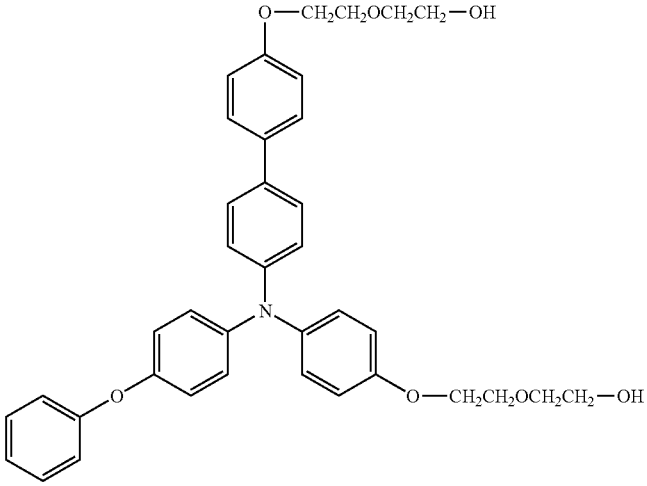

TABLE 58-continued
No. 203
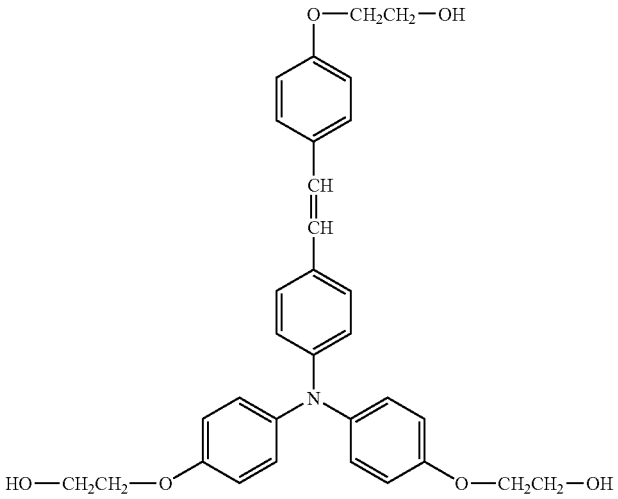
No. 204
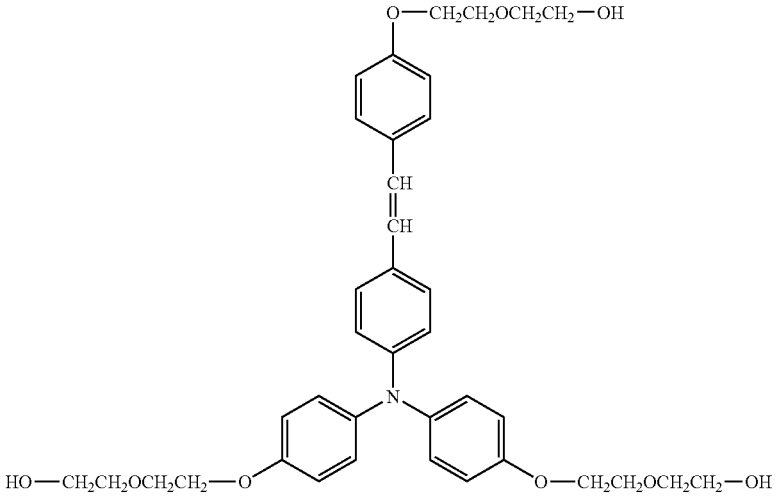
No. 205
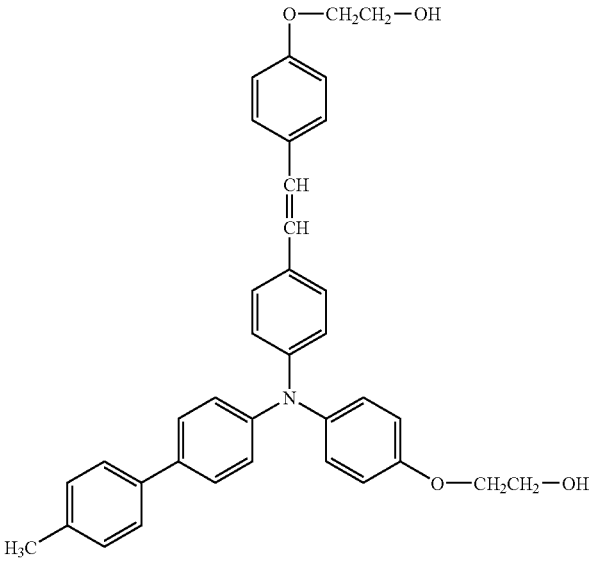

TABLE 58-continued
No. 206
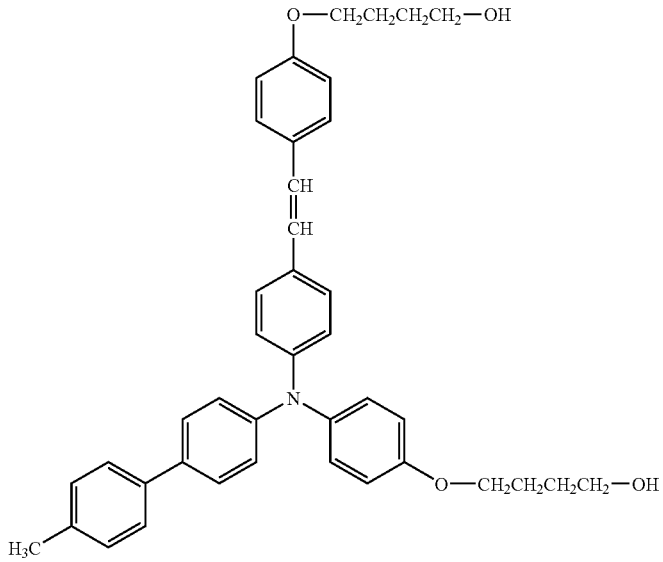
TABLE 59
No. 207
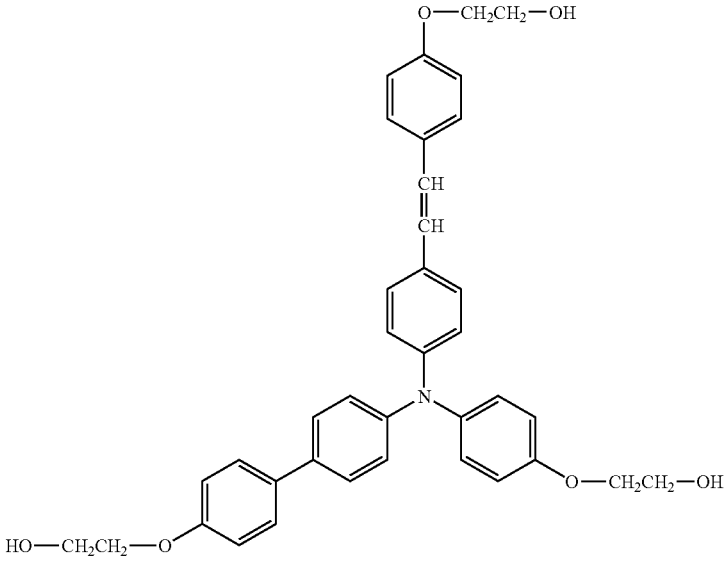

TABLE 59-continued
No. 208
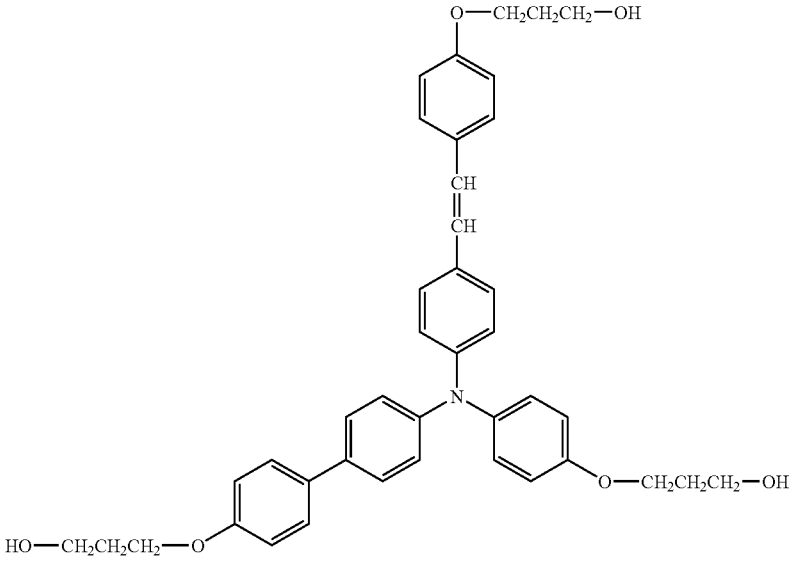
No. 209
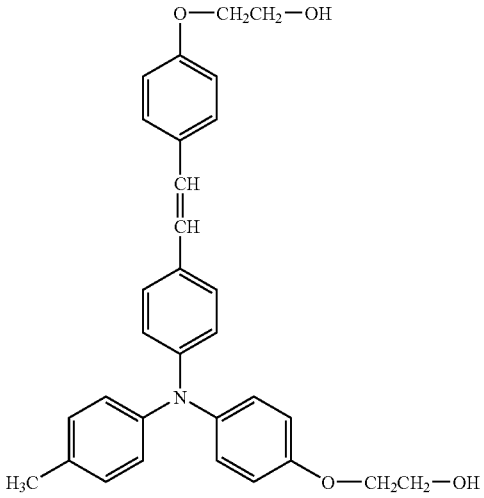
No. 210
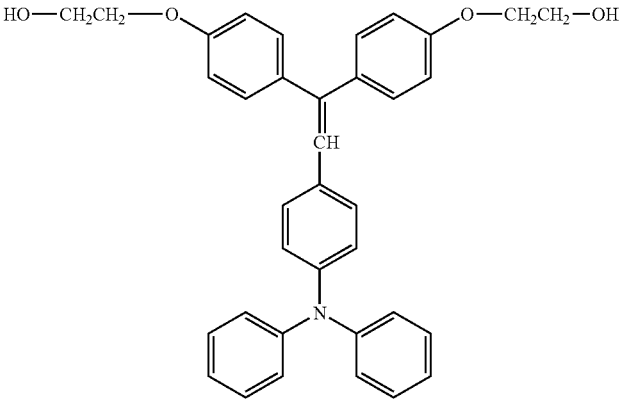

TABLE 59-continued
No. 211
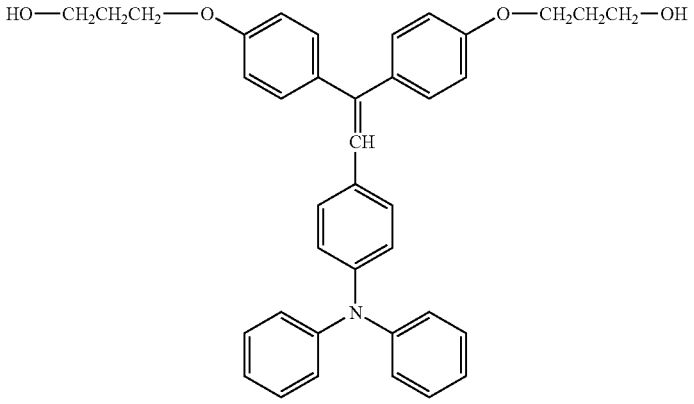
No. 212
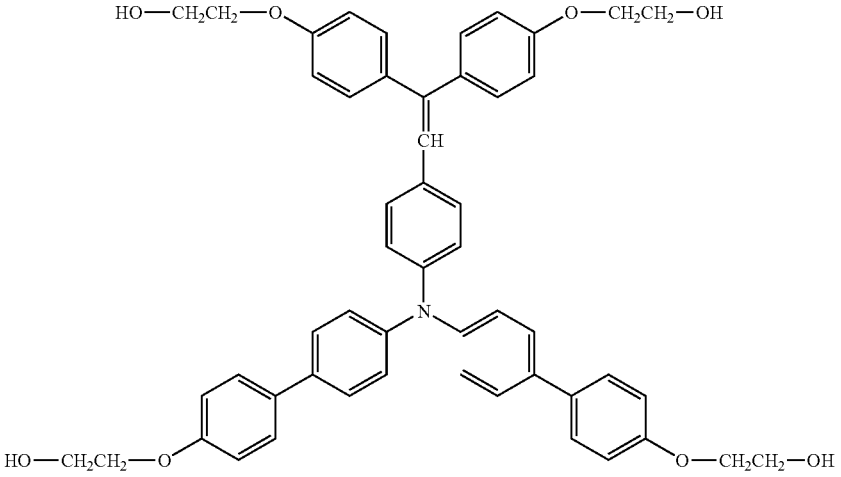
No. 213
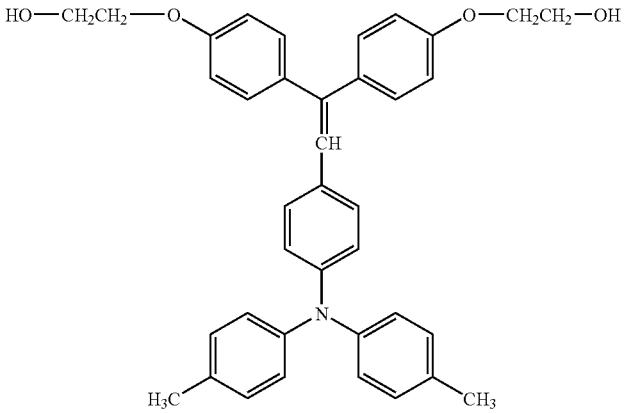

TABLE 59-continued
No. 214
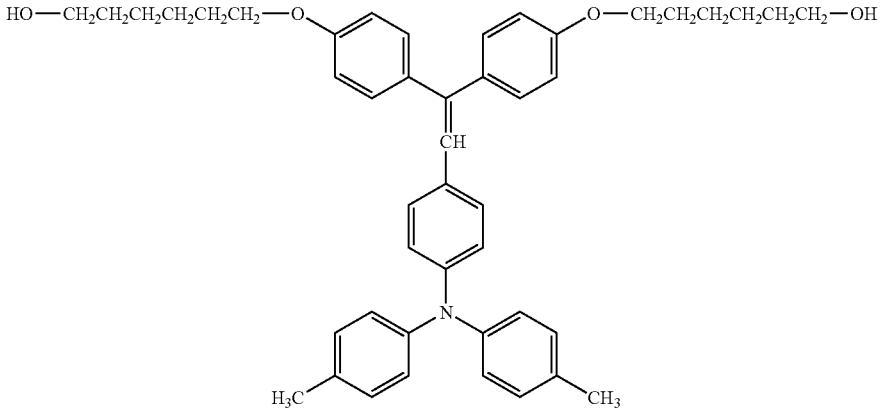
TABLE 60
No. 215
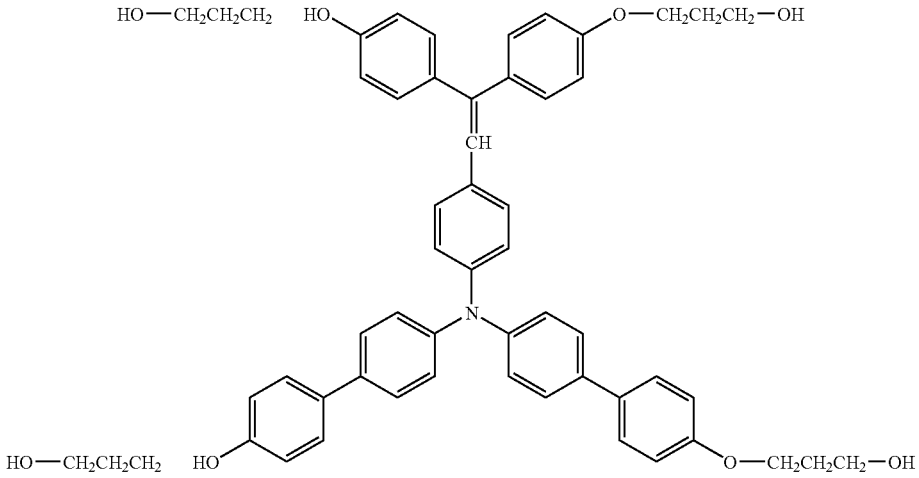
No. 216
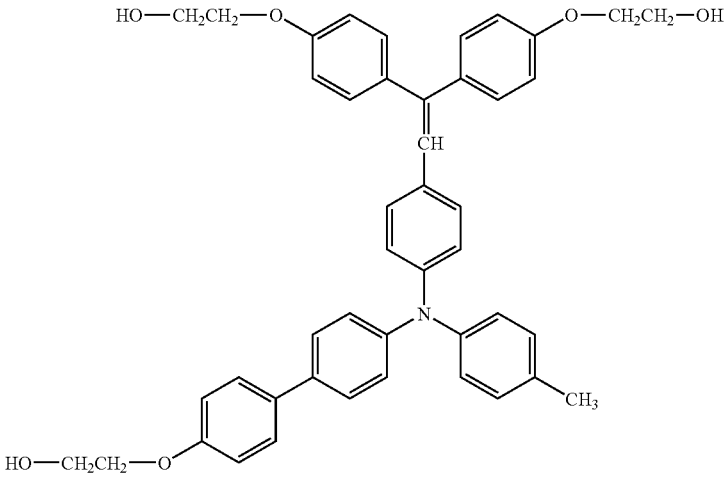

TABLE 60-continued

No. 217

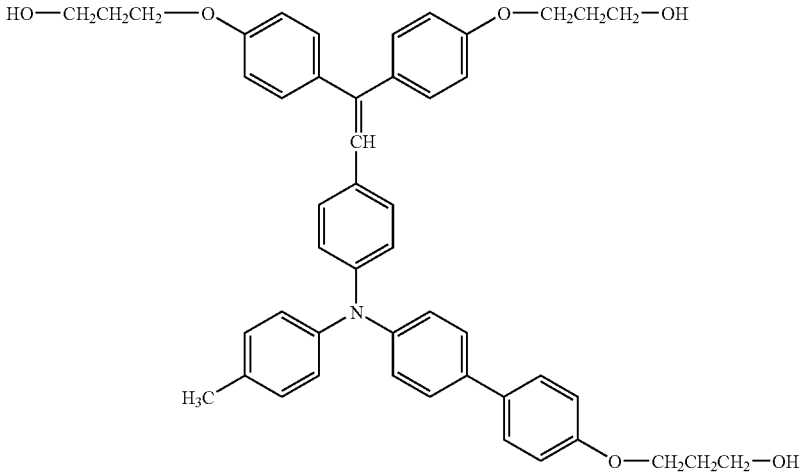

It was also established that use of these reactive charge transporting substances causes no troubles described above and leads to high wear resistance. The possible mechanism for this will be described. The compounds having General Formula (6), i.e., the reactive charge transporting substances employed in the present invention, have a structure in which two or more alkyl or alkoxy groups of 2 to 6 carbon atoms, each having at least a hydroxyl group, are bonded to a charge transporting compound group, the structure being incorporated into the main chain while forming two or more crosslink sites on the polyurethane chain. Since the hydroxyl group is bonded to the charge transporting compound group via an alkyl or alkoxy group having 2 to 6 carbon atoms, it results in the formation of structure in which the alkyl or alkoxy group resides between the charge transporting compound group and a urethane bond. In this alkyl or alkoxy group having 2 to 6 carbon atoms, since the carbon chain has a very high conformational freedom, it is less likely to be affected by the secondary structure of the polyurethane chain, although it is incorporated into the main chain. Thus steric strain is hard to occur in the charge transporting compound group, leading to the conclusion that this prevents reductions in the charge transportability and sensitivity as well as increase in residual potential for the achievement of high wear resistance.

It is possible to further prevent an increase in the residual potential by employing the moiety represented by General Formula (3) or (4) for charge transporting compound group X in the compounds represented by General Formula (2), which are reactive charge transporting substances, as well as in the compounds represented by General Formula (6). The possible mechanism for this will be described. Since steric strain is less likely to occur upon formation of urethane bonds in the present invention, it is made possible to obtain transportability that is derived from the charge transporting compound structure. The stilbene-based compound group of the compound of General Formula (3) and the α-phenylstilbene-based compound group of the compound of General Formula (4) both offer excellent charge transportability as a hydroxyl group-free non-reactive charge transporting substance. For this reason, even when they adopt the reactive charge transporting substance' structure in which an alkyl or alkoxy group having two hydroxyl groups is incorporated, they can still offer excellent charge transportability.

It was also established that use of reactive charge transporting substances having hydroxyl groups on two adjacent carbon atoms can achieve more improved wear resistance. The possible mechanism for this will be described. Since two hydroxyl groups are bonded to adjacent carbon atoms, crosslinking between the hydroxyl groups and isocyanate group results in structure in which two polyurethane bonds are joined by a carbon-carbon bond, at which a charge transporting compound group hangs down to form a pendant-shaped structure. Thus, it can be said that there would be little steric strain in the reactive charge transporting substance. In addition, since this structure has a minimum number of carbon atoms involved in the polyurethane main chain, a denser network results and thereby wear resistance increases. Accordingly, it is considered that improved wear resistance can be achieved without reducing charge transportability while ensuring excellent electrophotographic characteristics.

Furthermore, the charge transporting substances represented by the following General Formula (6), suitably used in the present invention, offer much excellent wear resistance.

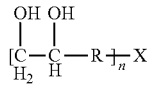

(6)

where n represents the number of substituents attached to substituent X and is an integer of 1 to 4; and R represents a divalent substituent having 1 to 50 carbon atoms.

The possible mechanism by which such charge transporting compounds offer much excellent wear resistance will be described. In the charge transporting substance represented by General Formula (6), the two adjacent carbon atoms each having a hydroxyl group are positioned at the terminal of the molecule, allowing the two hydroxyl groups to assume a conformation with minimum steric hindrance, a state where both of the hydroxyl groups are highly reactive. Therefore, the number of hydroxyl groups that remain intact after crosslinking reactions is considered to be very small. Thus, formation of coatings with a high crosslink density becomes easy and adverse effects of the residual functional groups on electrophotographic characteristics become very small, whereby it is made possible to provide a latent electrostatic image bearing member with high wear resistance and excellent electrophotographic characteristics.

Where necessary, it is possible for the outermost surface layer of the latent electrostatic image bearing member of the present invention to contain a polyol compound. It is only necessary for such a polyol compound to have two or more functional groups, and diols and polyols with three or more functional groups are employed. The following provides a non-exclusive list of polyols employed in the present invention.

Examples of diols include alkylene glycols such as ethylene glycol, 1,2-propylene glycol, 1,3-propylene glycol, 1,4-butandiol, and 1,6-hexanediol; alkylene ether glycols such as diethylene glycol, triethylene glycol, dipropylene glycol, polyethylene glycol, polypropylene glycol and polytetramethylene ether glycol; alicyclic diols such as 1,4-cyclohexanedimethanol and hydrogenated bisphenol A; bisphenols such as bisphenol A, bisphenol F and bisphenol S; and alkylene oxide (e.g., ethylene oxide, propylene oxide, or buthylene oxide) adducts of the foregoing alicyclic diols; alkylene oxide (e.g., ethylene oxide, propylene oxide, or buthylene oxide) adducts of the foregoing bisphenols.

Examples of polyols having three or more functional groups include aliphatic polyalcohols such as glycerine, trimethylolethane, trimethylolpropane, pentaerythritol and sorbitol; phenols having three or more functional groups such as phenol novolac and cresol novolac; and alkylene oxide adducts of these phenols.

Preferred examples are trimethylolpropane and a polyol represented by the following Structural Formula (1) (where, for example, l=28, m=42, n=30, with the number-average molecular weight being 1,000 or more, the weight-average molecular weight being about 31,000) the polyol being a hydroxyethyl group-introduced styrene-acrylic copolymer. An example of such a polyol is LZR-170, a styrene-acrylic copolymer produced by FUJIKURAKASEI Co., Ltd.

(I)

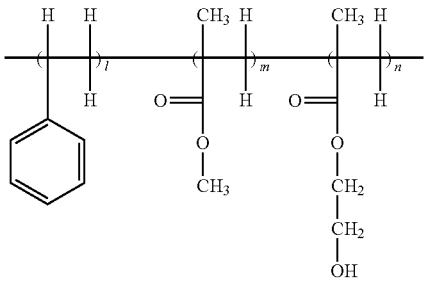

where l=28, m=42, and n=30

Examples of usable polyols include polyols having polyether structure, polyester structure, acryl structure, epoxy structure, polycarbonate structure, charge generating molecular structure, or charge transporting molecular structure.

It is possible to use the above-described polyols in combination. In this case, at least one of the multiple polyols preferably has a molecular weight-to-number of hydroxyl groups ratio (where molecular weight/number of hydroxyl groups =OH equivalent weight) of less than 150, more preferably 30 or more and less than 150, most preferably 40 or more and less than 120. By combining a polyol having an OH equivalent weight of 30 or more and less than 150, it is possible to form an outermost surface layer with high wear resistance. More specifically, increasing the content of polyol with small OH equivalent weight leads to increased crosslink density, by which finer three-dimensional networks are formed and thus wear resistance increases.

The content of a polyol whose OH equivalent weight falls within the above-specified range is preferably 10% to 90% by mass to the total amount of the multiple polyols. When less than 10% by mass is used, wear resistance increasing effects will not be obtained sufficiently. If greater than 90% by mass is used, it results in increased crosslink density and thus the wear resistance of the outermost surface layer increases, but the number of functional groups also increases, so too does the polyol reactivity. For this reason, when the polyols are prepared as coating solution, its storage stability decreases, shortening the coating solution life. This raises the possibility of occurrence of troubles during production processes, increasing the likelihood of generation of large amounts of organic wastewater. Moreover, the increased number of crosslink sites makes the amount of volume contraction larger, resulting in defects in the formed coating, such as cracks and/or dents, in some cases.

It is also preferable that at least one of the multiple polyols is a polyol having an OH equivalent weight of 150 or more and less than 1,500. By so doing it results in excellent coating formability and the resultant outermost surface layer offers high wear resistance, and furthermore, the coating solution for the outermost surface layer has high storage stability.

The possible mechanism for this will be described. Since polyols having the above-specified OH equivalent weight have relative large molecular weights, moderate viscosity is imparted to their coating solutions, whereby a state in which a polyol with a small OH equivalent weight, polyisocyanate, and reactive charge transporting substance employed in the present invention are homogenously mixed together is retained, increasing the leveling capability and uniformity of the wet coating.

The content of reactive charge transporting substance in the outermost surface layer is preferably 5% by mass to 45% by mass, more preferably 10% by mass to 35% by mass. If the content is less than 5% by mass, it results in poor charge transporting ability and increased residual potential even in an embodiment of the present invention containing conductive fine particles. If it exceeds 45% by mass, exposure of the outermost surface layer to oxidizing gas significantly reduced image density and, in some cases, caused troubles. For example, if greater than 45% by mass is used in such environments as an image forming apparatus equipped with a corotron or scorotron charger or an image forming apparatus placed in a room with a blue heater, in which apparatus the oxidizing gas level tends to raise, there is a concern that normal image forming fails in such environments.

In addition, if desired, various additives may be added to the outermost surface layer for the purpose of improving its smoothness and chemical stability.

The outermost surface layer can be formed on the photosensitive layer by any common coating method such as dip coating, spray coating, blade coating, or knife coating. Among these methods, dip coating and spray coating are preferable in view of mass productivity and coating quality.

The thickness of the outermost surface layer is not particularly limited and can be set to an appropriate level depending on the purpose; preference is given to 0.5 μm to 50 μm, more preferably 1 μm to 40 μm, further preferably 2 μm to 20 μm. If the thickness of the outermost surface layer is less than 0.5 μm, the layer's tolerance toward wears and scratches is often too small to ensure sufficient durability. If it exceeds 50 μm, troubles may occur such as increased residual potential. For these reasons, it is preferable to set the surface layer thickness to a suitable level that can ensure tolerance toward wears and scratches and that minimizes the generation of residual potential.

[Photosensitive Layer]

Hereinafter, a laminated photosensitive layer and a single-layer photosensitive layer, each of which constitutes the latent electrostatic image bearing member of the present invention, will be described.

<Laminated Photosensitive Layer>

The laminated photosensitive layer generally comprises a substrate and, in order, a charge generating layer (CGL) and a charge transporting layer (CTL) over the substrate.

(Charge Generating Layer)

The charge generating layer contains at least a charge generating substance, and it further contains a binder resin and other ingredients according to requirements.

The charge generating substance is not particularly restricted and can be appropriately selected according to intended purposes; it may be of inorganic material or organic material.

The inorganic material is not particularly restricted and can be appropriately selected according to applications. Examples thereof include crystalline selenium, amorphous-selenium, selenium-tellurium, selenium-tellurium-halogen and a selenium-arsenic compound.

The organic material is not particularly restricted and can be appropriately selected from heretofore known materials according to applications. Examples thereof include phthalocyanine pigments such as metal phthalocyanine and metal-free phthalocyanine, azulenium salt pigments, squaric acid methine pigment, azo pigments having a carbazole moiety, azo pigments having a triphenylamine moiety, azo pigments having a diphenylamine moiety, azo pigments having a dibenzothiophene moiety, azo pigments having a fluorenone moiety, azo pigments having an oxadiazole moiety, azo pigments having a bisstilbene moiety, azo pigments having a distyryl oxadiazole moiety, azo pigments having a distyrylcarbazole moiety, perylene pigments, anthraquinone or polycyclic quinone pigments, quinone imine pigments, diphenylmethane or triphenylmethane pigments, benzoquinone or naphtoquinone pigments, cyanine pigments, azomethine pigments, indigoido pigments and bisbenzimidazole pigments. These may be used singly or in combination.

The binder resin used for the charge generating layer is not particularly restricted and can be appropriately selected according to applications. Examples thereof include polyamide resins, polyurethane resins, epoxy resins, polyketone resins, polycarbonate resins, silicone resins, acrylic resins, polyvinyl butyral resins, polyvinyl formal resins, polyvinyl ketone resins, polystyrene resins, poly-N-vinyl carbazole resins and polyacrylamide resins. These may be used singly or in combination.

Any charge transporting substance may be added where necessary. Also, in addition to the above-mentioned binder resins, a polymeric charge transporting substance may be added as a binder resin in the charge generating layer.

The methods for the formation of the charge generating layer can be classified into two groups: vacuum thin film deposition methods and casting methods using dispersal system.

Examples of the vacuum thin film deposition methods are glow discharge polymerization, vacuum deposition, CVD, sputtering, reactive sputtering, ion plating and accelerated ion injection. Favorable film deposition from the above-mentioned inorganic materials or organic materials is made possible with any of these methods.

The formation of the charge transporting layer with a casting method using dispersal system can be accomplished by application of a coating solution for charge transporting layer by means of a common coating method such as dip coating, spray coating or bead coating.

Examples of organic solvents used for the charge generating layer coating solution include acetone, methyl ethyl ketone, methyl isopropyl ketone, cyclohexanone, benzene, toluene, xylene, chloroform, dichloromethane, dichloroethane, dichloropropane, trichloroethane, trichloroethylene, tetrachloroethane, tetrahydrofuran, dioxolane, dioxane, methanol, ethanol, isopropyl alcohol, butanol, ethyl acetate, butyl acetate, dimethylsulfoxide, methyl cellosolve, ethyl cellosolve and propyl cellosolve. These may be used singly or in combination.

Among these, tetrahydrofuran, methyl ethyl ketone, dichloromethane, methanol and ethanol having a boiling point of 40° C. to 80° C. are particularly favorable for easy drying after coating.

The charge generating layer coating solution is prepared by dispersing or dissolving the charge generating substance and the binder resin in the organic solvent. The method for dispersing an organic pigment in an organic solvent includes a dispersion method be means of a dispersing medium such as a ball mill, bead mill sand mill and vibrating mill and a high-speed liquid colliding dispersion method.

The electrophotographic characteristics, especially photosensitivity, varies according to the thickness of the charge generating layer, and in general, photosensitivity increases with increasing thickness. Therefore, the thickness of the charge generating layer is preferably set to be within a favorable range according to the required specification of the image forming apparatus. For the sensitivity required as a latent electrostatic image bearing member designed for electrophotography, the charge generating layer's thickness is preferably 0.01 μm to 5 μm, and more preferably 0.05 μm to 2 μm.

(Charge Transporting Layer)

When the charge transporting layer serves as the outermost surface layer, it contains (1) a crosslinked resin prepared by polymerization of an isocyanate compound and a reactive charge transporting substance having at least two hydroxyl groups, and (2) a compound represented by the following General Formula (1), as described above:

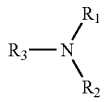

(1)

where $R^1$ and $R^2$ may be identical or different and each represent a substituted or unsubstituted alkyl group; and $R^3$ represents one of alkyl and aryl groups which have at least one hydroxyl group.

If the outermost surface layer is a protective layer provided on the charge transporting layer, there is no problem if the charge transporting layer offers low wear resistance.

The charge transporting layer is directed to retain charges and to move charges, which have been generated and separated from the charge generating layer upon exposure to light, such that the charges moving through the layer are coupled with the retained charges. It is required that the charge transporting layer have a high electrical resistance in order for the layer to retain charges. Moreover, it is also required that the charge transporting layer have a low permittivity and excellent charge transportability in order to obtain a high surface potential with the retained charges. The charge transporting layer can be prepared by dispersing or dissolving a charge transporting substance and binder resin into a suitable solvent, applying the resultant solution over the charge generating layer, and drying the solvent. Where necessary, additives such as plasticizers, leveling agents, and/or antioxidants may also be added. The charge transporting substances are of two types: hole transporting substance and electron transporting substance.

Examples of the hole transporting substance include electron donating substances, include an oxazole derivative, an oxadiazole derivative, an imidazole derivative, a triphenylamine derivative, 9-(p-diethylaminostyrylanthracene), 1,1-bis-(4-dibenzylaminophenyl)propane, styrylanthracene, styrylpyrazoline, phenylhydrozone ring, an α-phenylstilbene derivative, a thiazole derivative, a triazole derivative, a phenazine derivative, an acridine derivative, a benzofuran derivative, a benzimidazole derivative and a thiophene derivative. These may be used singly or in combination.

Examples of the electron transporting substance, i.e. electron accepting substance, include chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-one and 1,3,7-trinitrodibenzothiophene-5,5-dioxide. These may be used singly or in combination.

In the charge transporting layer, polymeric charge transporting substances may also be suitably employed as charge transporting substances that has a function as charge transporting substance and a function as binder resin. A charge transporting layer made of such polymeric charge transporting substance offers excellent wear resistance.

Examples of the polymeric charge transporting substances include polymers having the following structure.

(a) Polymers Having a Carbazole Ring

Examples thereof include poly-N-vinyl carbazole and compounds disclosed in JP-A Nos. 50-82056, 54-9632, 54-11737, 04-175337, 04-183719 and 06-234841.

(b) Polymers Having a Hydrazone Moiety

Examples thereof include compounds disclosed in JP-A Nos. 57-78402, 61-20953, 61-296358, 01-134456, 01-179164, 03-180851, 03-180852, 03-50555, 05-310904 and 06-234840.

(c) Polysilylene Polymers

Examples thereof include compounds disclosed in JP-A Nos. 63-285552, 01-88461, 04-264130, 04-264131, 04-264132, 04-264133 and 04-289867.

(d) Polymers Having a Triarylamine Moiety

Examples thereof include N,N-bis(4-methylphenyl)-4-aminopolystyrene and compounds disclosed in JP-A Nos. 01-134457, 02-282264, 02-304456, 04-133065, 04-133066, 05-40350 and 05-202135.

(e) Other Polymers

Examples thereof include a formaldehyde polycondensate of nitropyrene and compounds disclosed in JP-A Nos. 51-73888, 56-150749, 06-234836 and 06-234837.

Other examples of the polymeric charge transport materials include a polycarbonate resin having a triarylamine moiety, a polyurethane resin having a triarylamine moiety, a polyester resin having a triarylamine moiety and a polyether resin having a triarylamine moiety.

The examples further include compounds disclosed in JP-A Nos. 64-1728, 64-13061, 64-19049, 04-11627, 04-225014, 04-230767, 04-320420, 05-232727, 07-56374, 09-127713, 09-222740, 09-265197, 09-211877 and 09-304956.

As polymers having an electron donating group, a copolymer with a heretofore known monomer, a block polymer, a graft polymer, a star polymer and furthermore a cross-linking polymer having an electron donating group as disclosed in JP-A No. 03-109406 may also be used other than the polymers listed above.

Examples of the binder resins for the charge transporting layer include polycarbonate resins, polyester resins, methacrylic resins, acrylic resins, polyethylene resins, polyvinyl chloride resins, polyvinyl acetate resins, polystyrene resins, phenol resins, epoxy resins, polyurethane resins, polyvinylidene chloride resins, alkyd resins, silicone resins, polyvinyl carbazole resins, polyvinyl butyral resins, polyvinyl formal resins, polyacrylate resins, polyacrylamide resins and phenoxy resins. These may be used singly or in combination.

The charge transporting layer can be prepared by dispersing or dissolving a charge transporting substance and binder resin into a suitable solvent, applying the resultant solution over the charge generating layer, and drying the solvent. Where necessary, additives such as plasticizers, leveling agents, and/or antioxidants may also be added.

The thickness of the charge transporting layer is preferably 5 μm to 100 μm. The recent demand for high image quality has led to attempts to achieve thinner charge transport layers, with a preferred thickness being 5 μm to 30 μm for achieving high image quality (resolution=1,200 dpi or greater).

<Single-Layer Photosensitive Layer>

When the single-layer charge transporting layer serves as the outermost surface layer, it contains (1) a crosslinked resin prepared by polymerization of an isocyanate compound and a reactive charge transporting substance having at least two hydroxyl groups, and (2) a compound represented by the following General Formula (1), as described above:

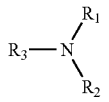

(1)

where $R^1$ and $R^2$ may be identical or different and each represent a substituted or unsubstituted alkyl group; and $R^3$ represents one of alkyl and aryl groups which have at least one hydroxyl group.

When a protective layer formed on the photosensitive layer constitutes the outermost surface layer, the single-layer photosensitive layer contains a charge generating substance, charge transporting substance and binder resin and, where necessary, further contains additional ingredient(s).

When the single-layer photoconductive layer is to be produced with the casting method, the single-layer photoconductive layer may often be formed by dissolving or dispersing in an appropriate solvent at least a charge generating substance, thermosetting binder resin, and charge transporting substance having crosslinkable functional groups and by coating and drying the solution. A plasticizer may also be added to the single-layer photoconductive layer according to requirements. The thickness of the single-layer photoconductive layer is preferably 5 μm to 100 μm, and more preferably 5 μm to 50 μm. A thickness of less than 5 μm may reduce charging ability, and a thickness exceeding 100 μm may result in reduced sensitivity.

<Substrate>

The substrate used in the present invention is not particularly restricted as long as it has an electric conductivity, and it can be appropriately selected according to applications. An electric conductor or an insulator with conductive treatment is favorable, and examples thereof include: metals such as Al, Ni, Fe, Cu and Au and alloys thereof; a substrate having a thin film of metal such as Al, Ag and Au or a conductive material such as $In_2O_3$ and SnO2 formed on an insulating substrate such as polyester, polycarbonate, polyimide and glass; a resin substrate that a metal powder or a conductive glass powder such as carbon black, graphite, Al, Cu and Ni is uniformly dispersed in a resin to provide conductivity to a resin; and paper with conductive treatment.

The substrate is not particularly restricted in terms of shape and size, and sheet-type, drum-type or belt-type substrate may be used. For example, a belt-type substrate increases the complexity and size of the apparatus since it requires a driving roller and a driven roller, but on the other hand, it provides merits such as increased layout flexibility. When a protective layer is formed, however, there is a possibility that the surface cracking occurs due to insufficient flexibility of the protective layer. This presumably results in the occurrence of background smear. Therefore, a drum-type substrate having high stiffness is favorable as a substrate.

<Undercoat Layer>

An undercoat layer may be provided between the support and the photoconductive layer according to requirements. The undercoat layer is provided for the purposes of improving the adhesion, preventing moirés, improving the coating property of the upper layer and reducing the residual potential.

The undercoat layer generally includes resins as a main component, and these resins preferably have low solubility with respect to common organic solvents, considering that a photoconductive layer is coated with a solvent over these resins.

Examples of the resins include water-soluble resins such as polyvinyl alcohol, casein, sodium polyacrylate; alcohol-soluble resins such as copolymer nylon and methoxy methylated nylon; a curing resin which forms three-dimensional network such as polyurethane resin, melamine resin, alkyd-melamine resin and epoxy resin.

Also, the undercoat layer may be added with a fine powder of metal oxide titanium oxide, silica, alumina, zirconium oxide, tin oxide and indium oxide, metal sulfide or metal nitride. An undercoat layer thereof may be formed by means of a common coating method with an appropriate solvent. Also, as the undercoat layer, metal oxide layer formed with silane coupling agents, titanium coupling agents and chromium coupling agents by means of a sol-gel method, a layer formed with an anodic oxidation of $Al_2O_3$ or a layer formed with organic materials such as polyparaxylylene (parylene) and inorganic materials such as $SiO_2$, $SnO_2$, $TiO_2$, ITO and $CeO_2$ by means of a vacuum thin-film preparation process may be used.

The thickness of the undercoat layer is not particularly restricted and can be selected according to applications. It is preferably 0.1 μm to 10 μm, and more preferably 1 μm to 5 μm.

<Intermediate Layer>

In the latent electrostatic image bearing member, i.e. photoconductor, an intermediate layer may be provided on the support according to requirements to improve the adhesion property and charge blocking property. The intermediate layer generally has resins as a main component, and these resins preferably have low solubility with respect to common organic solvents, considering that a photoconductive layer is coated with a solvent over these resins.

Examples of the resins include water-soluble resins such as polyvinyl alcohol, casein, sodium polyacrylate; alcohol-soluble resins such as copolymer nylon and methoxy methylated nylon; a curing resin which forms three-dimensional network such as polyurethane resin, melamine resin, phenol resin, alkyd-melamine resin and epoxy resin.

In the photoconductor of the present invention it is possible to add an antioxidant to each of the single-layer photosensitive layer, protective layer, charge transporting layer, charge generating layer and intermediate layer for the purpose of improving environment resistance and preventing reduction in the sensitivity and increase in residual potential.

Examples of such an antioxidant include phenolic compounds, paraphenylenediamines, hydroquinones, organic sulfuric compounds, and organic phosphorus compounds. These compounds may be used singly or in combination.

(Image Forming Apparatus and Image Forming Method)

The image forming apparatus of the present invention includes at least the latent electrostatic image bearing member of the present invention, a latent electrostatic image forming unit configured to form a latent electrostatic image on the image bearing member, a developing unit configured to develop the latent electrostatic image by using a toner to form a visible image, a transferring unit configured to transfer the visual image to a recording medium, and a fixing unit configured to fix the image to the recording medium, and it further includes other units appropriately selected according to requirements, such as a charge-eliminating unit, a cleaning unit, a recycling unit and a controlling unit. The cleaning unit is preferably configured such that it contacts a surface of the latent electrostatic image bearing member for removal of toner particles remaining over the latent electrostatic image bearing member.

The image forming method of the present invention can be suitably accomplished by the image forming apparatus of the present invention, wherein a latent electrostatic image forming step can be performed by the latent electrostatic image forming unit, a developing step can be performed by the developing unit, a transferring step can be performed by the transferring unit, and a fixing step can be performed by the fixing unit. If desired, the image forming method may further include additional steps appropriately selected, such as a charge eliminating step(s), cleaning step, recycling step, and/or controlling step.

<Latent Electrostatic Image Forming Step and Unit>

The latent electrostatic image forming step is a step of forming a latent electrostatic image on a charged latent electrostatic image bearing member by exposure, wherein the latent electrostatic image bearing member of the present invention is used. The latent electrostatic image forming unit comprises a charging unit and an exposing unit. Charging is accomplished for instance by applying voltage to a surface of the latent electrostatic image bearing member by use of the charging unit. The types of applicable charging units are not particularly restricted, and a suitable one can be selected according to the intended application. Examples thereof include known contact charging units having a conductive or semi-conductive roll, brush, film or rubber blade; non-contact charging units utilizing corona discharge such as a corotron and a scorotron; and a charging unit (roller) provided with a gap forming member (e.g., a gap tape) on the both ends such that the charging unit is located near but without contacting a latent electrostatic image bearing member through that gap tape.

Other than the above roller form, the charging unit or member may be of any form, including magnetic brush and fur brush, and may be selected according to the specification and the configuration of the electrophotographic apparatus. The magnetic brush is configured with various types of ferrite particles such as Zn—Cu ferrite used as a charging member; a nonmagnetic conductive sleeve for supporting the charging member; and a magnet roller included in the sleeve. Regarding the fur brush, a conduction-processed fur with carbon, copper sulfate, metal or metal oxide for conductivity is used as a material for the fur brush, and a charging unit is formed by wrapping or pasting the fur on a metal shaft or a conduction-processed shaft.

It is preferable to employ a contact charging unit or a charging unit provided with gap tapes for close-in positioning since provision of an image forming apparatus is made possible that produces a low level of ozone from the charging unit. It is particularly preferable that the charging unit be placed in contact with or not in contact with a latent electrostatic image bearing member such that direct and alternating voltages are superimposed and applied to charge the surface of the latent electrostatic image bearing member.

It is preferable that the charging unit be a charge roller which is located near but without contacting the latent electrostatic image bearing member through a gap tap such that direct and alternating voltages are superimposed and applied to electrify the surface of the latent electrostatic image bearing member. This configuration is particularly preferable since it provides an enormous advantage that maintenance-free use is made possible by virtue of reduced charge non-uniformity over the latent electrostatic image bearing member surface and increased tolerance to the occurrence of charge failure caused by smears on the charge roller.

Exposure is accomplished for instance by image-wise exposure of a surface of the latent electrostatic image bearing member by use of an exposing unit. The exposing unit is not particularly restricted as long as it can perform intended image-wise exposure on the surface of the latent electrostatic image bearing member charged by the charging unit; the type of the exposing unit can be appropriately selected according to applications. Examples of the exposing unit include a copying optical system, a rod lens array system, a laser optical system and liquid crystal shutter optical system. In the present invention, the back-exposure method may be adopted in which an exposure is performed imagewise from the back side of the latent electrostatic image bearing member.

<Developing Step and Unit>

The developing step is a step of developing a latent electrostatic image formed in the exposure step by use of a toner to produce a visible image. As used herein, the term "toner" includes a toner and a developer to be described later. More specifically, formation of a visible image is accomplished by the developing unit which develops a latent electrostatic image by use of a toner or developer. The developing unit is not particularly restricted as long as it is capable of development by use of a toner or developer, and can be appropriately selected from those known in the art. Preferred examples thereof include a developing unit that at least has a developing device that can impart a toner or developer in a contact or non-contact manner to a latent electrostatic image. The developing device may adopt either dry development method or wet development. It may also be a monochrome developing device or a multi-color developing device. For example, a developing device having a rotatable magnet roller and an agitator that frictions and agitates a toner or developer for electrification is preferable.

In the developing device, for example, a toner and carrier to be described later are mixed and agitated, whereby the toner is electrified by friction and toner particles are retained on the surface of the rotating magnetic roller in the form of many particle chains, forming a magnetic brush. The magnet roller is arranged near the latent electrostatic image bearing member, i.e. photoconductor; therefore, the toner constituting the magnetic brush formed on the surface of the magnetic roller partially transfers to the surface of the latent electrostatic image bearing member, i.e. photoconductor, due to electric attraction. As a result, the latent electrostatic image is developed by the toner, and a visible image is formed on the surface of the latent electrostatic image bearing member, i.e. photoconductor. Note that the developer contained in the developing device may be a one-component developer or two-component developer.

<Transferring Step and Unit>

The transferring step is a step of transferring a visible image to a recording medium. A preferred form of the transferring step is such that primary transfer is first conducted wherein a visible image is transferred onto an intermediate recording medium, followed by secondary transfer wherein the visible image is transferred to a recording medium. A more preferred form of the transferring step includes primary transfer wherein visible images of different colors, which have been produced by use of at least two different-color toners, more preferably a full-color toner, are transferred to an intermediate transfer medium to form a composite image thereon, and secondary transfer wherein the complex image is transferred to a recording medium.

Transfer of a visible image is accomplished for instance by charging the latent electrostatic image bearing member, i.e. photoconductor, using a transfer charger, and it may be performed by the transferring unit. A preferred form of the transferring includes a primary transferring unit configured to transfer a visible image to an intermediate transfer medium to form a composite image and a secondary transferring unit configured to transfer the composite image to a recording medium.

More specifically, it is preferable to design the transferring step such that toner images of different colors are formed on respective latent electrostatic image bearing members using respective developing units, the color toner images are sequentially deposited onto an intermediate transfer medium to form a composite image, and the composite image is transferred onto a recording medium at a time. The intermediate transfer medium is not particularly limited and can be appropriately selected from those known in the art; preferred examples are transfer belts.

The stationary friction coefficient of intermediate transfer member is preferably 0.1 to 0.6 and more preferably 0.3 to 0.5. The volume resistance of intermediate transfer member is preferably more than several Ωcm and less than $10^3$ Ωcm. By keeping the volume resistance within a range of several Ωcm to $10^3$ Ωcm, the charge over intermediate transfer member itself can be prevented and the charge given by the charging unit is unlikely to remain on the intermediate transfer member. Therefore transfer non-uniformity at the time of secondary transferring can be prevented and the application of transfer bias at the time of secondary transferring becomes relatively easy.

The materials making up the intermediate transfer member is not particularly limited, and may be selected from know materials accordingly. Examples are named hereinafter.

(1) Materials with high Young's modulus (tension elasticity) used as a single layer belt such as polycarbonates (PC), polyvinylidene fluoride (PVDF), polyalkylene terephthalate (PAT), blend materials of PC/PAT, ethylene tetrafluoroethylene copolymer (ETFE)/PC, and ETFE/PAT, thermosetting polyimides of carbon black dispersion, and the like. These single layer belts having high Young's modulus are small in their deformation against stress during image formation and are particularly advantageous in that registration error is least likely to occur during color image formation.

(2) A double or triple layer belt using above-described belt having high Young's modulus as a base layer, added with a surface layer and an optional intermediate layer around the peripheral side of the base layer. The double or triple layer belt has a capability of preventing dropouts in a lined image that is caused by hardness of the single layer belt.

(3) A belt with relatively low Young's modulus that incorporates a rubber or an elastomer. This belt is advantageous in that there is almost no print defect of unclear center portion in a line image due to its softness. Additionally, by making width of the belt wider than drive roller or tension roller and thereby using the elasticity of edge portions that extend over rollers, it can prevent meandering of the belt. It is also cost effective for not requiring ribs or units to prevent meandering.

Conventionally, intermediate transfer belts have been adopting fluorine resins, polycarbonate resins, polyimide resins, and the like; however, recently, elastic belts in which elastic members are used in all layers or a part thereof are used as the intermediate transfer belts. There are some issues over transfer of color images by resin belt as described below.

Color images are typically formed by four colors of color toners. In one color image, toner layers of layer 1 to layer 4 are formed. Toner layers are pressurized as they pass through the primary transferring (in which toner is transferred to the intermediate transfer belt from the photoconductor) and the secondary transferring (in which toner is transferred to the sheet from the intermediate transfer belt), and the cohesive force among toner particles increases. As the cohesive force increases, phenomena such as dropouts of letters or dropouts of edges of solid images are likely to occur. Since resin belts are too hard to deform corresponding to the toner layers, they tend to compress the toner layers and therefore letter drop outs are likely to occur.

Recently, there is an increasing demand toward printing full color images on various types of paper such as Japanese paper or paper having a rough surface. However, the paper having a rough surface is likely to have a gap between toner and sheet at the time of transferring and therefore leading to transfer errors. When the transfer pressure of secondary transfer section is increased in order to increase adhesiveness, the cohesive force of the toner layers becomes high, resulting in the letter drop outs as described above.

Elastic belts are employed for the following purpose. Elastic belts deform corresponding to the surface roughness of toner layers and the sheet having low smoothness in the transfer section. In other words, since elastic belts deform complying with local roughness and an appropriate adhesiveness can be obtained without excessively increasing the transfer pressure against toner layers, it is possible to obtain transfer images having excellent uniformity with no letter drop outs even in a case of paper sheets with poor flatness.

Resins for the elastic belts are not limited and may be selected accordingly. Examples thereof include polycarbonates, fluorine resins (ETFE, PVDF), styrene resins (homopolymers and copolymers including styrene or substituted styrene) such as polystyrene, chloropolystyrene, poly-α-methylstyrene, styrene-butadiene copolymer, styrene-vinyl chloride copolymer, styrene-vinyl acetate copolymer, styrene-maleic acid copolymer, styrene-acrylate copolymers (styrene-methyl acrylate copolymer, styrene-ethyl acrylate copolymer, styrene-butyl acrylate copolymer, styrene-octyl acrylate copolymer, and styrene-phenyl acrylate copolymer), styrene-methacrylate copolymers (styrene-methyl methacrylate copolymer, styrene-ethyl methacrylate copolymer, styrene-phenyl methacrylate copolymer, and the like), styrene-α-chloromethyl acrylate copolymer, styrene-acrylonitrile acrylate copolymer, and the like, methyl methacrylate resin, butyl methacrylate resin, ethyl acrylate resin, butyl acrylate resin, modified acrylic resins (silicone-modified acrylic resin, vinyl chloride resin-modified acrylic resin, acrylic urethane resin, and the like), vinyl chloride resin, styrene-vinyl acetate copolymer, vinyl chloride-vinyl acetate copolymer, rosin-modified maleic acid resin, phenol resin, epoxy resin, polyester resin, polyester polyurethane resin, polyethylene, polypropylene, polybutadiene, polyvinylidene chloride, ionomer resin, polyurethane resin, silicone resin, ketone resin, ethylene-ethylacrylate copolymer, xylene resin and polyvinylbutylal resin, polyamide resin, modified polyphenylene oxide resin, and the like. These may be used alone or in combination.

Rubber and elastomer of the elastic materials are not limited and may be selected accordingly. Examples thereof include butyl rubber, fluorine rubber, acrylic rubber, ethylene propylene rubber (EPDM), acrylonitrilebutadiene rubber (NBR), acrylonitrile-butadiene-styrene natural rubber, isoprene rubber, styrene-butadiene rubber, butadiene rubber, ethylene-propylene rubber, ethylene-propylene terpolymer, chloroprene rubber, chlorosulfonated polyethylene, chlorinated polyethylene, urethane rubber, syndiotactic 1,2-polybutadiene, epichlorohydrin rubber, silicone rubber, fluorine rubber, polysulfurized rubber, polynorbornen rubber, hydrogenated nitrile rubber, thermoplastic elastomers (polystyrene elastomers, polyolefin elastomers, polyvinyl chloride elastomers, polyurethane elastomers, polyamide elastomers, polyurea elastomers, polyester elastomers, and fluorine resin elastomers), and the like. These may be used alone or in combination.

The conductive agents for adjustment of the intermediate transfer medium's volume resistance are not limited and may be selected accordingly. Examples thereof include carbon black, graphite, metal powders such as aluminum, nickel, and the like and electric conductive metal oxides such as tin oxide, titanium oxide, antimony oxide, indium oxide, potassium titanate, antimony tin oxide (ATO), indium tin oxide (ITO), and the like. The conductive metal oxides may be coated with insulating particles such as barium sulfate, magnesium silicate, calcium carbonate, and the like. The conductive agents are not limited to those mentioned above.

Materials of the surface layer of the belts are required to prevent contamination of the photoconductor by elastic material as well as to reduce the surface friction of the transfer belt so that toner adhesion is lessened while cleaning ability and the secondary transfer property are improved. Materials which reduces surface energy and enhances lubrication by the use of alone or combination of polyurethane, polyester, epoxy resin, and the like may be dispersed for use. Examples of such materials include alone, combination of two or more or combination of different particle diameters of powders or particles such as fluorine resin, fluorine compound, carbon fluoride, titanium dioxide, silicon carbide, and the like. In addition, it is possible to use a material such as fluorine rubber that is treated with heat so that a fluorine-rich layer is formed on the surface and the surface energy is reduced.

Examples of manufacturing processes of the belts include, but not limited to centrifugal forming in which material is poured into a rotating cylindrical mold to form a belt, spray application in which a liquid paint is sprayed to form a film, dipping method in which a cylindrical mold is dipped into a solution of material and then pulled out, injection mold method in which material is injected between inner and outer mold, a method in which a compound is applied onto a cylindrical mold and the compound is vulcanized and grounded. In general, two or more processes are combined for manufacturing belts.

Methods to prevent elongation of the elastic belt include using a core resin layer that is difficult to elongate on which a rubber layer is formed, incorporating a material that prevents elongation into the core layer, and the like, but the methods are not particularly limited to the manufacturing processes. Examples of the materials constructing the core layer that prevent elongation include alone or combination of natural fibers such as cotton, silk and the like; synthetic fibers such as polyester fibers, nylon fibers, acrylic fibers, polyolefin fibers, polyvinyl alcohol fibers, polyvinyl chloride fibers, polyvinylidene chloride fibers, polyurethane fibers, polyacetal fibers, polyfluoroethylene fibers, phenol fibers, and the like; inorganic fibers such as carbon fibers, glass fibers, boron fibers, and the like, metal fibers such as iron fibers, copper fibers, and the like, and materials that are in a form of a weave or thread may be used. It should be noted that the materials are not limited to those described above.

A thread may be one or more of filaments twisted together, and any twisting and plying forms are accepted such as single twisting, multiple twisting, doubled yarn, and the like. Further, fibers of different materials selected from above-mentioned group may be spun together. The thread may be treated before use in such a way that it becomes electrically conductive. On the other hand, the weave may be of any type including plain knitting, and the like. It is possible to use a union weave for making it electrically conductive.

The manufacturing process of the core layer is not particularly limited. Examples include a method in which a weave that is woven in a cylindrical shape is placed on a mold or the like and a coating layer is formed on top of it, a method in which a cylindrical weave is dipped in a liquid rubber or the like so that coating layer(s) is formed on one side or on both sides of the core layer and a method in which a thread is wound helically to a mold or the like in an arbitrary pitch, and then a coating layer is formed thereon.

If the elastic layer is too thick, elongation and contraction of the surface becomes large and may cause cracks on the surface layer depending on the hardness of the elastic layer. Moreover, as the amount of elongation and contraction increases, the size of images are also elongated and contracted significantly. Therefore, too much thickness, about 1 mm or more, is not preferable.

The transferring units of the first and the second transferring preferably contain an image-transferring unit which releases the visible image formed on the photoconductor to the recording-medium side by charging. There may be one, two or more of the transferring unit. The transferring unit may be a corona transferring unit based on corona discharge, transfer belt, transfer roller, pressure transfer roller, or adhesion transferring unit, for example.

The recording medium is not limited as long as it is capable of transferring unfixed images after development and may be selected accordingly. The recording medium is typically plain paper, and other materials such as polyethylene terephthalate (PET) sheets for overhead projector (OHP) may be utilized.

<Fixing Step and Unit>

The fixing is a step of fixing the visible image transferred to the recording medium by use of a fixing unit. The fixing may be carried out for each color when being transferred to the recording medium, or simultaneously when all colors are being superimposed.

The fixing unit is not limited and may be selected accordingly, however it is preferably known heat application and pressurization unit. Examples of such unit include a combination of heating roller and pressure roller, and a combination of heating roller, pressure roller, and endless belt, and the like. The heating temperature in the heat application and pressurization unit is preferably 80° C. to 200° C. Further, known optical fixing unit may be used in addition to or in place of fixing and fixing unit, depending on the application.

The optional charge-eliminating is a step of applying a discharge bias to the photoconductor to discharge it, and may be performed by a charge-eliminating unit. The charge-eliminating unit is not particularly limited as long as it is capable of applying discharge bias to the photoconductor such as discharge lamps, and may be selected from known charge-eliminating units accordingly.

The optional cleaning step is a step in which residual electrophotographic toner on the latent electrostatic image bearing member is removed, and typically performed by a cleaning unit. Any known cleaning unit that is capable of removing residual electrophotographic toner on the latent electrostatic image bearing member may be used and examples include magnetic brush cleaner, electrostatic brush cleaner, magnetic roller cleaner, blade cleaner, brush cleaner, and web cleaner, etc.

The image forming apparatus of the present invention preferably includes a lubricant application unit which applies a lubricity-imparting agent or lubricant to a surface of the latent electrostatic image bearing member. The lubricity-imparting agent is preferably a metal soap, for example. Examples of the metal soap include zinc stearate, aluminum stearate and calcium stearate.

The optional recycling step is a step of transferring toner particles removed in the cleaning step back to the developing unit, and this step may be suitably performed by a recycling unit. The recycling unit is not particularly restricted, and a heretofore known transporting unit may be used.

The controlling step is a step of controlling each of the above-mentioned step, and this step may be favorably performed by a controlling unit. The controlling unit is not particularly restricted as long as it can control the performance of each unit. Examples thereof include such instruments as sequencers and computers.

Hereinafter, the image forming apparatus of the present invention will further be described with reference to the drawings.

Figure 5:
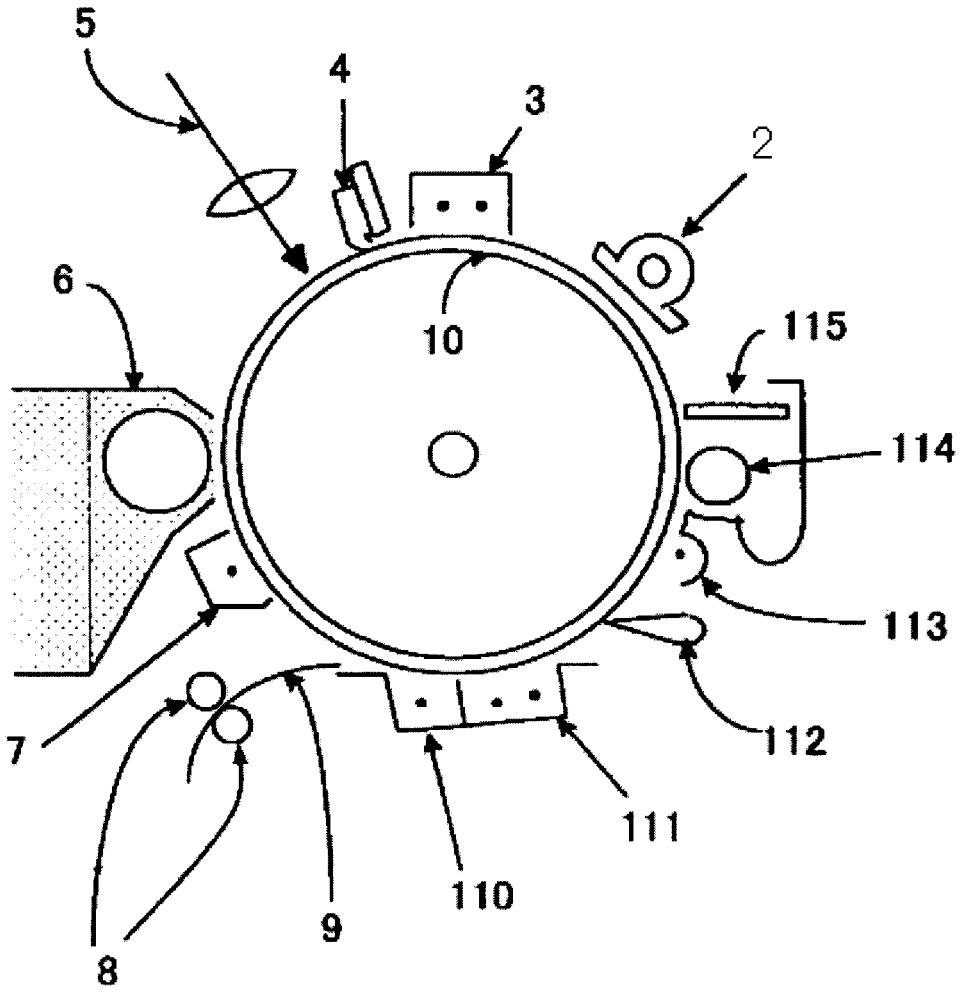
FIG. 5 is a schematic diagram showing an example of the image forming apparatus of the present invention.

FIG. 5 is a schematic diagram showing an example of the image forming apparatus of the present invention. The image forming apparatus shown in this drawing is an image forming apparatus equipped with the latent electrostatic image bearing member (photoconductor) of the present invention and is composed of a drum-shaped photoconductor 10, charge eliminating lamp 2, charger 3, eraser 4, image exposing unit 5, developing unit 6, pre-transfer charger 7, resist roller 8, transfer charger 110, separation charger 111, separation claw 112, pre-cleaning charger 113, cleaning brush 114, cleaning blade 115, and the like.

The shape of the photoconductor 10 is not specifically restricted to the drum shape shown in FIG. 5, and may be of sheet or endless belt shape, for example. In addition, the foregoing chargers may be selected from any known chargers such as corotrons, scorotrons, solid state chargers, charge rollers placed in contact with the latent electrostatic image bearing member, and charge rollers placed near but without contacting the latent electrostatic image bearing member through a gap-providing means such as a gap tape or step provided on both ends thereof.

A charge roller placed near but without contacting the photoconductor are significantly advantageous over a charge roller placed in contact with the photoconductor in that it provides improved charge uniformity and a greater tolerance to the occurrence of charge failure caused by smears on the charge roller, allowing them to be used without any maintenance. However, they have a disadvantage that the level of applied voltage should be increases. As a result, the stress or load on the photoconductor surface significantly increases and, in cases where conventional polymeric binder resin is used in the outermost surface layer (charge transporting layer or protective layer), it results in severe wearing of the photoconductor surface and shorter photoconductor life, thereby increasing costs and maintenance frequency.

The latent electrostatic image bearing member (photoconductor) of the present invention is capable of being stably charged even with a charging unit placed near but without contacting the photoconductor, while causing little wearing. Moreover, the photoconductor satisfies requirements such as reduced residual potential in the exposed area and prevention of image blur, and thus is capable of stable output of excellent images even over a long time repeated use. For the transferring unit it is generally possible to employ the chargers described above; however, a transferring unit like that shown in FIG. 5, which uses the transfer charger 110 and separation charger 111 in combination, is effective. A charge roller placed near the photoconductor exhibits unstable discharge only with direct voltage application, leading to non-uniform image density distribution. For this reason, it is preferable that direct voltage and alternating voltage be superimposed before application.

Light sources used for the image exposing unit 5 and charge eliminating lamp may be light-emitting materials in general such as fluorescent lighting, tungsten lamp, halogen lamp, mercury lamp, sodium lamp, light-emitting diode (LED), laser diode (LD) and electroluminescence (EL). Various filters such as sharp-cut filter, band-pass filter, near-infrared-cut filter, dichroic filter, interference filter and color-temperature conversion filter may be used to irradiate only a light with a desired wavelength.

The photoconductor can be irradiated with light by providing such additional steps as transferring step combined with light irradiation, charge eliminating step, cleaning step, or pre-exposing step, in addition to the units shown in FIG. 5.

Not all of the toner particles released on the photoconductor 10 by the developing unit 6 are transferred onto a recording medium 9; some of them remain on the photoconductor 10. When a subsequent copy process is carried out without cleaning these residual toner particles, it results in charging failure or troubles upon formation of latent electrostatic image by exposure. For this reason, it is generally preferable to remove residual toner particles by means of cleaning means. For such a cleaning means, a cleaning brush 114 and cleaning blade may be used singly or in combination, and any known cleaning brush is used, including a fur brush and a magnetic fur brush.

Materials used for the cleaning blade 115 are elastic bodies with small frictional coefficient; examples include urethane resins, silicone resins, fluorinated resins, urethane elastomers, silicone elastomers and fluorinated elastomers, preference is particularly given to urethane elastomers made of thermosetting urethane resin for their high wear resistance, ozone resistance and swear resistance. Note that elastomers include rubbers, The cleaning blade 115 preferably has a hardness (as measured in accordance with JIS-A) of around 65-85 degree, with preferable thickness being 0.8 mm to 3.0 mm and preferable protrusion amount being 3 mm to 15 mm. Other conditions such as contact pressure, contact angle, bite amount and the like can be set to appropriate levels according to the intended purpose.

The cleaning means that removes toner particles by contacting to the latent electrostatic image bearing member (photoconductor) has a high toner removal ability, but it of course may impart mechanical stress to the photoconductor to wear the outermost surface layer. In the photoconductor of the present invention, however, the protective layer has a high wear resistance. Thus, even when it is mounted to an image forming apparatus equipped with cleaning means that contacts the photoconductor surface for toner cleaning, it is capable of stable output of excellent images.

The image forming apparatus of the present invention may be provided with a mechanism by which a lubricity-imparting agent is applied over the photoconductor surface, though it is not shown in FIG. 5. In recent years, spherical toners, which are deemed to advantageous for achievement of high-resolution electrographic images, are put into practical use. It is known, however, that spherical toners are more difficult to be removed by means of blade cleaning than conventional pulverized toners. This problem has been solved by increasing the cleaning blade contact pressure and/or by employing a hard urethane rubber blade, for example.

These strategies tend to increase the mechanical stress to the photoconductor surface to which a cleaning blade is contacted, and are particularly effective because the wear amount of the photoconductor surface in fact increases in the case of spherical toner. The latent electrostatic image bearing member (photoconductor) of the present invention offers quite high wear resistance, the protective layer hardly wears even when used in high mechanical stress conditions described above.

There is a possibility that blade screaming and/or blade edge wear occur, which are considered to be due to high frictional coefficient with respect to the cleaning blade. These problems can be overcome by providing to the photoconductor surface a means of applying a lubricity-imparting agent, such that the frictional coefficient of the photoconductor surface with respect to the cleaning blade is kept low over a long period of time.

Figure 6:
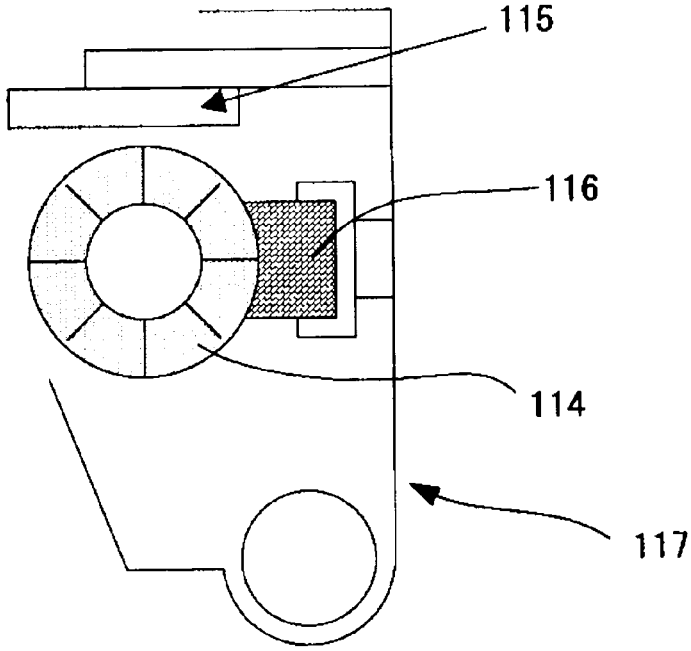
FIG. 6 is a schematic diagram showing an example of a lubricant application mechanism used in the image forming apparatus of the present invention.

In FIG. 6, a solid material that a lubricant 116 is made into a rod shape is pressed against a cleaning brush 114. The cleaning brush 114 scrapes the lubricant as it rotates, and the lubricant stuck on the brush is applied to the surface of the photoconductor. The lubricant is not necessarily a solid, and it may be applied to the surface of the latent electrostatic image bearing member as a liquid, a powder or in a half boiling state. It is not particularly restricted as long as it satisfies the electrophotographic characteristics, and it can be appropriately selected according to applications.

Examples of the lubricity-imparting agent or lubricant include metal soaps such as zinc stearate, barium stearate, aluminum stearate and calcium stearate; waxes such as carnauba, lanoline and haze wax; and lubricating oil such as silicone oil. Among these, zinc stearate, aluminum stearate and calcium stearate are particularly preferable for the easiness with which they are processed into a rod shape and for their high lubricating effect.

A lubricant application unit shown in FIG. 6 and provided in a cleaning unit 117 facilitates the layout design around the drum and simplifies the apparatus, but there are occasions that the contamination of a large quantity of lubricant in a cleaned toner makes it difficult to recycle the toner or reduces the cleaning efficiency of the brush. Although it is not shown in the figure, the above difficulties may be resolved by providing a application unit including a lubricant application unit independently and separately from a cleaning unit. Furthermore, by providing a plurality of application units and operating them in parallel or in series, the efficiency with which a lubricant is applied may be enhanced and/or the amount of consumption may be controlled.

Figure 7:
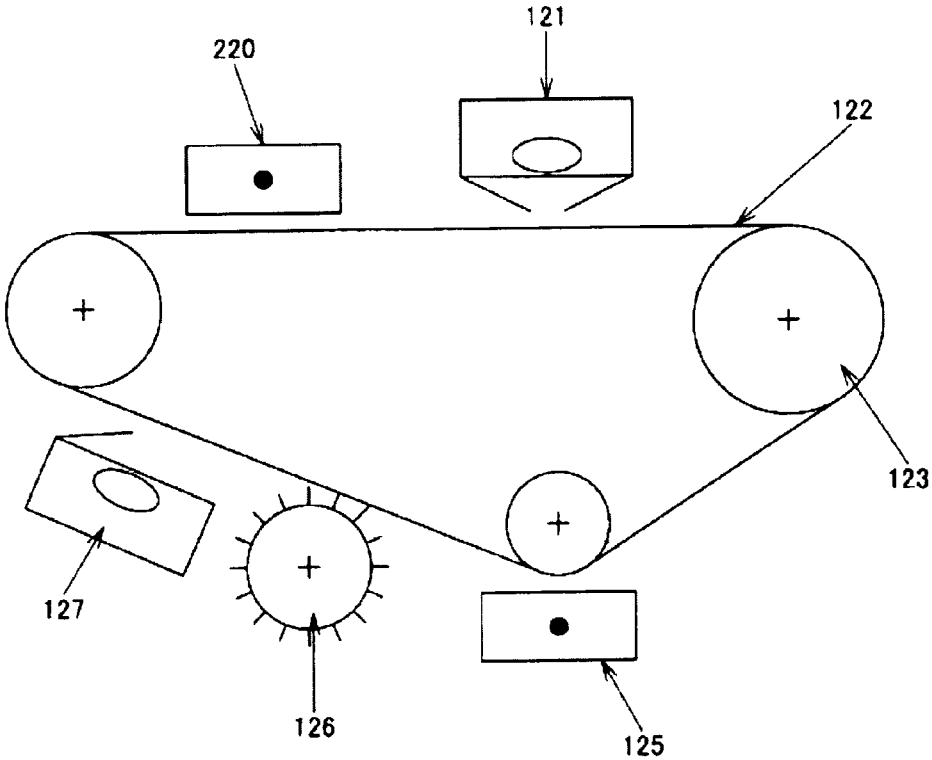
FIG. 7 is a schematic diagram showing another example of the image forming apparatus of the present invention.

FIG. 7 is a schematic diagram showing another example of the image forming apparatus of the present invention. In the image forming apparatus, a photoconductor 122 is the latent electrostatic image bearing member of the present invention and is driven to rotate by a drive roller 123. A process consisting of charging by means of a charger 220, image-wise exposure by means of an image-wise exposure light source 121, developing (not shown), transferring by means of a transfer charger 125, cleaning by means of a cleaning brush 126, and charge elimination by means of a charge eliminating light source 127 is repeatedly conducted.

Figure 8:
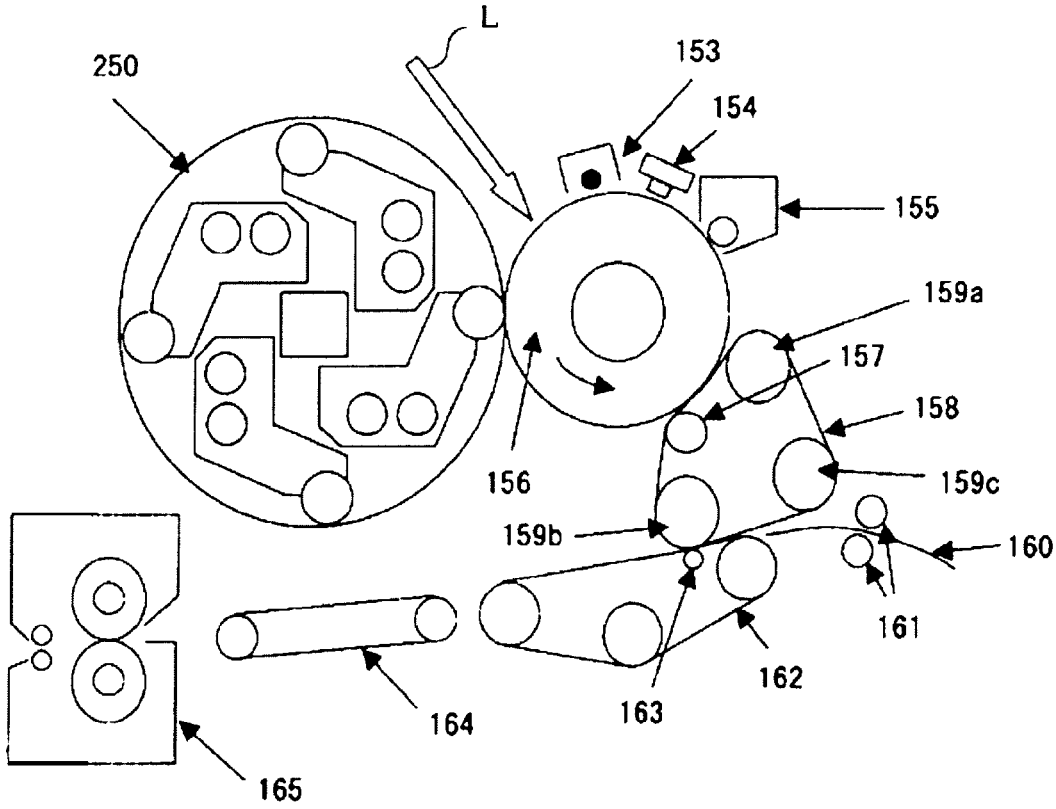
FIG. 8 is a schematic diagram showing still another example of the image forming apparatus of the present invention.

FIG. 8 is a schematic diagram showing a full-color image forming apparatus to which the photoconductor of the present invention has been applied. In FIG. 8, a photoconductor 156, which is the latent electrostatic image bearing member of the present invention, is driven to rotate toward the anticlockwise direction in FIG. 8, a surface thereof is charged uniformly by a charger 153 equipped with a corotron or scorotron, then the photoconductor 156 bears thereon a latent electrostatic image by being scanned with a scanning laser L from a laser device (not shown). The scanning is carried out by the mono-color information of yellow, magenta, cyan, and black based on the full-color image, therefore, the mono-color electrostatic latent images of yellow, magenta, cyan, and black are formed on the photoconductor 156.

A revolving developing unit 250 is disposed at the left side of the photoconductor 156 as shown in FIG. 8. The developing unit 250 comprises a yellow developing device, magenta developing device, cyan developing device, and developing device in the revolving drum-like housing, the respective developers are moved in sequence to the opposite developing site of the photoconductor 156 through revolving motion. The yellow developing device, magenta developing device, cyan developing device, and black developing device respectively cause the adhesion of yellow toner, magenta toner, cyan toner, and black toner, thereby to develop the electrostatic latent images. The electrostatic latent images of yellow, magenta, cyan, and black images are formed in sequence, and are developed by the respective revolving developer of revolving developing unit 250 in sequence, thereby yellow, magenta, cyan, and black toner images are formed.

An intermediate transferring unit is disposed at the downstream from the developing site in the revolution direction of the photoconductor 156. The intermediate transferring unit is activated by rotating endlessly in clockwise direction the intermediate transferring belt 158, tensioned on a tension roller 159*a*, an intermediate transferring bias roller 157 as transferring unit, a secondary transferring backup roller 159*b*, and a belt driving roller 159*c*, by the rotating force of the belt driving roller 159*c*. The yellow toner image, magenta toner image, cyan toner image, and black toner image developed on the photoconductor drum 156 progress into the intermediate nip where photoconductor drum 156 and intermediate transferring belt make contact. Then a color image with superimposed four colors is produced by superimposing respective toner images on an intermediate transferring belt 158 under the effect of the bias from the intermediate transferring bias roller 157.

The intermediate transferring system using a so-called intermediate transfer belt on which toner images are to be superimposed, which system consists of primary transfer wherein toner images of different monochrome colors formed on respective latent electrostatic image bearing members by means of developing units are sequentially stacked onto an intermediate transfer medium by means of transferring units and of secondary transfer wherein the resultant toner images are transferred onto a recording medium at a time, is capable positioning of the photoconductors and intermediate transfer medium relatively easily and precisely and can reduce the possibility of color displacement. For this reason, this system lends itself to an effective way of obtaining color images of high quality.

A surface of the photoconductor drum 156, passed through the nip as a result of rotation, is subjected to cleaning of the residual toner particles by drum cleaning unit 55. A drum cleaning unit 55, which cleans the residual transferring toner by a cleaning roller to which cleaning bias is applied, may equipped with a cleaning brush such as far brush or magnetic fur brush, or a cleaning blade.

The surface of the photoconductor drum 156, where the residual toner has been cleaned, is subjected to charge elimination by charge eliminating lamp 154. The charge eliminating lamp 154 may be a fluorescent lamp, tungsten lamp, halogen lamp, mercury lamp, sodium lamp, light emitting diode (LED), semiconductor laser (LD) and electroluminescent (EL) lamp. To achieve irradiation with light of desired wavelengths alone, various filters may be utilized such as a sharp-cut filter, band pass filter, near-infrared cut filter, dichroic filter, interference filter and color conversion filter.

At the bottom side of FIG. 8 showing the intermediate transfer unit, there are provided a transferring unit consisting of a transfer belt and various rollers (e.g., transfer bias roller and drive roller). At the left bottom side of the drawing a carrying belt 164 and a fixing unit 165 are illustrated. The transferring unit may be so configured that the endless carrying belt moves vertically in the drawing by means of unillustrated moving means. When at least a single-color toner image (e.g., yellow toner image) or a composite toner image consisting of superimposed toner images of 2 or 3 different colors passes through a position that faces the transfer bias roller 163, the transferring unit moves to a position where it never contacts the intermediate transfer belt 158. Before the head of the composite toner image on the intermediate transfer belt 156, which image consists of superimposed toner images of 4 different colors, moves to a position facing the transfer bias roller 163, the transferring unit moves to a position where it contacts the intermediate transfer belt 158 for the formation of a secondary transfer nip.

Meanwhile, a pair of resist rollers 161 that holds a recording medium 160 sent from a feed cassette (not shown) between the rollers sends the recording medium 160 toward the secondary transfer nip such that the composite toner image on the intermediate transfer belt 158 can be transferred on the recording medium 160. The composite toner image, which consists of superimposed toner images of 4 different colors and is formed on the intermediate transfer belt 158, is entirely transferred on the recording medium 160 in the secondary transfer nip by means of a secondary transfer bias from the transfer bias roller 163. As a result of this secondary transfer, a full-color image is formed on the recording medium 160.

The recording medium 160 carrying the full-color image is then transferred to the conveying belt 164 by means of the transfer belt 162. The conveying belt 164 sends the recording medium 160 received from the transferring unit into a fixing device 165, where the recording medium 165 is transferred between a fixing nip formed by contact between a heat roller and a backup roller. The full-color image on the recording medium 160 is fixed onto the recording medium 160 by means of heat from the heat roller and pressure in the fixing nip.

Although not shown in the drawing, bias voltage has been applied to the transfer belt 162 and conveying belt 164 so that a recording medium P is kept attached thereto. Also, there are provided a charge eliminating charger for removing charges from the recording medium 160, and three charge eliminating chargers for removing charges from the intermediate belt 158, transfer belt 162, and conveying belt 164. The intermediate transfer unit includes a belt cleaning unit with a configuration similar to that employed in the drum cleaning unit 155, whereby residual toner particles on the intermediate transfer belt 158 are cleaned.

Figure 9:
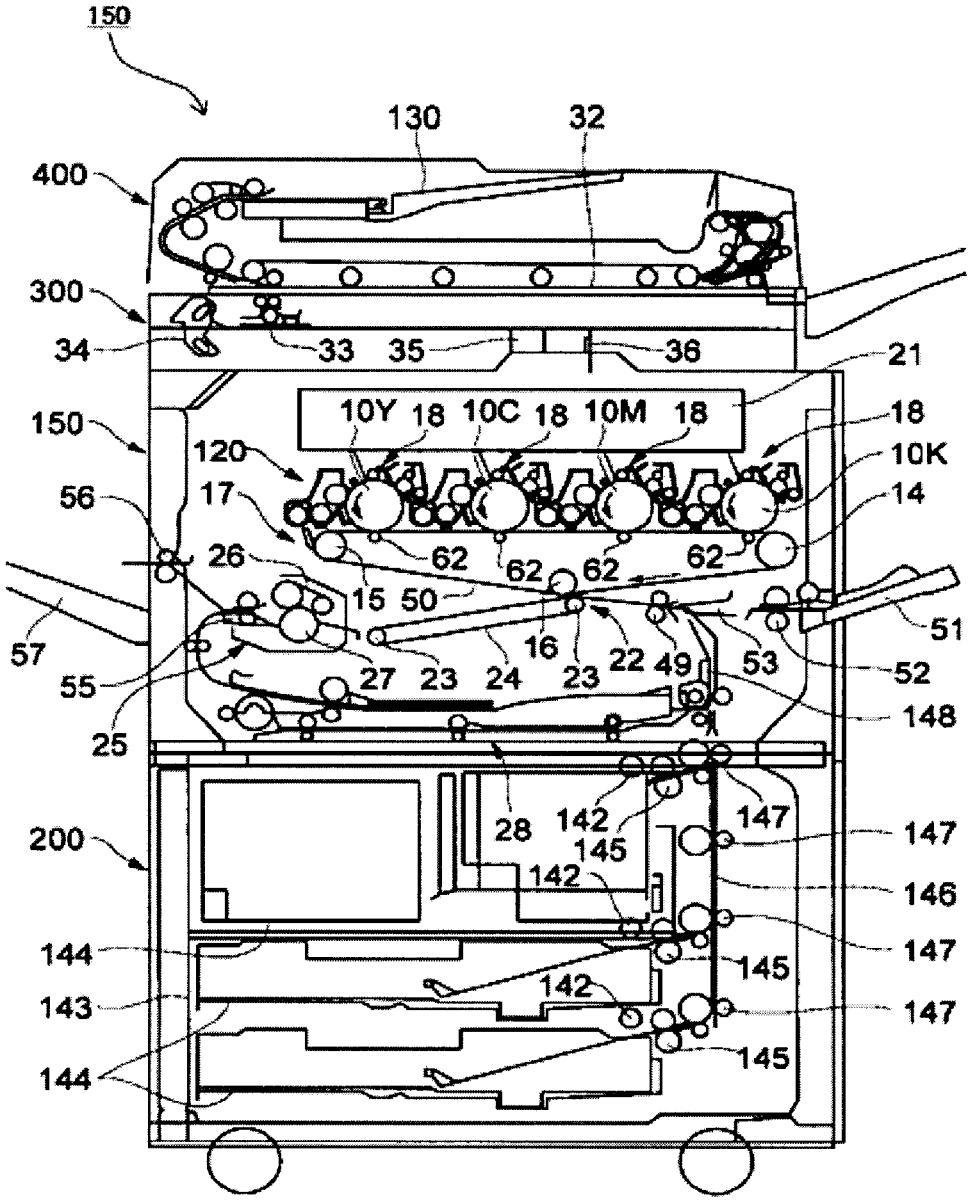
FIG. 9 is a schematic explanatory diagram showing an example of embodying the image forming method of the present invention by using the image forming apparatus (tandem color image forming apparatus) of the present invention.

The image forming apparatus of the present invention can be a tandem configuration that has a plurality of image forming elements each composed of a latent electrostatic image bearing member, a latent electrostatic image forming unit, a developing unit, and a transferring unit. FIG. 9 shows a schematic diagram of an example of a tandem image forming apparatus. In this drawing the copier main body 150 is provided with an endless belt-shaped intermediate transfer medium 50 at its center. The intermediate transfer member 50 is extended between support rollers 14, 15 and 16 so as to be rotatable in the clockwise direction shown in FIG. 9. The intermediate transfer member cleaning unit 17 is placed near the support roller 15 in order to remove the residual toner on the intermediate transfer member 50. The tandem developing device, in which four image forming unit 18, yellow, cyan, magenta and black, are positioned in line along the transport direction in the intermediate transfer member 50, which is being extended between the support roller 14 and 15. The exposure unit 21 is placed near the tandem developing unit element. The secondary transferring unit 22 is placed on the opposite side where the tandem developing unit element is placed in the intermediate transfer member 50. The secondary transfer belt 24, an endless belt, is extended between a pair of the roller 23 and the transfer paper transported on the secondary transfer belt 24 and the intermediate transfer member 50 are accessible to each other in the secondary transferring unit 22. The fixing unit 25 is placed near the secondary transferring unit 22.

The sheet inversion unit 28 is placed near the secondary transferring unit 22 and the fixing unit 25 in the tandem image forming apparatus, in order to invert the transfer paper to form images on both sides of the transfer paper.

Formation of full-color image (color copy) using the tandem developing device 120 will be explained. Firstly, a document is set on the document table 130 of the automatic document feeder (ADF) 400 or the automatic document feeder 400 is opened and a document is set on the contact glass 32 of the scanner 300 and the automatic document feeder 400 is closed.

By pushing the start switch (not shown), the scanner 300 is activated after the document was transported and moved onto the contact glass 32 when the document was set on the automatic document feeder 400, or the scanner 300 is activated right after, when the document was set onto the contact glass 32, and the first carrier 33 and the second carrier 34 will start running. The light from the light source is irradiated from the first carrier 33 simultaneously with the light reflected from the document surface is reflected by the mirror of second carrier 34. Then the scanning sensor 36 receives the light via the imaging lens 35 and the color copy (color image) is scanned to provide image information of black, yellow, magenta and cyan.

Figure 10:
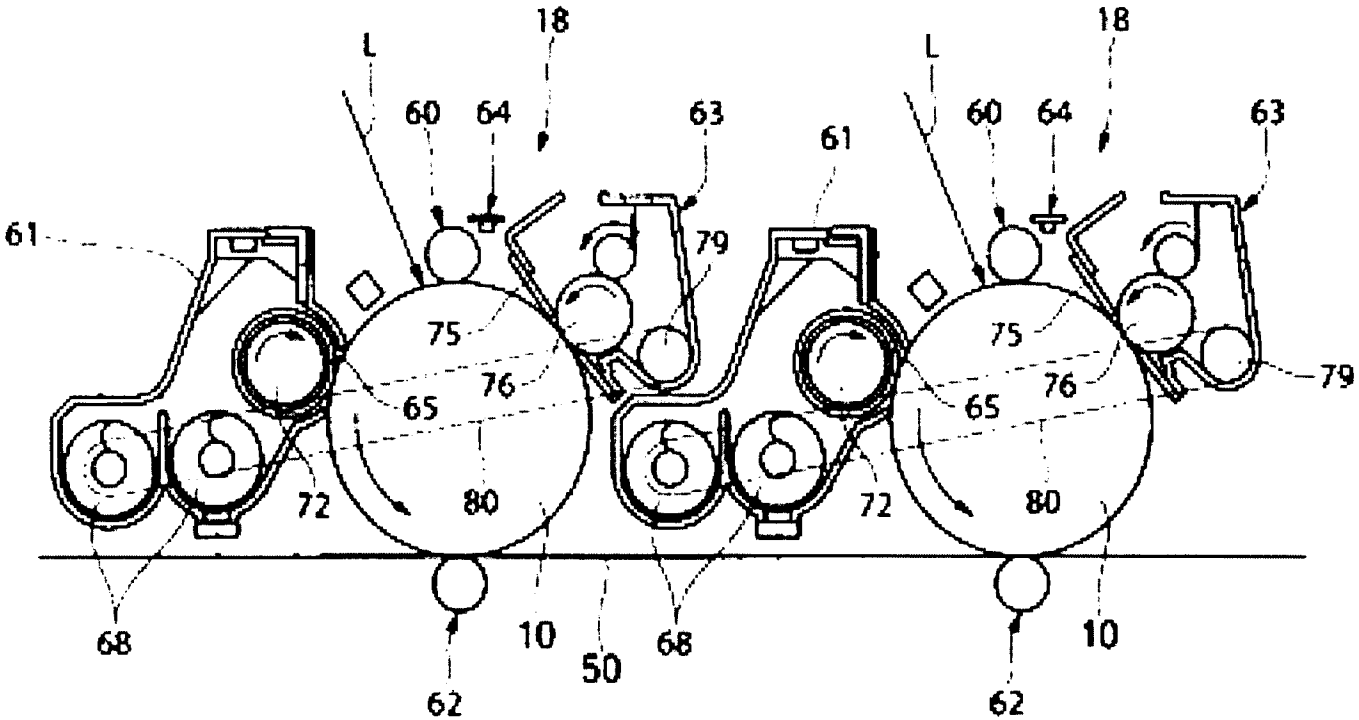
FIG. 10 is a partially enlarged explanatory diagram of the image forming apparatus of FIG. 9.

Each image information for black, yellow, magenta and cyan is transmitted to each image forming unit 18, i.e., black image forming unit, yellow image forming unit, magenta image forming unit and cyan image forming unit, of the tandem developing device 120 and each toner image of black, yellow, magenta and cyan is formed in each image forming unit. The image forming unit 18: black image forming unit, yellow image forming unit, magenta image forming unit and cyan image forming unit of the tandem image forming element 120 as shown in FIG. 10 is equipped with the photoconductor 10: photoconductor 10K for black, photoconductor 10Y for yellow, photoconductor 10M for magenta and photoconductor 10C for cyan, the charger 60 that charges photoconductor evenly, an exposing unit by which the photoconductor is exposed image-wise corresponding to each color images based on each color image information as indicated by L in FIG. 10 to form a latent electrostatic image corresponding to each color image on the photoconductor, the developing unit 61 by which the latent electrostatic image is developed using each color toner: black toner, yellow toner, magenta toner and cyan toner to form toner images, the charge-transferring unit 62 by which the toner image is transferred onto the intermediate transfer member 50, the photoconductor cleaning unit 63 and the charge eliminating unit 64. The image forming unit 18 is able to form each single-colored image: black, yellow, magenta and cyan images, based on each color image information.

These formed images: black image formed on the photoconductor 10K for black, yellow image formed on the photoconductor 10Y for yellow, magenta image formed on the photoconductor 10M for magenta and cyan image formed on the photoconductor 10C for cyan, are transferred sequentially onto the intermediate transfer member 50 which is being rotationally transported by the support rollers 14, 15 and 16 (primary transfer). And the black, yellow, magenta and cyan images are superimposed to form a composite color image, a color image to be transferred.

Each of the color toners for developing a latent electrostatic image is mixed with carrier and placed in a developing unit and agitated by a agitation screw 68, whereby toner particles are charged. The charged toner and carrier particles are retained to the magnetic roller 72 in the form of chains, forming a magnetic brush 65. Some toner particles of the magnetic brush 65 are transferred onto a surface of the latent electrostatic image bearing member 10 by electrical attracting force. In this way a toner visible image is formed on the surface of the latent electrostatic image bearing member 10.

At the downstream of the transferring unit, there is provided a cleaning unit 63 for cleaning residual toner particles. In FIG. 10 a brush cleaner 76 and a cleaning blade 75 are provided, the cleaning blade 75 placed such that it points in the direction opposite to the rotation of the latent electrostatic image bearing member surface. In this way residual toner particles on the latent electrostatic image bearing member surface are recovered. The recovered toner particles can be introduced back into the developing device by means of a recycling unit. In FIG. 10 toner recycling is accomplished by introducing toner particles recovered by means of the cleaning unit are introduced into the developing device 61 by means of a conveying screw 79 through a recycle path 80.

In the feeding table 200, one of the feeding rollers 142 is selectively rotated and sheets (recording paper) are rendered out from one of the feeding cassettes 144 equipped with multiple-stage in the paper bank 143 and sent out to feeding path 146 after being separated one by one by the separation roller 145. The sheets are then transported to the feeding path 148 in the copier main body 150 by the transport roller 147 and are stopped running down to the resist roller 49. Alternatively, sheets (recording paper) on the manual paper tray 51 are rendered out by the rotating feeding roller 142, inserted into the manual feeding path 53 after being separated one by one by the separation roller 52 and stopped by running down to the resist roller 49. Generally, the resist roller 49 is used being grounded; however, it is also usable while bias is imposed for the sheet powder removal.

The resist roller 49 is rotated on the composite color image (color transfer image) on the intermediate transfer member 50 in conjunction with the composite color image formed on the intermediate transfer member 25, and a sheet (recording paper) is sent out between the intermediate transfer member 50 and the secondary transferring unit 22. The color image is then formed on the sheet (recording paper) by transferring (secondary transferring) the composite color image (color transfer image) by the secondary transferring unit 22. The residual toner on the intermediate transfer member 50 after the image transfer is cleaned by the intermediate transfer member cleaning unit 17.

The sheet (recording paper) on which the color image is transferred and formed is taken out by the secondary transferring unit 22 and sent out to the fixing unit 25 in order to fix the composite color image (color transfer image) onto the sheet (recording paper) by means of heat and pressure. The fixing unit 25 is configured by pressing the pressure roller 27 against the fixing belt 26.

Triggered by the switch claw 55, the sheet (recording paper) is ejected by the ejection rollers 56 and stacked on the output tray 57. Alternatively, triggered by the switch 55, the sheet is inverted by the sheet inversion unit 28 and led to the transfer position again. After recording an image on the reverse side, the sheet is then ejected by the ejection rollers 56 and stacked on the output tray 57.

With this tandem configuration it is possible form and develop latent electrostatic images of different colors in parallel, thereby making image formation much faster than image forming apparatus with a revolver configuration. The printer shown in FIG. 9 adopts the intermediate transfer system and by being equipped with the photoconductor of the present invention, it is capable of high-speed, stable output of high-quality full-color images with less color displacement over a long period of time.

<Process Cartridge>

The process cartridge in the present invention comprises the latent electrostatic image bearing member of the present invention and at least one unit selected from the group consisting of the charging unit, exposing unit, developing unit, transferring unit, and cleaning unit, and may further comprise additional unit(s) appropriately selected as needed.

The developing unit comprises at least a developer container for housing therein toner or developer, and a developer bearing member for bearing thereon and transferring the toner or developer, and may further comprise for instance a thickness regulating member for regulating the thickness of the toner layer on the developer bearing member.

Figure 11:
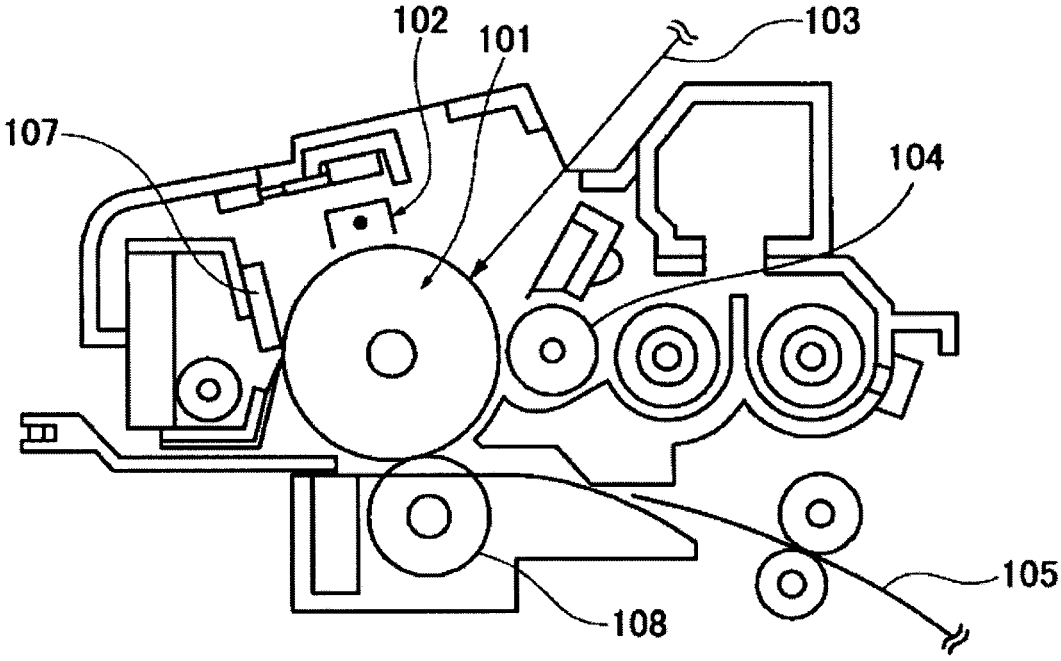
FIG. 11 is a schematic diagram showing an example of the process cartridge of the present invention.

As shown in FIG. 11, for example, the process cartridge comprises the photoconductor 101 therein, comprises the charger 102, exposure light 103 from a exposing device, developing unit 104 and cleaning unit 107, and further comprises additional unit(s) where necessary. In this drawing reference numeral 105 denotes a recording medium, and 108 denotes a transfer roller. For the photoconductor 101, the latent electrostatic image bearing member of the present is employed. For the exposing device a light source capable of high-resolution writing is employed. For the charger 102, any charging member can be employed.

In the image forming apparatus of the present invention, such components as the latent electrostatic image bearing member, developing device, and cleaning unit may be integrated to form a unit, which is detachably mounted to the main body of the image forming apparatus. Alternatively, a process cartridge may be fabricated by integrally providing the latent electrostatic image bearing member and at least one of the charger, image-wise exposing device, developing device, transferring or separating device, and cleaning device, to form a single unit that can be detachably mounted to the main body through such guide means as a rail, which is provided to the main body.

By adopting this process cartridge configuration, the latent electrostatic image bearing member and other process members can be replaced readily in a short time, thereby shortening the maintenance time for reduced costs. In addition, since the latent electrostatic image bearing member and process members are integrally provided, the precision of their relative physical relationship increases.

<Toner>

Toners for visualizing latent electrostatic images by the developing unit of the image forming apparatus of the present invention will be described. The toners employed in the image forming apparatus of the present invention are not particularly limited in terms of toner materials, manufacturing methods and the like, and can be appropriately selected from those known in the art according to the purpose. Examples of methods of manufacturing toner are pulverization/classification method, suspension polymerization method, emulsion polymerization method and polymer emulsion method, in which the latter three methods involve emulsification, suspension, or aggregation of an oil phase in an aqueous solvent to form toner base particles.

The pulverization method is the method for obtaining a base particle for toner by melting and kneading toner materials (e.g., binder resin, colorant and releasing agent and the like), and by pulverizing and classifying them. Furthermore, in the case of this pulverization method, in order to adjust the toner's average circularity to 0.97 to 1.0, a mechanical impact force may be applied to toner base particles to make their shape spherical. In this case, a mechanical impact force may be applied to toner base particles using a device such as a hybridizer or a mechano-fusion.

In the suspension polymerization method, a colorant, a releasing agent and the like are dispersed in an oil soluble polymerization initiator and a polymerizable monomer, and emulsified and dispersed by the below-described emulsification method in an aqueous medium in which a surfactant and other solid dispersants are contained. Thereafter, polymerization is effected to form toner particles, and then a wet treatment may be conducted in which inorganic fine particles are attached to the toner particle surface. In this process it is preferable that the treatment be conducted to toner particles from which remaining surfactant and the like has been removed by washing.

By employing as the polymerizable monomers some of the compounds selected from acids such as acrylic acid, methacrylic acid, α-cyanoacrylate, α-cyanomethacrylate, itaconic acid, crotonic acid, fumaric acid, maleic acid and maleic anhydride, acrylamide, methacrylamide, diacetone acrylamide or methylol compounds thereof, vinylpyridine, vinylpyrrolidone, vinylimidazole, ethyleneimine, and (meth) acrylates having amino groups such as dimethylaminoethyl methacrylate, it is possible to introduce functional groups to the toner particle surface. Moreover, by selecting the ones that contain acid groups or basic groups as dispersants to be used, a dispersant is made to adsorb and remain on the particle surface, thus enabling to introduce functional groups.

In the emulsification polymerization method, a water-soluble polymerization initiator and a polymerizable monomer are emulsified with a surfactant in water, and latex is synthesized by the normal emulsification and polymerization methods. Another dispersion in which a colorant, a releasing agent and the likes are dispersed in an aqueous medium is prepared, and coagulated in toner size after mixing, and melted and deposited by heating to obtain toner. Thereafter, the below-described treatment for depositing inorganic fine particles may be conducted by wet method. The use of a monomer similar to that is usable in the suspension and polymerization method as latex allows functional groups to be introduced to the toner particle surface.

In the present invention manufacturing methods that emulsify or disperse in an aqueous medium a solution or dispersion liquid containing dissolved or dispersed toner materials (start materials) are preferable. This is because these methods offer high resin selectivity and excellent toner granulation properties, achieve easy control of the particle diameter, particle size distribution and shape of toner, and are capable of producing toners that have excellent low temperature fixing properties. Note that the solution is obtained by dissolving toner materials in a solvent, and the dispersion liquid is obtained by dispersing toner materials in a solvent.

The toner prepared by emulsifying or dispersing of toner materials in an aqueous medium contains at least an adhesive base material and the like produced by reacting together an active hydrogen group-containing compound, a polymer capable of reacting with the active hydrogen group-containing compound, a releasing agent, and a colorant, and may further contain binder resin appropriately selected from those known in the art. Where necessary, the toner may further contain additional ingredients such as resin fine particles and charge controlling agent. Note that the toner employed in the present invention contains at least binder resin except where it contains neither active hydrogen group-containing compound nor polymer capable of reacting with the compound.

As will be described later, those toners are preferable that are produced by emulsifying or dispersing in an aqueous phase an oil phase which has been prepared by dissolving in an organic solvent toner materials containing at least an active hydrogen group-containing compound (AC) and a polymer (PC) capable of reacting with (AC). For the purpose of simplicity, the active hydrogen group-containing compound and the polymer capable of reacting with the active hydrogen group-containing compound may be abbreviated as (AC) and (PC), respectively.

—Adhesive Base Material—

The adhesive base material exhibits adhesion with respect to a recording medium such as paper, contains at least an adhesive polymer that is obtained by reacting an active hydrogen group-containing compound and a polymer capable of reacting with this active hydrogen group-containing compound in an aqueous medium, and further may contain a binder resin suitably selected from known binder resins.

The weight-average molecular weight of the adhesive base material may be suitably selected depending on the purpose without particular limitation. The weight-average molecular weight is, for example, preferably 1,000 or more, more preferably 2,000 to 10,000,000, still more preferably 3,000 to 1,000,000. When the weight-average molecular weight is less than 1,000, it may result in low hot offset resistance.

The storage elastic modulus of the adhesive base material may be suitably selected depending on the purpose without particular limitation. For example, temperatures (T'G) of 10,000 dyne/cm$^2$ at a measured frequency 20 Hz is normally 100° C. or more, preferably 110° C. to 200° C. When this (T'G) is less than 100° C., a heat offset resistance may be worse.

The viscosity of the adhesive base material may be suitably selected depending on the purpose without particular limitation. For example, temperatures ($T\eta$) of 1,000 poises at a measured frequency 20 Hz is normally 180° C. or more, preferably 90° C. to 160° C. When this ($T\eta$) exceeds 180° C., a low-temperature fixing property may be worse.

Consequently, in respect of achieving both hot offset resistance and low-temperature fixing property, the (TG') is preferred to be higher than the ($T\eta$). That is, a difference ($TG'-T\eta$) between (TG') ad ($T\eta$) is preferably 0° C. or more, more preferably 10° C. or more, still more preferably 20° C. or more. The larger this difference is, the better it is.

In addition, from the viewpoint of achieving both low-temperature fixing property and heat resistant preserving property, the ($TG'-T\eta$) is preferably 0° C. to 100° C., more preferably 10° C. to 90° C., still more preferably 20° C. to 80° C.

Specific examples of the adhesive base materials may be suitably selected depending on the purpose without particular limitation, and preferably include polyester reins, and the like. The polyester resins may be suitably selected depending on the purpose without particular limitation, and in particular, preferably include urea modified polyester resin, and the like.

The urea modified polyester resin is obtained by the reaction in the aqueous medium of amines (B) as the active hydrogen group-containing compound, and isocyanate group-containing polyester pre-polymer (A) as a polymer capable of reacting with this active hydrogen group-containing compound.

The urea modified polyester resin may contain a urethane bond other than a urea bond. In this case, the molar ratio of containing this urea bond and this urethane bond (urea bond/urethane bond) may be suitably selected depending on the purpose without particular limitation, and is preferably 100/0 to 10/90, more preferably 80/20 to 20/80, particularly preferably 60/40 to 30/70. When the urea bonds are less than 10, the hot offset resistance may be reduced.

Specific examples of the urea modified polyester resin preferably include the following (1) to (10):

(1) a mixture of urea products with isophorone diamine of polyester prepolymer obtained by reacting with isophorone diisocyanate a polycondensate of bisphenol A ethylene oxide (2 mol) adduct and an isophthalic acid, and polycondensate of bisphenol A ethylene oxide (2 mol) adduct and an isophthalic acid.

(2) a mixture of urea products with isophorone diamine of polyester prepolymer obtained by reacting with isophorone diisocyanate a polycondensate of bisphenol A ethylene oxide (2 mol) adduct and an isophthalic acid, and a polycondensate of bisphenol A ethylene oxide (2 mol) adduct and an terephthalic acid.

(3) a mixture of urea products with isophorone diamine of polyester prepolymer obtained by reacting with isophorone diisocyanate a polycondensate of bisphenol A ethylene oxide (2 mol) adduct/bisphenol A propylene oxide (2 mol) adduct and an terephthalic acid, and a polycondensate of bisphenol A ethylene oxide (2 mol) adduct/bisphenol A propylene oxide (2 mol) adduct and an terephthalic acid.

(4) a mixture of urea products with isophorone diamine of polyester prepolymer obtained by reacting with isophorone diisocyanate a polycondensate of bisphenol A ethylene oxide (2 mol) adduct/bisphenol A propylene oxide (2 mol) adduct and an terephthalic acid, and a polycondensate of bisphenol A propylene oxide (2 mol) adduct and an terephthalic acid.

(5) a mixture of urea products with hexamethylene diamine of polyester prepolymer obtained by reacting with isophorone diisocyanate a polycondensate of bisphenol A ethylene oxide (2 mol) adduct and a terephthalic acid, and a polycondensate of bisphenol A ethylene oxide (2 mol) adduct and an terephthalic acid.

(6) a mixture of urea products with hexamethylene diamine of polyester prepolymer obtained by reacting with isophorone diisocyanate a polycondensate of bisphenol A ethylene oxide (2 mol) adduct and an terephthalic acid, and a polycondensate of bisphenol A ethylene oxide (2 mol) adduct/bisphenol A propylene oxide (2 mol) adduct and an terephthalic acid.

(7) a mixture of urea products with ethylene diamine of polyester prepolymer obtained by reacting with isophorone diisocyanate a polycondensate of bisphenol A ethylene oxide (2 mol) adduct and a terephthalic acid, and a polycondensate of bisphenol A ethylene oxide (2 mol) adduct and an terephthalic acid.

(8) a mixture of urea products with hexamethylene diamine of polyester prepolymer obtained by reacting with diphenylmethane diisocyanate a polycondensate of bisphenol A ethylene oxide (2 mol) adduct and an isophthalic acid, and a polycondensate of bisphenol A ethylene oxide (2 mol) adduct and an isophthalic acid.

(9) a mixture of urea products with hexamethylene diamine of polyester prepolymer obtained by reacting with diphenylmethane diisocyanate a polycondensate of bisphenol A ethylene oxide (2 mol) adduct/bisphenol A propylene oxide (2 mol) adduct and an terephthalic acid/dodecenylsuccinic anhydride, and a polycondensate of bisphenol A ethylene oxide (2 mol) adduct/bisphenol A propylene oxide (2 mol) adduct and an terephthalic acid.

(10) a mixture of urea products with hexamethylene diamine of polyester prepolymer obtained by reacting with toluene diisocyanate a polycondensate of bisphenol A ethylene oxide (2 mol) adduct and an isophthalic acid, and a polycondensate of bisphenol A ethylene oxide (2 mol) adduct and an isophthalic acid.

(Active Hydrogen Group-Containing Compound)

The active hydrogen group-containing compound acts as an extender and cross linking agent when a polymer capable of reacting with this active hydrogen group-containing compound is extended and cross-linked in an aqueous medium.

The active hydrogen group-containing compounds may be suitably selected depending on the purpose without particular limitation insofar as they contain active hydrogen groups. For example, in the case where a polymer capable of reacting with the hydroxyl group-containing compound is the isocyanate group-containing polyester prepolymer (A), in respect of being capable of having higher molecular weight by the reactions such as extension reaction or cross-linking reaction with this isocyanate group-containing polyester prepolymer (A), the amines (B) are preferred.

The active hydrogen groups may be suitably selected depending on the purpose without particular limitation, and include, for example, hydroxyl groups (alcoholic hydroxyl groups or phenolic hydroxyl groups), amino groups, carboxyl groups, and mercapto groups. They may be used alone, or two or more of them may be used in combination. Out of them, alcoholic hydroxyl groups are particularly preferred.

The amines (B) may be suitably selected depending on the purpose without particular limitation, and include, for example, diamine (B1), polyamine (B2) having 3 or more amino groups, amino alcohol (B3), amino mercaptan (B4), amino acid (B5), and blocked amino groups of the B1 to B5 (B6). They may be used singly or in combination. Out of them, diamine (B1) and a mixture of diamine (B1) and a small amount of polyamine (B2) with 3 or more amino groups are particularly preferred.

The diamines (B1) include, for example, an aromatic diamine, an alicyclic diamine, and an aliphatic diamine. These aromatic diamines include, for example, phenylenediamine, and diethyltoluenediamine, 4,4' diaminephenylmethane. These alicyclic diamines include, for example, 4,4'-diamine-3,3' dimethyldicyclohexylmethane, diaminecyclohexane, and isophorone diamine. These aliphatic diamines include, for example, ethylene diamine, tetramethylene diamine, and hexamethylene diamine.

The polyamine (B2) having 3 or more amino groups include, for example, diethylene triamine, and triethylene tetramine. The amino alcohol (B3) include, for example, ethanolamine and hydroxylethyl aniline. The aminomercaptan (B4) include, for example, aminoethyl mercaptan and aminopropylmercaptan. The amino acids (B5) include, for example, aminopropionic acid and aminocaproic acid. The blocked amino groups of the B1 to B5 (B6) include, for example, ketimine compound and oxazolidine compound that are obtained with any amines of the (B1) to (B5), and any ketones (acetone, methylethyl ketone, methylisobutyl ketone, and the like).

Furthermore, to stop the extension reaction and the cross-linking reaction between the active hydrogen group-containing compound and the polymer capable of reacting with the active hydrogen group-containing compound, a reaction terminator can be used. The use of this reaction terminator is preferred in respect of capable of controlling e.g., molecular weights of the adhesive base materials in a desired range. These reaction terminators include, for example, monoamine (diethylamine, dibutylamine, butylamine, laurylamine, and the like), or the ones that are obtained by blocking these monoamines (ketimine compound).

As the mixing ratio between the amines (B) and the isocyanate group-containing polyester prepolymers (A), the mixing ratio ([NCO]/[NHx]) between isocyanate groups [NCO] in the isocyanate group-containing prepolymers (A) and amino groups [NHx] in the amines (B), on an equivalent weight basis, is preferably 1/3 to 3/1, more preferably 1/2 to 2/1, still more preferably 1/1.5 to 1.5/1. When the mixing ratio ([NCO]/[NHx]) is less than 1/3, a low-temperature fixing property may be worse. When exceeding 3/1, a molecular weight of the urea modified polyester resin is decreased. The hot offset resistance may be worse.

(Polymer Capable of Reacting with Active Hydrogen Group-Containing Compound)

The polymers capable of reacting with an active hydrogen group-containing compound (hereinafter, may be referred to as "prepolymers") may be suitably selected from known resins depending on the purpose without particular limitation insofar as at least they have sites capable of reacting with the active hydrogen group-containing compound, and include, for example, polyol resins, polyacrylic resins, polyester resins, epoxy resins, and derivative resins. They may be used singly or in combination. Out of these resins, polyester resins are particularly preferred in respect of high flowability in the melted state and transparency.

The sites capable of reacting with the active hydrogen group-containing compound in the prepolymer may be suitably selected from known substituent groups depending on the purpose without particular limitation, and include, for example, isocyanate groups, epoxy groups, carboxylic acids, and acid chloride groups. They may be used singly or in combination. Out of these substituent groups, isocyanate groups are particularly preferred.

Among the prepolymers, in view of the fact that the molecular weights of high molecular components are easy to adjust, that an oil-less low-temperature fixing property in toner manufactured by dry method, and that an excellent releasing property and fixing property are reliably achieved particularly even in the case where there is no releasing oil application mechanism to a fixing heating medium, urea-bond generating group-containing polyester resin (RMPE) are particularly preferred.

The urea bond generating groups include, for example, isocyanate groups. In the case where this urea bond generating group in the urea bond generating group-containing polyester resin (RMPE) is this isocyanate group, the polyester resins (RMPE) particularly preferably include the isocyanate group-containing polyester prepolymers (A).

The isocyanate group-containing polyester prepolymers (A) may be suitably selected depending on the purpose without no particular limitation, and include, for example, the one which is a polycondensate of polyol (PO) and polycarboxylic acid (PC), as well as which is obtained by reacting the active hydrogen group-containing polyester resin with polyisocyanate (PIC).

The polyols (PO) may be suitably selected depending on the purpose without no particular limitation, and include, for example, diol (DIO), polyol (TO) having 3 or more hydroxyl groups, and the mixture of diol (DIO) and polyol (TO) having 3 valneces or more. They may be used alone, or two or more of them may be used in combination. Out of them, the diol (DIO) alone and the mixture of the diol (DIO) and a small amount of the polyol (TO) having or more hydroxyl groups are preferred.

Examples of the diols (DIO) include alkylene glycol, alkylene ether glycol, alicyclic diol, alkylene oxide adducts of alicyclic diol, bisphenols, and alkylene oxide adducts of bisphenols.

The alkylene glycols preferably have 2 to 12 carbon atoms. Examples of the alkylene glycols include ethylene glycol, 1,2-propylene glycol, 1,3-propylene glycol, 1,4-butanediol, and 1,6-hexanediol. Examples of the alkylene ether glycols include diethylene glycol, triethylene glycol, dipropylene glycol, polyethylene glycol, polypropylene glycol, and polytetramethylene ether glycol. Examples of the alicyclic diols include 1,4-cyclohexane dimethanol and hydrogenated-bisphenol A. Examples of the alkylene oxide adducts of alicyclic diol include adducts of alkylene oxides such as ethylene oxide, propylene oxide, and butylene oxide with respect to the alicyclic diol. Examples of the bisphenols include bisphenol A, bisphenol F, and bisphenol S. Examples of the alkylene oxide adducts of bisphenols include adducts of alkylene oxides such as ethylene oxide, propylene oxide, and butylene oxide with respect to the bisphenols.

Out of them, alkyleneglycols having 2 to 12 carbon atoms, and alkylene oxide adducts of bisphenols are preferred, and alkylene oxide adducts of bisphenols, and a mixture of alkylene oxide adducts of bisphenols and alkyleneglycols having 2 to 12 carbon atoms are particularly preferred.

For the polyols (TO) having 3 or more hydroxyl groups, those having 3 to 8 hydroxyl groups or more are preferable. Examples include polyhydric aliphatic alcohols 3 or more hydroxyl groups, polyphenols having 3 or more hydroxyl groups, and alkylene oxide adducts of polyphenols having 3 or more hydroxyl groups.

Examples of the polyhydric aliphatic alcohols having 3 or more hydroxyl groups include glycerin, trimethylol ethane, trimethylol propane, pentaerythritol, and sorbitol. Examples of the polyphenols having 3 or more hydroxyl groups include trisphenol PA, phenol novolac, and cresol novolac. Examples of the alkylene oxide adducts of polyphenols having 3 or more hydroxyl groups include adducts of alkylene oxides such as ethylene oxide, propylene oxide, and butylenes oxide with respect to the polyphenols having 3 or more hydroxyl groups.

The mixing ratio (DIO:TO) between the diol (DIO) and the polyol(TO) having 3 or more hydroxyl groups in the mixture of the diol (DIO) and the polyol(TO) having 3 or more hydroxyl groups, on a mass basis, is preferably 100:0.01 to 100:10, more preferably 100:0.01 to 100:1.

The polycarboxylic acids (PC) may be suitably selected depending on the purpose without particular limitation, and include, for example, dicarboxylic acid (DIC), polycarboxylic acid(TC) having 3 or more carboxyl groups, and a mixture of dicarboxylic acid (DIC) and polycarboxylic acid having 3 or more carboxyl groups.

They may be used singly or in combination. Out of them, dicarboxylic acid (DIC) alone or a mixture of DIC and a small amount of polycarboxylic acid having 3 or more carboxyl groups (TC) are preferable.

Examples of the dicarboxylic acids include alkylene dicarboxylic acids, alkenylene dicarboxylic acids, and aromatic dicarboxylic acids.

Examples of the alkylene dicarboxylic acids include succinic acid, adipic acid, and sebacic acid. The alkenylene dicarboxylic acids preferably have 4 to 20 carbon atoms, and examples include, for example, maleic acid and fumaric acid. The aromatic dicarboxylic acids preferably have 8 to 20 carbon atoms, and examples include, for example, phthalic acid, isophthalic acid, terephthalic acid, and naphthalene dicarboxylic acid. Out of them, alkenylene dicarboxylic acids of carbon 4 to 20 carbon atoms, and aromatic dicarboxylic acids of 8 to 20 carbon atoms are preferable.

For the polycarboxylic acids (TO) having 3 or more carboxyl groups those having 3 to 8 carboxyl groups or more are preferable, and examples include, for example, aromatic polycarboxylic acids. The aromatic polycarboxylic acids preferably have 9 to 20 carbon atoms, and examples include, for example, trimellitic acid and pyromellitic acid.

For the polycarboxylic acids (PC), it is also possible to use acid anhydrides or lower alkylester products that are selected from the dicarboxylic acids (DIC), the polycarboxylic acids having 3 or more carboxyl groups (TC), and a mixture of the dicarboxylic acids (DIC) and the polycarboxylic acids having 3 or more carboxyl groups. Examples of the lower alkylesters include methylester, ethylester, and isopropylester.

The mixing ratio (DIC:TC) between the dicarboxylic acid (DIC) and the polycarboxylic acid having 3 or more carboxyl groups (TC) in the mixture of the dicarboxylic acid (DIC) and the polycarboxylic acid having 3 or more carboxyl groups (TC), on a mass basis, may be suitably selected depending on the purpose without no particular limitation, and is preferably 100:0.01 to 100:10, more preferably 100:0.01 to 100:1.

Upon polycondensation reaction between the polyol (PO) and polycarboxylic acid (PC), the mixing ratio between them on a mass basis may be suitably selected depending on the purpose without particular limitation. For example, the mixing ratio ([OH]/[COOH]) between hydroxyl group [OH] in the polyol (PO) and carboxylic group [COOH] in the polycarboxylic acid (PC) on an equivalence basis is preferably 2/1 to 1/1, more preferably 1.5/1 to 1/1, still more preferably 1.3/1 to 1.02/1.

The content of the polyol (PO) in the isocyanate group-containing polyester prepolymer (A) may be suitably selected depending on the purpose without particular limitation, and is, for example, preferably 0.5% by mass to 40% by mass, more preferably 1% by mass to 30% by mass, still more preferably 2% by mass to 20% by mass. When the content is less than 0.5% by mass, a hot offset resistance may be worse, and both a heat resistant preserving property and a low-temperature fixing property may be hard to achieve. When exceeding 40% by mass, a low-temperature fixing property may be worse.

The polyisocyanates (PIC) may be suitably selected depending on the purpose without particular limitation, and include, for example, aliphatic polyisocyanates, alicyclic polyisocyanates, aromatic diisocyanates, araliphatic diisocyanates, isocyanurates, and blocked ones with phenol derivatives, oximes or caprolactams.

Examples of the aliphatic polyisocyanates include tetramethylene diisocyanate, hexamethylene diisocyanate, 2,6-diisocyanatomethyl caproate, octamethylene diisocyanate, decamethylene, diisocyanate, dodecamethylene diisocyanate, tetradecamethylene diisocyanate, trimethylhexane diisocyanate, and tetramethylhexane diisocyanate. Examples of the alicyclic polylsocyanates include isophorone diisocyanate, and cyclohexylmethane diisocyanate. Examples of the aromatic diisocyanates include tolylene diisocyanate, diphenylmethane diisocyanate, 1,5-naphthylene diisocyanate, diphenylene-4,4'-diisocyanate, 4,4'-diisocyanate-3,3'-dimethyldiphenyl, 3-methyldiphenylmethane-4,4'-diisocyanate, diphenylether-44'-diisocyanate. Examples of the araliphatic diisocyanates include α,α,α',α'-tetramethylxylylene diisocyanate. Examples of the isocyanurates include tris-isocya isocyanatoalkyl-isocyanurate, and triisocyanatocycroalkyl-isocyanurate. They may be used alone, or two or more of them may be used in combination.

For the mixing ratio when the polyisocyanate (PIC) and the active hydrogen group-containing polyester resin (for example, a hydroxyl group-containing polyester resin) are reacted, normally a blend equivalence ratio ([NCO]/[OH]) between isocyantate groups [NCO] in this polyisocyanate (PIC) and hydroxyl groups [OH] in this hydroxyl group-containing polyester resin is preferably 5/1 to 1/1, more preferably 4/1 to 1.2/1, still more preferably 3/1 to 1.5/1. When the isocyanate groups [NCO] exceed 5, the low-temperature fixing property may be worse. When it is less 1, the offset resistance may be worse.

The content of the polyisocyanate (PIC) in the isocyanate group-containing polyester prepolymer (A) may be suitably selected depending on the purpose without particular limitation, and, for example, is preferably 0.5% by mass to 40% by mass, more preferably 1% by mass to 30% by mass, still more preferably 2% by mass to 20% by mass. When the content is less than 0.5% by mass, a hot offset resistance may be worse, and both a heat resistant preserving property and a low-temperature fixing property may be hard to achieve. When exceeding 40% by mass, a low-temperature fixing property may be worse.

The average number of isocyanate groups contained in one molecule of the isocyanate group-containing polyester prepolymer (A) is preferably 1 or more, more preferably 1.2 to 5, still more preferably 1.5 to 4. When the average number of the isocyanate groups is less 1, the molecular weight of polyester resin (RMPE) modified with the urea-bond generating groups becomes low, and thus the hot offset resistance may be worse.

The weight average molecular weight (Mw) of a polymer capable of reacting with the active hydrogen group-containing compound, with a molecular weight distribution by GPC (gel permeation chromatography) of tetrahydrofuran (THF) soluble part, is preferably 1,000 to 30,000, more preferably 1,500 to 15,000. When this weight average molecular weight (Mw) is less than 1,000, a heat resistant preserving property may be worse. When exceeding 30,000, a low-temperature fixing property may be worse.

The measurement of molecular weight distribution by the gel permeation chromatography (GPC) may be conducted, for example, as follows. That is, a column is equilibrated in a heat chamber at 40° C. At this temperature, tetrahydrofuran (THF) is allowed to flow at a flow rate of 1 ml per one minute as a column solvent. Then, 50 μl to 200 μl of a tetrahydrofuran sample solution of resin whose sample concentration has been adjusted to 0.05% by mass to 0.6% by mass is injected, and then measured. In measurement of molecular weights in the sample, a molecular weight distribution which the sample includes is calculated from the relationship between log values of calibration curve prepared with several kinds of monodispersed polystyrene standard samples, and count numbers. As standard polystyrene samples for the calibration curve preparation, preferably used are the ones whose molecular weights are $6\times10^2$, $2.1\times10^2$, $4\times10^2$, $1.75\times10^4$, $1.1\times10^5$, $3.9\times10^5$, $8.6\times10^5$, $2\times10^6$, and $4.48\times10^6$, manufactured by Pressure Chemical Co. or Toyo Soda Industry Co., Ltd. At least about ten standard polystyrene samples are preferably used. Further, as the detector, RI (refraction) detector may be used.

(Binder Resin)

The binder resins may be suitably selected depending on the purpose without particular limitation, and include, for example, polyester resins. In particular, unmodified polyester resins (polyester resin not modified) are preferred. If toner contains the unmodified polyester resin, it is possible to improve a low-temperature fixing property and glossiness.

Examples of the unmodified polyester resins include the same ones as the urea bond generating group-containing polyester resin, that is a polycondensate of polyol (PO) and polycarboxylic acid (PC). This unmodified polyester resin is preferably compatible with the urea bond generating group-containing polyester resin (RMPE) at a part thereof, that is, they are in the similar structure compatible with each other in respect of a low-temperature fixing property and a hot offset resistance.

The weight average molecular weight (Mw) of the unmodified polyester resin, in the molecular weight distribution by GPC (gel permeation chromatography) of a tetrahydrofuran (THF) soluble part, is preferably 1,000 to 30,000, more preferably 1,500 to 15,000. When the weight average molecular weight (Mw) is less than 1,000, a thermal stability may be reduced. Thus, the content of components the weight average molecular weight (Mw) of which are less than 1,000 needs to be 8% by mass to 28% by mass, as described above. On the other hand, when the weight average molecular weight (Mw) exceeds 30,000, a low temperature fixing property may be worse.

The glass transition temperature of the unmodified polyester resin is normally 30° C. to 70° C., more preferably 35° C. to 70° C., still more preferably 35° C. to 50° C., particularly preferably 35° C. to 45° C. When the glass transition temperature is less than 30° C., a heat resistant preserving property of toner may be worse. When exceeding 70° C., a low temperature fixing property may be insufficient.

The hydroxyl value of the unmodified polyester resin is preferably 5 mgKOH/g or more, more preferably 10 mgKOH/g to 120 mgKOH/g, still more preferably 20 mgKOH/g to 80 mgKOH/g. When the hydroxyl value is less than 5 mgKOH/g, both a heat resistant preserving property and a low-temperature fixing property may be hard to achieve.

The acid value of the unmodified polyester resin is preferably 1.0 mgKOH/g to 50.0 mgKOH/g, more preferably 1.0 mgKOH/g to 45.0 mgKOH/g, still more preferably 15.0 mgKOH/g to 45.0 mgKOH/g. In general, by causing the toner to have acid values, toner is more likely to be of negative chargeability.

In the case where the toner materials contain the unmodified polyester resins, the mixing ratio (polymer/unmodified polyester resin) between a polymer capable of reacting with an active hydrogen group-containing compound (for example, an urea bond generating group-containing polyester resin) and this unmodified polyester resin on a mass basis is preferably 5/95 to 80/20, more preferably 10/90 to 25/75. When a blend mass ratio of the unmodified polyester resin (PE) exceeds 95, a hot offset resistance may be worse, and both a heat resistant preserving property and a low-temperature fixing property may be hard to achieve. When it is less than 20, glossiness may be worse.

The content of the unmodified polyester resin in the binder resin, for example, is preferably 50% by mass to 100% by mass, more preferably 70% by mass to 95% by mass, still more preferably 80% by mass to 90% by mass. When the content is less than 50% by mass, a low-temperature fixing property or glossiness of images may be worse.

(Colorant)

The colorants may be suitably selected depending on the purpose from known dyes and pigments without particular limitation, and include, for example, carbon black, Nigrosine dyes, black iron, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, LitholFast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emeraldegreen, Pigment Green B, Naphthol Green B, Green Gold, Acidegreen Lake, Malachite Green Lake, Phthalocyanine Green, Anthraquinone Green, titanium oxide, zinc oxide, and lithopone. These colorants may be used singly or in combination.

The content of colorant in the toner may be suitably selected depending on the purpose without particular limitation, and is preferably 1% by mass to 15% by mass, more preferably 3% by mass to 10% by mass. When the content is less than 1% by mass, the coloring power of toner is shown to decrease. When exceeding 15% by mass, dispersion defects of pigments occur in toner, and the reduction in coloring power, and the decrease in electrical properties of toner may be induced.

The colorants may be used as a master batch that is combined with resin. The resin may be suitably selected from known ones depending on the purpose without particular limitation. Examples of the colorants include styrene or substituted polymers thereof, styrene copolymers, polymethyl methacrylate, polybutylmethacrylate, polyvinyl chloride, polyvinyl acetate, polyethylene, polypropylene, polyesters, epoxy resins, epoxy polyol resins, polyurethane resins, polyamide resins, polyvinyl butyral resins, polyacrylic resins, rosin, modified rosins, terpene resins, aliphatic or alicyclic hydrocarbon resins, aromatic petroleum resins, chlorinated paraffin, and paraffin. These resins may be used singly or in combination.

Examples of the styrene or polymers of substitutes thereof include polyester resin, polystyrene, poly-p-chlorostyrene, and polyvinyltoluene. Examples of the styrene copolymers include styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl $\alpha$-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers.

The master batch can be manufactured by mixing and kneading the master batch resin and the colorant under large shearing force. In this process, to enhance interaction between colorants and resins, an organic solvent is preferably added. Furthermore, the so-called flushing method is preferred in that a wet cake of colorants can be used as it is, and no drying is needed. In this flushing method, an aqueous paste containing colorants is mixed and kneaded with resins and organic solvents, and the colorants are made to transfer to the resin side to remove water and organic solvent components. In the mixing and kneading, a high shearing dispersion apparatus, for example, a three-roll mill is preferably used.

(Additional Ingredients)

The additional ingredients may be suitably selected depending on the purpose without particular limitation, and include, for example, a releasing agent, inorganic fine particles, a flowability improver, a cleanability improver, magnetic materials, and a metal soap.

The releasing agents may be suitably selected from known ones depending on the purpose without particular limitation; preferable examples include waxes.

The waxes include, for example, carbonyl group-containing waxes, polyolefin waxes, and long chain hydrocarbons. They may be used alone, or two or more of them may be used in combination. Out of them, carbonyl group-containing waxes are preferred. Examples of the carbonyl group-containing waxes include polyalkanoic acid esters, polyalkanol esters, polyalkanoic acid amide, polyalkylamide, and dialkyl ketone.

Examples of the polyalkanoic acid esters include carnauba wax, montan wax, trimethylolpropane tribehenate, pentaerythritol tetrabehenate, pentaerythritol diacetate dibehenate, glycerintribehenate, and 1,18-octadecanediol distearate.

Examples of the polyalkanol esters include trimellitic acid tristearyl, and distearyl maleate. Examples of the polyalkanoic acid amides include dibehenyl amide. Examples of the polyalkylamides include trimellitic acid tristearylamide. Examples of the dialkyl ketones include distearyl ketone. In these carbonyl group-containing waxes, polyalkanoic acid esters are particularly preferred.

Examples of the polyolefin waxes include polyethylene wax and polypropylene wax. Examples of the long chain hydrocarbons include paraffin wax and xazole wax.

The melting point of the releasing agents may be suitably selected depending on the purpose without particular limitation, and is preferably 40° C. to 160° C., more preferably 50° C. to 120° C., still more preferably 60° C. to 90° C. When the melting point is less than 40° C., wax may adversely affect a heat resistant preserving property. When it exceeds 160° C., cold offset is likely to occur at the time of fixing at low temperature.

The melting viscosity of the releasing agents, as measured values at temperatures higher than a melting point of these waxes by 20° C., is preferably 5 cps to 1,00 cps, more preferably 10 cps to 100 cps. When the melting viscosity is less than 5 cps, a releasing property may be reduced. When it exceeds 1,000 cps, improvement effects on a hot offset resistance and a low-temperature fixing property may not be obtained.

The content of the releasing agent in the toner may be suitably selected on the purpose without particular limitation, and is preferably 0% by mass to 40% by mass, more preferably 3% by mass to 30% by mass. When the content exceeds 40% by mass, the toner flowability may be reduced.

The charge controlling agent is not particularly limited, may be suitably selected from those known in the art, however, when a colored material is used for the charge controlling agent, the color tone of toner may be changed, therefore, colorless materials or materials in close to white color are preferably used. Examples thereof include triphenylmethane dyes, molybdic acid chelate pigments, rhodamine dyes, alkoxy amines, quaternary ammonium salts such as fluorine-modified quaternary ammonium salts; alkylamides, phosphoric monomer or compounds thereof, tungsten monomer or compounds thereof, fluorine activator, salicylic acid metallic salts, and salicylic acid derivative metallic salts. Each of these charge controlling agents may be used singly or in combination.

For the charge controlling agent, commercially available products may be used, and examples of the commercially available charge controlling agents include Bontron P-51 being a quaternary ammonium salt, Bontron S-34 being a metal-containing azo dyes, Bontron E-82 being an oxynaphthoic acid metal complex, Bontron E-84 being a salicylic acid metal complex, and Bontron E-89 being a phenol condensate (manufactured by Orient Chemical Industries, Ltd.); TP-302 and TP-415 being a quaternary ammonium salt molybdenum metal complex (by Hodogaya Chemical Co.); Copy Charge PSY VP2038 being a quaternary ammonium salt, Copy Blue PR being a triphenylmethane derivative, and Copy Charge NEG VP2036 and Copy Charge NX VP434 being a quaternary ammonium salt (by Hoechst Ltd.); LRA-901, and LR-147 being a boron metal complex (by Japan Carlit Co., Ltd.); quinacridones, azo pigments, and other high-molecular mass compounds having a functional group such as sulfonic acid group, carboxyl group, and quaternary ammonium salts.

The charge controlling agents may be dissolved and dispersed after dissolving and kneading with the masterbatch or may be directly added to the organic solvent at the time of dissolving and dispersing the organic solvent with each of the toner components.

The content of the charge controlling agent in the toner is determined depending on the type of the binder resin, presence or absence of additives used in accordance with the necessity, and the dispersion method and is not limited uniformly, however, for example, relative to 100 parts by mass of the binder resin, the charge controlling agent is used in the range from 0.1 parts by mass to 10 parts by mass, and more preferably in the range from 0.2 parts by mass to 5 parts by mass. When the usage amount of the charge controlling agent is less than 0.1 parts by mass, charging ability of the toner may not be obtained. When the usage amount of the charge controlling agent is more than 10 parts by mass, charging ability of the toner is exceedingly large, which reduces the effect of the primarily used charge controlling agent, and electrostatic suction force relative to developing rollers increases, resulting in lessened flowability of the developer and reduced image density.

The resin fine particles may be suitably selected depending on the purpose from known resins insofar as they are resins capable of forming an aqueous dispersion in an aqueous medium. The resin fine particles may be thermoplastic resin or thermosetting resin, and examples include, for example, vinyl resins, polyurethane resins, epoxy resins, polyester resins, polyamide resins, polyimide resins, silicon resins, phenol resins, melamine resins, urea resins, aniline resins, ionomer resins, and polycarbonate resins.

They may be used singly or in combination. Out of them, in view of the fact that an aqueous dispersion of resin fine particles of fine spherical shapes are easy to obtain, it is preferable that resin fine particles be made of at least one resin selected from vinyl resins, polyurethane resins, epoxy resins and polyester resins.

Moreover, the vinyl resins are a polymer obtained by mono-polymerization or copolymerization of vinyl monomers, and examples include, for example, styrene-(metha) acryl ester resins, styrene-butadiene co-polymers, (metha) acrylic acid-acryl ester copolymers, styrene-acrylonitrile copolymers, styrene-maleic anhydride copolymers, and styrene-(metha) acrylic acid copolymers.

Further, as the resin fine particles, a copolymer that contains monomers having at least two unsaturated groups may be used as well.

The monomers having at least two unsaturated groups may be suitably selected depending on the purpose without particular limitation, and include, for example, sodium salts of sulfate ester of methacrylic acid ethylene oxide adduct (Eleminol RS-30, manufactured by Sanyo Chemical Industries Ltd.), divinyl benzene, and 1,6-hexane diol acrylate.

The resin fine particles may be obtained by polymerization according to the known method suitably selected depending on the purpose, and is preferably obtained as an aqueous dispersion of these resin fine particles. Preparation methods of an aqueous dispersion of these resin fine particles preferably include, for example, (1) method in which in the case of the vinyl resin, an aqueous dispersion of resin fine particles is directly manufactured by any polymerization reaction selected from suspension polymerization method, emulsification polymerization method, seed polymerization method, and dispersion polymerization method with vinyl monomer a starting material, (2) method in which in the polyaddition or condensation resins such as the polyester resin, polyurethane resin, and epoxy resin, precursors (monomer, oligomer and the like) or a solvent solution thereof is dispersed in an aqueous medium in the presence of a suitable dispersant, and thereafter heated or added with a curing agent to be cured, to manufacture an aqueous dispersion of resin fine particles (3) method in which in the polyaddition or condensation resins such as the polyester resin, polyurethane resin, and epoxy resin, a suitable emulsifying agent is dissolved in precursors (monomer, oligomer and the like) or a solvent solution thereof (liquid is preferred. It may be liquefied by heating), and thereafter water is added to be phase-inverted and emulsified (4) method in which resin having been preliminarily prepared by polymerization reaction (may be any polymerization reaction method of addition polymerization, ring-opening polymerization, polyaddition, addition condensation, and condensation polymerization) is milled using pulverizing mills of mechanical rotation-type or jet-type and subsequently classified to obtain resin fine particles, and thereafter dispersed in water in the presence of a suitable dispersant (5) method in which a resin solution in which resin having been preliminarily prepared by polymerization reaction (may be any polymerization reaction method of addition polymerization, ring-opening polymerization, polyaddition, addition condensation, and condensation polymerization) is dissolved in a solvent is sprayed in atomization state to obtain resin fine particles, and thereafter these resin fine particles are dispersed in water in the presence of a suitable dispersant (6) method in which resin fine particles are precipitated by adding a lean solvent to a resin solution in which resin having been preliminarily prepared by polymerization reaction (may be any polymerization reaction method of addition polymerization, ring-opening polymerization, polyaddition, addition condensation, and condensation polymerization) is dissolved into a solvent, or cooling a resin solution in which this resin has been preliminarily heated and dissolved, then the solvent is removed to obtain resin fine particles, and thereafter these resin fine particles are dispersed in water in the presence of a suitable dispersant (7) method in which a resin solution in which resin having been preliminarily prepared by polymerization reaction (may be any polymerization reaction method of addition polymerization, ring-opening polymerization, polyaddition, addition condensation, and condensation polymerization) is dissolved into a solvent, is dispersed in an aqueous medium in the presence of a suitable dispersant, and thereafter a solvent is removed by e.g., heating or depressurizing (8) method in which a suitable emulsification agent is dissolved in a resin solution in which resin having been preliminarily prepared by polymerization reaction (may be any polymerization reaction method of addition polymerization, ring-opening polymerization, polyaddition, addition condensation, and condensation polymerization) is dissolved into a solvent, and thereafter water is added to be phase-inverted and emulsified.

Examples of toners used in the present invention include those produced by known methods such as suspension polymerization method, emulsification coagulation method, and emulsification dispersion method. A preferable example is a toner obtained by dissolving in an organic solvent a toner material containing active hydrogen group-containing compound and a polymer capable of reacting with this active hydrogen group-containing compound to prepare a toner solution, thereafter dispersing this toner solution in an aqueous medium to prepare a dispersion, causing the active hydrogen group-containing compound and a polymer capable of reacting with the active hydrogen group-containing compound to react to generate an adhesive base material in particulates, and removing the organic solvent.

The toner solution is prepared by dissolving toner materials into an organic solvent. Usable organic solvents are not particularly restricted as long as toner materials can be dissolved or dispersed therein, and suitable organic solvents can be selected according to the intended purpose.

The organic solvents may be suitably selected depending on the purpose without particular limitation insofar as they are solvents capable of dissolving or dispersing the toner materials, and preferably the ones which are volatile with a boiling point less than 150° C. because they can be removed readily. Examples of the organic solvents include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These solvents may be used alone, or two or more of them may be used in combination. Among these solvents, toluene, xylene, benzene, methylene chloride, 1,2-dichloroethane, chloroform, carbon tetrachloride and the like are preferred. Ethyl acetate is particularly preferred.

The amount of organic solvent used may be determined depending on the purpose without particular limitation, and is preferably, for example, 40 parts by mass to 300 parts by mass, more preferably 60 parts by mass to 140 parts by mass, still more preferably 80 parts by mass to 120 parts by mass per 100 parts by mass of the toner materials.

The dispersion liquid is prepared by dispersing the toner solution in an aqueous medium. When the toner solution is dispersed in the aqueous medium, a dispersion (oil droplets) formed of the toner solution is formed in this aqueous medium.

The aqueous medium may be suitably selected from known ones without particular limitation, and examples include, for example, water, a solvent mixable with water, and a mixture thereof. Out of them, water is particularly preferred.

Solvents mixable with the water are not particularly limited insofar as they are mixable with the water, and include, for example, alcohol, dimethyl formamide, tetrahydrofuran, cellusolves, and lower ketones. The alcohols include, for example, methanol, isopropanol, and ethylene glycol. The lower ketones include, for example, acetone, and methyl-ethyl-ketone. They may be used alone, or two or more of them may be used in combination.

The toner solution is preferably dispersed under stirring in the aqueous medium. Methods of dispersing may be suitably selected using known dispersers without particular limitation. Examples of these dispersers include a low-speed shearing disperser, a high-speed shearing disperser, a friction disperser, a high-pressure jet disperser, and an ultrasonic disperser. Out of them, in that particle sizes of the dispersion (oil droplets) can be controlled to be 2 μm to 20 μm, a high-speed shearing disperser is preferred.

In the case of using the high-speed shearing disperser, conditions such as the number of revolutions, a dispersion time period, and dispersing temperature may be suitably selected depending on the purpose without particular limitation. For example, the number of revolutions is preferably 1,000 rpm to 30,000 rpm, more preferably 5,000 rpm to 20,000 rpm. The dispersion time period is preferably 0.1 minutes to 5 minutes in the case of batch method. The dispersing temperature is preferably 0° C. to 150° C., more preferably 40° C. to 98° C. under pressure. In addition, the higher the dispersing temperature is, generally the easier dispersing is.

<Toner Manufacturing Method>

As an example of the toner manufacturing method will be described, in which method the adhesive base material is produced in particulates.

In the method of producing the adhesive base material in particulates to granulate toner, for example, made are preparation of an aqueous medium phase, preparation of the toner solution, preparation of the dispersion liquid, addition of the aqueous medium, and others (synthesis of a polymer capable of reacting with the active hydrogen group-containing compound (prepolymer), synthesis of the active hydrogen group-containing compound, and the like). Preparation of the aqueous medium phase may be made by, for example, dispersing the resin fine particles in the aqueous medium. The added amount of these resin fine particles in this aqueous medium may be suitably selected depending on the purpose without particular limitation, and is preferably 0.5% by mass to 10% by mass.

Preparation of the Toner Solution May be Made by Dissolving or dispersing in the organic solvent toner materials such as the active hydrogen group-containing compound, the polymer capable of reacting with the active hydrogen group-containing compound, the colorant, the releasing agent, the charge control agent, and the unmodified polyester resin. Furthermore, to form an inorganic oxide particle-containing layer within 1 μm from the toner surface, inorganic oxide particles such as silica, titania, and alumina are added. Moreover, among toner materials, ingredients other than a polymer (prepolymer) capable of reacting with the active hydrogen group-containing compound, in the aqueous medium phase preparation, may be added and mixed in this aqueous medium when the resin fine particles are dispersed in the aqueous medium, or may be added to the aqueous medium phase along with this toner solution when the toner solution is added to the aqueous medium phase.

The dispersion liquid may be prepared by emulsifying and dispersing the toner solution having been preliminarily prepared in the aqueous medium phase having been preliminarily prepared. Further, in these emulsification and dispersing, the active hydrogen group-containing compound and the polymer capable of reacting with the active hydrogen group-containing compound are brought in extension reaction or cross-linking reaction, and thus the adhesive base material is produced.

The adhesive base material (for example, the urea modified polyester resin) may be produced by the following methods. These methods are; (1) method in which the toner solution containing the polymer capable of reacting with the active hydrogen group-containing compound (for example, the isocyanate group-containing polyester prepolymer (A)) is emulsified or dispersed in the aqueous medium phase along with the active hydrogen group-containing compound (for example, the amines (B)), a dispersion is formed, and both are brought in extension reaction or cross-linking reaction in this aqueous medium phase; (2) method in which the toner solution is emulsified or dispersed in the aqueous medium to which the active hydrogen group-containing compound has been preliminarily added, a dispersion is formed, and both are brought in extension reaction or cross-linking reaction in this aqueous medium phase; and (3) method in which the toner solution is added to and mixed with the aqueous medium, thereafter the active hydrogen group-containing compound is added, a dispersion is formed, and both of them are brought in extension reaction and cross-linking reaction at the interface of particles in this aqueous medium phase. Furthermore, in the case of the (3), a modified polyester resin is preferentially produced on the surface of toner to be prepared, and a concentration gradient may also be provided in this toner particle.

For the reaction conditions used for producing the adhesive base materials by the emulsification and dispersion are not particularly limited, but may be suitably selected based on the combinations between a polymer capable of reacting with the active hydrogen group-containing compound and the active hydrogen group-containing compound. A reaction time period is preferably 10 minutes to 40 hours, more preferably 2 hours to 24 hours. A reaction temperature is preferably 0° C. to 150° C., more preferably 40° C. to 98° C.

Methods of stably forming the dispersion containing a polymer capable of reacting with the active hydrogen group-containing compound (for example, the isocyanate group-containing polyester prepolymer (A)), include, for example, the method in which a toner solution prepared by causing the toner materials such as a polymer capable of reacting with the active hydrogen group-containing compound (for example, the isocyanate group-containing polyester prepolymer (A)), the colorant, the releasing agent, the charge control agent, and the unmodified polyester resin, to be dissolved or dispersed in the organic solvent, is added and dispersed by a shearing force. In addition, details of the dispersing method are as described above.

Upon preparation of the dispersion liquid, when necessary, from the standpoint of causing the dispersion (oil droplets formed of the toner solution) to be stable and of making a particle size distribution sharp while obtaining desired shapes, a dispersant is preferred to be used.

The dispersants may be suitably selected depending on the purpose without particular limitation, and include, for example, a surfactant, an inorganic compound dispersant with poor water solubility, and high-molecular protective colloid. They may be used singly or in combination. Out of them, surfactants are preferred.

The surfactants include, for example, anionic surfactants, cationic surfactants, non-ionic surfactants, and ampholytic surfactants.

Examples of the anionic surfactants include alkylbenzene sulfonate, α-olefin sulfonate, and phosphate, preferably a surfactant having a fluoroalkyl group. Examples of anionic surfactants having this fluoroalkyl group include fluoroalkyl carboxylic acids having from 2 to 10 carbon atoms or metal salts thereof, disodium perfluorooctanesulfonyl glutamate, sodium 3-{omega-fluoroalkyl(C6-C11)oxy}-1-alkyl(C3-C4) sulfonate, sodium 3-{omega-fluoroalkanoyl(C6-C8)-N-ethylamino}-1-propanesulfonate, fluoroalkyl(C11-C20) carboxylic acids and metal salts thereof, perfluoroalkylcarboxylic acids and metal salts thereof, perfluoroalkyl(C4-C12)sulfonate and metal salts thereof, perfluorooctanesulfonic acid diethanol amides, N-propyl-N-(2-hydroxyethyl-)perfluorooctanesulfone amide, perfluoroalkyl (C6-C10)sulfoneamidepropyltri-methylammonium salts, perfluoroalkyl (C6-C10)-N-ethylsulfonyl glycin salts, and monoperfluoroalkyl(C6-C16)ethylphosphates. Examples of commercially available products of surfactants containing this fluoroalkyl group include SURFLON S-111, S-112 and S-113, manufactured by Asahi Glass Co., Ltd.; FRORARD FC-93, FC-95, FC-98 and FC-129, manufactured by Sumitomo 3M Ltd.; UNIDYNE DS-101 and DS-102, manufactured by Daikin Industries, Ltd.; MEGAFACE F-110, F-120, F-113, F-191, F-812 and F-833, manufactured by Dainippon Ink and Chemicals, Inc.; ECTOP EF-102, 103, 104, 105, 112, 123A, 306A, 501, 201 and 204, manufactured by Tohchem Products Co., Ltd.; and FUTARGENT F-100 and F150 manufactured by Neos.

Examples of the cationic surfactants include amine salt-type surfactants and cationic surfactants of quaternary ammonium salt-type. Examples of the amine salt-type surfactants include alkyl amine salts, aminoalcohol fatty acid derivatives, polyamine fatty acid derivatives and imidazoline. Examples of cationic surfactants of the quaternary ammonium salt-type include alkyltrimethyl ammonium salts, dialkyldimethyl ammonium salts, alkyldimethyl benzyl ammonium salts, pyridinium salts, alkyl isoquinolinium salts and benzethonium chloride. These cationic surfactants include primary, secondary and tertiary aliphatic amino acids having a fluoroalkyl group, aliphatic quaternary ammonium salts such as perfluoroalkyl(C6-C10)sulfoneamidepropyltrimethylammonium salts, benzalkonium salts, benzetonium chloride, pyridinium salts, and imidazolinium salts. Examples of commercially available products of these cationic surfactants include SURFLON S-121 (from Asahi Glass Co., Ltd.); FRORARD FC-135 (from Sumitomo 3M Ltd.); UNIDYNE DS-202 (from Daikin Industries, Ltd.); MEGAFACE F-150 and F-824 (from Dainippon Ink and Chemicals, Inc.); ECTOP EF-132 (from Tohchem Products Co., Ltd.); and FUTARGENT F-300 (from Neos).

Examples of non-ionic surfactants include fatty acid amide derivatives and polyhydric alcohol derivatives.

Examples of the ampholytic surfactants include alanine, dodecyldi(aminoethyl)glycin, di(octylaminoethyle) glycin, and N-alkyl-N,N-dimethylammonium betaine.

Examples of the inorganic compound dispersants with poor water solubility include tricalcium phosphate, calcium carbonate, titanium oxide, colloidal silica, and hydroxyapatite.

Examples of the polymeric protection colloids include acids, (metha)acrylic monomers containing acids hydroxyl groups, vinyl alcohol or ethers of vinyl alcohol, esters of vinyl alcohol with a compound having a carboxyl group, amide compounds or methylol compounds thereof, chlorides, homopolymers or copolymers such as those containing nitrogen atoms or heterocycles thereof, polyoxyethylenes, and celluloses.

Examples of the acids include acrylic acid, methacrylic acid, α-cyanoacrylic acid, α-cyanomethacrylic acid, itaconic acid, crotonic acid, fumaric acid, maleic acid and maleic anhydride.

Examples of the (metha)acrylic monomers having a hydroxyl group include β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, glycerinmonomethacrylic acid esters N-methylolacrylamide and N-methylolmethacrylamide.

Examples of the vinyl alcohol and ethers of vinyl alcohol include vinyl methyl ether, vinyl ethyl ether and vinyl propyl ether.

Examples of the esters of vinyl alcohol with a compound having a carboxyl group include vinyl acetate, vinyl propionate and vinyl butyrate.

Examples of the amide compounds or methylol compounds thereof include acrylamide, methacrylamide and diacetoneacrylamide or methylol compounds thereof.

Examples of the chlorides include acrylic acid chloride and methacrylic acid chloride.

Examples of the homopolymers or copolymers with nitrogen atoms or heterocycle thereof include vinyl pyridine, vinyl pyrrolidone, vinyl imidazole and ethylene imine.

Examples of the polyoxyethylenes include polyoxyethylene, polyoxypropylene, polyoxyethylene alkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters.

Examples of the celluloses include methyl cellulose, hydroxyethyl cellulose and hydroxypropyl cellulose.

In preparation of the dispersion liquid, a dispersion stabilizer may be used as necessary.

Examples of the dispersion stabilizers include, for example, those that are soluble in acid and alkali, such as calcium phosphate. In the case of using this dispersion stabilizer, calcium phosphate can be removed by a method in which calcium phosphate is dissolved in an acid such as hydrochloric acid and washed with water, or a method of decomposing by use of enzyme. In preparation of the dispersion, catalysts in the extension reaction or the cross-linking reaction may be used. These catalysts include, for example, dibutyltin laurate and dioctyltin laurate.

The organic solvent is removed from a dispersion (emulsified slurry) having been obtained. This organic solvent is removed by the method (1) in which the whole reaction system is warmed by degrees to completely evaporate and remove the organic solvent in the oil droplets, and the method (2) in which an emulsified dispersion is atomized in a dry atmosphere, and an insoluble organic solvent in oil droplets is completely removed to form toner fine particles, as well as an aqueous dispersant is evaporated and removed.

When the organic solvent is removed, toner particles are formed. To these toner particles, washing and drying are conducted, and thereafter classification is further conducted if desired. This classification is conducted in a liquid by removing fine particle parts with cyclone, decanter, and a centrifugal separator. The classification operation may be conducted after having been obtained as powders after drying.

The toner particles obtained in this way are then mixed with particles of the colorant, releasing agent and charge control agent, and a mechanical impact is imparted to them, thereby preventing the particles from coming off from the surface of this toner particle.

Examples of methods of applying a mechanical impact include, for example, a method of applying an impact to a mixture by means of a vane rotating at high speed, and a method in which the mixture is put in a high-speed air current such that particles are accelerated and collided with each other or that aggregated particles are made to collide to a suitable collision plate. Apparatuses for use in these methods include, for example, an Angmill (manufactured by Hosokawa Micron Corporation), a modified I-type mill (manufactured by Nippon Pneumatic MFG., Co., Ltd.), which is reconstructed in reduced pulverizing air pressure, a hybridization system (manufactured by Nara Machine Corporation), Kryptron System (manufactured by Kawasaki Heavy Industries, Ltd.), and an automatic mortar.

It is preferable that the toner have the following volume-average particle diameter (Dv), volume-average particle diameter (Dv)/number-average particle diameter (Dn), average circularity, and shape factors SF-1 and SF-2.

The volume-average particle diameter of the toner is preferably 3 μm to 8 μm, more preferably 4 μm to 7 μm, still more preferably 5 μm to 6 μm. Herein, the volume-average particle diameter is defined as $Dv=[(\Sigma(nD^3)/\Sigma n)^{1/3}$ (where n is the number of particles, and D is particle diameter).

When the volume average particle diameter is less than 3 μm, in a two component developer, toner is fused onto the surface of a carrier under stirring for a long time period in a developing unit, and thus a chargeability of the carrier may be decreased; and in one-component developer, since filming of toner onto a developing roller is made, or toner is made in a thinner layer, the fusion of toner onto members such as blades is likely to occur. When exceeding 8 μm, images of high resolution and high image quality becomes hard to obtain. Further, in the case of toner balance in a developer being conducted, the variation of particle sizes of toner may be larger.

The ratio (Dv/Dn) of volume-average particle diameter (Dv) to number-average particle diameter (Dn) is, for example, preferably 1.25 or less, more preferably 1.00 to 1.25, still more preferably 1.10 to 1.20. When the ratio (Dv/Dn) is 1.20 or less, the particle size distribution of the toner is comparatively sharp, and fixing property is improved. When, however, it is less 1.00, in a two component developer, toner is fused onto the surface of a carrier under stirring for a long time period in a developing unit, and thus a chargeability of the carrier may be decreased or a cleaning property may be worse; and in one-component developer, since filming of toner onto a developing roller is made, or toner is made in a thinner layer, the fusion of toner onto members such as blades is likely to occur. When exceeding 1.40, images of high resolution and high image quality become hard to obtain. Further, in the case of toner balance in a developer being conducted, the variation of particle sized of toner may be larger.

The ratio (Dv/Dn) of volume average particle diameter the number average particle diameter may be measured using a particle size analyzer ("Multi-Sizer", manufactured by Beckman Coulter Electronics, Inc.,).

The average circularity is a value obtained by dividing the perimeter of a circle having the same area as a projected toner shape area by the perimeter of the actual particle, and is preferably, for example, 0.930 to 1.000, more preferably 0.940 to 0.99. When the average circularity is less than 0.930, the toner shape becomes irregular and departs from a spherical shape, and thus no high-quality images having a sufficient transfer property and with no dusts may be obtained. If it exceeds 0.98, in an image forming system adopting blade cleaning, cleaning defects on a photoconductor, a transfer belt and the like occurs, and thus the following dirt on images will be generated. For example, in the case of forming images of high image area ratio such as photographic images, background smear of images may occur due to that toner having formed non-transferred images is accumulated as residual transfer toner on the photoconductor owing to e.g., paper feeding failure. Further, this toner contaminates a charging roller functioning to be in contact to charge the photoconductor, and thus an original electrostatic chargeability may not be exhibited.

The average circularity can be measured, for example, by the method of an optical detection band in which a suspension containing toner is passed through an image detection band on a flat plate, and particle images are optically detected with a CCD camera and analyzed. Measurement is made with the use of a flow-type particle image analyzer FPIA-2100 (manufactured by Sysmex Corporation).

The degree of sphericity (roundness) of toner particle is represented by the shape factor SF-1 represented by the following Equation (1). SF-1 is a value obtained by dividing the square of the maximum length (MXLNG) across a two-dimensional projection of a toner particle by the projection area (AREA) and by multiplying by $100\pi/4$.

$$SF\text{-}1=[(MXLNG)^2/AREA]\times(100\pi/4) \qquad \text{Equation (1)}$$

where MXLNG represents the maximum length across a two-dimensional projection of a toner particle, and AREA represents the area of the projection The shape factor SF-1 is 100 to 180, more preferably 105 to 140. If the shape factor SF-1 is 100, the toner shape is a perfect sphere; the greater the shape factor SF-1, the more irregular the toner shape. If the shape factor SF-1 is greater than 180, toner removability is improved but the charge density distribution becomes wide, thereby resulting in increased background fogging and reduced image quality because the toner shape largely deviates from sphere. In addition, since developing and transferring of image are not conducted in strict accordance with magnetic field lines due to air drag upon transfer, the toner is developed between thin lines to result in reduced image uniformity and poor image quality.

The degree of surface irregularities of toner particles is represented by the shape factor SF-2 represented by the following Equation (2). SF-2 is a value obtained by dividing the square of the perimeter (PERI) of a two-dimensional projection of a toner particle by the projection area (AREA) and by multiplying by $100/4\pi$.

$$SF\text{-}2=[(PERI)^2/AREA]\times(100/4\pi) \qquad \text{Equation (2)}$$

where PERI represents the perimeter of a two-dimensional projection of a toner particle, and AREA represents the area of the projection The shape factor SF-2 is 100 to 180, more preferably 105 to 140. If SF-2 is 100, it indicates that no irregularities are present on the surface of toner; the greater the SF-2, the more conspicuous the irregularities.

The shape factors SF-1 and SF-2 can be determined by, for example, using a scanning electron microscope (S-800, manufactured by Hitachi Ltd.) to take toner particle pictures and analyzing them by an image analyzer (LUSEX3, manufactured by NIRECO Corp.) using the foregoing Equations (1) and (2).

The toner can be expressed in terms of the following shape definition. Suppose the major axis, minor axis, and thickness of spherical toner particle are defined as r1, r2, and r3, respectively (where $r1 \geqq r2 \geqq r3$), the ratio of major axis to minor axis (r2/r1) is preferably 0.5 to 1.0, and the ratio of thickness to minor axis (r3/r2) is preferably 0.7 to 1.0. If r2/r1 is less than 0.5, the toner shape deviates from sphere, resulting in poor dot reproducibility and toner transfer efficiency, which in turn may result in failure to obtain high-quality images. If r3/r2 is less than 0.7, the toner shape becomes close to flat, and such flat toner particles may not be transferred efficiently in contrast to spherical toner particles. In particular, if r3/r2 is 1.0, the toner particles spin about their major axis, whereby toner flowability can be improved.

The color of toner may be suitably selected depending on the purpose without particular limitation, and at least one toner may be selected from black toner, cyan toner, magenta toner and yellow toner. Although each color of toner can be obtained by suitably selecting suitable colorants, color toners are preferred.

(Developer)

The developer for use in the present invention contains at least the toner, and contains additional ingredients suitably selected, such as carrier, in accordance with the development method and specification.

This developer may be one-component developer or a two component developer. When used in a high-speed printer that meets the recent need for higher information processing speed, a two component developer is preferred for long life.

In the case of a one-component developer containing the toner, even if toner has been spent or supplied, the variation of toner particle size toner is small, no filming occurs on a developing roller and no toner fusion occur onto members such as blades for making toner in a thinner layer, and thus an excellent and stable developability and images can be obtained even if a developing unit is used (under stirring) for a long time period. Moreover, in the case of the two component developer using the toner, even if the balance of toner over a long time period is conducted, the variation of toner particle size in a developer is small, and an excellent and stable developability can be obtained even if a developing unit is used under stirring for a long time period.

The carrier may be suitably selected depending on the purpose without particular limitation, and preferably includes a core member and a resin layer covering this core member.

Materials of the core member may be suitably selected from known ones without particular limitation, and are preferably, for example, 50 emu/g to 90 emu/g of manganese-strontium (Mn—Sr) material and manganese-magnesium (Mn—Mg) material. Further, materials of the core member are preferably high-magnetic materials such as iron powder (100 emu/g or more) and magnetite (75 emu/g to 120 emu/g) in respect of highly reliable image densities. Furthermore, materials of the core members are preferably low-magnetic materials such as copper-zinc (Cu—Zn) materials (30 emu/g to 80 emu/g) in respect of smaller collision to a photoconductor where toner is in the napping state, and being advantageous in higher image quality. They may be used alone, or two or more of them may be used in combination.

The particle diameter of the core member is preferably 10 μm to 200 μm, more preferably 40 μm to 100 μm in terms of the average particle size (volume average particle diameter ($D_{50}$)). When the average particle size (volume average particle diameter ($D_{50}$)) is less 10 μm, many fine powders occur in the distribution of carrier particles, a magnetization per one particle comes to be lower, and thus the splash of carrier may occur. When it exceeds 200 μm, a specific surface area is decreased, and thus the splash of toner may occur. In full-color having much solids, particularly reproduction of solids may be worse.

Materials of the resin layer may be suitably selected depending on the purpose from known resins without particular limitation, and include, for example, amino resins, polyvinyl resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, copolymers of vinylidenefluoride and acrylic monomer, copolymers of vinylidenefluoride and vinylfluoride, fluoroterpolymers such as terpolymers of tetrafluoroethylene, vinylidenefluoride and non-fluoride monomers, and silicone resins. They may be used singly or in combination.

Examples of the amino resins include urea-formaldehyde resins, melamine resins, benzoguanamine resins, urea resins, polyamide resins, and epoxy resins. Examples of the polyvinyl resins include acrylic resins, polymethylmethacrylate resins, polyacrylonitirile resins, polyvinyl acetate resins, polyvinyl alcohol resins, polyvinyl butyral resins. Examples of the polystyrene resins include polystyrene resins and styrene-acrylic copolymer resins. Examples of the halogenated olefin resins include polyvinyl chloride resins. Examples of the polyester resins include polyethyleneterephthalate resins and polybutyleneterephthalate resins.

The resin layer may contain conductive powders as necessary. These conductive powders include, for example, metal powders, carbon black, titanium oxide, tin oxide, and zinc oxide. These conductive powders are preferably 1 μm or less in an average particle size. When the average particle size exceeds 1 μm, electric resistances may be hard to control.

The resin layer can be formed by dissolving in a solvent the silicone resin and the like to prepare a coating solution, applying the coating solution by any known coating method uniformly onto the surface of the core member, drying the coating solution, and conducting baking. Examples of the coating methods include, for example, dipping, spraying, and brushing.

The solvent may be suitably selected depending on the purpose without particular limitation, and include, for example, toluene, xylene, methylethyl ketone, methylisobutyl ketone, celsolbutyl acetate.

The baking is not particularly limited, and may be external heating or internal heating. Examples of the baking include the methods of using a fixed-type electric furnace, a flow-type electric furnace, a rotary-type electric furnace, or a burner furnace, and the method of using microwaves.

The resin layer is preferably 0.01% by mass to 5.0% by mass in amounts in the carrier. When the amount is less than 0.01% by mass, the resin layer may not be uniformly formed on the surface of the core member. When exceeding 5.0% by mass, the resin layer is too thick, then granulation of carriers with each other occur, and thus uniform carrier particles may not be obtained.

In the case where the developer is a two component developer, the contents of carrier in this two component developer may be suitably selected depending on the purpose without particular limitation, and are, for example, preferably 90% by mass to 98% by mass, more preferably 93% by mass to 97% by mass.

The blend ratio between toner and carrier in a two component developer is generally preferred to be 1 part by mass to 10.0 parts by mass of toner with respect to 100 parts by mass of carrier.

According to the present invention, it is possible to provide a latent electrostatic image bearing member which has high wear resistance and excellent electrographic characteristics and which is capable of stable image formation over a long period of time; and an image forming apparatus, image forming method and process cartridge using the latent electrostatic image bearing member.

EXAMPLES

Hereinafter, the present invention will be described with reference to Examples and Comparative Examples, which however shall not be construed as limiting the present invention. Note that "part" denotes "part by mass" unless otherwise indicated.

Firstly, toners for use in the evaluations for the latent electrostatic image bearing members of the below-described Examples and Comparative Examples were prepared in the manner described below.

Preparation Example 1

A reaction vessel equipped with a condenser tube, stirrer and nitrogen feed tube was charged with 724 parts of bisphenol A ethylene oxide (2 mol) adduct, 276 parts of isophthalic acid, and 2 parts of dibutyltin oxide, allowing reaction to proceed at 230° C. for 8 hours under normal pressure, and then under reduced pressure of 10-15 mmHg for 5 hours, and the vessel was cooled to 160° C. The reaction vessel was then charged with 32 parts of phthalic anhydride for reaction for a further 2 hours. The vessel was cooled to 80° C. and the resultant product was reacted with 188 parts of isophorone diisocyanate for 2 hours in ethyl acetate to give an isocyanate containing-prepolymer (1), 267 parts of which was then reacted with 14 parts of isophorone diamine for 2 hours at 50° C. to give a urea-modified polyester resin (1) with a weight-average molecular weight of 6,4000. In a similar way 724 parts of bisphenol A ethylene oxide (2 mol) adduct was condensed with 276 parts of terephthalic acid at 230° C. for 8 hours under normal pressure, and then under reduced pressure of 10-15 mmHg for 5 hours, to give a unmodified polyester resin (a) with a peak molecular weight of 5,000.

In 2,000 parts of a 1:1 mixture solvent of ethyl acetate and MEK were dissolved 200 parts of the urea-modified polyester resin (1) and 800 parts of the unmodified polyester resin (a) to give a toner binder resin (1) in ethyl acetate/MEK solution. A portion of this solution was dried under reduced pressure to isolate toner binder resin (1), which was shown to have a glass transition temperature (Tg) of 62° C. and an acid value of 10 mgKOH/g.

Next, a beaker was charged with 240 parts of the toner binder resin (1) in ethyl acetate/MEK solution, 20 parts of pentaerythritol tetrabehenate (melting point=81° C., melting viscosity=25 cps), and 10 parts of carbon black, and the ingredients were homogenously mixed with TK Homomixer at 60° C. at 12,000 rpm to obtain a toner material solution.

Meanwhile, a beaker was charged with 706 parts of ion-exchanged water, 294 parts of 10% suspension of hydroxyapatite (Supertite 10, produced by Nippon Chemical Industrial, Co., Ltd.), and 0.2 parts of sodium dodecylbenzenesulfonate, and these ingredients were homogenously mixed to prepare an aqueous phase. The mixture was heated to 60° C. and the toner material solution prepared above was added with agitation at 12,000 rpm by means of TK Homomixer, and the mixture was agitated for a further 10 minutes. The resultant mixture was placed into another flask with a stirrer and thermometer, and heated to 98° C. for partial removal of solvent. After cooling to room temperature, the mixture was agitated at 2,000 rpm with TK Homomixer to deform toner particles and the solvent was completely removed, followed by filtration, washing, drying, and wind classification to give toner base particles. Hydrophobic silica (0.5 parts) was added to 100 parts of the toner base particles and mixed with HENSCHEL MIXER to produce toner of Preparation Example 1. The average circularity of this toner, as measured in accordance with the procedure described below, was 0.948.

<Method of Measuring Average Circularity>

Using first grade sodium chloride, a 1 mass % NaCl aqueous solution was prepared as electrolytic aqueous solution. As a dispersing agent 0.1-5 ml of surfactant (alkylbenzene sulfonate), and 2-20 mg of analyte were added to 100-150 ml of the electrolytic aqueous solution, and dispersing treatment was conducted for about 1-3 minutes with a ultrasonic disperser to produce sample particles dispersed in solution. Into another beaker 100-200 ml of the electrolytic aqueous solution was added, and the sample particle solution was added into the beaker to a given sample particle concentration to produce a suspension. The average circularity was measured by the method of an optical detection band in which the suspension was passed through an image detection band on a flat plate, and particle images were optically detected with a CCD camera and analyzed. Measurement was made with a flow-type particle image analyzer FPIA-1000 (manufactured by Sysmex Corporation).

Preparation Example 2

In 2,000 parts of a 1:1 mixture solvent of ethyl acetate and MEK were dissolved 850 parts of the urea-modified polyester resin (1) and 150 parts of the unmodified polyester resin (a), both prepared in Preparation Example 1, to give a toner binder resin (2) in ethyl acetate/MEK solution. A portion of this solution was dried under reduced pressure to isolate toner binder resin (2). The toner of Preparation Example 2 was prepared in the same manner as that of Preparation Example 1 except that the toner binder resin (2) was employed instead of the toner binder resin (1). The average circularity of this toner, measured as in Preparation Example 1, was 0987.

Preparation Example 3

A reaction vessel equipped with a condenser tube, stirrer and nitrogen feed tube was charged with 343 parts of bisphenol A ethylene oxide (2 mol) adduct, 166 parts of isophthalic acid, and 2 parts of dibutyltin oxide, allowing reaction to proceed at 230° C. for 8 hours under normal pressure, and then under reduced pressure of 10-15 mmHg for 5 hours, and the vessel was cooled to 80° C. The resultant product was reacted with 14 parts of toluene diisocyanate in toluene at 110° C. for 5 hours. After the reaction completed, solvent removal was conducted to give a urethane-modified polyester resin with a weight-average molecular weight of 98,000.

As in Preparation Example 1, 363 parts of bisphenol A ethylene oxide (2 mol) adduct was condensed with 166 parts of terephthalic acid at 230° C. to give a unmodified polyester resin.

In toluene 350 parts of the urethane-modified polyester resin and 650 parts of the unmodified polyester resin were dissolved and mixed, and toluene was removed to prepare toner binder resin (3). After pre-mixing 100 parts of the toner binder resin (3) with 8 parts of carbon black with HENSCHEL MIXER, the mixture was kneaded with a continuous-type kneader. The obtained product was pulverized with a jet pulverizer and classified with an air flow classifier to obtain toner particles. Hydrophobic silica (1.0 part) and 0.5 parts of hydrophobic titanium oxide were added to 100 parts of the toner particles and mixed with HENSCHEL MIXER to produce toner of Preparation Example 3. The average circularity of this toner, measured as in Preparation Example 1, was 0934.

<Preparation Example of Reactive Charge Transporting Substance>

Charge transporting polyols (reactive charge transporting substance) for use in the formation of a protective layer upon fabrication of the latent electrostatic image bearing member according to the present invention are, for example, known charge transporting polyols such as those prepared by the method disclosed in Japanese Patent Publication (JP-B) No. 3540056.

[Preparation of Charge Transporting Polyol (CTP-2)]

Preparation of diethyl 4-methoxybenzylphosphonate 4-methoxybenzylchloride and triethyl phosphite were reacted at 150° C. for 5 hours, followed by vacuum distillation for removal of excess triethyl phosphite and by-products to give diethyl 4-methoxybenzylphosphonate.

Preparation of 4-methoxy-4'-(di-p-tolylamino)stilbene

Equal molar amounts of diethyl 4-methoxybenzylphosphonate and 4-(di-p-tolylamino)benzaldehyde were dissolved into N,N-dimethylformamide, and with agitation under water cooling, t-butoxy potassium was added little by little. After agitation for 5 hours at room temperature, water was added, and the solution was rendered acidic so that crude target product precipitates. The crude target product was purified by column chromatography on silica gel to give 4-methoxy-4'-(di-p-tolylamino)stilbene.

Preparation of 4-hydroxy-4'-(di-p-tolylamino)stilbene (CTP-1)

The obtained 4-methoxy-4'-(di-p-tolylamino)stilbene and two equivalent amounts of sodium ethanethiolate were dissolved into N,N-dimethylformamide, allowing reaction to proceed at 130° C. for 5 hours. The solution was cooled, added in water, and neutralized with hydrochloric acid, and the target product was extracted with ethyl acetate. The extract liquid was washed with water and dried, and solvent was removed to obtain a crude product, which was then purified by column chromatography on silica gel to give 4-hydroxy-4'-(di-p-tolylamino)stilbene (CTP-1), a target product.

(CTP-1)

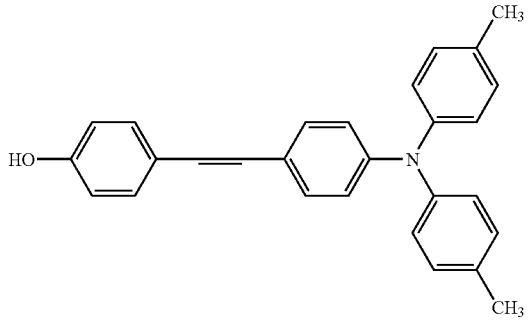

Preparation of 1,2-dihydroxy-3-[4'-(di-p-tolylamino) stilbene-4-iloxy]propane

A reaction vessel equipped with a stirrer, thermometer, condenser tube and dropping funnel was charged with 11.75 g of 4-hydroxy-4'-(di-p-tolylamino)stilbene, 4.35 g of glycidyl methacrylate and 8 ml of toluene and, after heated to 90° C., 0.16 g of triethylamine was added. Thereafter, the mixture was heated at 95° C. for 8 hours with agitation, and 16 ml of toluene and 20 ml of 10% sodium hydroxide aqueous solution were added and heated at 95° C. for a further 8 hours with agitation.

After the reaction, the resultant product was diluted with ethyl acetate and sequentially washed with acid and water. Thereafter, solvent removal was conducted to yield a crude product (19 g), which was then purified by column chromatography on silica gel (solvent=ethyl acetate) to give a target compound 1,2-dihydroxy-3-[4'-(di-p-tolylamino)stilbene-4-iloxy]propane (CTP-2) with a OH equivalent weight of 232.80, having the following structural formula (yield=9.85 g, yellow crystal, melting point=127-128.7° C.).

(CTP-2)

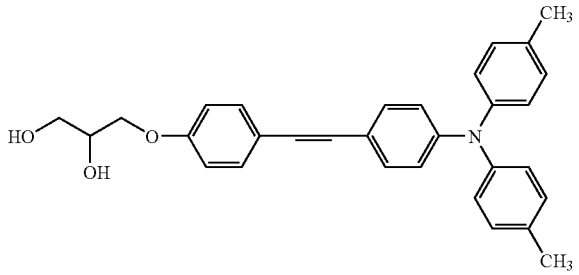

Figure 12:
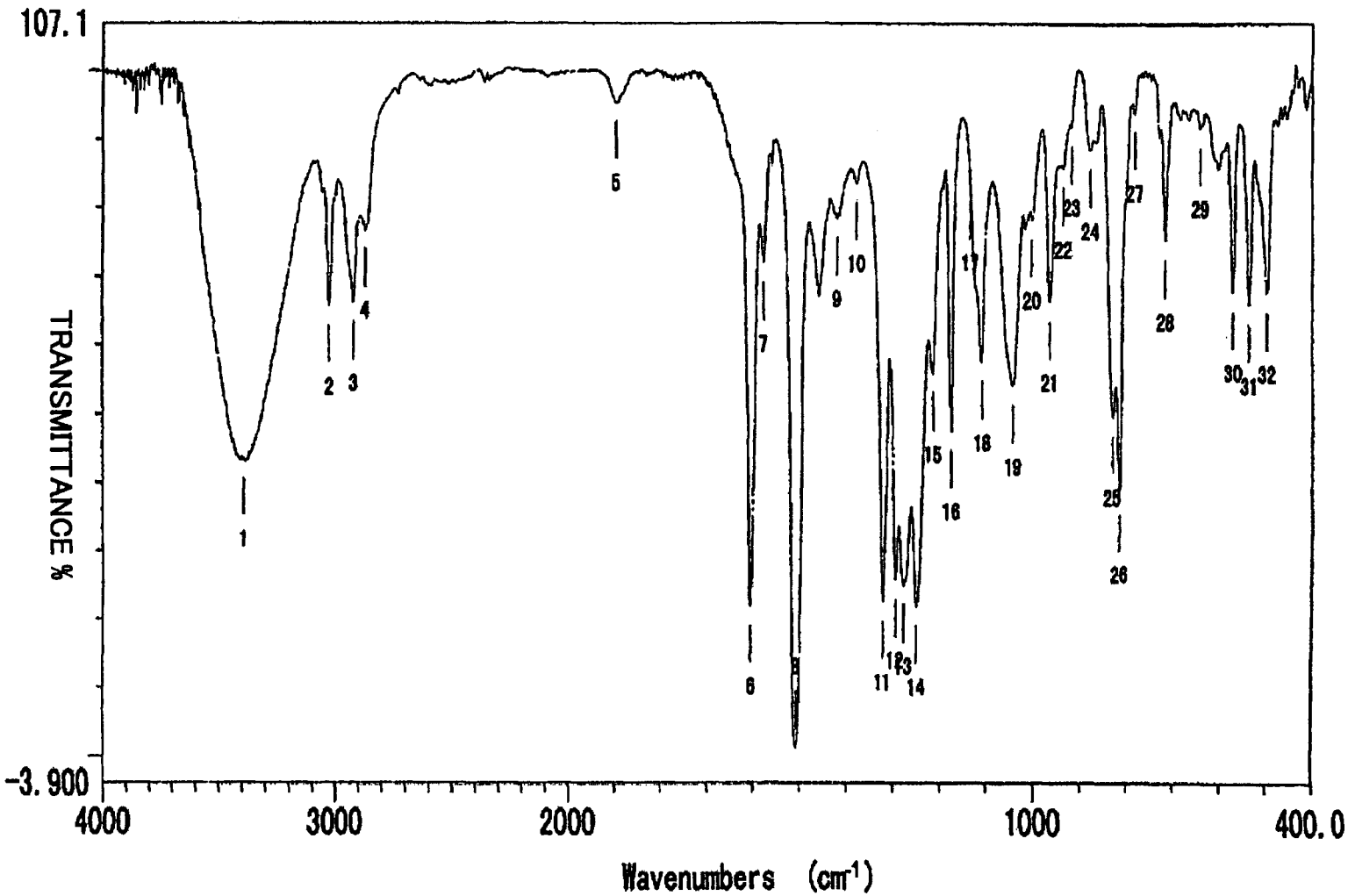
FIG. 12 is an IR spectrum chart of 1,2-dihydroxy-3-[4'-(di-p-tolylamino)stilbene-4-iloxy]propane (CTP-2).

IR measurement data for CTP-2 (IR data No. 1) is shown in FIG. 12.

Other charge transporting polyols having 1,2-dihydroxypropyloxy group can be prepared by first preparing a methoxy group-containing triphenylamine derivative as described above and reacting it through a reaction path similar to that described above.

In the reaction path, after reacting a hydroxyl group-containing charge transporting substance and glycidyl methacrylate, the reaction product is subjected to alkaline hydrolysis by which 1,2-dihydroxypropyloxy group can be introduced. Thus it is possible to optionally determine the number of hydroxyl groups while considering the balance between charge transportability and wear resistance. Note that any desired number—theoretically an infinite number—of hydroxyl groups can be provided in the hydroxyl group-containing charge transporting substance by appropriately designing its molecular structure. In the present invention the number of 1,2-dihydroxypropyloxy groups is preferably 1 to 4.

[Preparation of Charge Transporting Polyol (CTP-4)]

Using a derivative necessary to obtain the structure of a target compound and through a reaction path similar to that in the above-described Preparation Examples, ([4-[2,2-bis-(4-hydroxyphenyl)-vinyl]-phenyl]-di-p-tolyl-amine) (CTP-3), a hydroxy σ-phenylstilbene derivative, was prepared.

(CTP-3)

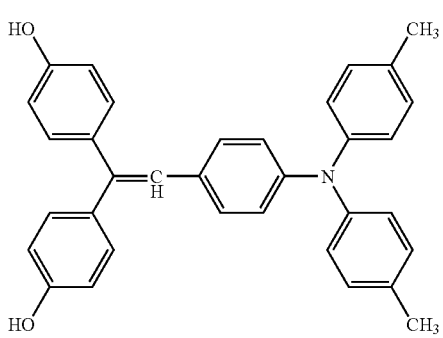

In a reaction vessel equipped with a stirrer, 33.9 g of [4-[2,2-bis-(4-hydroxyphenyl)-vinyl]-phenyl]-di-p-tolyl-amine (CTP-3) and 35 g of potassium carbonate were placed, and 120 ml of DMAc and 3 ml of nitrobenzene were poured into the reaction vessel to dissolve the ingredients. Subsequently, 70.5 g of 2-bromoethanol was added dropwise and reacted at 100° C. for 18 hours, the reaction vessel was cooled to room temperature, insoluble matter was removed, and the reaction product was diluted with toluene. The obtained toluene solution was washed with salt water and water, and magnesium sulfate was added for dehydration. The toluene solution was filtrated for removal of toluene to yield a crude target product (39.6 g), which was then purified by column chromatography on silica gel using a mixture solvent of dichloromethane/ethyl acetate (20/1-3/1) and purified twice by recrystallization using a mixture solvent of toluene/cyclohexane (2/1), thereby giving 2-(4-[2-[4-(di-p-tolyl-amino)phenyl-]-1-[4-(2-hydroxy-ethoxy)-phenyl]-vinyl]-phenoxy)-ethanol (CTP-4) with a OH equivalent weight of 285.86, having the following structural formula (yield=22.3 g, yellow crystal, melting point=178.5-179.0° C.).

(CTP-4)

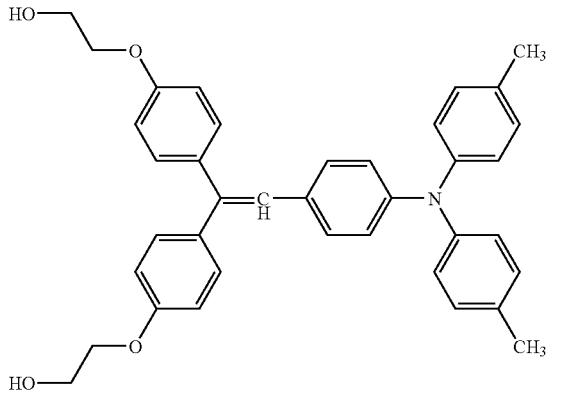

By reacting a hydroxyl group-containing charge transporting substance and 2-bromoethanol as described above, 2-hydroxyethoxy group can be introduced. By controlling the number of carbon atoms in a bromoalcohol in the foregoing reaction, it is possible to introduce hydroxylalkoxyl group with any desired number of carbon atoms, whereby the number of hydroxyl groups can be optionally determined while satisfying the balance between charge transportability and wear resistance.

Preparation of p-diethylaminophenetyl Alcohol

A four-necked flask was charged with 9.6 g (70 mmol) of p-aminophenetyl alcohol, 38.7 g (280 mmol) of potassium carbonate and 100 ml of monochlorobenzene under argon gas atmosphere, and heated at 120° C. with agitation. To the flask was added dropwise 32.8 g (210 mmol) of ethyl iodide over 5 hours, and after addition, heated for 5 hours with agitation. The reaction solution was cooled to room temperature, diluted with dichloromethane, and washed with water three times. The dichloromethane solution was dried with anhydrous magnesium sulfate followed by solvent removal, and purified by column chromatography on silica gel using mixture solvent of toluene/ethyl acetate (2/1) to give 12.1 g of p-diethylaminophenetyl alcohol (yield=89% by mass).

By reacting a hydroxyl group-containing primary or secondary amine and an alkyl halide as described above, a desired tertiary amine can be readily obtained.

Example 1

<Fabrication of Latent Electrostatic Image Bearing Member 1>

The latent electrostatic image bearing member 1 was fabricated in accordance with the following procedure.

[Formation of Undercoat Layer]

Into 150 parts of methyl ethyl ketone were dissolved 15 parts of alkyd resin (BECKOLITE M6401-50, produced by Dainippon Ink and Chemicals Incorporated) and 10 parts of melamine resin (SUPER BEKKAMIN G-821-60, produced by Dainippon Ink and Chemicals Incorporated), and 90 parts of titanium oxide powder (TIPAQUE CR-EL, produced by Ishihara Sangyo Co., Ltd.) was added. The resultant mixture was milled with a ball mill for 12 hours to produce a coating solution for undercoat layer. The coating solution was applied over a 30 mm-diameter cylindrical aluminum substrate by dip coating, and dried at 130° C. for 20 minutes to form a undercoat layer of 3.5 μm thickness.

[Formation of Charge Generating Layer]

Four parts of polyvinylbutyral resin (XYHL, produced by UCC) was dissolved into 150 parts of cyclohexanone, 10 parts of bisazo pigment having the following Structural Formula (A) was added, and milled with a ball mill for 48 hours. Thereafter, 210 parts of cyclohexanone was added and milled for 3 hours. The resultant solution was placed into a container and diluted with cyclohexanone to a solid content of 1.5% by mass, to produce a coating solution for charge generating layer.

The coating solution for charge generating layer was applied over the undercoat layer and dried at 130° C. for 20 minutes to form a charge generating layer of 0.2 μm thickness.

(A)

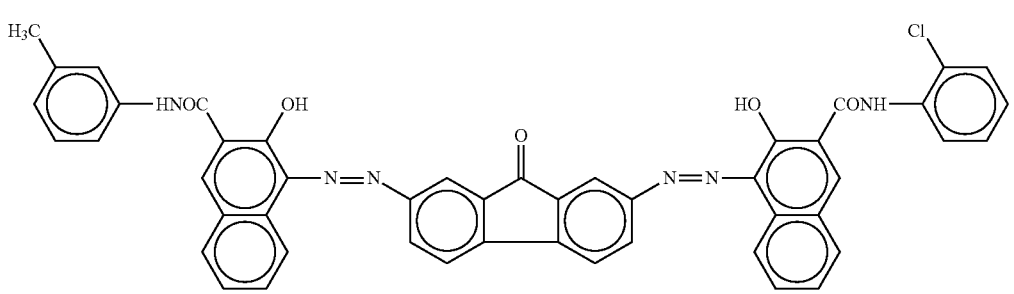

[Formation of Charge Transporting Layer]

Into 100 parts of tetrahydrofuran were dissolved 10 parts of bisphenol Z polycarbonate resin, 0.002 parts of silicone oil (KF-50, produced by Shin-Etsu Chemical Co., Ltd.) and 7 parts of a charge transporting substance represented by the following Structural Formula (B), preparing a coating solution for charge transporting layer.

The coating solution was applied over the charge generating layer by dip coating and dried at 110° C. for 20 minutes to form a charge transporting layer of 22 μm thickness.

(B)

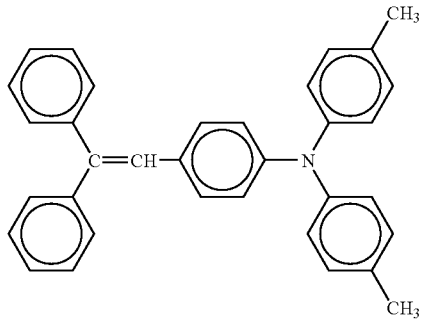

[Formation of Protective Layer]

Into 50 parts of cyclehexanone and 200 parts of tetrahydrohuran were dissolved 20 parts of polyol (styrene-acryl copolymer made of styrene, methyl methacrylate and hydroxyethyl methacrylate; LZR-170, OH equivalent weight=about 367, solid content=41% by mass, produced by FUJIKURAKASEI Co., Ltd.), 20 parts of 2-(4-[2-[4-(di-p-tolyl-amino)phenyl-]-1-[4-(2-hydroxy-ethoxy)-phenyl]-vinyl]-phenoxy)-ethanol (CTP-4) and 5 parts of p-diethylaminophenetyl alcohol. Subsequently, 38 parts of polyol adduct of tolylene diisocyanate (CORONATE L, NCO %=13%, solid content=75%, produced by Nippon Polyurethane Industry Co., Ltd.) was dissolved therein to prepare a coating solution for protective layer. The coating solution was applied over the charge transporting layer by spray coating and dried at 150° C. for 30 minutes to form a protective layer of 8 μm thickness.

In this way the latent electrostatic image bearing member 1 consisting of, in order, an aluminum substrate, undercoat layer, charge generating layer, charge transporting layer, and protective layer was fabricated.

Example 2

<Fabrication of Latent Electrostatic Image Bearing Member 2>

A undercoat layer, charge generating layer, and charge transporting layer were formed over an aluminum substrate as in Example 1. Subsequently, a coating solution for protective layer prepared in the following manner was applied over the charge transporting layer by spray coating and dried at 150° C. for 30 minutes to form a protective layer of 8 μm thickness. In this way the latent electrostatic image bearing member 2 consisting of, in order, an aluminum substrate, undercoat layer, charge generating layer, charge transporting layer, and protective layer was fabricated.

[Preparation of Coating Solution for Protective Layer]

To 100 parts of tetrahydrofuran was added 16 parts of zinc antimonate sol (product name=CELNAX CX-Z210, produced by Nissan Chemical Industries, Ltd., solid content=20% by mass, volume-average particle diameter=0.04 μm) and sonicated for 10 minutes for dispersing. In this way a dispersion liquid I was prepared.

Next, 21 parts of polyol (styrene-acryl copolymer made of styrene, methyl methacrylate and hydroxyethyl methacrylate; LZR-170, OH equivalent weight=about 367, solid content=41% by mass, produced by FUJIKURAKASEI Co., Ltd.), 20 parts of 2-(4-[2-[4-(di-p-tolyl-amino)phenyl-]-1-[4-(2-hydroxy-ethoxy)-phenyl]-vinyl]-phenoxy)-ethanol (CTP-4) and 5.3 parts of p-diethylaminophenetyl alcohol were dissolved into 51 parts of cyclehexanone and 80 parts of tetrahydrohuran, and 39 parts of polyol adduct of hexamethylene diisocyanate (Sumijule HT, NCO %=13%, solid content=75%, produced by Sumika Bayer Urethane Co., Ltd.) was dissolved therein. The resultant solution was added to the dispersion liquid I above to prepare a coating solution for protective layer.

Example 3

<Fabrication of Latent Electrostatic Image Bearing Member 3>

A undercoat layer, charge generating layer, and charge transporting layer were formed over an aluminum substrate as in Example 1. Subsequently, a coating solution for protective layer prepared in the following manner was applied over the charge transporting layer by spray coating and dried at 150° C. for 30 minutes to form a protective layer of 8 μm thickness. In this way the latent electrostatic image bearing member 3 consisting of, in order, an aluminum substrate, undercoat layer, charge generating layer, charge transporting layer, and protective layer was fabricated.

[Preparation of Coating Solution for Protective Layer]

To 100 parts of tetrahydrofuran was added 17 parts of zinc antimonate sol (product name=CELNAX CX-Z210, produced by Nissan Chemical Industries, Ltd., solid content=20% by mass, volume-average particle diameter=0.04 μm) and sonicated for 10 minutes for dispersing. In this way a dispersion liquid II was prepared.

Next, 27.5 parts of polyol (styrene-acryl copolymer made of styrene, methyl methacrylate and hydroxyethyl methacrylate; LZR-170, OH equivalent weight=about 367, solid content=41% by mass, produced by FUJIKURAKASEI Co., Ltd.), 20 parts of 2-(4-[2-[4-(di-p-tolyl-amino)phenyl-]-1-[4-(2-hydroxy-ethoxy)-phenyl]-vinyl]-phenoxy)-ethanol (CTP-4) and 5.7 parts of p-diethylaminophenetyl alcohol were dissolved into 55 parts of cyclehexanone and 90 parts of tetrahydrohuran, and 42 parts of polyol adduct of tolylene diisocyanate (CORONATE L, NCO %=13%, solid content=75%, produced by Nippon Polyurethane Industry Co., Ltd.) was dissolved therein. The resultant solution was added to the dispersion liquid II above to prepare a coating solution for protective layer.

Example 4

<Fabrication of Latent Electrostatic Image Bearing Member 4>

The latent electrostatic image bearing member 4 was fabricated in the same manner as that of Example 3 except that benzylmethylethanolamine (produced by Sigma Aldrich Corp.) was employed instead of p-diethylaminophenetyl alcohol and that the added amounts of polyol (LZR-170), 2-(4-[2-[4-(di-p-tolyl-amino)phenyl-]-1-[4-(2-hydroxy-ethoxy)-phenyl]-vinyl]-phenoxy)-ethanol (CTP-4) and isocyanate (CORONATE L) were changed to 16 parts, 23.6 parts and 43 parts, respectively.

Example 5

<Fabrication of Latent Electrostatic Image Bearing Member 5>

The latent electrostatic image bearing member 5 was fabricated in the same manner as that of Example 3 except that 4-diethylaminophenol (produced by Sigma Aldrich Corp.) was employed instead of p-diethylaminophenetyl alcohol and that the added amounts of polyol (LZR-170), 2-(4-[2-[4-(di-p-tolyl-amino)phenyl-]-1-[4-(2-hydroxy-ethoxy)-phenyl]-vinyl]-phenoxy)-ethanol (CTP-4) and isocyanate (CORONATE L) were changed to 16 parts, 23.6 parts and 43 parts, respectively.

Example 6

<Fabrication of Latent Electrostatic Image Bearing Member 6>

The latent electrostatic image bearing member 6 was fabricated in the same manner as that of Example 3 except that p-dibenzylaminophenetyl alcohol was employed instead of p-diethylaminophenetyl alcohol and that the added amounts of polyol (LZR-170), 2-(4-[2-[4-(di-p-tolyl-amino)phenyl-]-1-[4-(2-hydroxy-ethoxy)-phenyl]-vinyl]-phenoxy)-ethanol (CTP-4) and isocyanate (CORONATE L) were changed to 22 parts, 23.6 parts and 40 parts, respectively.

Example 7

<Fabrication of Latent Electrostatic Image Bearing Member 7>

The latent electrostatic image bearing member 7 was fabricated in the same manner as that of Example 3 except that 20 parts of ([4-[2,2-bis-(4-hydroxyphenyl)-vinyl]-phenyl]-di-p-tolyl-amine) (CTP-3) was employed instead of CTP-4 and that the added amounts of polyol (LZR-170) and isocyanate (CORONATE L) were changed to 23 parts and 44 parts, respectively.

Example 8

<Fabrication of Latent Electrostatic Image Bearing Member 8>

The latent electrostatic image bearing member 8 was fabricated in the same manner as that of Example 3 except that 20 parts of a charge transporting compound (CTP-5) represented by the following Structural Formula was employed instead of CTP-4 and that the added amounts of polyol (LZR-170) and isocyanate (CORONATE L) were changed to 32 parts and 40 parts, respectively.

(CTP-5)

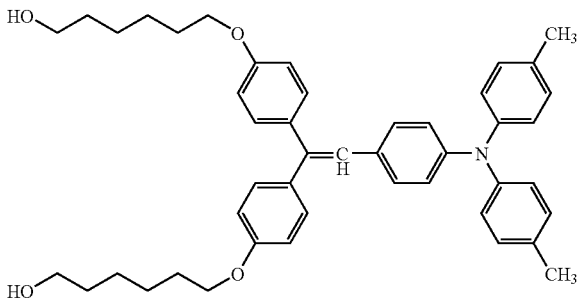

Example 9

<Fabrication of Latent Electrostatic Image Bearing Member 9>

The latent electrostatic image bearing member 9 was fabricated in the same manner as that of Example 3 except that 20 parts of a charge transporting compound (CTP-6) represented by the following Structural Formula was employed instead of CTP-4 and that the added amounts of polyol (LZR-170) and isocyanate (CORONATE L) were changed to 7.5 parts and 53 parts, respectively.

(CTP-6)

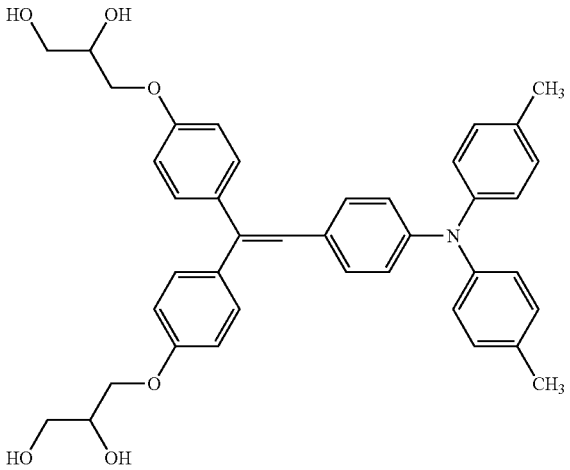

Example 10

<Fabrication of Latent Electrostatic Image Bearing Member 10>

The latent electrostatic image bearing member 10 was fabricated in the same manner as that of Example 3 except that 20 parts of a charge transporting compound (CTP-2) represented by the following Structural Formula was employed instead of CTP-4 and that the added amounts of polyol (LZR-170) and isocyanate (CORONATE L) were changed to 22 parts and 45 parts, respectively.

(CTP-2)

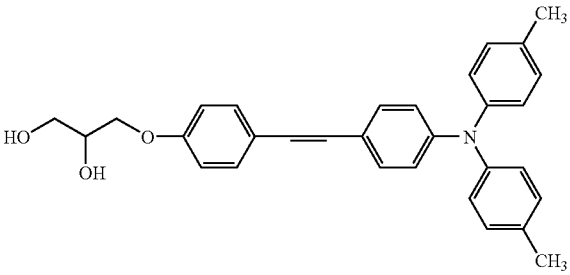

Example 11

<Fabrication of Latent Electrostatic Image Bearing Member 11>

The latent electrostatic image bearing member 11 was fabricated in the same manner as that of Example 3 except that 20 parts of a charge transporting compound (CTP-7) represented by the following Structural Formula was employed instead of CTP-4 and that the added amounts of polyol (LZR-170) and isocyanate (CORONATE L) were changed to 20 parts and 46 parts, respectively.

(CTP-7)

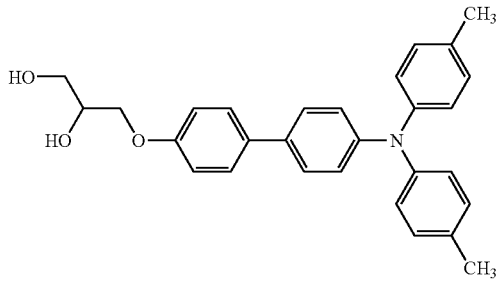

Example 12

<Fabrication of Latent Electrostatic Image Bearing Member 12>

The latent electrostatic image bearing member 12 was fabricated in the same manner as that of Example 3 except that 20 parts of a charge transporting compound (CTP-8) represented by the following Structural Formula was employed instead of CTP-4 and that the added amounts of polyol (LZR-170) and isocyanate (CORONATE L) were changed to 27 parts and 42 parts, respectively.

(CTP-8)

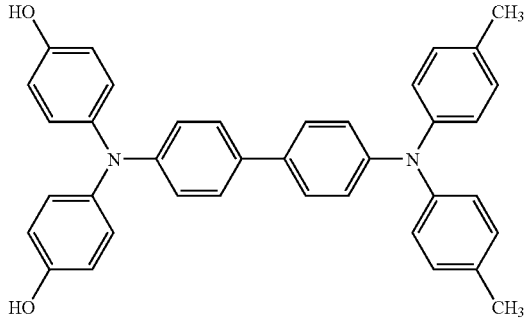

Example 13

<Fabrication of Latent Electrostatic Image Bearing Member 13>

The latent electrostatic image bearing member 13 was fabricated in the same manner as that of Example 3 except that 20 parts of a charge transporting compound (CTP-9) represented by the following Structural Formula was employed instead of CTP-4 and that the added amounts of polyol (LZR-170) and isocyanate (CORONATE L) were changed to 29 parts and 41 parts, respectively.

(CTP-9)

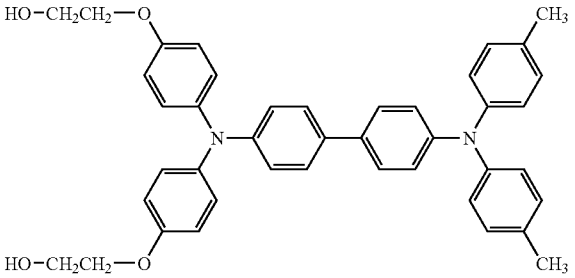

Example 14

<Fabrication of Latent Electrostatic Image Bearing Member 14>

The latent electrostatic image bearing member 14 was fabricated in the same manner as that of Example 3 except that 20 parts of a charge transporting compound (CTP-10) represented by the following Structural Formula was employed instead of CTP-4 and that the added amounts of polyol (LZR-170) and isocyanate (CORONATE L) were changed to 12 parts and 50 parts, respectively.

(CTP-10)

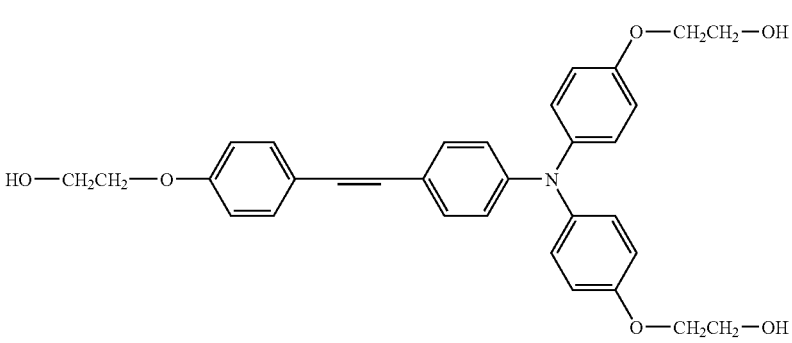

Example 15

<Fabrication of Latent Electrostatic Image Bearing Member 15>

The latent electrostatic image bearing member 15 was fabricated in the same manner as that of Example 3 except that the added amounts of polyol (LZR-170), CTP-4 and isocyanate (CORONATE L) were changed to 66 parts, 6 parts and 39 parts, respectively.

Example 16

<Fabrication of Latent Electrostatic Image Bearing Member 16>

The latent electrostatic image bearing member 16 was fabricated in the same manner as that of Example 3 except that the added amounts of polyol (LZR-170), CTP-4 and isocyanate (CORONATE L) were changed to 74 parts, 2.5 parts and 39 parts, respectively.

Example 17

<Fabrication of Latent Electrostatic Image Bearing Member 17>

The latent electrostatic image bearing member 17 was fabricated in the same manner as that of Example 3 except that the added amounts of polyol (LZR-170), CTP-4 and isocyanate (CORONATE L) were changed to 12 parts, 26 parts and 42 parts, respectively.

Example 18

<Fabrication of Latent Electrostatic Image Bearing Member 18>

The latent electrostatic image bearing member 18 was fabricated in the same manner as that of Example 13 except that the added amounts of polyol (LZR-170), CTP-9 and isocyanate (CORONATE L) were changed to 0.1 parts, 33 parts and 44 parts, respectively and that no zinc antimonate was added.

Example 19

<Fabrication of Latent Electrostatic Image Bearing Member 19>

The latent electrostatic image bearing member 19 was fabricated in the same manner as that of Example 3 except that as isocyanate 22 parts of xylene diisocyanate (TAKENATE 500, NCO %=45%, produced by Mitsui Chemicals Polyurethanes, Inc.) was employed and that the added amounts of polyol (LZR-170) and p-diethyleneaminophenetyl alcohol were changed to 59 parts and 7.2 parts, respectively.

Example 20

<Fabrication of Latent Electrostatic Image Bearing Member 20>

The latent electrostatic image bearing member 20 was fabricated in the same manner as that of Example 19 except that the added amount of polyol (LZR-170) was changed to 62 parts and that as isocyanate 21 parts of tolylene diisocyanate (COSMONATE T-80, NCO %=48%, produced by Mitsui Chemicals Polyurethanes, Inc.) was employed.

Example 21

<Fabrication of Latent Electrostatic Image Bearing Member 21>

The latent electrostatic image bearing member 21 was fabricated in the same manner as that of Example 19 except that the added amount of polyol (LZR-170) was changed to 56 parts and that as isocyanate 7.2 parts of naphthalene diisocyanate (COSMONATE ND, NCO %=40%, produced by Mitsui Chemicals Polyurethanes, Inc.) was employed.

Example 22

<Fabrication of Latent Electrostatic Image Bearing Member 22>

The latent electrostatic image bearing member 22 was fabricated in the same manner as that of Example 19 except that the added amount of polyol (LZR-170) was changed to 47 parts and that as isocyanate 29 parts of polymeric MDI (COSMONATE M-100, NCO %=30%, produced by Mitsui Chemicals Polyurethanes, Inc.) was employed.

Example 23

<Fabrication of Latent Electrostatic Image Bearing Member 23>

The latent electrostatic image bearing member 23 was fabricated in the same manner as that of Example 3 except that 7 parts of trimethylolpropane (OH equivalent weight=45) was employed instead of polyol (LZR-170) and that the added amount of isocyanate (CORONATE L) was changed to 53 parts.

Example 24

<Fabrication of Latent Electrostatic Image Bearing Member 24>

The latent electrostatic image bearing member 24 was fabricated in the same manner as that of Example 23 except that the added amounts of trimethylolpropane and isocyanate (CORONATE L) were changed to 6 parts and 49 parts, respectively and that 24 parts of tin oxide colloid (SUN COLLOID HIT301M1, produced by Nissan Chemical Industries, Ltd., solid content=30% by mass, volume-average particle diameter=0.01 μm) was employed instead of zinc antimonate.

Example 25

<Fabrication of Latent Electrostatic Image Bearing Member 25>

The latent electrostatic image bearing member 25 was fabricated in the same manner as that of Example 23 except that the added amounts of trimethylolpropane and isocyanate (CORONATE L) were changed to 7 parts and 53 parts, respectively and that 3.5 parts of conductive titanium oxide fine particles (ET-500W, produced by Ishihara Sangyo Co., Ltd., volume-average particle diameter=0.25 μm) was employed instead of zinc antimonate.

Example 26

<Fabrication of Latent Electrostatic Image Bearing Member 26>

The latent electrostatic image bearing member 26 was fabricated in the same manner as that of Example 3 except that 7 parts of silica particles (KMPX-100, produced by Shin-Etsu Silicone Co., Ltd.) was added in the dispersion liquid II and sonication was conducted, and that the added amounts of polyol (LZR-170) and isocyanate (CORONATE L) were changed to 17 parts and 38 parts, respectively.

Example 27

<Fabrication of Latent Electrostatic Image Bearing Member 27>

The latent electrostatic image bearing member 27 was fabricated in the same manner as that of Example 26 except that 7 parts of alumina fine particles (SUMIKORANDOM AA-03, produced by Sumitomo Chemical Co., Ltd.) was employed instead of silica fine particles.

Example 28

<Fabrication of Latent Electrostatic Image Bearing Member 28>

The latent electrostatic image bearing member 28 was fabricated in the same manner as that of Example 26 except that 7 parts of titanium oxide fine particles (TIPAQUE, produced by Ishihara Sangyo Co., Ltd.) was employed instead of silica fine particles.

Example 29

<Fabrication of Latent Electrostatic Image Bearing Member 29>

The latent electrostatic image bearing member 29 was fabricated in the same manner as that of Example 26 except that 7 parts of tin oxide fine particles (produced by Mitsubishi Materials Corporation) was employed instead of silica fine particles.

Example 30

<Fabrication of Latent Electrostatic Image Bearing Member 30>

The latent electrostatic image bearing member 30 was fabricated in the same manner as that of Example 3 except that indium antimonate in methanol sol (solid content=18% by mass, volume-average particle diameter=0.026 μm) was prepared in the manner disclosed in Example 2 of JP-A No. 07-144917 and added n an amount of 20 parts instead of zinc antimonate sol.

Example 31

<Fabrication of Latent Electrostatic Image Bearing Member 31>

A undercoat layer, charge generating layer, and charge transporting layer were formed over an aluminum substrate as in Example 1.

[Formation of Charge Transporting Layer]

To 70 parts of tetrahydrofuran was added 17 parts of zinc antimonate sol (CELNAX CX-Z210, produced by Nissan Chemical Industries, Ltd., solid content=20% by mass, volume-average particle diameter=0.04 μm) and sonicated for 10 minutes for dispersing. In this way a dispersion liquid II was prepared.

Next, 27.5 parts of polyol (styrene-acryl copolymer made of styrene, methyl methacrylate and hydroxyethyl methacrylate; LZR-170, OH equivalent weight=about 367, solid content=41% by mass, produced by FUJIKURAKASEI Co., Ltd.), 20 parts of CTP-4 and 5.7 parts of p-diethylaminophenetyl alcohol were dissolved into 23 parts of cyclehexanone. Subsequently, 42 parts of polyol adduct of tolylene diisocyanate (CORONATE L, NCO %=13%, solid content=75%, produced by Nippon Polyurethane Industry Co., Ltd.) was dissolved therein, and the resultant solution was added to the dispersion liquid II above to prepare a coating solution for charge transporting layer. The coating solution was applied over the charge generating layer by spray coating and dried at 150° C. for 40 minutes to form a charge transporting layer of 18 μm thickness. In this way the latent electrostatic image bearing member 31 consisting of, in order, an aluminum substrate, undercoat layer, charge generating layer, and charge transporting layer was fabricated.

Comparative Example 1

<Fabrication of Latent Electrostatic Image Bearing Member 32>

The latent electrostatic image bearing member 32 was fabricated in the same manner as that of Example 3 except that no p-diethylaminophenetyl alcohol was added and that the added amounts of polyol (LZR-170) and isocyanate (CORONATE L) were changed to 46 parts and 39 parts, respectively.

Comparative Example 2

<Fabrication of Latent Electrostatic Image Bearing Member 33>

The latent electrostatic image bearing member 33 was fabricated in the same manner as that of Example 3 except that benzylethanolamine (produced by Sigma Aldrich Corp.) was employed instead of p-diethylaminophenetyl alcohol and that the added amounts of polyol (LZR-170) and isocyanate (CORONATE L) were changed to 11 parts and 50 parts, respectively.

Comparative Example 3

<Fabrication of Latent Electrostatic Image Bearing Member 34>

The latent electrostatic image bearing member 34 was fabricated in the same manner as that of Example 3 except that dibenzylamine (produced by Sigma Aldrich Corp.) was employed instead of p-diethylaminophenetyl alcohol and that the added amounts of polyol (LZR-170) and isocyanate (CORONATE L) were changed to 28 parts and 42 parts, respectively.

Comparative Example 4

<Fabrication of Latent Electrostatic Image Bearing Member 35>

The latent electrostatic image bearing member 35 was fabricated in the same manner as that of Example 3 except that N-benzyl-N-ethylaniline (produced by Sigma Aldrich Corp.) was employed instead of p-diethylaminophenetyl alcohol and that the added amounts of polyol (LZR-170) and isocyanate (CORONATE L) were changed to 38 parts and 36 parts, respectively.

Comparative Example 5

<Fabrication of Latent Electrostatic Image Bearing Member 36>

The latent electrostatic image bearing member 36 was fabricated in the same manner as that of Example 3 except that 20 parts of a charge transporting compound (CTP-11) represented by the following Structural Formula was employed instead of CTP-4 and that the added amounts of polyol (LZR-170) and isocyanate (CORONATE L) were changed to 34 parts and 38 parts, respectively.

(CTP-11)

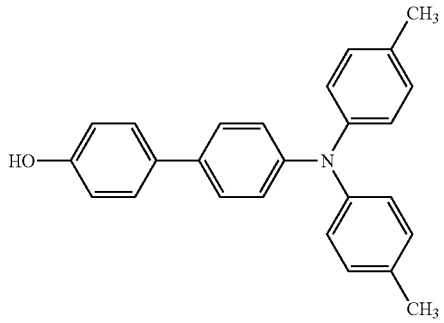

Comparative Example 6

<Fabrication of Latent Electrostatic Image Bearing Member 37>

The latent electrostatic image bearing member 37 was fabricated in the same manner as that of Example 3 except that 20 parts of a charge transporting compound (CTP-1) represented by the following Structural Formula was employed instead of CTP-4 and that the added amounts of polyol (LZR-170) and isocyanate (CORONATE L) were changed to 34 parts and 38 parts, respectively.

(CTP-1)

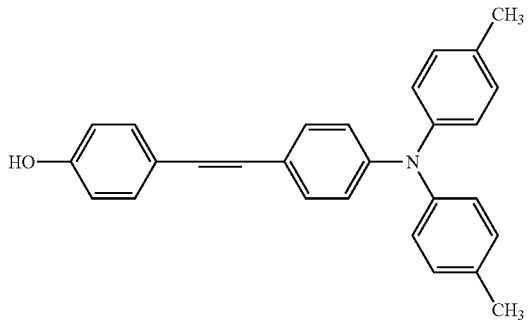

<Evaluation of Wear Resistance>

Each of the latent electrostatic image bearing member and toner prepared in Preparation Example 1 were mounted to a modified full-color printer (IPSio CX8200, manufactured by Ricoh Company, Ltd.) in which the cleaning blade contact pressure is increased 3-fold for applying load to the photoconductor surface.

The voltage of the charger in the modified printer was adjusted such that the non-exposed area voltage (VD) is −700V. Using a laser beam of 660 nm wavelength for exposure, a running test was conducted by printing 50,000 test sheets each having an A4-size 600 dpi image at an image coverage ratio of 6%. The change in the thickness of the photoconductor layer before and after the test was measured with an eddy current thickness meter (FISCHERSCOPE MMS, manufactured by Fischer), thereby determining the wear amount. The results are shown in Table A.

<Wear Accelerating Test and Evaluation of Voltage of Exposed Area after Wear Accelerating Test>

The latent electrostatic image bearing members were each subjected to a wear accelerating test for 4 hours using a wear accelerating tester for photoconductor disclosed in JP-A No. 2002-139958, with the surface voltage set to −800V and drum passing current set to −35 μA. Each latent electrostatic image bearing member was mounted to the modified printer equipped with a developing unit that is modified such that the probe of a surface voltage meter (Trek Inc., model 344) is placed on the development sleeve, the voltage of the charger was adjusted such that the non-exposed area voltage (VD) is −600V, and printing of a 1,200 dpi solid image was conducted. At this point, the surface voltage of the development sleeve was measured for evaluation of the residual potential at the exposed area. The results are shown in Table A.

<Evaluation of Gas Resistance>

Each latent electrostatic image bearing member was placed for 4 days in a desiccator containing 50 ppm nitrogen oxide gas. Gas resistance was evaluated by measuring the change in image resolution between before and after storage in desiccators at 27° C. under 80% relative humidity. The results are shown in Table A.

TABLE A

| | Photo-conductor No. | Exposed area voltage after wear accelerating test (-V) | Wear amount (mm) | Before gas expsoure (resolution: the number of lines/mm) | After gas expsoure (resolution: the number of lines/mm) |
|---|---|---|---|---|---|
| Ex. 1 | 1 | 270 | 3.5 | 7.1 | 5.6 |
| Ex. 2 | 2 | 330 | 2.8 | 7.1 | 5.6 |
| Ex. 3 | 3 | 170 | 2.5 | 7.1 | 6.3 |
| Ex. 4 | 4 | 180 | 2.6 | 7.1 | 6.3 |
| Ex. 5 | 5 | 160 | 2.7 | 7.1 | 5.6 |
| Ex. 6 | 6 | 180 | 2.6 | 7.1 | 5.6 |
| Ex. 7 | 7 | 160 | 3.5 | 7.1 | 6.3 |
| Ex. 8 | 8 | 170 | 2.7 | 7.1 | 6.3 |
| Ex. 9 | 9 | 190 | 1.7 | 7.1 | 6.3 |
| Ex. 10 | 10 | 160 | 2.6 | 7.1 | 6.3 |
| Ex. 11 | 11 | 170 | 2.7 | 7.1 | 6.3 |
| Ex. 12 | 12 | 200 | 3.4 | 7.1 | 6.3 |
| Ex. 13 | 13 | 190 | 2.8 | 7.1 | 6.3 |
| Ex. 14 | 14 | 170 | 2.1 | 7.1 | 6.3 |
| Ex. 15 | 15 | 240 | 2.3 | 7.1 | 6.3 |
| Ex. 16 | 16 | 270 | 2.2 | 7.1 | 6.3 |
| Ex. 17 | 17 | 130 | 2.8 | 7.1 | 5.6 |
| Ex. 18 | 18 | 120 | 3.1 | 7.1 | 5.6 |
| Ex. 19 | 19 | 180 | 2.2 | 7.1 | 6.3 |
| Ex. 20 | 20 | 170 | 2.3 | 7.1 | 6.3 |
| Ex. 21 | 21 | 180 | 3.9 | 7.1 | 6.3 |
| Ex. 22 | 22 | 180 | 3.7 | 7.1 | 6.3 |
| Ex. 23 | 23 | 180 | 1.8 | 7.1 | 6.3 |
| Ex. 24 | 24 | 220 | 1.7 | 6.3 | 5.6 |
| Ex. 25 | 25 | 200 | 1.8 | 6.3 | 5.6 |
| Ex. 26 | 26 | 190 | 2.1 | 7.1 | 6.3 |
| Ex. 27 | 27 | 200 | 1.9 | 7.1 | 6.3 |
| Ex. 28 | 28 | 190 | 1.8 | 7.1 | 6.3 |
| Ex. 29 | 29 | 190 | 2.1 | 7.1 | 6.3 |
| Ex. 30 | 30 | 160 | 2.7 | 7.1 | 6.3 |
| Ex. 31 | 31 | 320 | 3.5 | 7.1 | 5.6 |
| Comp. Ex. 1 | 32 | 150 | 2.3 | 7.1 | 3.2 |
| Comp. Ex. 2 | 33 | 180 | 2.9 | 7.1 | 3.2 |
| Comp. Ex. 3 | 34 | 170 | 2.7 | 7.1 | 3.6 |
| Comp. Ex. 4 | 35 | 180 | 2.9 | 7.1 | 3.2 |
| Comp. Ex. 5 | 36 | 170 | N/A | 7.1 | 6.3 |
| Comp. Ex. 6 | 37 | 180 | N/A | 7.1 | 6.3 |

Note:

In Comparative Examples 5 and 6 the protective layer completely worn off after printing of 40,000 sheets.

The results show that the latent electrostatic image bearing members of Examples 1 to 31 having the configuration of the present invention offered excellent wear resistance and reduced residual potential rise in the exposed area after the wear accelerating test, satisfying the practical requirement. The results also show that the latent electrostatic image bearing members of Examples 1 to 31 offered relatively high image resolution and less degree of image blur under high-temperature, high-humidity conditions after gas exposure. The latent electrostatic image bearing members of Comparative Examples 1 to 4 without the configuration of the present invention, by contrast, offered significant reduction in the image resolution which may be due to the presence of oxidizing gas. In Comparative Examples 5 and 6, the outermost surface layer was worn out greatly by the running test; wear resistance was poor as the protective layer.

Other Examples and Evaluation Results

Although the toner of Preparation Example 1 was employed for the foregoing Examples, the results of evaluations of latent electrostatic image bearing members, fabricated in a manner similar to those Examples 1 to 31, for their wear amount, photoconductor's surface potential (VL) after the wear accelerating test and image quality using the toners of Preparation Examples 2 and 3 were comparable with those of Examples 1 to 31.

Another running test was conducted with the image forming apparatus of the present invention in the following manner. Process cartridge were prepared that are provided with a mechanism by which a bar having solidified zinc stearate is pressed against the cleaning brush by means of a spring, so that zinc stearate is applied over the photoconductor surface through the cleaning brush. The latent electrostatic image bearing members of Examples 1 to 31 were then mounted to the respective process cartridges and running tests were conducted. After the running tests almost all of the photoconductors showed significant reduction in the wear amount. Moreover, running tests using a bar having aluminum stearate or calcium stearate and running tests using a wax bar having solidified carnauba wax all resulted in excellent performance.

That is, the latent electrostatic image bearing member of the present invention is excellent in wear resistance and electrophotographic characteristics. Accordingly, an image forming apparatus, a process cartridge and an image forming method, each of which uses this latent electrostatic image bearing member, are capable of stable image formation over a long period of time.

What is claimed is:

1. A latent electrostatic image bearing member, comprising an outermost surface layer that comprises:

(a) a compound of formula (1), (1)

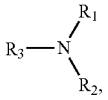

wherein $R_1$ and $R_2$ are independently a substituted or unsubstituted alkyl group, and $R_3$ is an alkyl group comprising a hydroxyl group or an aryl group comprising a hydroxyl group; and (b) a crosslinked resin formed by crosslinking between an isocyanate compound (b-1) and a reactive charge transporting substance (b-2) comprising at least two hydroxyl groups, wherein the reactive charge transporting substance (b-2) is a compound of formula (6)

(6)

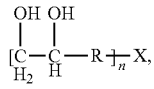

wherein n is 1, 2, 3, or 4,

R is a divalent substituent comprising 1 to 48 carbon atoms,

X is a charge transporting compound group comprising at least one of (i)-(iv):

(i) a diarylamino group —$NAr_1Ar_2$, wherein $Ar_1$ and $Ar_2$ are independently a substituted or non-substituted aromatic group;

(ii) a structure of formula (3) in which a hydrogen atom attached to an aromatic group is removed for substituent Y to be attached (3)

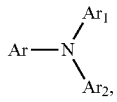

wherein $Ar_1$ and $Ar_2$ are independently a substituted or non-substituted aromatic group, and Ar is an arylene group;

(iii) a structure of formula (4) in which a hydrogen atom attached to an aromatic group is removed for substituent Y to be attached (4)

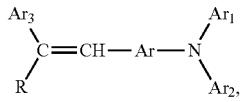

wherein $Ar_1$, $Ar_2$, and $Ar_3$ are independently a substituted or non-substituted aromatic group, Ar is an arylene group, and R is a hydrogen atom or aromatic group;

(iv) a structure of formula (5) in which a hydrogen atom attached to an aromatic group is removed for substituent Y to be attached, (5)

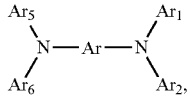

wherein $Ar_1$ and $Ar_2$ are independently a substituted or non-substituted aromatic group;

$Ar_5$ and $Ar_6$ are independently an alkyl group or aryl group; and

Ar is an arylene group.

2. The member of claim 1, further comprising:
a substrate;
a photosensitive layer over the substrate; and
a protective layer over the photosensitive layer,
wherein the protective layer constitutes the outermost surface layer.

3. The member of claim 1, wherein the outermost surface layer further comprises conductive fine particles made of a compound of formula $M_xSb_yO_z$, wherein M is a metal element, and x, y, and z each represent the molar ratio of its corresponding element.

4. The member of claim 3, wherein the conductive fine particles are made of zinc antimonate ($ZnSb_2O_6$).

5. The member of claim 1, wherein the outermost surface layer further comprises fine particles made of at least one compound selected from silica, alumina, titanium oxide, and tin oxide.

6. The member of claim 1, wherein the isocyanate compound (b-1) comprises an aromatic ring and two or more isocyanate groups.

7. The member of claim 6, wherein the isocyanate compound (b-1) is an adduct of a diisocyanate compound and a polyol.

8. The member of claim 1, wherein the content of isocyanate group (—NCO) in the isocyanate compound (b-1) is 3% by mass to 50% by mass.

9. The member of claim 1, wherein the content of the reactive charge transporting substance (b-2) is 5% by mass to 45% by mass.

10. The member of claim 1, wherein the outermost surface layer comprises a crosslinked resin formed using an isocyanate compound and at least one polyol compound that does not act as the reactive charge transporting substance.

11. An image forming apparatus comprising:
the latent electrostatic image bearing member of claim 1;
a latent electrostatic image forming unit configured to form a latent electrostatic image on the latent electrostatic image bearing member;
a developing unit configured to develop the latent electrostatic image by use of a toner to form a visible image;
a transferring unit configured to transfer the visible image onto a recording medium; and
a fixing unit configured to fix the visible image to the recording medium.

12. A process cartridge, comprising:
at least one unit selected from the group consisting of a charging unit, an exposing unit, a transferring unit, and a cleaning unit; and
the latent electrostatic image bearing member of claim 1.

13. The member of claim 1, wherein, the reactive charge transporting substance (b-2), X comprises (i).

14. The member of claim 1, wherein, the reactive charge transporting substance (b-2), X comprises (ii).

15. The member of claim 1, wherein, the reactive charge transporting substance (b-2), X comprises (iii).

16. The member of claim 1, wherein, the reactive charge transporting substance (b-2), X comprises (iv).

17. The member of claim 1, wherein the outermost surface layer further comprises fine particles comprising silica.

18. The member of claim 1, wherein the outermost surface layer further comprises fine particles comprising alumina.

19. The member of claim 1, wherein the outermost surface layer further comprises fine particles comprising titanium oxide.

20. The member of claim 1, wherein the outermost surface layer further comprises fine particles comprising tin oxide.

* * * * *